US011465254B2

(12) United States Patent
Kobata et al.

(10) Patent No.: US 11,465,254 B2
(45) Date of Patent: Oct. 11, 2022

(54) POLISHING MACHINE AND A POLISHING METHOD FOR A SUBSTRATE

(71) Applicant: Ebara Corporation, Tokyo (JP)

(72) Inventors: Itsuki Kobata, Tokyo (JP); Katsuhide Watanabe, Tokyo (JP); Hozumi Yasuda, Tokyo (JP); Yuji Yagi, Tokyo (JP); Nobuyuki Takahashi, Tokyo (JP); Koichi Takeda, Tokyo (JP)

(73) Assignee: Ebara Corporation, Tokyo (JP)

( * ) Notice: Subject to any disclaimer, the term of this patent is extended or adjusted under 35 U.S.C. 154(b) by 326 days.

(21) Appl. No.: 16/787,892

(22) Filed: Feb. 11, 2020

(65) Prior Publication Data

US 2020/0171618 A1 Jun. 4, 2020

Related U.S. Application Data

(62) Division of application No. 15/453,442, filed on Mar. 8, 2017, now abandoned.

(30) Foreign Application Priority Data

Mar. 10, 2016 (JP) ..... 2016-047483

(51) Int. Cl.
*B24B 37/013* (2012.01)
*B24B 37/04* (2012.01)
*B24B 37/20* (2012.01)

(52) U.S. Cl.
CPC ..... *B24B 37/013* (2013.01); *B24B 37/042* (2013.01); *B24B 37/20* (2013.01)

(58) Field of Classification Search
CPC ..... B24B 37/20; H01L 21/02021
USPC ..... 451/41
See application file for complete search history.

(56) References Cited

U.S. PATENT DOCUMENTS

| | | | |
|---|---|---|---|
| 5,860,181 | A | 1/1999 | Maekawa et al. |
| 6,139,400 | A | 10/2000 | Sato et al. |
| 6,179,690 | B1 | 1/2001 | Talieh |
| 6,379,230 | B1 | 4/2002 | Hayashi et al. |
| 6,527,621 | B1 | 3/2003 | Halley |
| 8,257,143 | B2 | 9/2012 | Katsuoka et al. |

(Continued)

FOREIGN PATENT DOCUMENTS

| | | | |
|---|---|---|---|
| JP | H11-31671 | A | 2/1990 |
| JP | H02-257629 | A | 10/1990 |

(Continued)

*Primary Examiner* — Joseph J Hail
*Assistant Examiner* — J Stephen Taylor
(74) *Attorney, Agent, or Firm* — Leydig, Voit & Mayer, Ltd.

(57) ABSTRACT

One object is to provide a polishing machine and a polishing method capable of improving a processing accuracy on the surface of an object. A method of polishing an object is provided. Such a method comprises: a first step of polishing an object by moving the object and a first polishing pad having a smaller dimension than that of the object relative to each other while the first polishing pad is made to contact the object, a second step of polishing the object, after the first step of polishing, by moving the object and a second polishing pad having a larger dimension than that of the object relative to each other while the second polishing pad is made to contact the object, and a step of detecting the state of the surface of the object before the first step of polishing.

7 Claims, 154 Drawing Sheets

(56) References Cited

U.S. PATENT DOCUMENTS

| | | | | |
|---|---|---|---|---|
| 2009/0209176 | A1 | 8/2009 | Katsuoka et al. | |
| 2013/0122613 | A1 | 5/2013 | Wang et al. | |
| 2014/0162534 | A1* | 6/2014 | Lin | H01L 21/02021 451/287 |
| 2015/0352686 | A1 | 12/2015 | Wu et al. | |
| 2016/0005618 | A1 | 1/2016 | Chen et al. | |
| 2016/0016280 | A1 | 1/2016 | Chen et al. | |
| 2016/0136779 | A1* | 5/2016 | Kashiwada | H01L 21/3221 51/298 |

FOREIGN PATENT DOCUMENTS

| | | | |
|---|---|---|---|
| JP | H11-90816 | A | 4/1999 |
| JP | 2009-194134 | A | 8/2009 |
| JP | 2011-101930 | A | 5/2011 |
| JP | 2015-220370 | A | 12/2015 |
| TW | 201545222 | A | 12/2015 |

* cited by examiner

POLISHING MACHINE AND A POLISHING METHOD FOR A SUBSTRATE

CROSS-REFERENCE TO RELATED APPLICATIONS

This patent application is a divisional of U.S. patent application Ser. No. 15/453,442, filed Mar. 8, 2017, which claims the benefit of Japanese Priority Patent Application JP 2016-047483, filed Mar. 10, 2016, which are incorporated herein by reference in their entireties.

TECHNICAL FIELD

The present invention relates to a polishing machine and a polishing method for a substrate.

BACKGROUND ART

Recently, a processing machine is used to perform various kinds of processing for a processing object (for example, a substrate for a semiconductor wafer, or various kinds of films formed on the surface of a substrate). As one example of a processing machine, there is a CMP (Chemical Mechanical Polishing) machine for performing processing, such as polishing a processing object.

A CMP machine includes a polishing unit for polishing a processing object, a cleaning unit for cleaning and drying the processing object, a load/unload unit for receiving and delivering the processing object to the polishing unit, and receiving the processing object that has undergone cleaning and drying treatment by the cleaning unit or the like. Also, the CMP machine includes a transport mechanism that transports a processing object among the polishing unit, the cleaning unit and the load/unload unit. The CMP machine sequentially performs various kinds of processing for polishing, cleaning and drying while a processing object is transported by the transport mechanism.

CITATION LIST

Patent Literature

Patent Literature 1: US Patent Application Publication No. 2015/0352686

[Patent Literature 2] Japanese Patent Laid-Open No. 2009-194134

SUMMARY OF INVENTION

Required accuracies for respective processes in manufacturing semiconductor devices in recent years have already reached the order of several nm, and CMP is no exception. To satisfy this requirement, polishing and cleaning conditions are optimized in CMP. But, even if the optimum conditions are determined, changes in polishing and cleaning performance cannot be avoided because of variations in control by components and temporal changes in consumable material. Also, there are variations in a semiconductor wafer itself, a processing object; for example, there are variations in film thickness of a film formed on a processing object and device shape before CMP. These variations are actualized in the form of variations in residual film, imperfect step removal during CMP and after CMP, and further a film residue in case of polishing the film to be, essentially, completely removed. These variations occur between chips or across chips, and furthermore, occur also between wafers and between lots. Under present circumstances, to prevent such cases, a polishing condition for a wafer during polishing or before polished (for example, a pressure distribution applied on a wafer surface at polishing, the number of rotation of a wafer holding table and slurry) and a cleaning condition are controlled, and/or rework (re-polishing) for a wafer exceeding a threshold is conducted so that these variations fall within a certain threshold.

However, because the suppressing effect on the variations by using the above polishing condition is exerted mainly in a radial direction of a wafer, it is difficult to adjust variations in a circumferential direction of the wafer. Additionally, there may be variations of polishing amount locally occurred on the wafer surface due to a processing condition at CMP and the state of a under layer of a film to be polished by CMP. Also, regarding control of a polishing distribution in the radial direction of a wafer in a CMP process, a device area in the wafer surface has been widened in terms of recent improvement of a yield ratio, and it has been required to adjust the polishing distribution closer to the edge portion of a wafer. In the edge portion of a wafer, variations in polishing pressure distribution and inflow of slurry, i.e. a polishing agent, have a larger effect than that near the center of the wafer. Control of the polishing condition and the cleaning condition, and rework are carried out basically by a polishing unit that performs CMP. In this case, a polishing pad almost always contacts the whole wafer surface, and also in the case of partial contact, a contact area between a polishing pad and a wafer has to be made wide for keeping a processing speed. Under such a circumstance, for example, if a variation exceeding a threshold occurs in a particular area on the wafer surface and this variation is corrected by rework or the like, then in the rework, an area to be polished would be extended to an unnecessary portion due to the wide contact area. Consequently, it becomes difficult to perform correction so that the wafer falls within an essentially required threshold. Thus, there is a need for a method and a machine capable of controlling a processing condition and reprocessing, such as rework, at an arbitrary position on the wafer surface, in a configuration which can control a polishing and cleaning states in a smaller area.

Therefore, one object of the present invention is to provide a polishing machine and a polishing method capable of improving a processing accuracy for the polishing processing surface of a processing object.

According to a first embodiment of the invention, a method of polishing an object is provided, the method including the steps of: first polishing the object by moving the object and a first polishing pad having a smaller dimension than that of the object relative to each other while the first polishing pad is made to contact the object, second polishing the object, after the first polishing, by moving the object and a second polishing pad having a larger dimension than that of the object relative to each other while the second polishing pad is made to contact the object, and detecting the state of a surface of the object before the first polishing. For example, according to the method of the first embodiment, if the concavity and convexity, existed on the surface of the object and difficult to planarize in following second step of polishing, is planarized in the first step of polishing, the whole surface of the object can be polished with better accuracy in the following second step of polishing.

According to a second embodiment of the invention, in the method of the first embodiment, the method includes the step of: determining a processing condition for the first polishing based on the detected state of the surface of the object. According to the second embodiment of the invention, an optimum polishing condition can be determined based on the state of the surface before the first step of polishing.

According to a third embodiment of the invention, in the method of the first embodiment or the second embodiment, the step of detecting the state of the surface includes a step of detecting at least one distribution of a film thickness of the surface of the object, a signal corresponding to the film thickness and a signal corresponding to a surface shape.

According to a fourth embodiment of the invention, a polishing machine for polishing an object is provided, such a polishing machine includes: a detector for detecting the state of a surface of the object, a first polishing module for performing a first step of polishing by moving the object and a first polishing pad having a smaller dimension than that of the object relative to each other while the first polishing pad is made to contact the object, a second polishing module for performing a second step of polishing by moving the object and a second polishing pad having a larger dimension than that of the object relative to each other while the second polishing pad is made to contact the object, and a control device for controlling the first polishing module and the second polishing module, in which the control device controls so that the second step of polishing is performed after the first step of polishing, and the detector detects the state of the surface of the object before the first step of polishing. According to the polishing machine of the fourth embodiment, for example, if the concavity and convexity, existed on the surface of the object and difficult to planarize in following second step of polishing, is planarized in the first step of polishing, the whole surface of the object can be polished with better accuracy in the following second step of polishing.

According to a fifth embodiment of the invention, in the polishing machine in the fourth embodiment, the control device is configured to determine a polishing condition for the first step of polishing based on the state of the surface detected by the detector. According to the polishing machine in the fifth embodiment, an optimum polishing condition based on the state of the surface can be determined before the first step of polishing.

According to a sixth embodiment of the invention, the polishing machine in the fourth embodiment includes a storage device for storing data about the state of the surface that is a target to the object, and the control device for determining a polishing condition for the first step of polishing and a polishing condition for the second step of polishing based on the data stored in the storage device and the state of the surface detected by the detector.

According to a seventh embodiment of the invention, there is provided a program for controlling an operation of a polishing machine for polishing an object, the program being configured to control the polishing machine to execute: a first step of polishing the object by moving the object and a first polishing pad having a smaller dimension than that of the object relative to each other while the first polishing pad is made to contact the object, a second step of polishing, after the first step of polishing, the object by moving the object and a second polishing pad having a larger dimension than that of the object relative to each other while the second polishing pad is made to contact the object, and a step of detecting the state of the surface of the object before the first step of polishing.

According to an eighth embodiment of the invention, in the program of the seventh embodiment, the polishing machine further executes: a step of determining a processing condition for the first step of polishing based on the detected state of the surface of the object.

According to a ninth embodiment of the invention, in the program of the seventh embodiment or the eighth embodiment, the step of detecting the state of the surface controls the polishing machine to execute: a step of detecting at least one distribution of a film thickness of the surface of the object, a signal corresponding to the film thickness and a signal corresponding to a surface shape.

According to a tenth embodiment of the invention, there is provided a non transitory computer readable medium that stores the program described in any one of the seventh embodiment to the ninth embodiment.

According to an eleventh embodiment of the invention, there is provided a polishing module for polishing an object, the polishing module including: a rotatable polishing head, a polishing pad held by the polishing head, a rotatable stage for holding the object, a polishing solution supply device for supplying a polishing solution over the surface of the object, an actuator configured to apply a pressing force to the surface of the object by the polishing pad, a positioning mechanism configured to movably control a contact position of the polishing pad on the object, and a pad conditioning device disposed to be on the approximately same plane or an approximately parallel plane to the surface of the object held by the stage, in which the pad conditioning device is configured to be able to move relative to the polishing pad.

According to a twelfth embodiment of the invention, in the polishing module according to the eleventh embodiment, the polishing pad has a diameter not greater than 30 mm.

According to a thirteenth embodiment of the invention in the polishing module according to the eleventh embodiment or the twelfth embodiment, the polishing pad is held by the polishing head via a cushion layer softer than a surface layer in contact with the object.

According to a fourteenth embodiment of the invention in the polishing module according to any one of the eleventh embodiment to the thirteenth embodiment, the polishing head is configured so that the surface of the polishing pad is vertical to an axis of rotation of the polishing head.

According to a fifteenth embodiment of the invention, in the polishing module according to any one of the eleventh embodiment to the thirteenth embodiment, an angle between an axis vertical to the surface of the object and the axis of rotation of the polishing head of the polishing head is greater than 0 degree.

According to a sixteenth embodiment of the invention, in the polishing module according to any one of the eleventh embodiment to the thirteenth embodiment, the axis of rotation of the polishing head is substantially parallel to the surface of the object, the polishing pad has a diameter larger than that of the polishing head, and the center of the polishing pad is the same as the axis of rotation of the polishing head.

According to a seventeenth embodiment of the invention, in the polishing module according to any one of the eleventh embodiment to the sixteenth embodiment, an opening is formed in the central portion of the polishing pad, and the polishing solution supply device is configured to supply a polishing solution to the surface of the object through the opening of the polishing pad.

According to an eighteenth embodiment of the invention, the polishing module according to any one of the eleventh embodiment to the seventeenth embodiment includes an XY stage fixed to the stage and configured to be able to move the object straightly.

According to an nineteenth embodiment of the invention, in the polishing module according to any one of the eleventh embodiment to the seventeenth embodiment, the stage is configured to be able to stop at an arbitrary rotational position, and the polishing head is connected to a liner-moving operated mechanism passing through the center of the object.

According to a twentieth embodiment of the invention, in the polishing module according to any one of the eleventh embodiment to the seventeenth embodiment, the stage is configured to be able to stop at an arbitrary rotational position, and the polishing head is connected to a swing mechanism passing along a circular path that passes through the center of the object.

BRIEF DESCRIPTION OF DRAWINGS

FIG. 35B is a flowchart showing the flow of polishing process according to the example 20, using the polishing machine according to one embodiment;

FIG. 35C is a flowchart showing the flow of polishing process according to the example 20, using the polishing machine according to one embodiment;

FIG. 35D is a flowchart showing the flow of polishing process according to the example 20, using the polishing machine according to one embodiment;

FIG. 35E is a flowchart showing the flow of polishing process according to the example 20, using the polishing machine according to one embodiment;

FIG. 35F is a flowchart showing the flow of polishing process according to the example 20, using the polishing machine according to one embodiment;

FIG. 35G is a flowchart showing the flow of polishing process according to the example 20, using the polishing machine according to one embodiment;

FIG. 36A is a flowchart showing a flow of polishing process according to an example 21, using a polishing machine according to one embodiment;

FIG. 36B is a flowchart showing the flow of polishing process according to the example 21, using the polishing machine according to one embodiment;

FIG. 36C is a flowchart showing the flow of polishing process according to the example 21, using the polishing machine according to one embodiment;

FIG. 36D is a flowchart showing the flow of polishing process according to the example 21, using the polishing machine according to one embodiment;

FIG. 37A is a flowchart showing a flow of polishing process according to an example 22, using a polishing machine according to one embodiment;

FIG. 37B is a flowchart showing the flow of polishing process according to the example 22, using the polishing machine according to one embodiment;

Figure 37A:
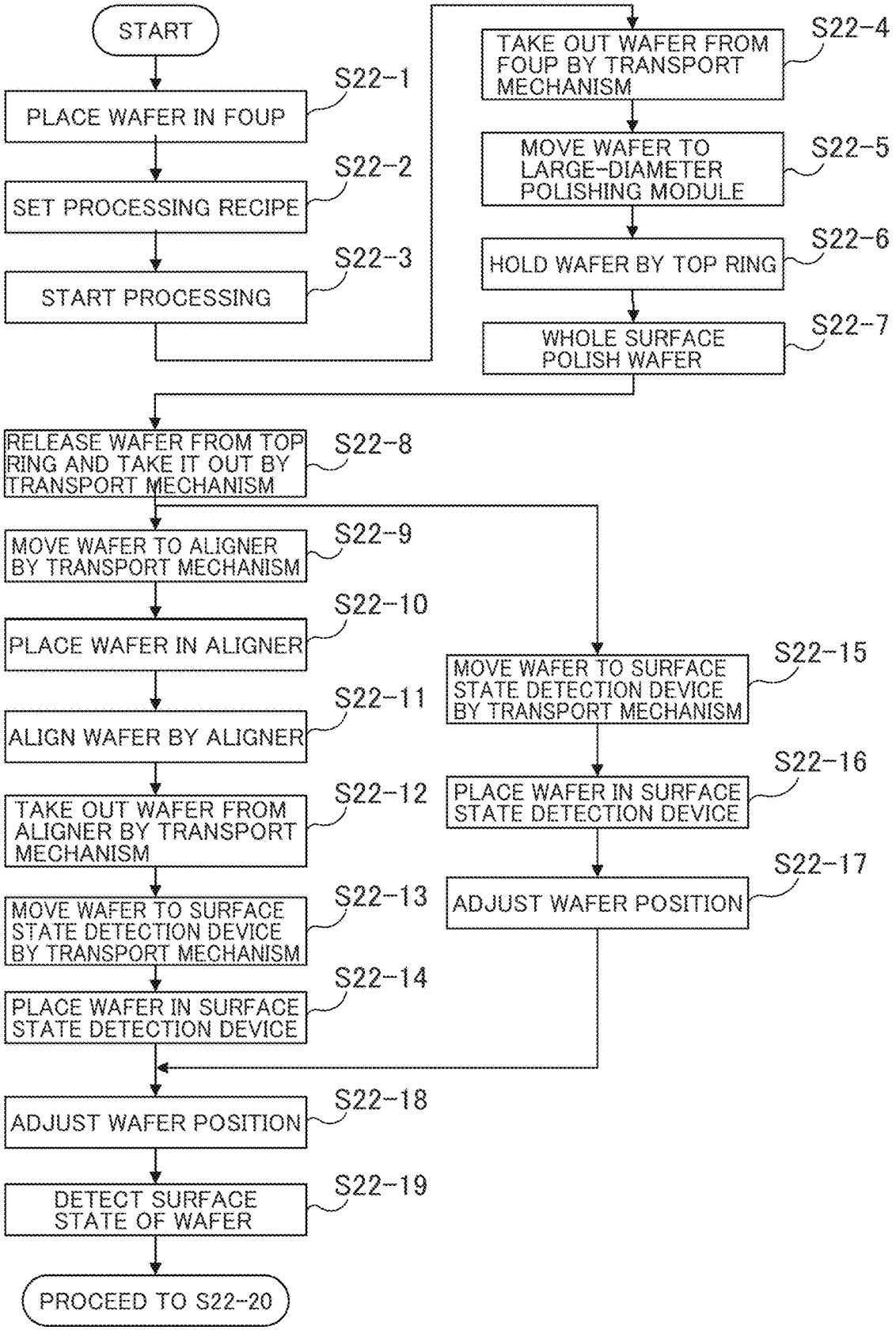
Figure 37B:
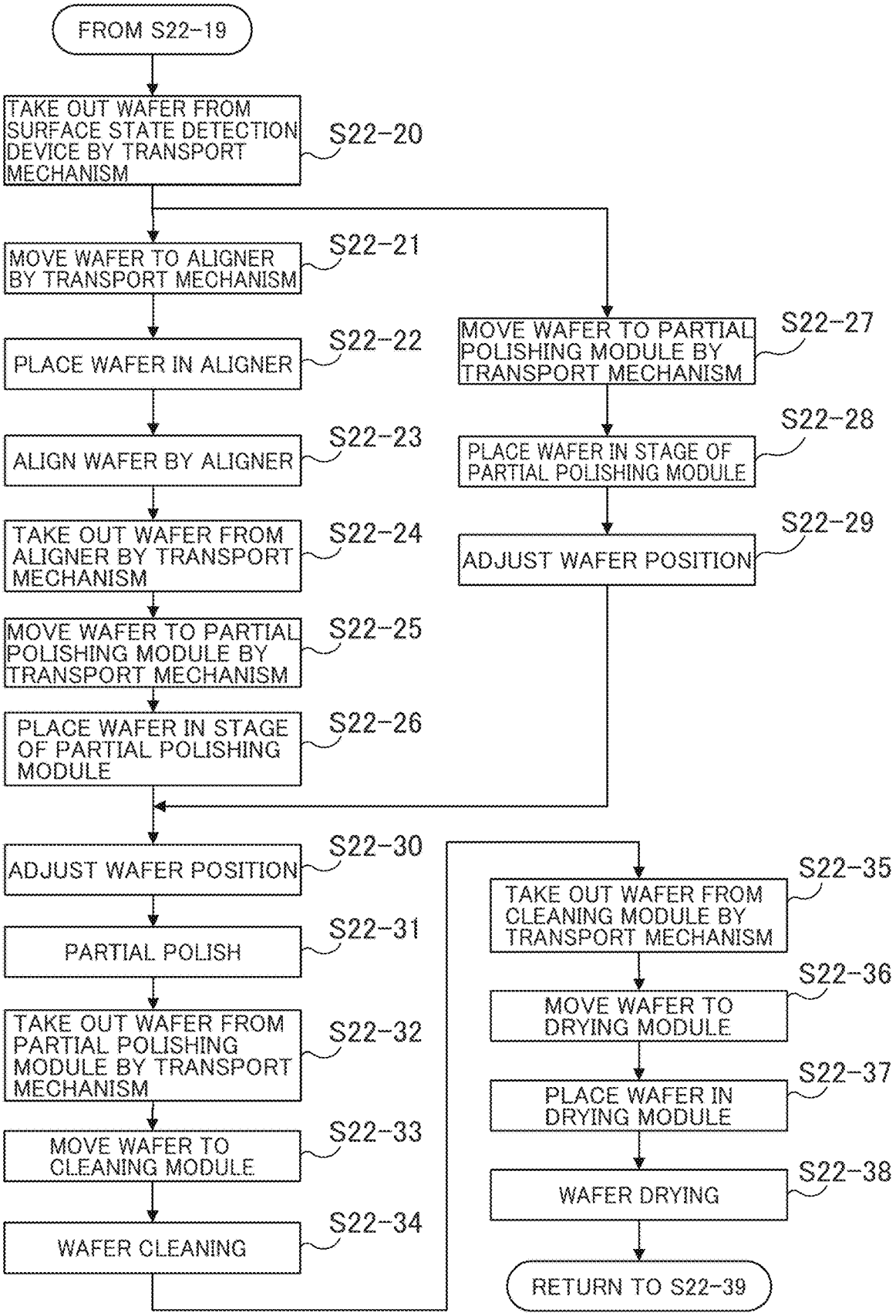
Figure 37C:
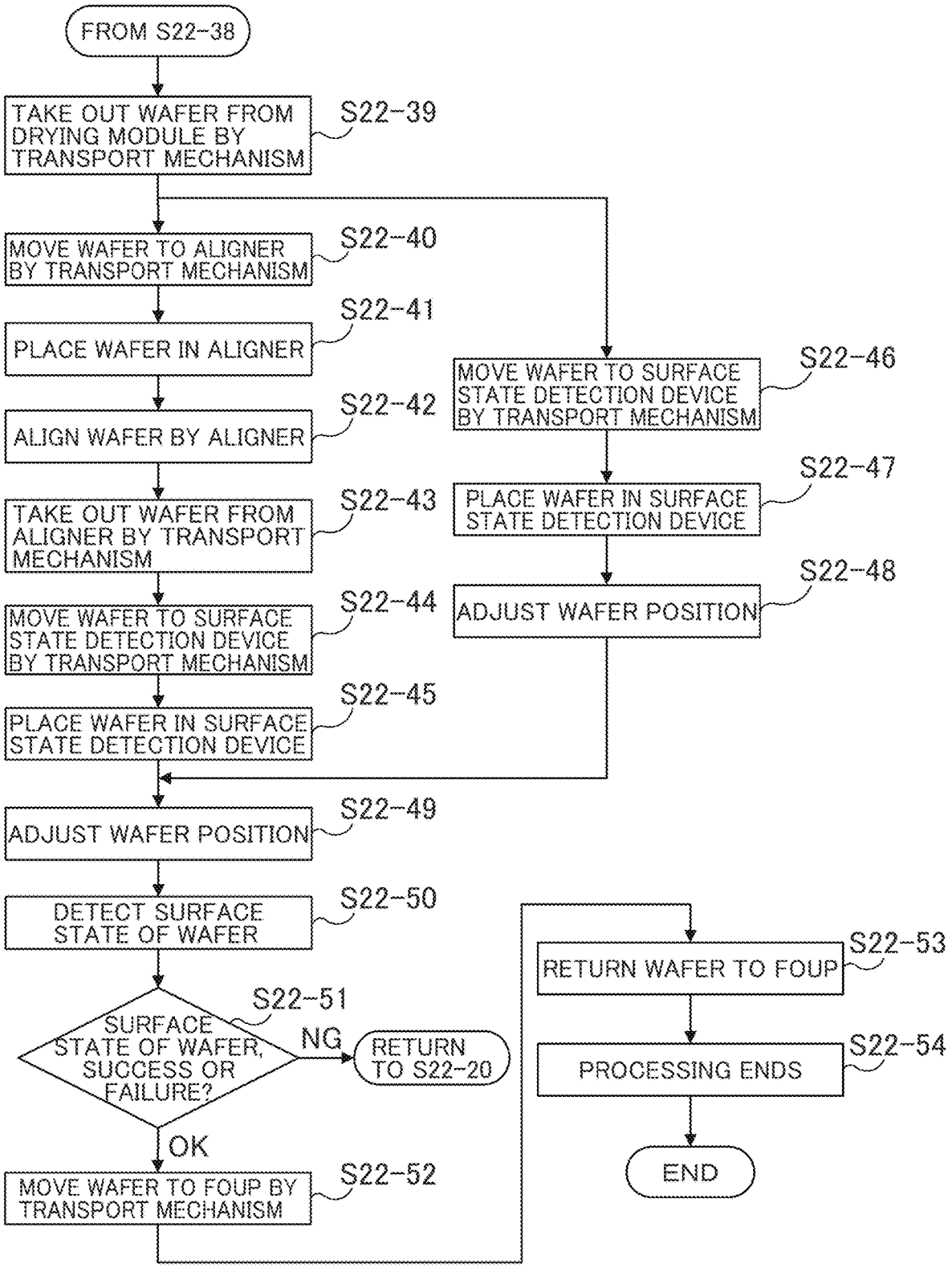
Figure 38A:
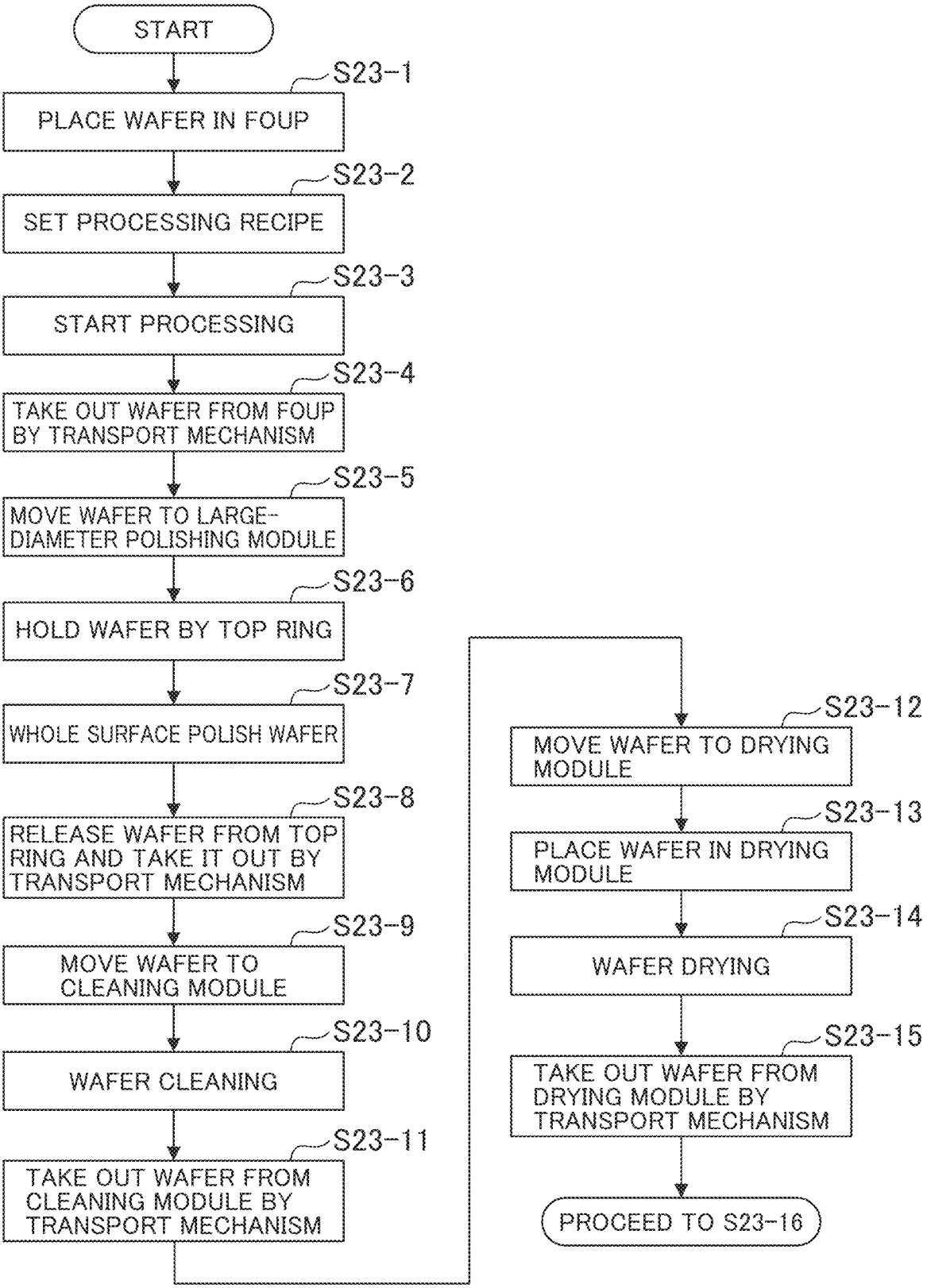
Figure 38B:
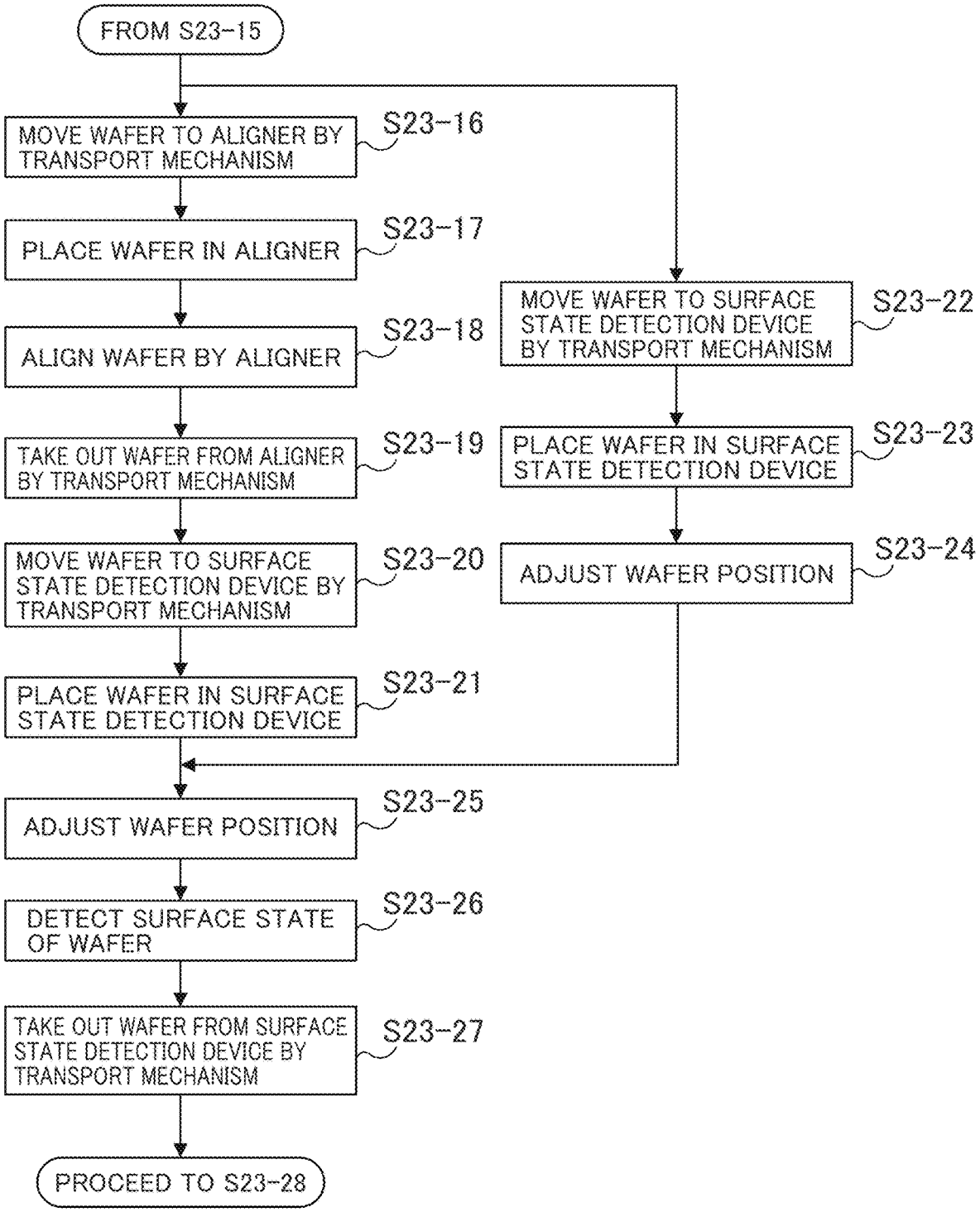
Figure 38C:
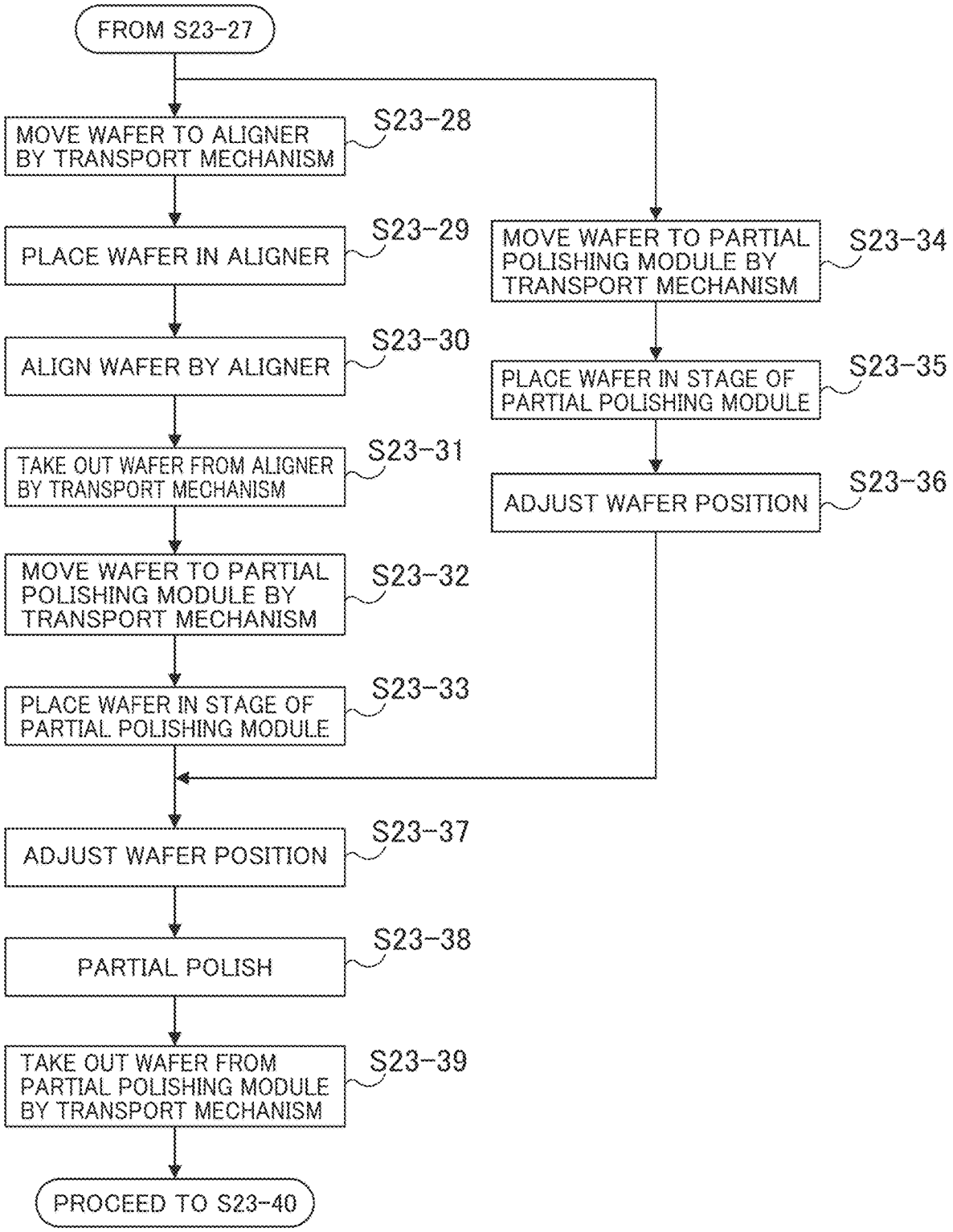
Figure 38D:
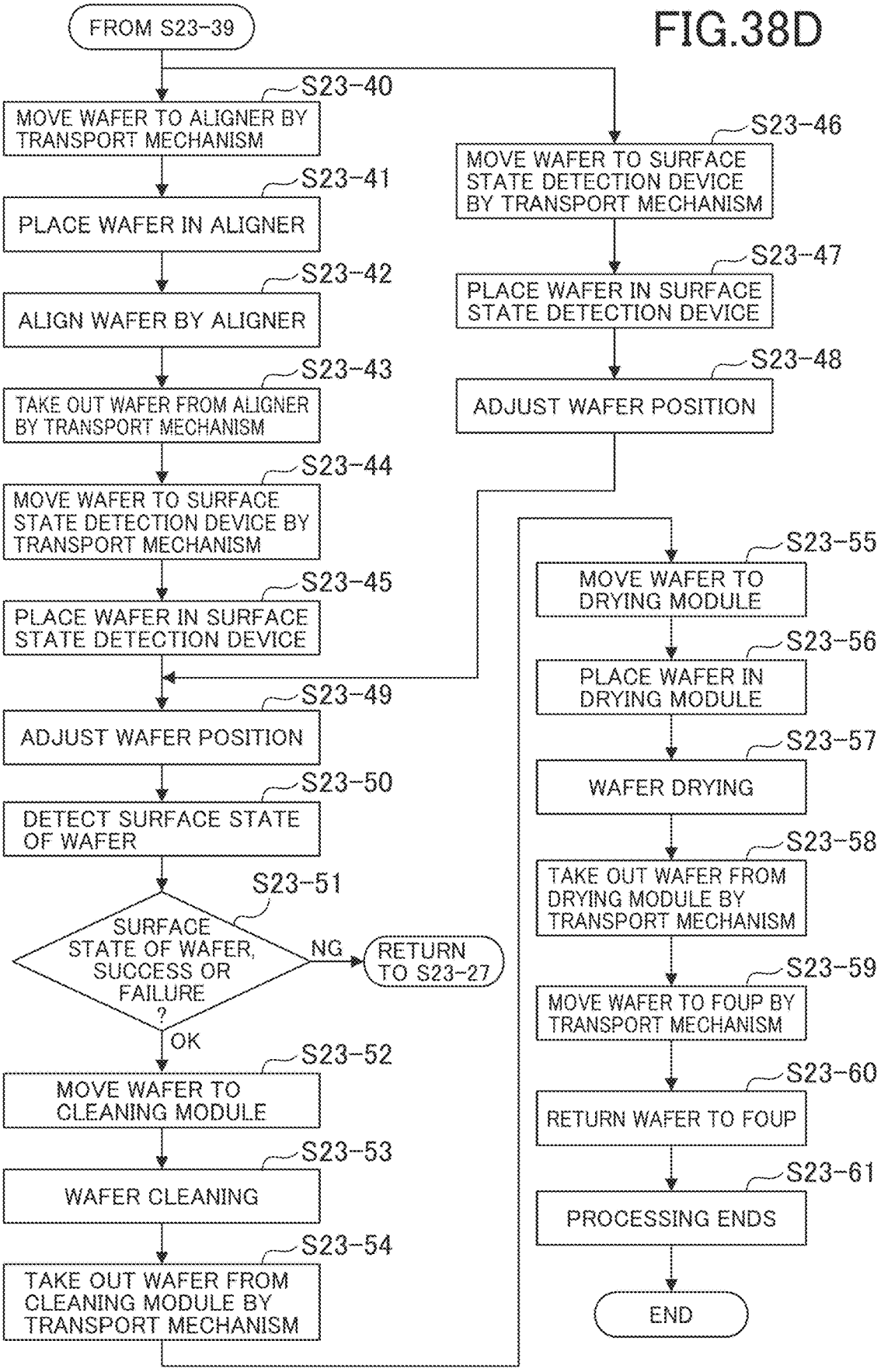
Figure 39A:
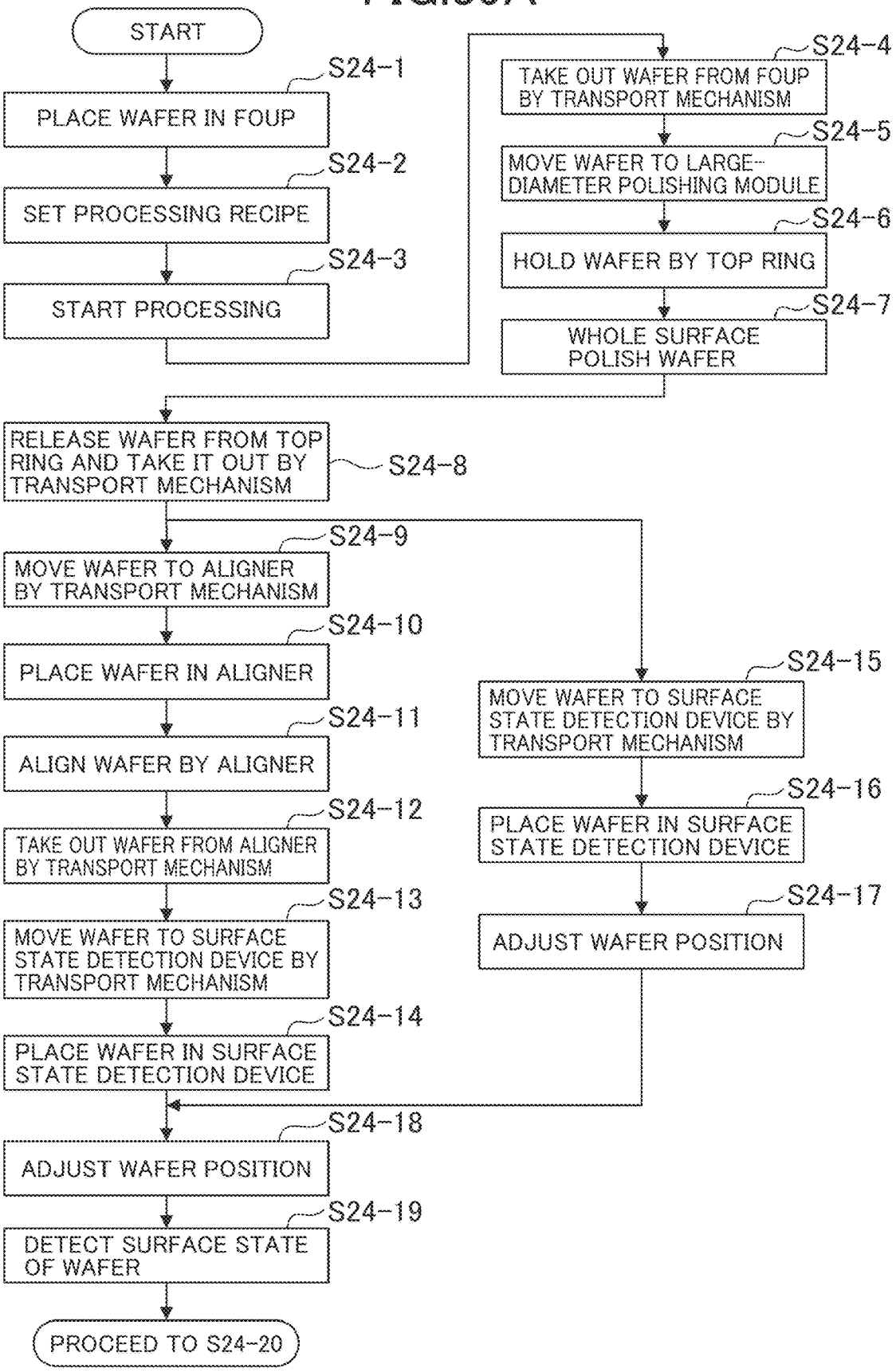
Figure 39B:
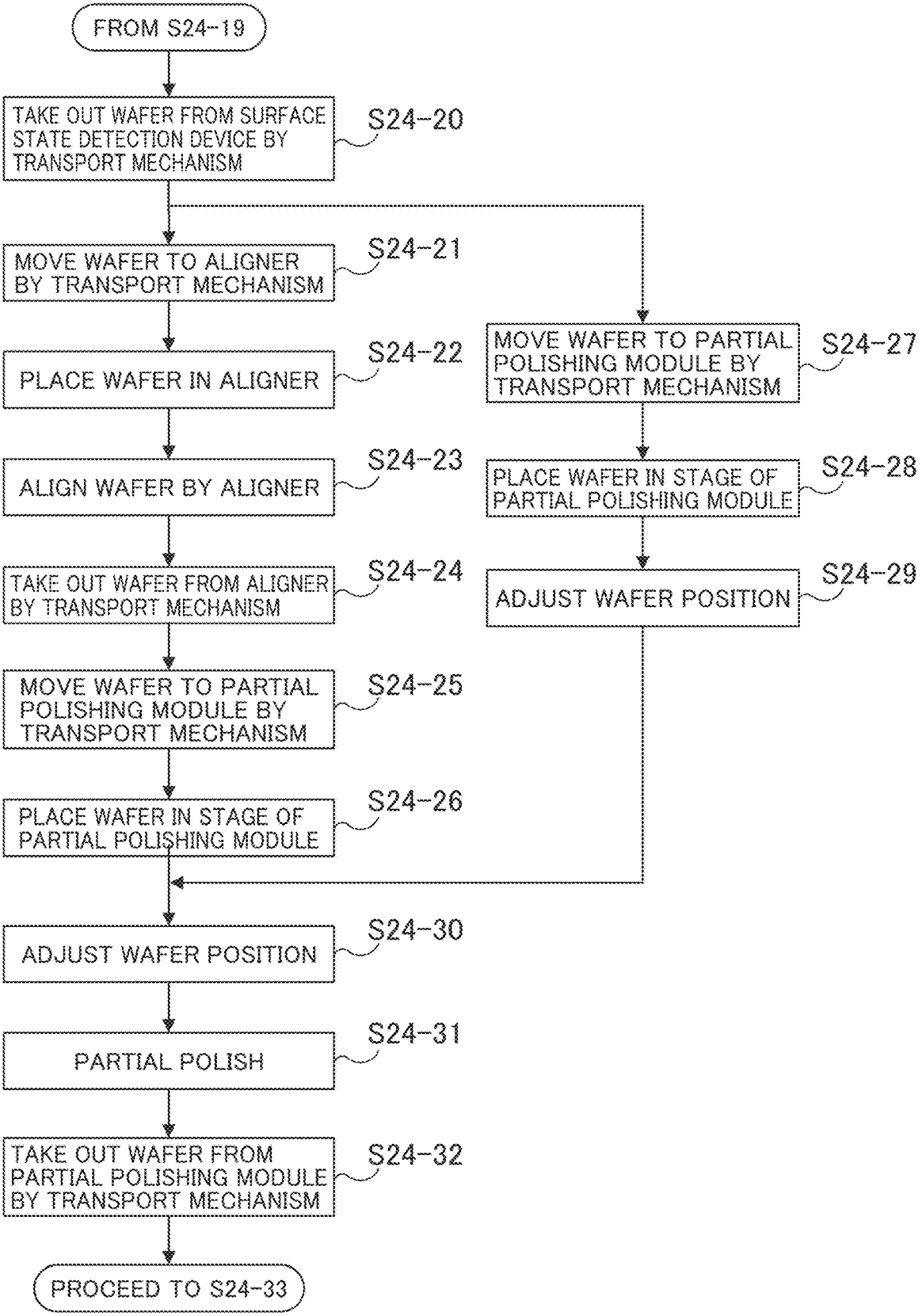
Figure 39C:
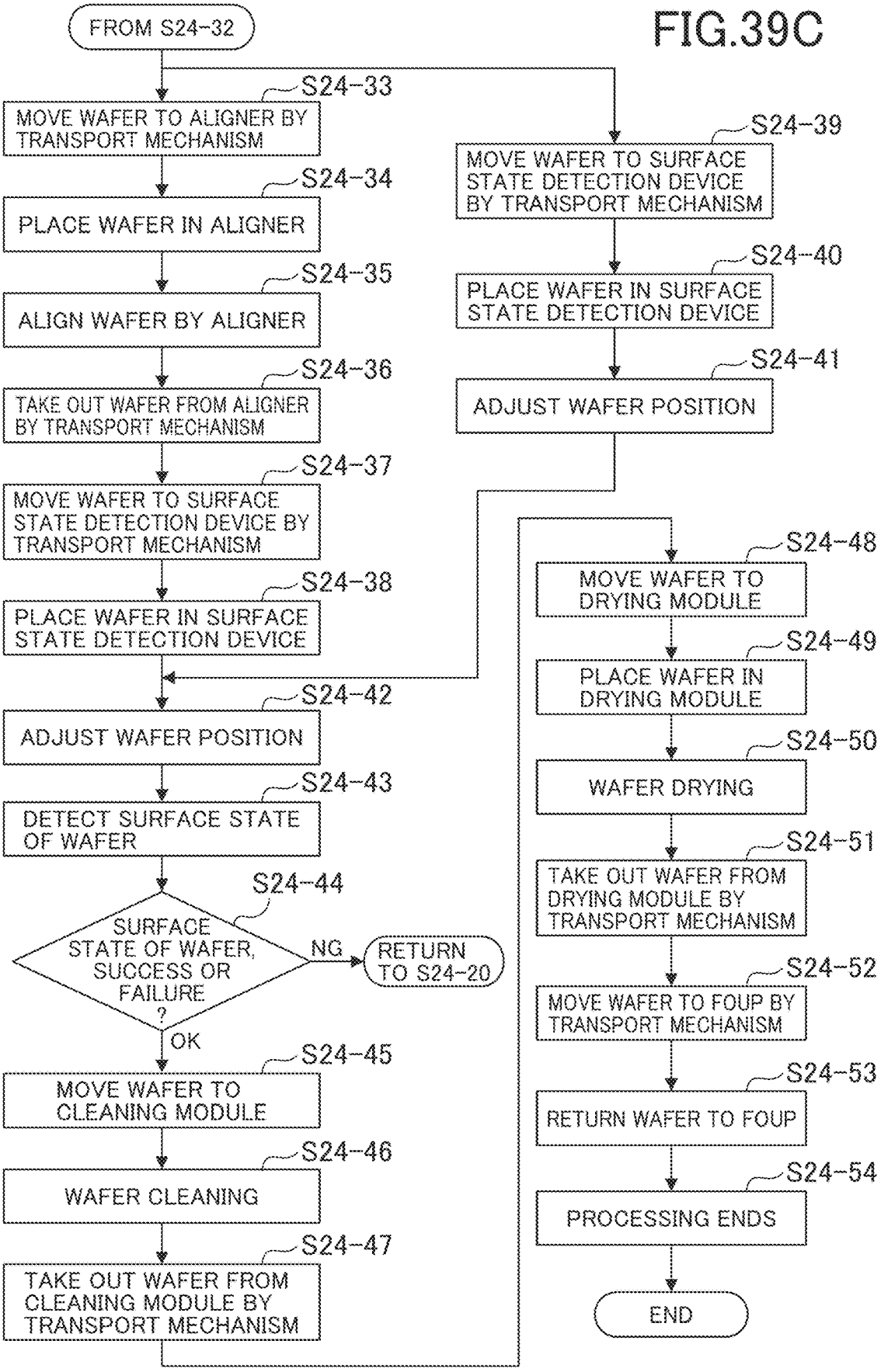
Figure 40A:
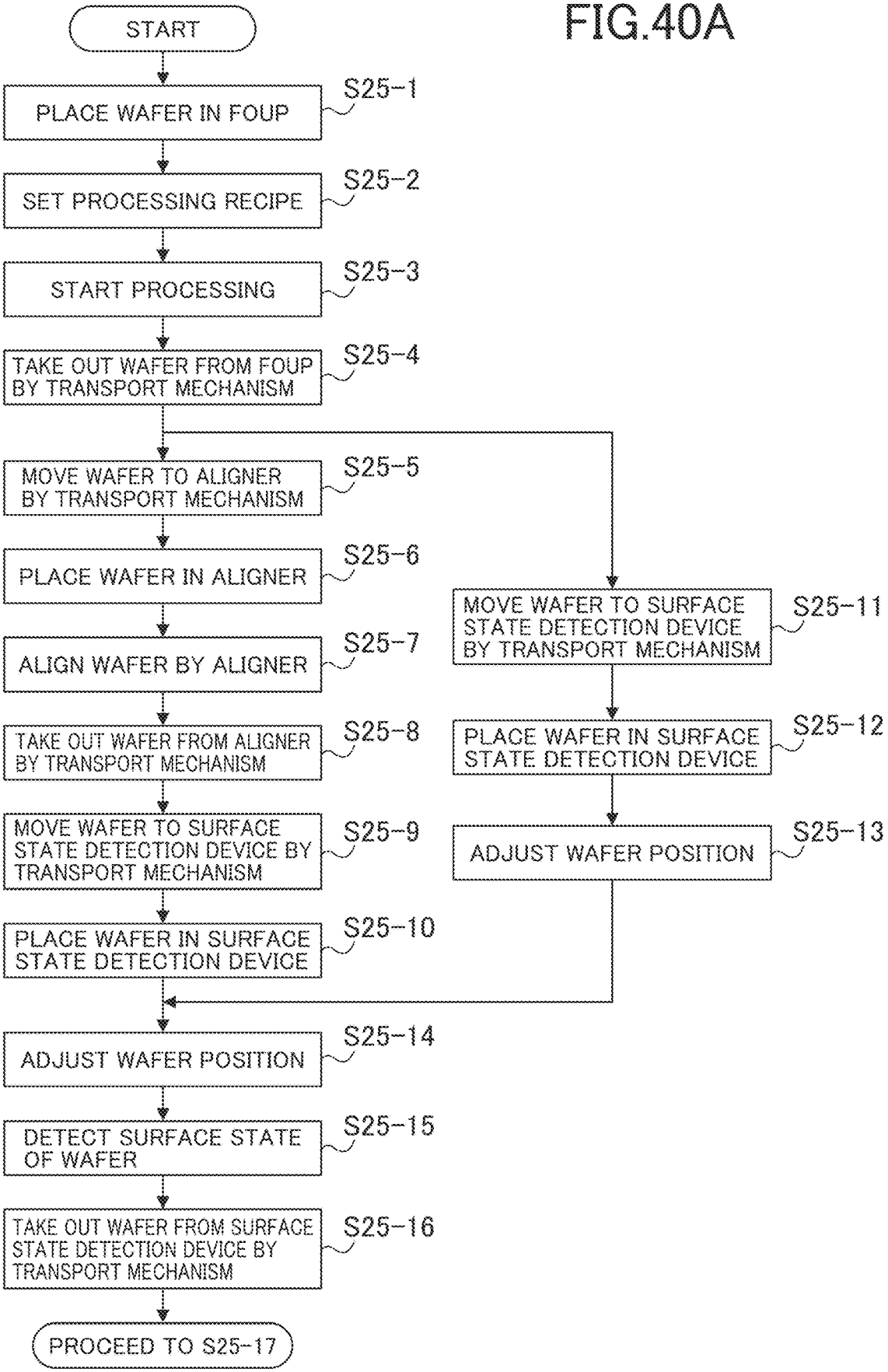
Figure 40B:
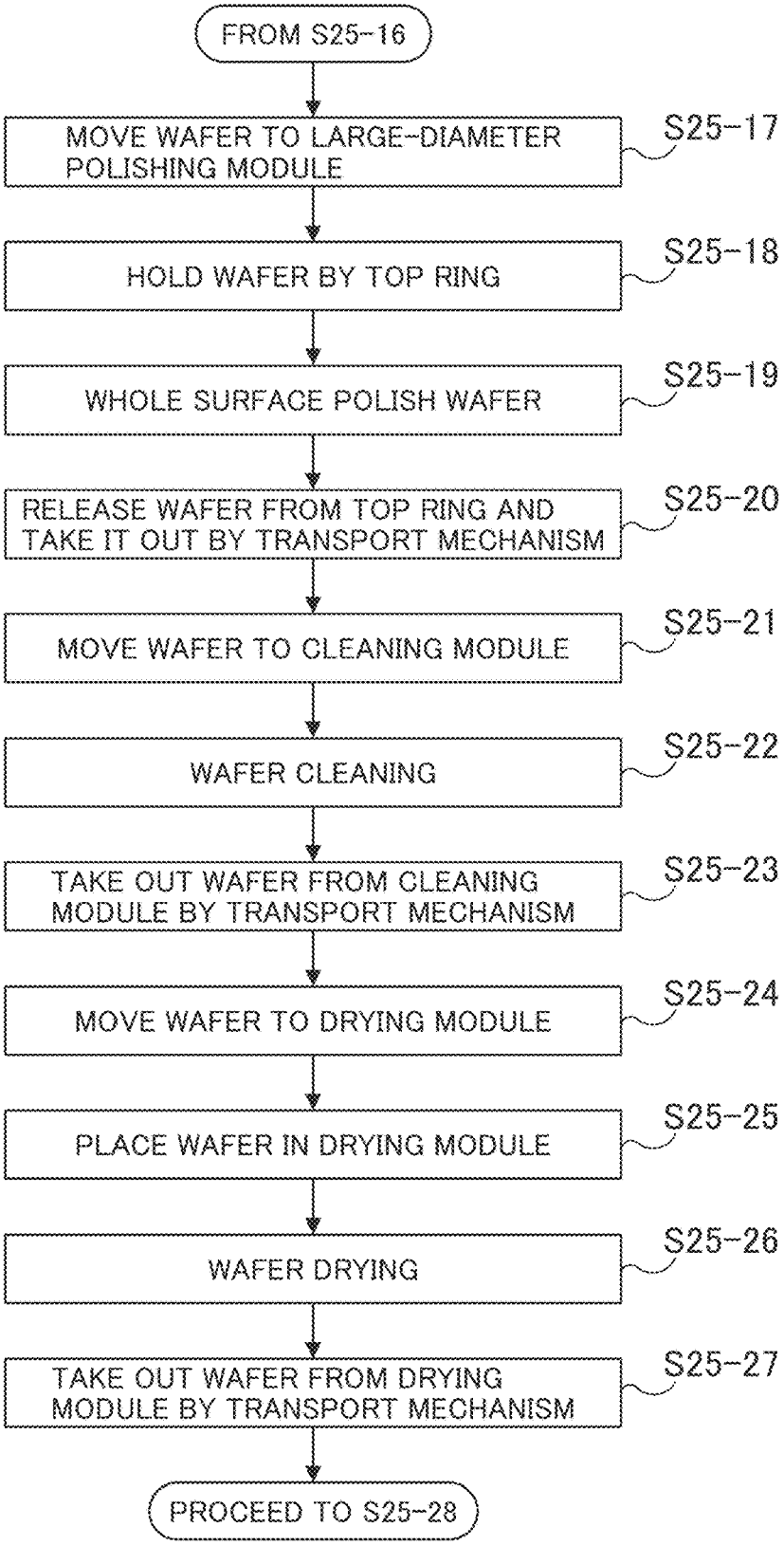
Figure 40C:
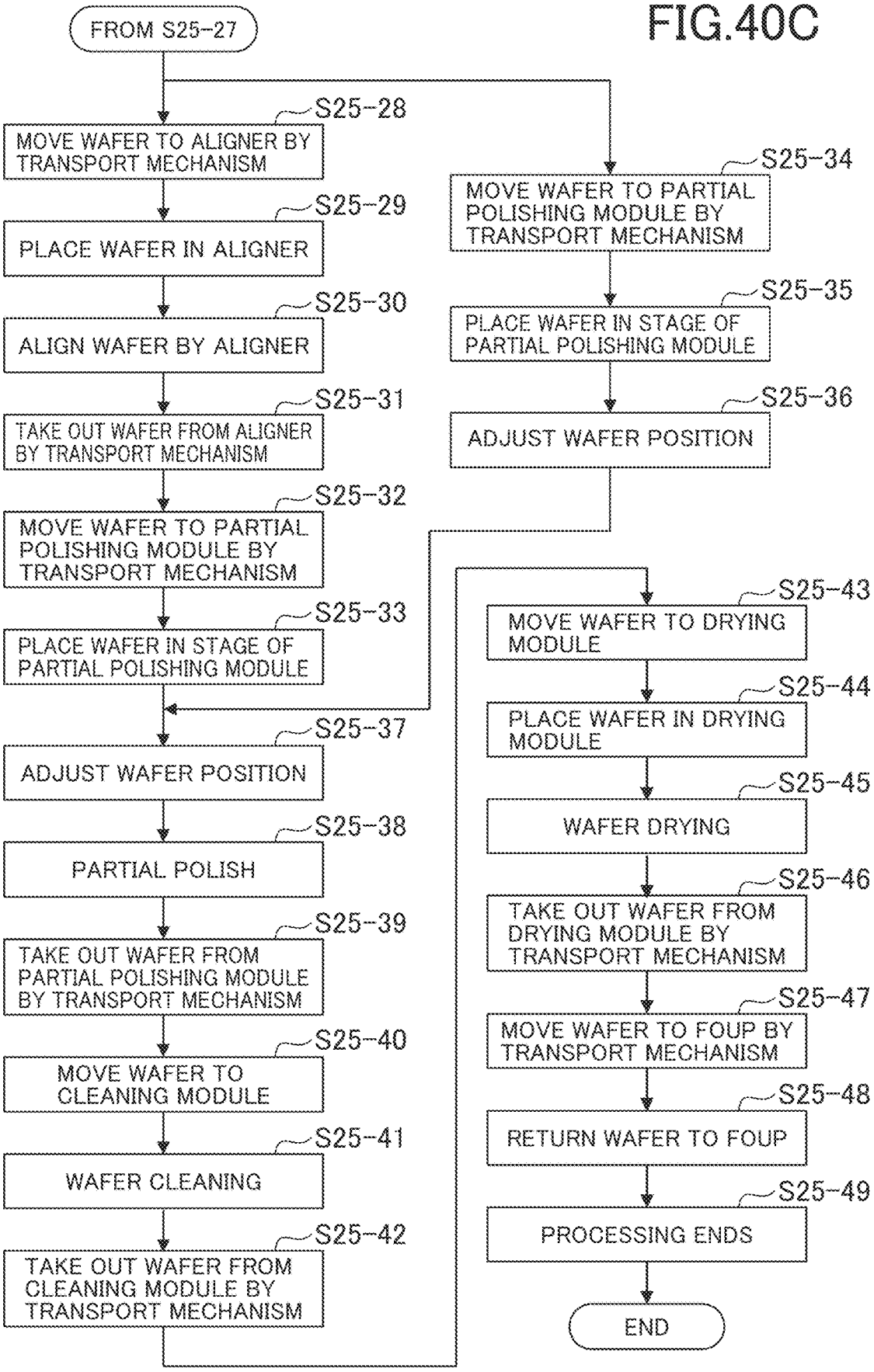
Figure 41A:
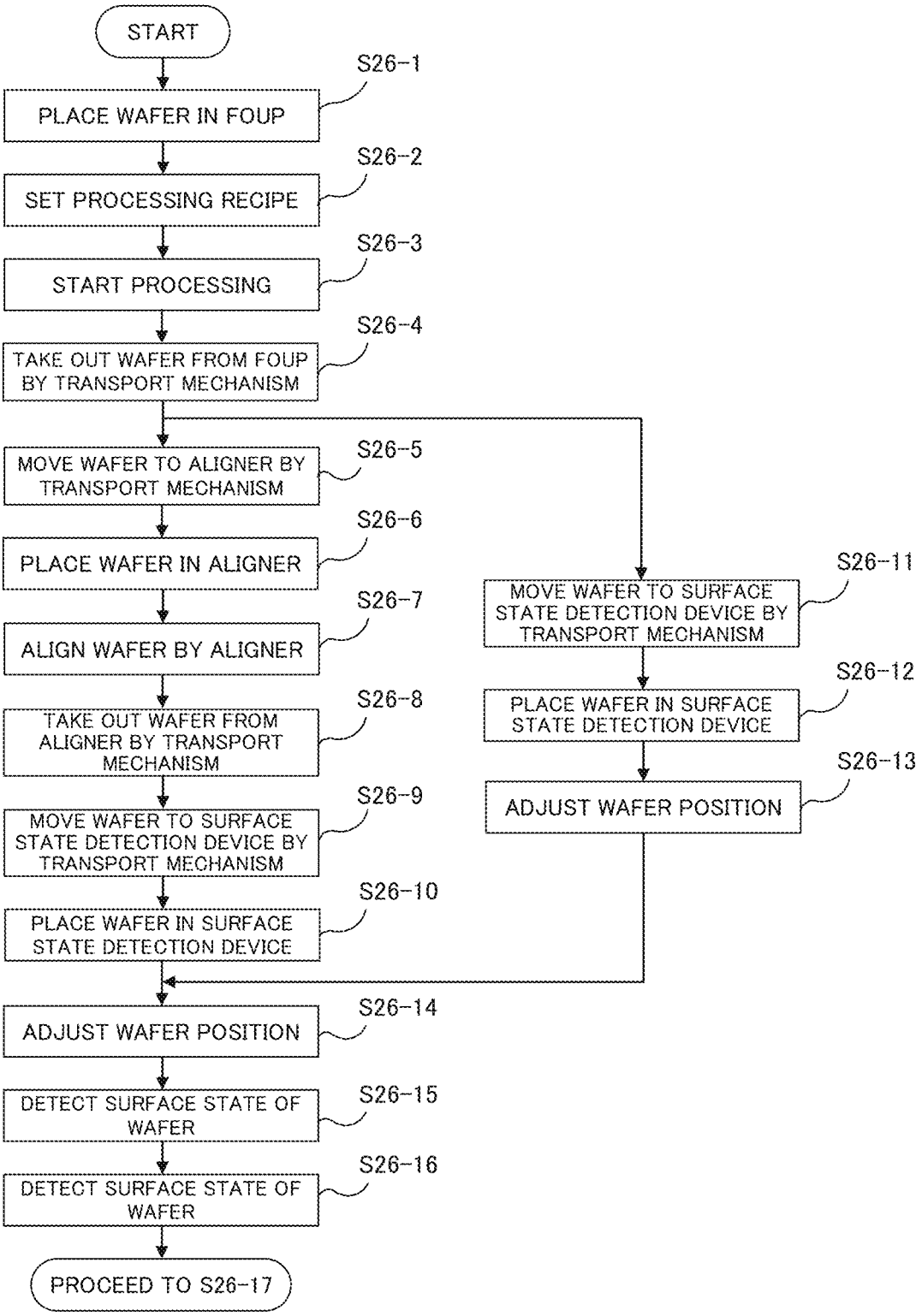
Figure 41B:
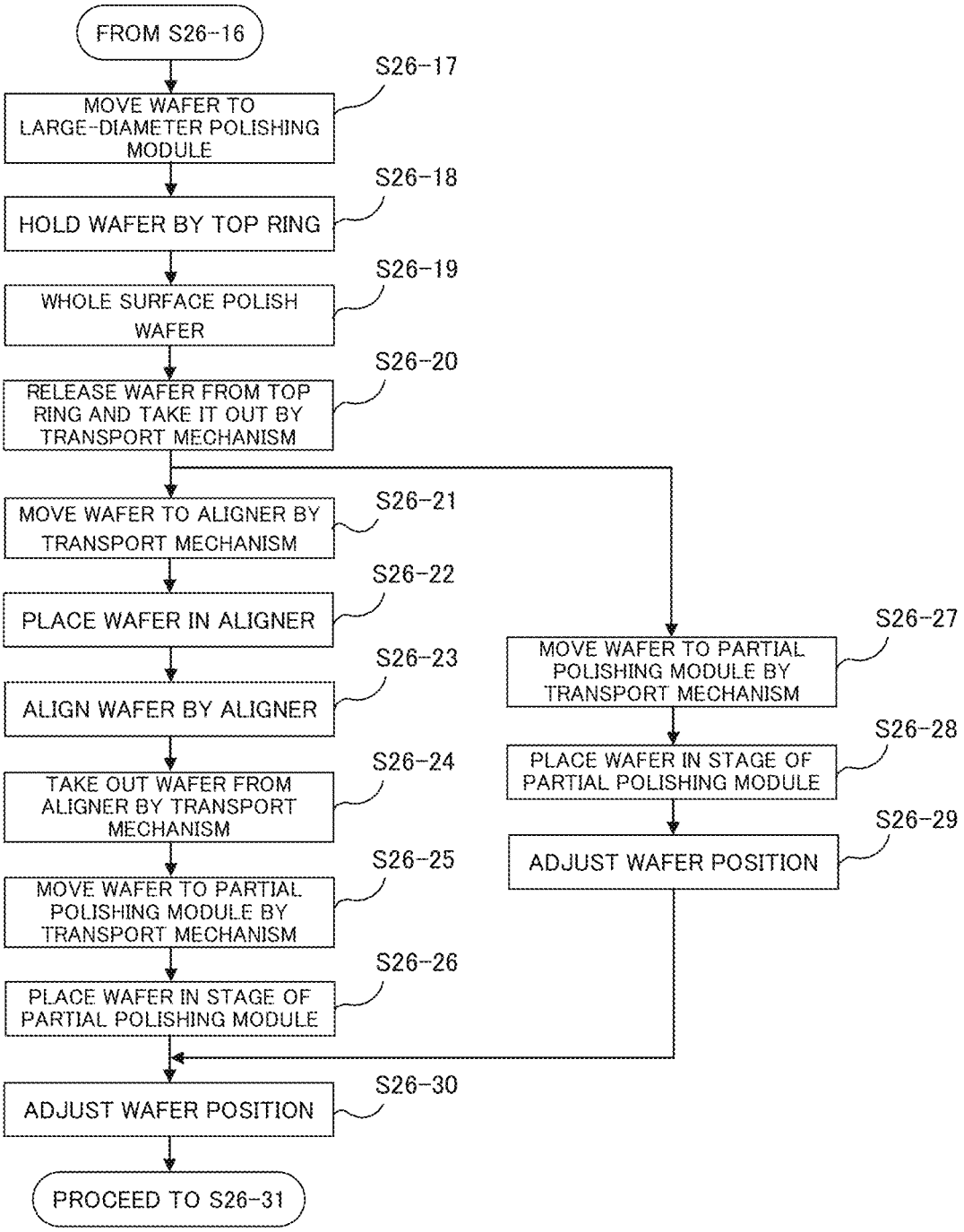
Figure 41C:
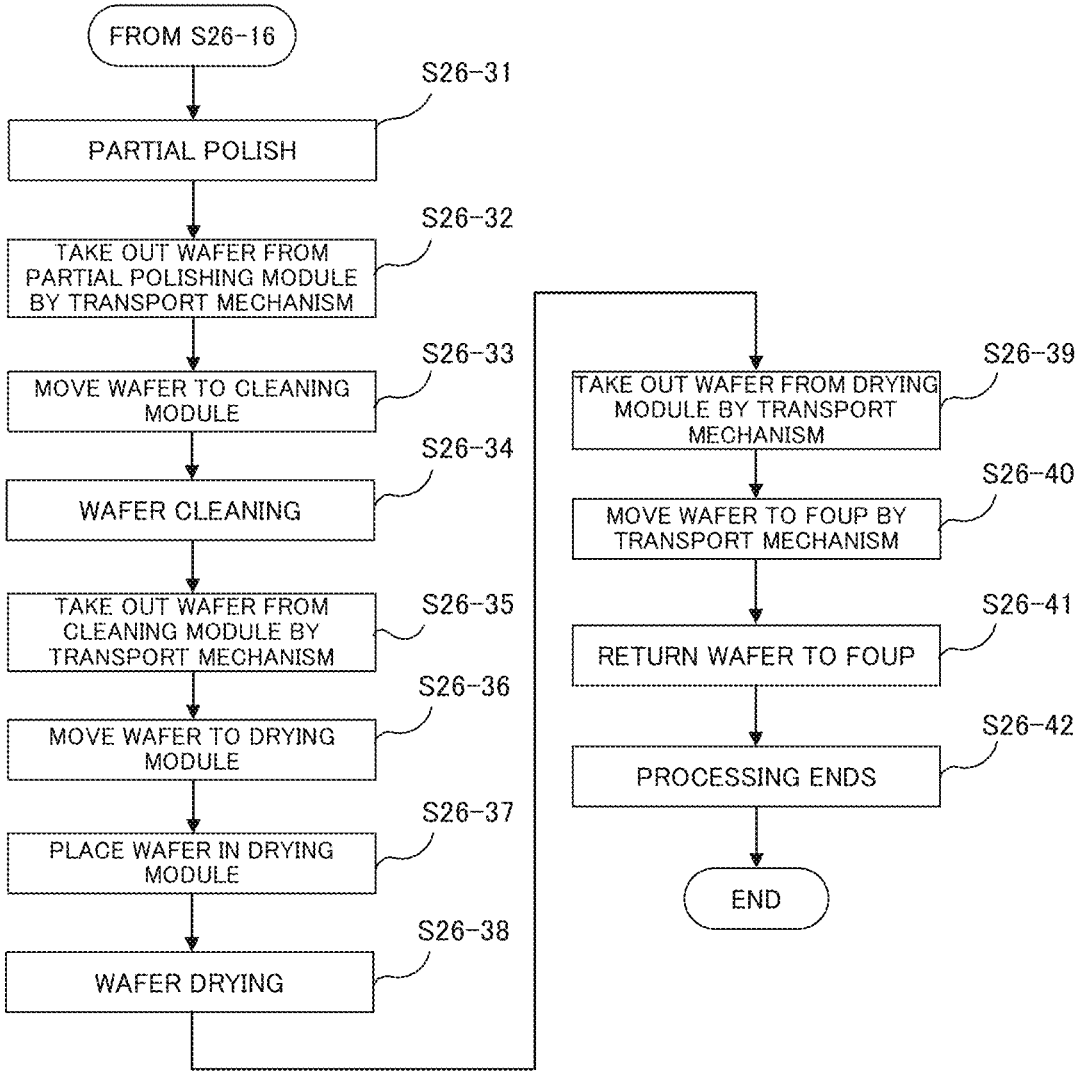
Figure 42A:
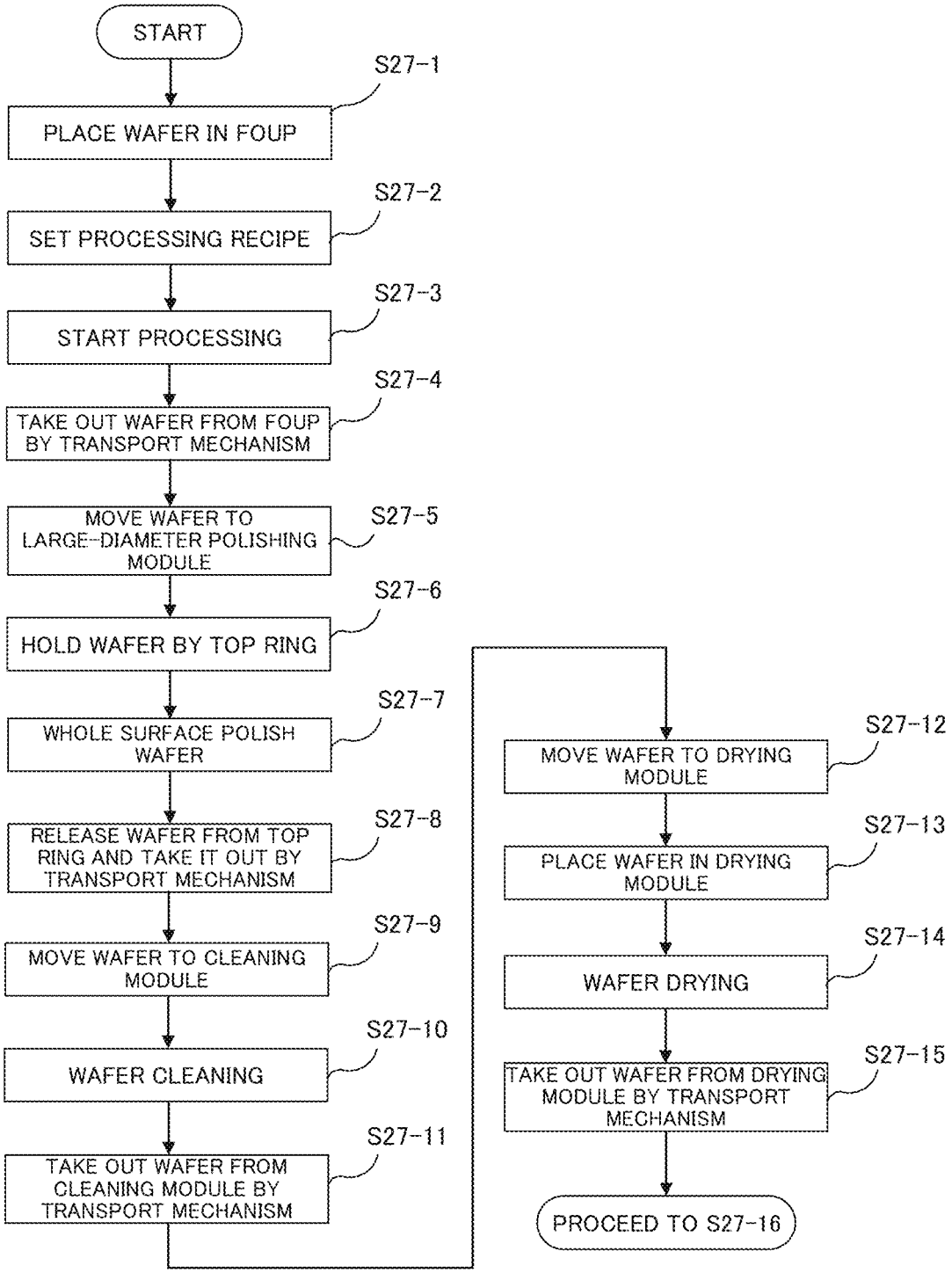
Figure 42B:
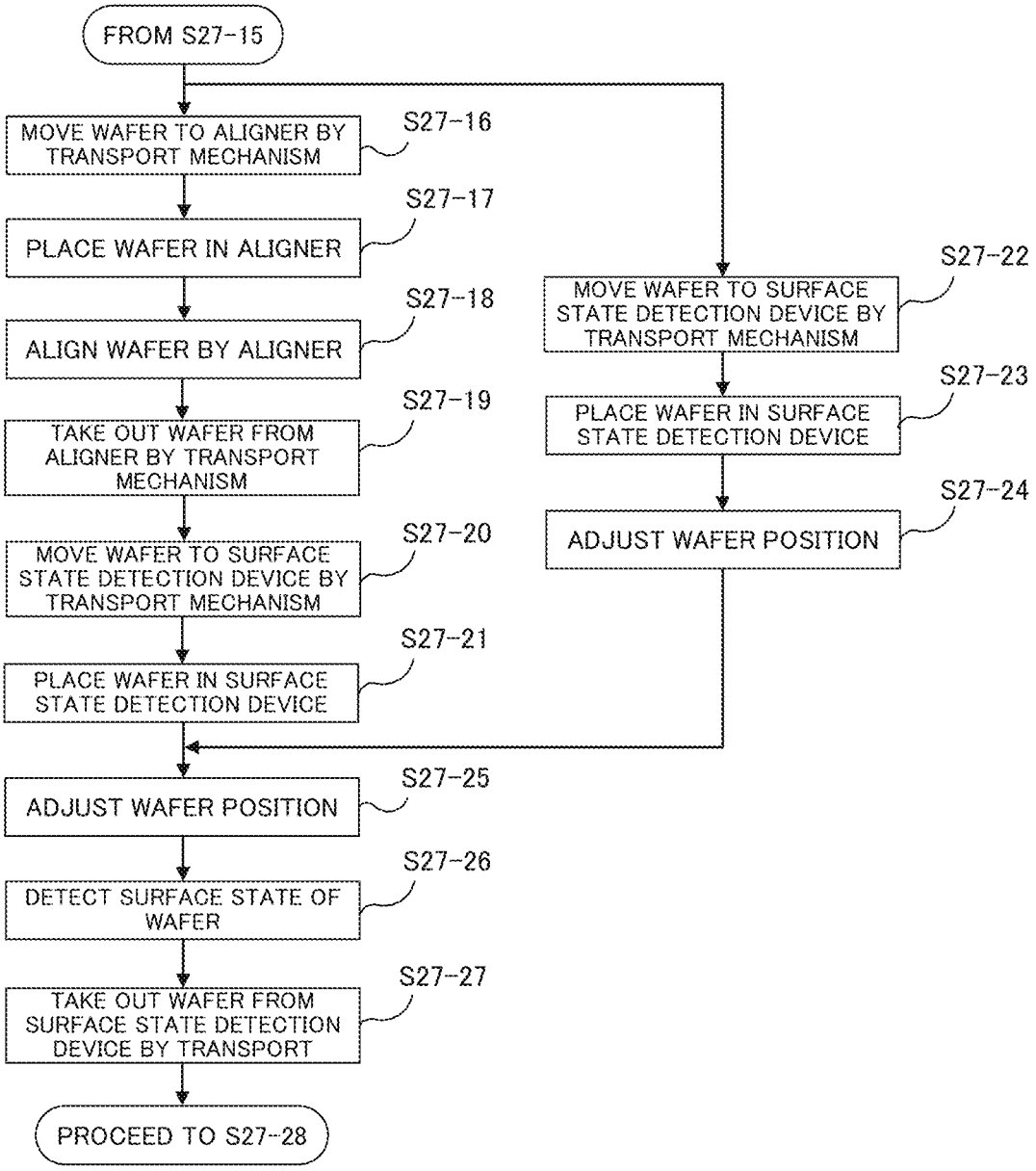
Figure 42C:
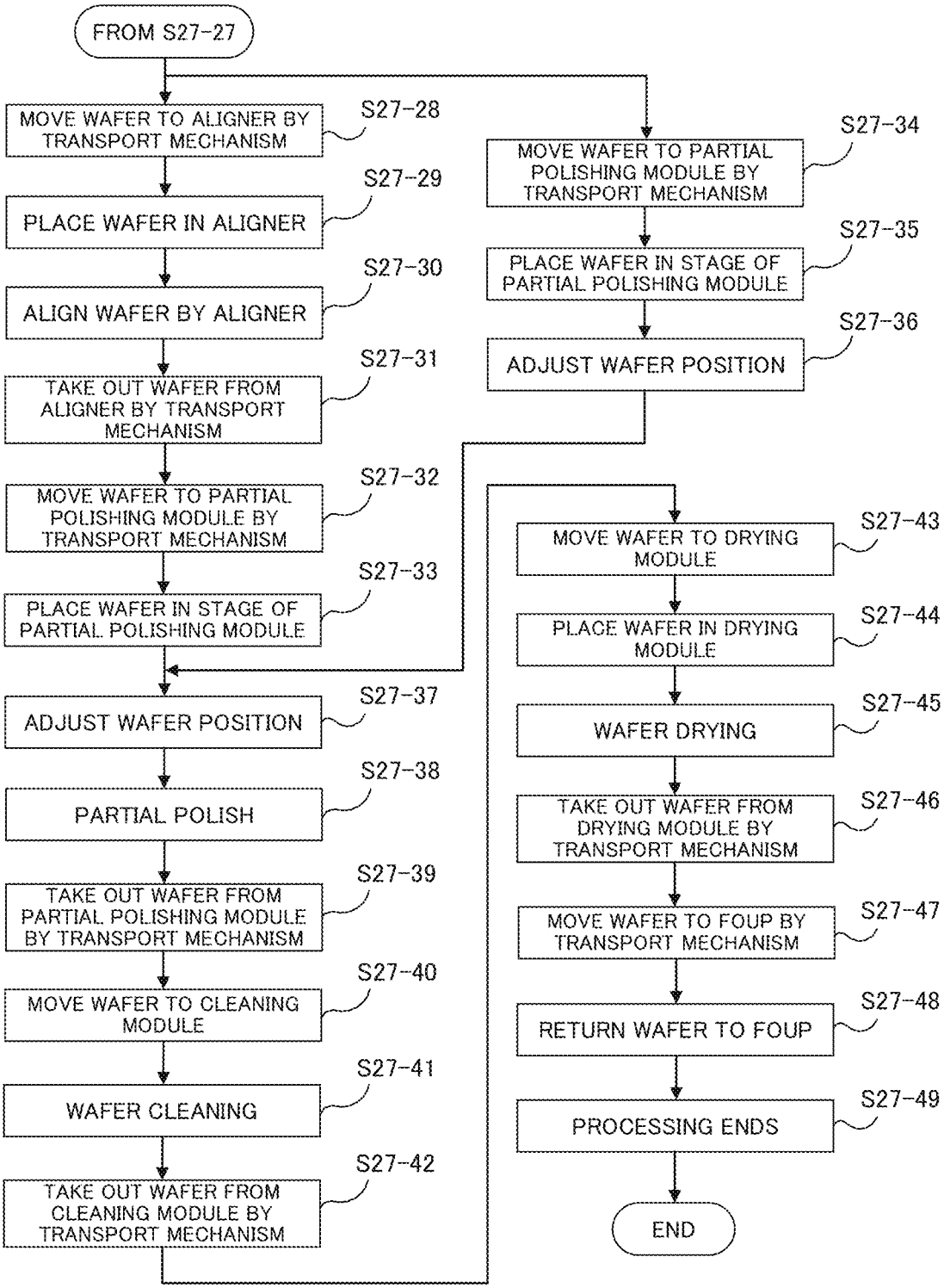
Figure 43A:
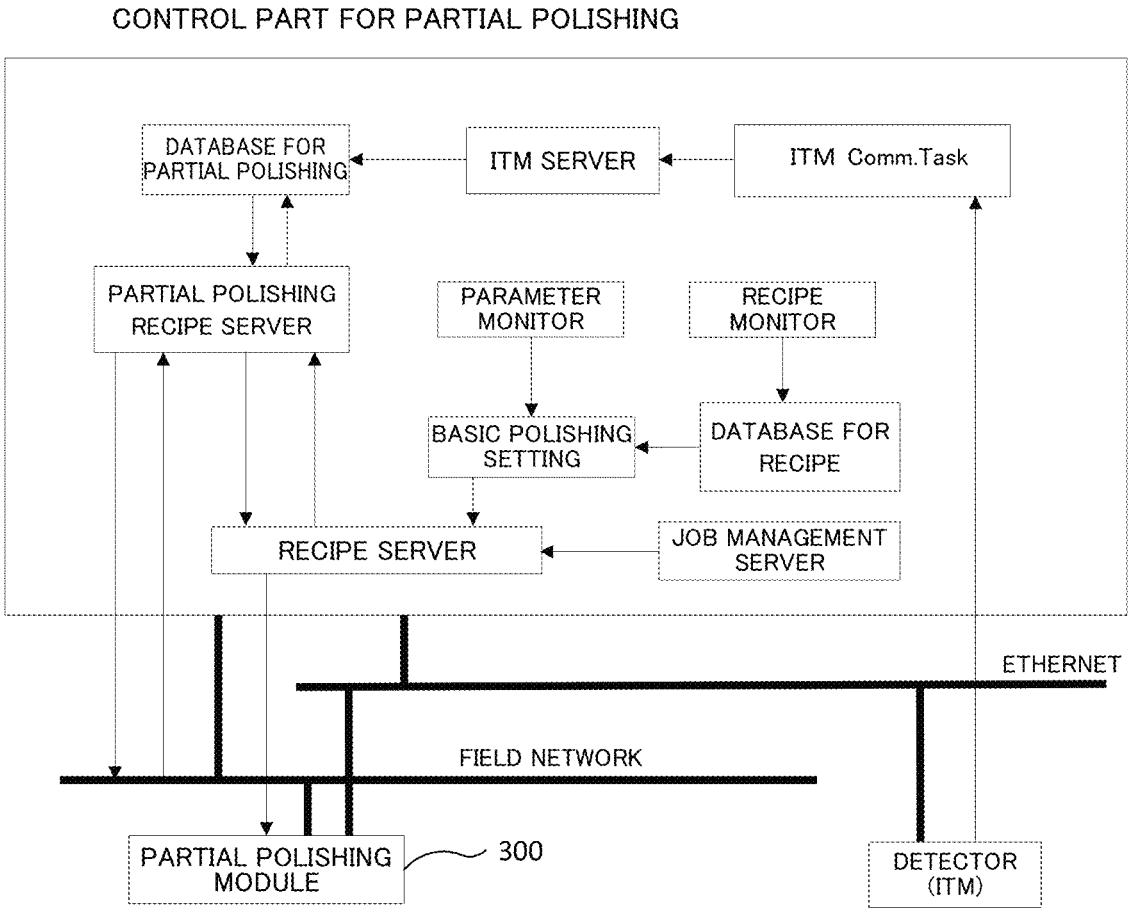
Figure 43B:
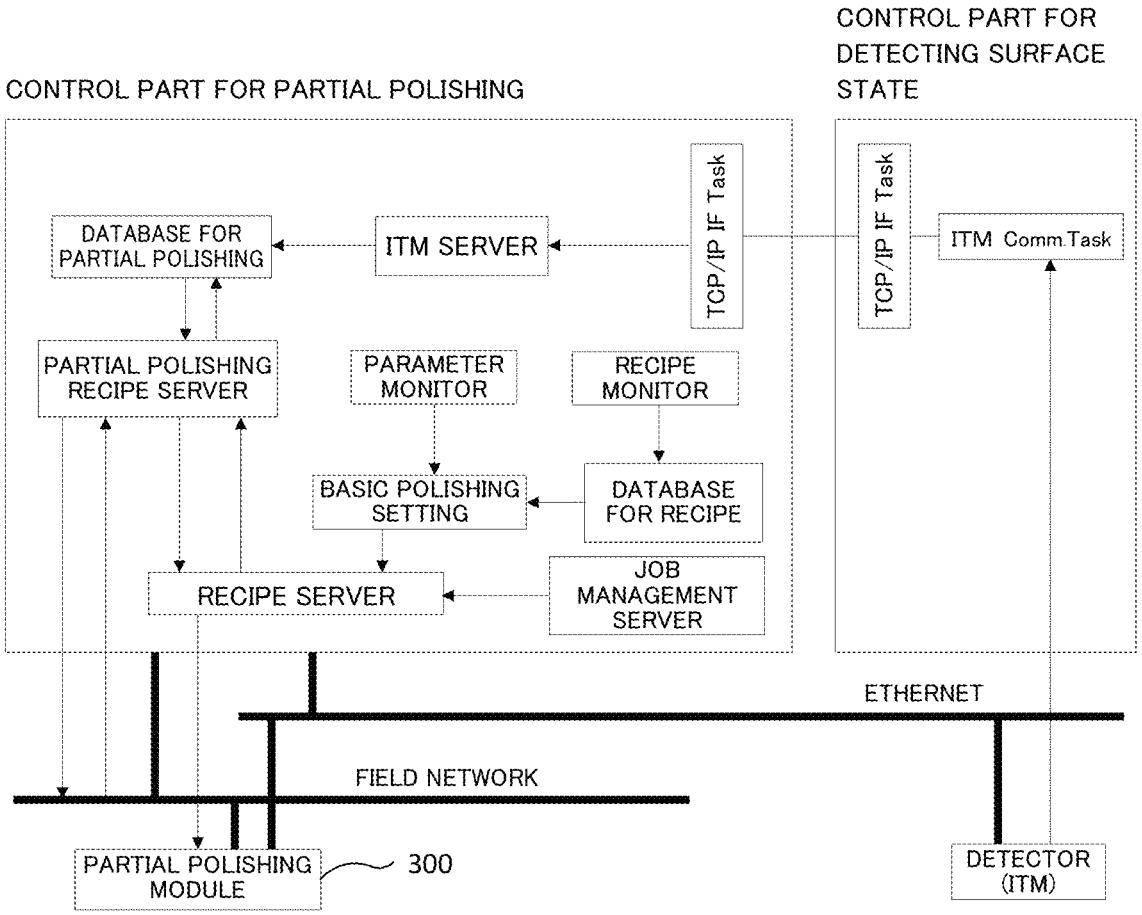
Figure 44A:
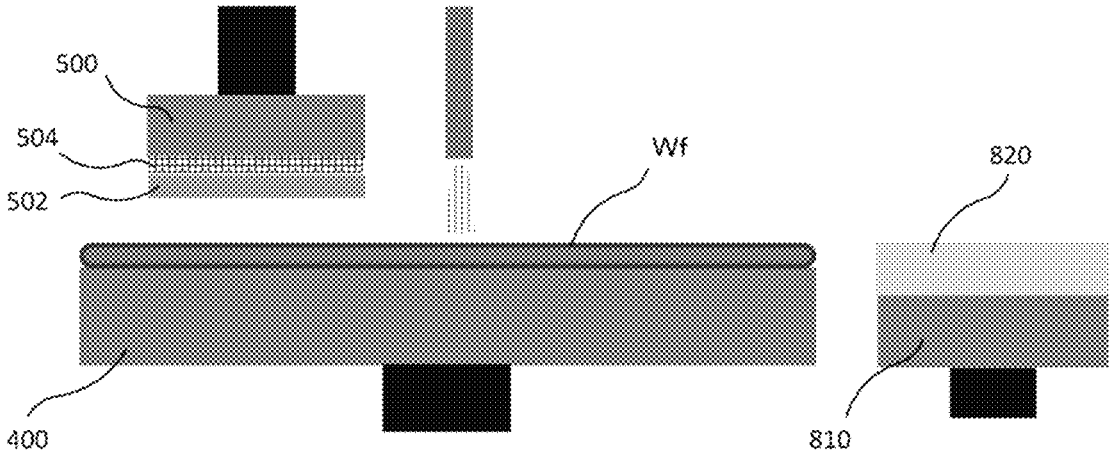
Figure 44B:
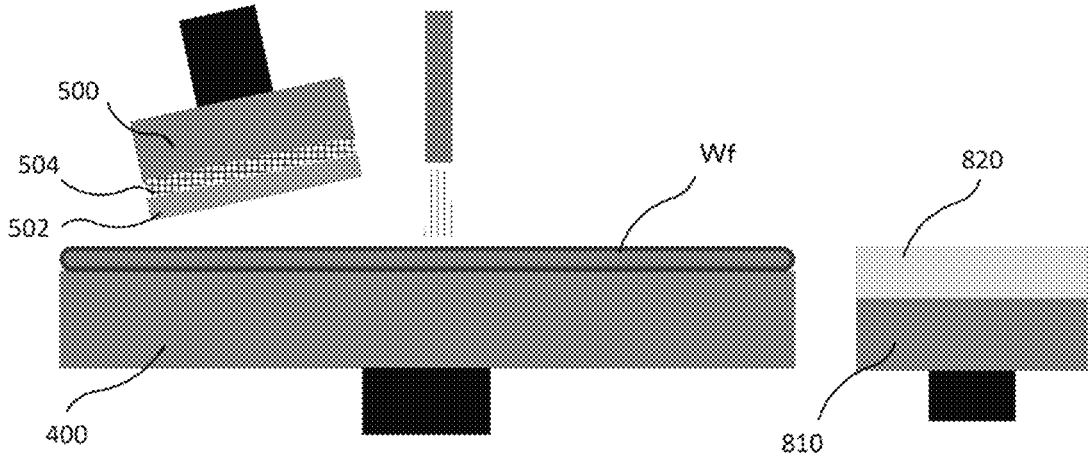
Figure 44C:
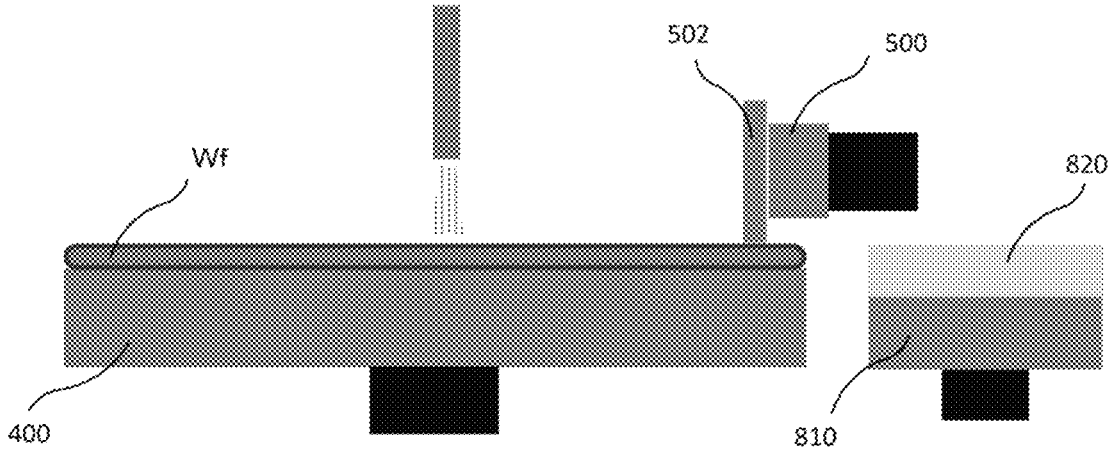
Figure 45A:
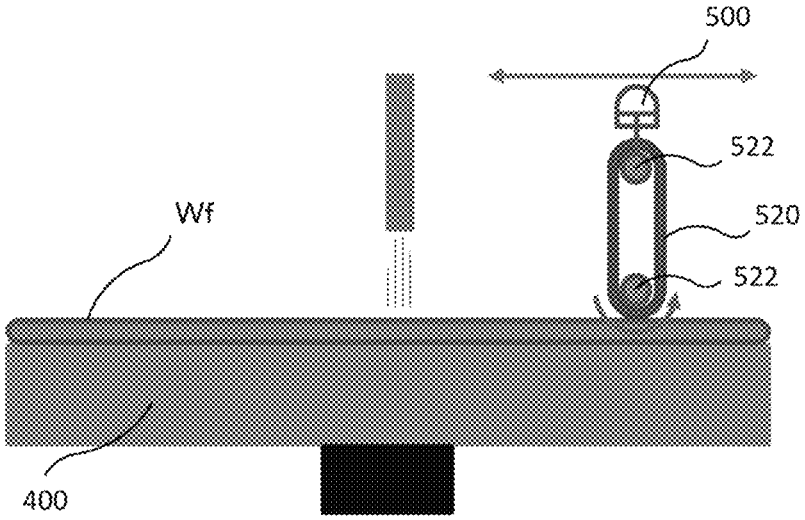
Figure 45B:
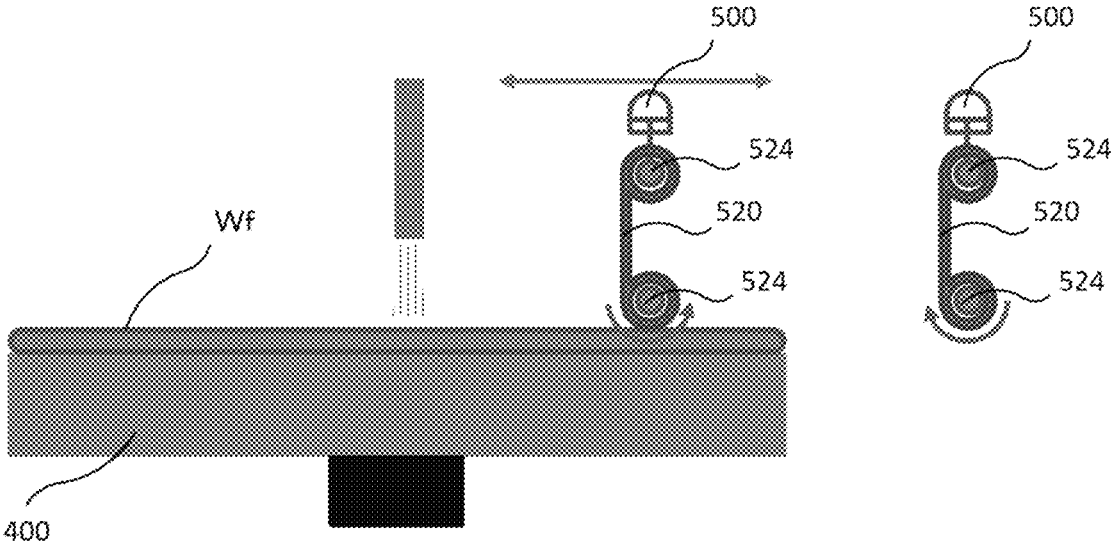
Figure 45C:
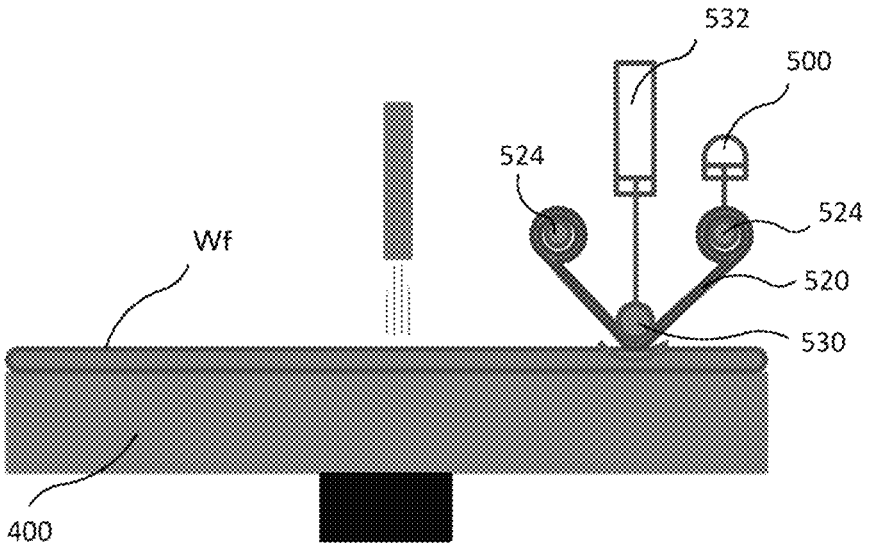
Figure 45D:
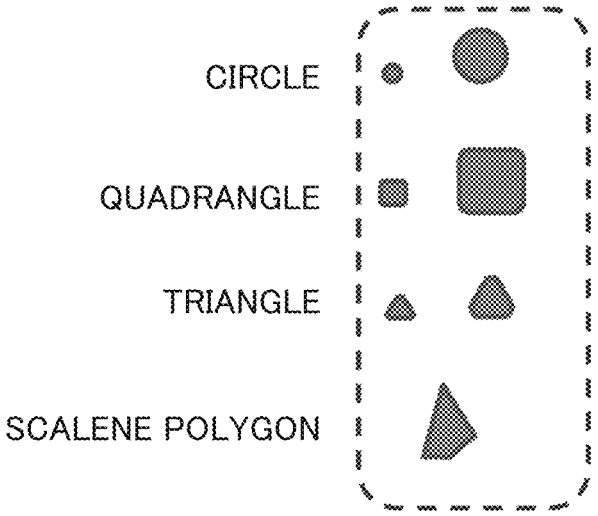

FIG. 37C is a flowchart showing the flow of polishing process according to the example 22, using the polishing machine according to one embodiment;

FIG. 38A is a flowchart showing a flow of polishing process according to an example 23, using a polishing machine according to one embodiment;

FIG. 38B is a flowchart showing the flow of polishing process according to the example 23, using the polishing machine according to one embodiment;

FIG. 38C is a flowchart showing the flow of polishing process according to the example 23, using the polishing machine according to one embodiment;

FIG. 38D is a flowchart showing the flow of polishing process according to the example 23, using the polishing machine according to one embodiment;

FIG. 39A is a flowchart showing a flow of polishing process according to an example 24, using a polishing machine according to one embodiment;

FIG. 39B is a flowchart showing the flow of polishing process according to the example 24, using the polishing machine according to one embodiment;

FIG. 39C is a flowchart showing the flow of polishing process according to the example 24, using the polishing machine according to one embodiment;

FIG. 40A is a flowchart showing a flow of polishing process according to an example 25, using a polishing machine according to one embodiment;

FIG. 40B is a flowchart showing the flow of polishing process according to the example 25, using the polishing machine according to one embodiment;

FIG. 40C is a flowchart showing the flow of polishing process according to the example 25, using the polishing machine according to one embodiment;

FIG. 41A is a flowchart showing a flow of polishing process according to an example 26, using a polishing machine according to one embodiment;

FIG. 41B is a flowchart showing the flow of polishing process according to the example 26, using the polishing machine according to one embodiment;

FIG. 41C is a flowchart showing the flow of polishing process according to the example 26, using the polishing machine according to one embodiment;

FIG. 42A is a flowchart showing a flow of polishing process according to an example 27, using a polishing machine according to one embodiment;

FIG. 42B is a flowchart showing the flow of polishing process according to the example 27, using the polishing machine according to one embodiment;

FIG. 42C is a flowchart showing the flow of polishing process according to the example 27, using the polishing machine according to one embodiment;

FIG. 43A is a schematic view showing a configuration of a control circuit of a polishing machine according to one embodiment;

FIG. 43B is a schematic view showing a configuration of a control circuit of a polishing machine according to one embodiment;

FIG. 44A is a view showing a schematic configuration of a partial polishing module according to one embodiment;

FIG. 44B is a view showing a schematic configuration of a partial polishing module according to one embodiment;

FIG. 44C is a view showing a schematic configuration of a partial polishing module according to one embodiment;

FIG. 45A is a view showing a schematic configuration of a partial polishing module according to one embodiment;

FIG. 45B is a view showing a schematic configuration of a partial polishing module according to one embodiment;

FIG. 45C is a view showing a schematic configuration of a partial polishing module according to one embodiment; and FIG. 45D is a view showing a cross-section shape of an idler according to one embodiment.

DETAILED DESCRIPTION

Now, embodiments of a polishing machine and a polishing method according to the invention will be described below with respect to appended drawings. In the appended drawings, identical or similar elements are designated by identical or similar reference symbols, and in the description of respective embodiments, description about identical or similar elements may be omitted if overlapping each other. Additionally, unless a feature described in respective embodiments is contradictory to each other, the feature is applicable to other embodiments.

Figure 1:
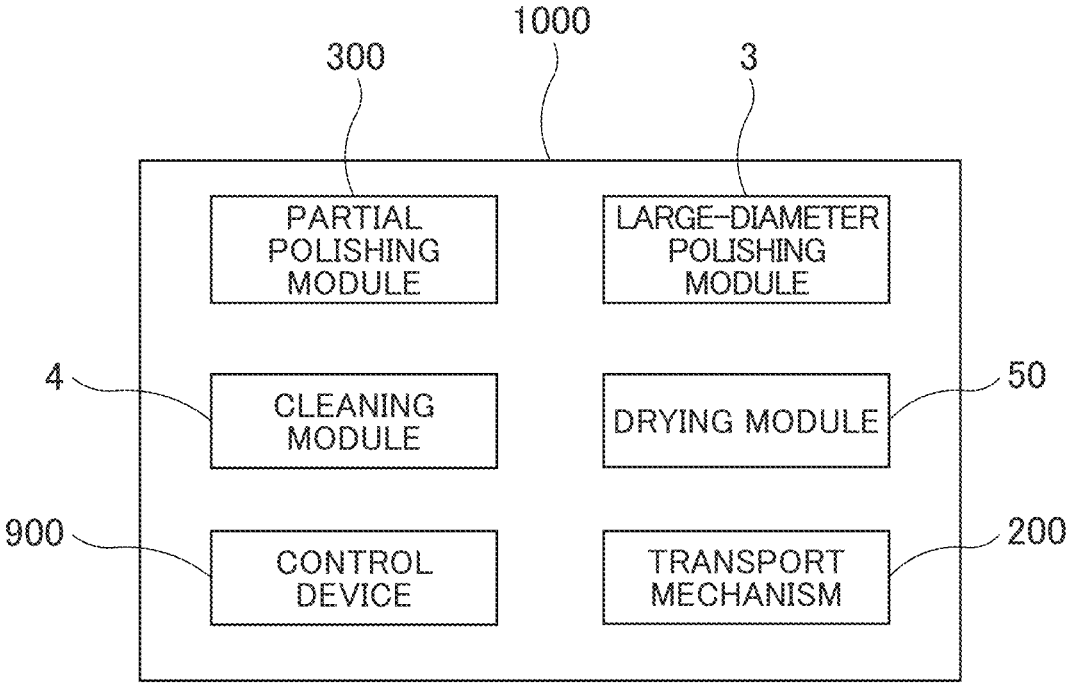
FIG. 1 is a block diagram showing the general configuration of a polishing machine according to one embodiment.

FIG. 1 is a block diagram showing the general configuration of a polishing machine according to one embodiment. As shown in FIG. 1, a polishing machine 1000 includes a partial polishing module 300, a large-diameter polishing module 3, a cleaning module 4, a drying module 50, a transport mechanism 200 and a control device 900. The partial polishing module 300 is a module for polishing a substrate that is an object to be polished (for example, a semiconductor wafer Wf), using a polishing pad having a smaller dimension than that of the substrate. A detailed configuration of the partial polishing module 300 will be described later. The large-diameter polishing module 3 is a module for polishing a substrate that is an object to be polished, using a polishing pad having a larger dimension than that of the substrate. A detailed configuration of the large-diameter polishing module 3 will be described later. The cleaning module 4 is a module for cleaning a substrate after polished. The cleaning module 4 can wash a substrate at an arbitrary timing. For example, after each of partial polishing and whole surface polishing described below ends, the cleaning module 4 can perform cleaning, and also, after both partial polishing and whole surface polishing end, the cleaning module 4 can perform cleaning. As the cleaning module 4, any known cleaning module can be used and its details will not be described here. The drying module 50 is a module for drying a cleaned substrate. As the drying module 50, any known drying module can be used and its details will not be described here. The transport mechanism 200 is a mechanism for transporting a substrate in the polishing machine 1000, and receives and delivers a substrate among the partial polishing module 300, the large-diameter polishing module 3, the cleaning module 4 and the drying module 50. Additionally, the transport mechanism 200 receives and delivers a substrate from/to the polishing machine 1000. As the transport mechanism 200, any known transport mechanism can be used and its details will not be described here. The control device 900 controls a behavior of each of the modules in the polishing machine 1000. The control device 900 can be composed of a general-purpose computer, a dedicated computer or the like, and includes hardware, such as a storage device, an input/output device, a memory and a CPU.

Figure 2:
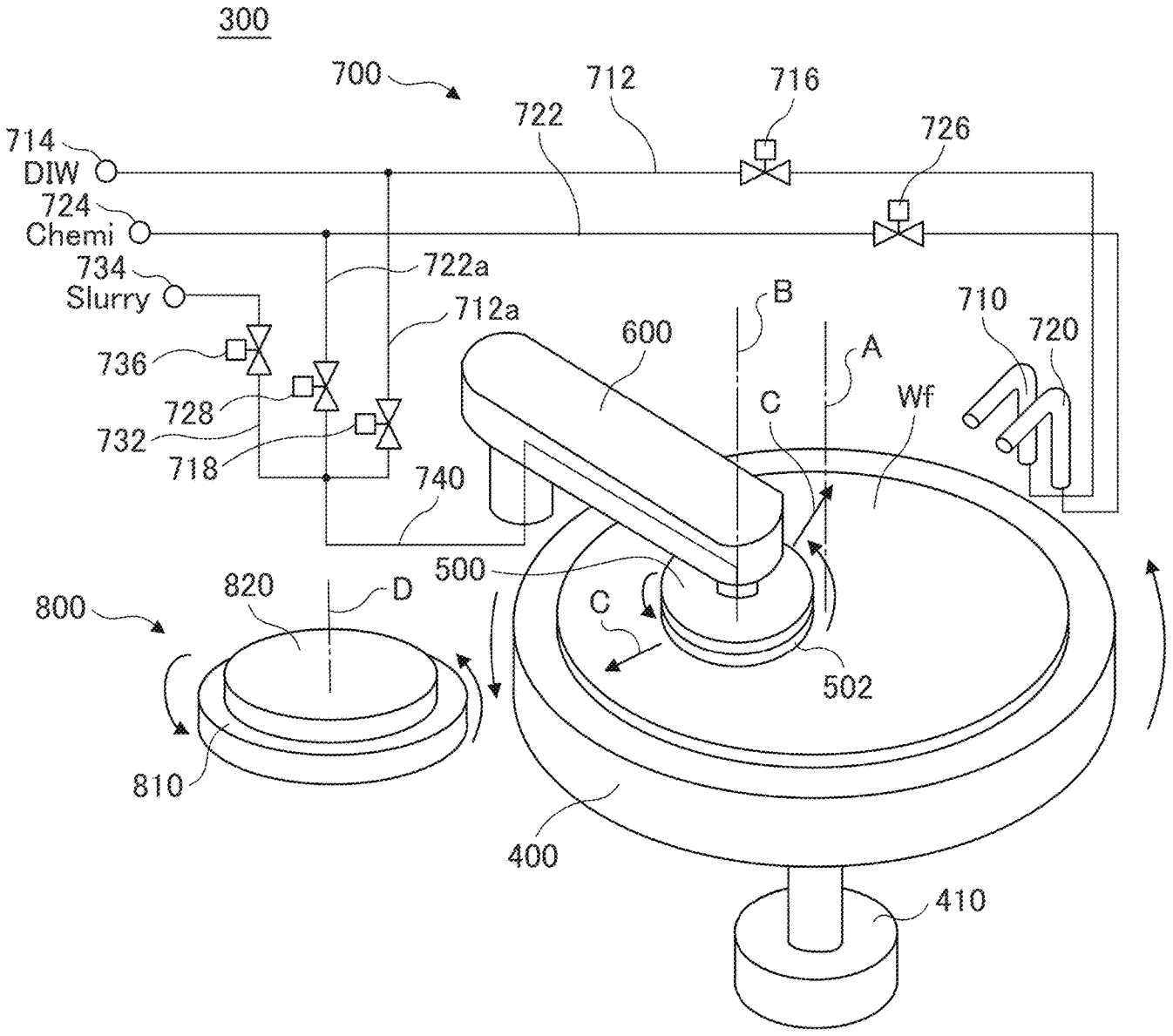
FIG. 2 is a view showing a schematic configuration of one example of a partial polishing module for performing polishing process using a polishing pad having a smaller diameter than that of an object.

FIG. 2 is a view showing a schematic configuration of one example of the partial polishing module 300 for performing polishing process, using a polishing bad having a smaller diameter than that of an object to be polished. In the partial polishing module 300 shown in FIG. 2, a polishing pad 502 is used, the polishing pad 502 having a smaller diameter than that of a wafer Wf that is an object to be polished. As shown in FIG. 2, the partial polishing module 300 includes a table 400 on which a wafer Wf is placed, a head 500 to which the polishing pad 302 for treating a surface to be processed of the wafer Wf is attached, an arm 600 to hold the head 500, a treatment liquid supply system 700 for supplying a treatment liquid and a conditioning device 800 for conditioning (dressing) the polishing pad 502. The behavior of the entire partial polishing module 300 is controlled by the control device 900. As described above, the control device 900 can be composed of a general-purpose computer, a dedicated computer or the like.

As shown in FIG. 2, the polishing pad 502 has a smaller dimension than that of a wafer Wf. Then, it is desirable that the diameter Φ of the polishing pad 502 is smaller than or equal to an area having variations in film thickness and shape of an object to be polished. Desirably, the diameter is preferably not larger than 50 mm, more preferably from Φ10 to 30 mm. This is because the larger the diameter of the polishing pad is, the smaller an area ratio to a wafer becomes, thus a polishing rate for the wafer increases. On the one hand, in contrast, regarding uniformity of a wafer polishing rate on the surface, the smaller the diameter of the polishing pad is, the better uniformity on the surface is improved. This is because a unit processing area becomes small, and as shown in FIG. 2, relatively moving the polishing pad 502 such as in a form of swinging on the surface of a wafer Wf by the arm 600 becomes advantageous in a method of polishing a small area having variations of film thickness and shape present on the wafer surface. Thus, if an area to be partially polished of a wafer Wf or a removal quantity is sufficiently small and low productivity is within an acceptable range with a slow polishing rate for the wafer Wf, then the diameter can be set to be not more than Φ10 mm. Note that a treatment liquid includes at least one of polishing solutions, such as DIW (pure water), a cleaning chemical solution and slurry. Desirably for keeping the state (flatness and residual film amount) of the surface to be polished after CMP, a removal quantity in processing is for example less than 50 nm, preferably less than 10 nm. If a variation amount of such film thickness and shape is small, such as the order from several nm to several tens nm, and a removal rate like a that required for a usual CMP is not needed, then a polishing rate may be adjusted by suitably treating a polishing solution, such as diluting. Additionally, the polishing pad 502 is formed of, for example, a hard pad of foamed polyurethane system, a soft pad of suede system, or sponge. Then, in control and rework for reducing variations on the wafer surface, a smaller contact area between the polishing pad 502 and a wafer Wf allows various kinds of variations to be more easily dealt with. Thus, the polishing pad diameter is desirably small, in particular, the diameter Φ is not larger than 50 mm, and preferably, the diameter Φ is not larger than about 30 mm. A kind of polishing pad may be suitably selected based on quality of material of an object to be polished and the state of an area to be removed. For example, if an area to be removed is made of the same material and has local concavity and convexity, then there may be the case in which step removal becomes important, and in this case, to improve step removal performance, a hard pad, i.e. a pad having a high hardness and stiffness may be used as a polishing pad. On the one hand, if an object to be polished is, for example, a material having a small mechanical strength, such as a Low-k film, and a plurality of materials is simultaneously processed, then to lower a damage to the surface to be polished, a soft pad may be used. Also, if a treatment liquid is a polishing solution like slurry, because a removal rate for an object and presence or absence of damage occurrence are not determined only based on hardness and stiffness of a polishing pad, the polishing pad may be suitably selected. Also, on the surface of these polishing pads, for example, groove geometry, such as a groove in a concentric fashion, an XY groove, a spiral groove, a groove in a radial fashion, may be provided. Furthermore, at least one or more holes through a polishing pad may be provided in a polishing pad, and a treatment liquid may be supplied through the hole. If a polishing pad is small and it is difficult to supply a treatment liquid through the hole, then, for example, the arm 600 may be provided with a supply nozzle for the treatment liquid, and the supply nozzle may be simultaneously moved as the arm 600 swings, or the treatment liquid supply nozzle may be provided independently of the arm 600. Additionally, as a polishing pad, a sponge-like material into which a treatment liquid can permeate, such as PVA sponge, may be used. These allows a flow distribution of a treatment liquid on a polishing pad to be uniformized and by-products removed by polishing to be rapidly discharged.

The polishing pad 502 as shown in FIG. 44A, may be held by the head 500 via a cushion layer 504 softer than a surface layer directly contacting a wafer Wf. Then, as the cushion layer 504, soft rubber, a resin layer having many gas cavities or material having airspaces like non-woven cloth may be used. This allows the polishing pad 502 to uniformly contact a wafer Wf.

The table 400 has a mechanism for adsorbing a wafer Wf and holds the wafer Wf. In the embodiment shown in FIG. 2, the table 400 is configured to rotate around an axis of rotation A by a driving mechanism 410. Also, the table 400 may be configured to angularly rotate a wafer Wf by the driving mechanism 410, or move it in a scrolling fashion, or stop it at an arbitrary position of the table 400 after rotation. Combination of these motions and a swinging motion of the arm 600 described below allows the polishing pad 502 to move to an arbitrary position on a wafer Wf. The polishing pad 502 is attached to the surface of the head 500 facing a wafer Wf. The head 500 is configured to be able to rotate around an axis of rotation B by a driving mechanism not shown. Note that, in this example, the axis of rotation B is situated vertically to a wafer Wf, but may tilt at an arbitrary angle. In this case, a contact area of the polishing pad 502 is limited, so that a smaller area can be processed. Then, one example of the head 500 having the polishing pad 502 is shown in FIG. 44B and FIG. 44C. The head 500 is fixed substantially vertically to that axis of rotation and may not have a following mechanism to a wafer Wf like a gimbal mechanism. In FIG. 44B, the axis of rotation of the head 500 is installed to form an angle larger than 0 degree to an axis vertical to the surface of a wafer Wf, and in partial polishing, an edge portion of the polishing pad 502 contacts a wafer Wf. Also, in FIG. 44C, the head 500 is fixed in a position so that the axis of rotation is substantially parallel to the substrate surface, and the center of the head 500 is the same as the axis of rotation. In this case, in partial polishing, the side portion of the polishing pad 502 contacts a wafer Wf. In any case, the polishing pad 502 is configured to be able to locally contact a wafer Wf. Note that in the example shown in FIG. 44C, the polishing pad 502 may have a larger diameter than that of the head 500. Accordingly, an area that the polishing pad 502 can use becomes larger and a life of the polishing pad becomes longer. Also, the head 500 is configured to be able to press the polishing pad 502 against the surface to be processed of a wafer Wf by a driving mechanism not shown, for example an actuator, such as an air cylinder and a ball screw. Note that regarding a pressing mechanism for the polishing pad 502, the pressing force applied to a wafer Wf by the polishing pad 502 may be adjusted by a pressing force of the above air cylinder or by a fluid pressure supplied to an air bag that is provided on the back face of the polishing pad 502. The arm 600 can move the head 500 in the range of a radius or a diameter of a wafer Wf, as shown by the arrow C. Further, the arm 600 is configured to swing the head 500 to a position so that the polishing pad 502 can face the conditioning device 800. Note that in this example, positioning of the head 500 to an arbitrary position on the surface of a wafer Wf is realized by combination of movement of the head 500 and rotation or angular rotation of the table 400, but as other examples, to move a relative position of the head 500 to a wafer Wf, an XY stage fixed to the stage may be used. Additionally, as a motion example of the arm 600, the head 500 may be configured to be connected to a liner-moving mechanism passing through the center of a wafer Wf, thereby a relative position of the polishing pad 502 to a wafer Wf is movable. Also, as other motion example of the arm 600, the polishing pad 502 may be configured to be connected to a swing mechanism passing along a circular path that passes through the center of a wafer Wf, thereby a relative position of the polishing pad 502 to a wafer Wf is movable.

Note that these embodiments show an example where each of the head 500 and polishing pad 502 is one for a wafer Wf, but the number of the heads and polishing pads may be plural, respectively. The head 500 may have a plurality of polishing pads 502 therein, and in this case, the polishing pads 502 may have different sizes. Additionally, the partial polishing module 300 may have a plurality of heads 500 that have the polishing pads 502 having different sizes. By selectively using these heads 500 or polishing pads 502 based on an area to be polished of a wafer Wf, the surface of a wafer Wf can be more efficiently processed. Also, though not shown, if the partial polishing module 300 has a plurality of the polishing pads 502, the arm 600 may be configured to be capable of automatically selecting an optimum head 500. By doing so, if there is a plurality of the polishing pads 502 or heads 500 restrictions due to spatial placement can be reduced.

The conditioning device 800 is a component for conditioning the surface of the polishing pad 502. An example of the conditioning device 800 has a dress table 810 and a dresser 820 installed on the dress table 810, as shown in FIG. 2. The dress table 810 is configured to be able to rotate around an axis of rotation D by a driving mechanism not shown. Also, the dress table 810 may be configured to be able to move the dresser 820 in a scrolling fashion by a driving mechanism not shown. The dresser 620 is formed of a diamond dresser whose surface has diamond particles fixed by electrodeposition or in which diamond abrasive grains are placed on the whole surface of a contact surface with a polishing pad or on a part of it, a brush dresser in which brush hair made from resin is placed on the whole surface of a contact surface with a polishing pad or on a part of it, or a combination thereof.

The partial polishing module 300 swing the arm 600 until the polishing pad 502 reaches a position facing the dresser 820 when the polishing pad 502 is conditioned. The partial polishing module 300 rotates the dress table 810 around the axis of rotation D, simultaneously rotates the head 500, and presses the polishing pad 502 against the dresser 820, thereby the polishing pad 502 is conditioned. Note that as a conditioning condition, a conditioning load is preferably not greater than 80 N. Additionally, the conditioning load is more preferably not greater than 40 N in terms of a life of the polishing pad 502. Further, the polishing pad 502 and the dresser 820 are desirably used under the condition that the number of rotation is not larger than 500 rpm.

Note that this embodiment shows an example where the surface to be polished of a wafer Wf and the dress surface of the dresser 820 are horizontally installed, but is not limited to this. For example, though not shown, in the partial polishing module 300, the table 400 and the dress table 810 can be disposed so that the surface to be polished of a wafer Wf and the dress surface of the dresser 820 are vertically installed. In this case, the arm 600 and the head 500 are disposed to be capable of polishing the surface to be polished of a wafer Wf disposed vertically by making the polishing pad 502 contact the surface to be polished, and conditioning the dress surface of the dresser 820 disposed vertically by making the polishing pad 502 contact the dress surface. Furthermore, either the table 400 or the dress table 810 may be disposed vertically and the entire arm 600 or a part thereof may rotate so that the polishing pad 502 disposed on the arm 600 is vertical to each surface of the tables. Additionally, this embodiment shows an example where for conditioning the polishing pad 502, the diamond dresser and the hair brush made from resin are used, but a noncontact cleaning method, such as a method in which a high-pressure fluid is supplied to the surface of the polishing pad 502, may be used.

Note that in this embodiment, a board type polishing pad 502 is used to polish a wafer Wf, but for example, a tape shaped polishing member may be used. FIG. 45A, FIG. 45B and FIG. 45C show an example of a partial polishing machine using a tape shaped polishing member.

In the example of FIG. 45A, the head 500 includes a polishing member 520 and a rotating body 522 fixed to an axis of rotation not shown, and the polishing member 520 is fixed to this rotating body 522. The axis of rotation can rotate or angularly rotate, thereby providing a mechanism that can continuously or intermittently feed the polishing member 520. Then, the polishing member 520 may be of the same material as that of a usual CMP polishing pad, formed in a belt shape, or of the polishing member 520 integrally fixed to the surface of a belt-shaped base member in contact with a wafer Wf, though not shown. Note that in the latter case, as the polishing member 520, a pad of the same material as that of the above usual CMP polishing pad may be disposed, but for example, a pad in which abrasive grains are disposed on a base member may be applicable. In this case, to prevent the abrasive grains from dropping off, the abrasive grain surface may be coated with resin, or the abrasive grains themselves may be fixed on the base member by electrode position. Note that a material of the base member includes, for example, polyimide, rubber, PET, resin material, composite material made by impregnating these materials with fibers, and further at least one of metal foils or a combination thereof. Also, a contact area between the polishing member 520 and a wafer Wf can be adjusted by a diameter of the rotating body 522. Note that in this embodiment, the head 500 is disposed so that a straight line connecting two axes of rotation is vertical to a wafer Wf, but to adjust the contact area, the head 500 may be disposed so that the above straight line tilts at an angle from 0 to 90 degrees. Additionally, though not shown, the head 500 may be formed to be fixed to an arm capable of moving horizontally or in a circular arc relative to the surface of a wafer Wf so that the head 500 is movable on the surface of a wafer Wf. Also, the head 500 may be configured to connect to an actuator, such as an air cylinder or a ball screw, for making the entire head 500 contact and press a wafer Wf. Because of such a structure, regarding the polishing member 520, by keeping a distance between the axes of rotation, a length of the polishing member 520, then an area in which a wafer Wf is processed increases, so that at partial polishing, an amount of wear per unit, area of the polishing member 520 can be reduced, and not only polishing efficiency of a wafer Wf can be maintained, but a life of the polishing member 520 can be prolonged.

Next, in FIG. 45B, the head 500 includes a polishing member 520 and a winding shaft 524. The winding shaft 524 can rotate or angularly rotate, thereby providing a mechanism that can continuously or intermittently feed a polishing member. Then, the polishing member 520 may be of the same material as that of a usual CMP polishing pad, formed in a belt shape, or though not shown, of the polishing member 520 integrally fixed to the surface of a belt-shaped base member in contact with a wafer Wf. Note that in the latter case, as the polishing member 520, a pad of the same material as that of the above usual CMP polishing pad may be disposed, or for example, a pad in which abrasive grains are disposed on a base member may be applicable. In this case, to prevent the abrasive grains from dropping off, the abrasive grain surface may be coated with resin, or the abrasive grains themselves may be fixed on a base member by electrode position. Note that a material of the base member includes, for example, polyimide, rubber, PET, resin material, composite material made by impregnating these materials with fibers, and further at least one of metal foils or a combination thereof. In this embodiment, partial polishing process is performed while the polishing member 520 being fed continuously or intermittently in one direction. Then, when the polishing member 520 reaches an end portion, it may be used again by feeding it in an inverse direction. But, if the feeding direction has an effect on polishing characteristics of partial polishing, then the polishing member 520 may be rewound to a start portion once and partial polishing may be performed again while the polishing member 520 being fed in the same direction. Also, a contact area between the polishing member 520 and a wafer Wf can be adjusted by a diameter of the rotating body 524. Note that though not shown, the head 500 may be formed to be fixed to an arm capable of moving horizontally or in a circular arc relative to the surface of a wafer Wf so that the head 500 is movable on the surface of a wafer Wf. Also, the head 500 may be connected to an actuator, such as an air cylinder or a ball screw, for making the entire head 500 contact and press a wafer Wf. By using a head having such a rewind-type structure, a length of the polishing member 520, then an area in which a wafer Wf can be processed further increases, so that at partial polishing process, an amount of wear per unit area of the polishing member 520 can be more reduced, and not only polishing efficiency of a wafer Wf can be maintained, but a life of the polishing member 520 can be prolonged.

Additionally, in FIG. 45C, the head 500 includes a polishing member 520, a winding shaft 524 and an idler 530 for making the polishing member 520 contact and press a wafer Wf. A shape of the idler 530 allows a contact area between the polishing member 520 and a wafer Wf to be defined. Note that the winding shaft 524 can rotate or angularly rotate, thereby providing a mechanism that can continuously or intermittently feed a polishing member. Then, regarding the shape of the idler 530, as shown in FIG. 45D, its cross-section shape may be any of a circle, a triangle, a quadrangle and a scalene polygon, and the cross-section shape and depth shape of the idler 530 may be suitably adjusted based on an area to be partially polished. The polishing member 520 may be of the same material as that of a usual CMP polishing pad, formed in a belt shape, or though not shown, of the polishing member 520 integrally attached to the surface of a belt-shaped base member in contact with a wafer Wf. Note that in the latter case, as the polishing member 520, a pad of the same material as that of the above usual CMP polishing pad may be disposed, but for example, a pad in which abrasive grains are disposed on a base member may be applicable. In this case, to prevent the abrasive grains from dropping off, the abrasive grain surface may be coated with resin, or the abrasive grains themselves may be fixed on the base member by electrode position. Note that a material of the base member includes, for example, polyimide, rubber, PET, resin material, composite material made by impregnating these materials with fibers, and further at least one of metal foils or a combination thereof. In this embodiment, partial polishing process is performed while the polishing member 520 being fed continuously or intermittently in one direction. Then, when the polishing member 520 reaches an end portion, it may be used again by feeding it in an inverse direction. But, if the feeding direction has an effect on polishing characteristics of partial polishing, then the polishing member 520 may be rewound to a start portion once and partial polishing may be performed again while the polishing member 520 being fed in the same direction. Note that though not shown, the head 500 may be formed to be fixed to an arm capable of moving horizontally or in a circular arc relative to the surface of a wafer Wf so that the head 500 is movable on the surface of a wafer Wf. Also, the idler 530 for making the polishing member 520 contact a wafer Wf may be connected to an actuator 532, such as an air cylinder and a ball screw. By using the head 500 having such a rewind-type structure, the polishing member 520 can further increase an area in which a wafer Wf can be processed, so that not only polishing efficiency of a wafer Wf can be maintained, but a life of the polishing member 520 can be prolonged. Additionally, use of the idler 530 allows a contact area between a wafer Wf and the polishing member 520 to be adjusted.

A treatment liquid supply system 700 includes a pure water nozzle 710 for supplying pure water (DIW) to the surface to be polished of a wafer Wf. The pure water nozzle 710 is connected to a pure water supply source 714 via pure water piping 712. The pure water piping 712 is provided with an on-off valve 716 capable of opening/closing the pure water piping 712. The control device 900 controls the on-off valve 716 to open and close, so that at an arbitrary timing, the pure water can be supplied to the surface to be polished of a wafer Wf.

Additionally, the treatment liquid supply system 700 includes a chemical solution nozzle 720 for supplying a chemical solution (Chemi) to the surface to be polished of a wafer Wf. The chemical solution nozzle 720 is connected to a chemical solution supply source 724 via chemical solution piping 722. The chemical solution piping 722 is provided with an on-off valve 726 capable of opening/closing the chemical solution piping 722. The control device 900 controls the on-off valve 726 to open and close, so that at an arbitrary timing, the chemical solution can be supplied to the surface to be polished of a wafer Wf.

The partial polishing module 300 is configured so that a polishing solution, such as pure water, chemical solution or slurry, can be selectively supplied to the surface to be polished of a wafer Wf via the arm 600, the head 500 and the polishing pad 502.

That is, branch pure water piping 712*a* branches from between the pure water supply source 714 and on-off valve 716 in the pure water piping 712. Also, branch chemical solution piping 722*a* branches from between the chemical solution supply source 724 and the on-off valve 726 in the chemical solution piping 722. Polishing solution piping 732 connected to the branch pure water piping 712*a*, the branch chemical solution piping 722*a* and polishing solution supply source 734 meets a solution supply piping 740. The branch pure water piping 712*a* is provided with an on-off valve 718 capable of opening/closing the branch pure water piping 712*a*. The branch chemical solution piping 722*a* is provided with an on-off valve 728 capable of opening/closing the branch chemical solution piping 722*a*. The polishing solution piping 732 is provided with an on-off valve 736 capable of opening/closing the polishing solution piping 732. Note that there may be a configuration in which the polishing solution can be supplied on the wafer Wf from the outside of the head 500, similarly to the pure water and the chemical solution.

A first end of the solution supply piping 740 is connected to three systems of piping composed of the branch pure water piping 712*a*, the branch chemical solution piping 722*a* and the polishing solution piping 732. The solution supply piping 740 extends through the inside of the arm 600, the central portion of the head 500 and the central portion of the polishing pad 502. A second end of the solution supply piping 740 opens toward the surface to be polished of a wafer Wf. The control device 900 controls the on-off valve 718, the on-off valve 728 and the on-off valve 736 to open/close, thereby at an arbitrary timing, any one of the polishing solution, such as pure water, chemical solution, slurry, or a mixed solution including an arbitrary combination thereof can be supplied to the surface to be polished of a wafer Wf.

In this embodiment, the partial polishing module 300 supplies a treatment liquid to a wafer Wf via the solution supply piping 740, and further rotates or angularly rotates the table 400 around the axis of rotation A and moves the arm 600, thus makes the polishing pad 502 reach an arbitrary position of the wafer Wf. In this situation, the Wf can be polished while the polishing pad 502 being pressed against the surface to be processed and the head 500 being rotated around the axis of rotation B. Note that desirably, a condition for polishing process is that the pressure is preferably not greater than 3 psi, further preferably not greater than 2 psi in terms of reducing a damage to a wafer Wf. But, on the one hand, if there are many areas to be processed, it is desirable that a processing speed for respective areas is large, and in this case, it is desirable that the number of rotation of the head 500 is large. However, desirably, the number of rotation is not larger than 1000 rpm in terms of treatment liquid distribution on the surface. Note that if areas to be processed are present on the surface of a wafer Wf in a concentric fashion, the processing speed can be increased by rapidly rotating the wafer Wf. Note that a moving speed of the head 500 is not greater than 300 mm/sec. Also, when areas to be processed is polished, the head 500 may swing. This swinging allows polishing unevenness occurring in a rotational direction and in a vertical direction to be reduced, thus providing polishing with a better accuracy. Note that if areas to be processed are present on the surface of a wafer Wf in a concentric fashion, the head will swing in the state where the wafer Wf rotates, but a distribution of optimal moving speed varies depending on the number of rotation of the wafer Wf and the head 500 and a travel distance of the head 500, accordingly it is desirable that the moving speed of the head 500 on a wafer Wf is variable. In this case, desirably, a method for changing the moving speed is, for example, a method that a travel distance on the surface of a wafer Wf is divided into a plurality of sections and a moving speed can be set for respective sections. Also, a treatment liquid flow rate should be large so that a distribution of a sufficient treatment liquid on the wafer surface can be maintained even at a high-speed rotation of a wafer Wf and the head 500. But, meanwhile, an increase in treatment liquid flow rate results in an increase in processing cost, thus the flow rate is desirably not greater than 1000 ml/min, preferably not greater than 500 ml/min.

Figure 3:
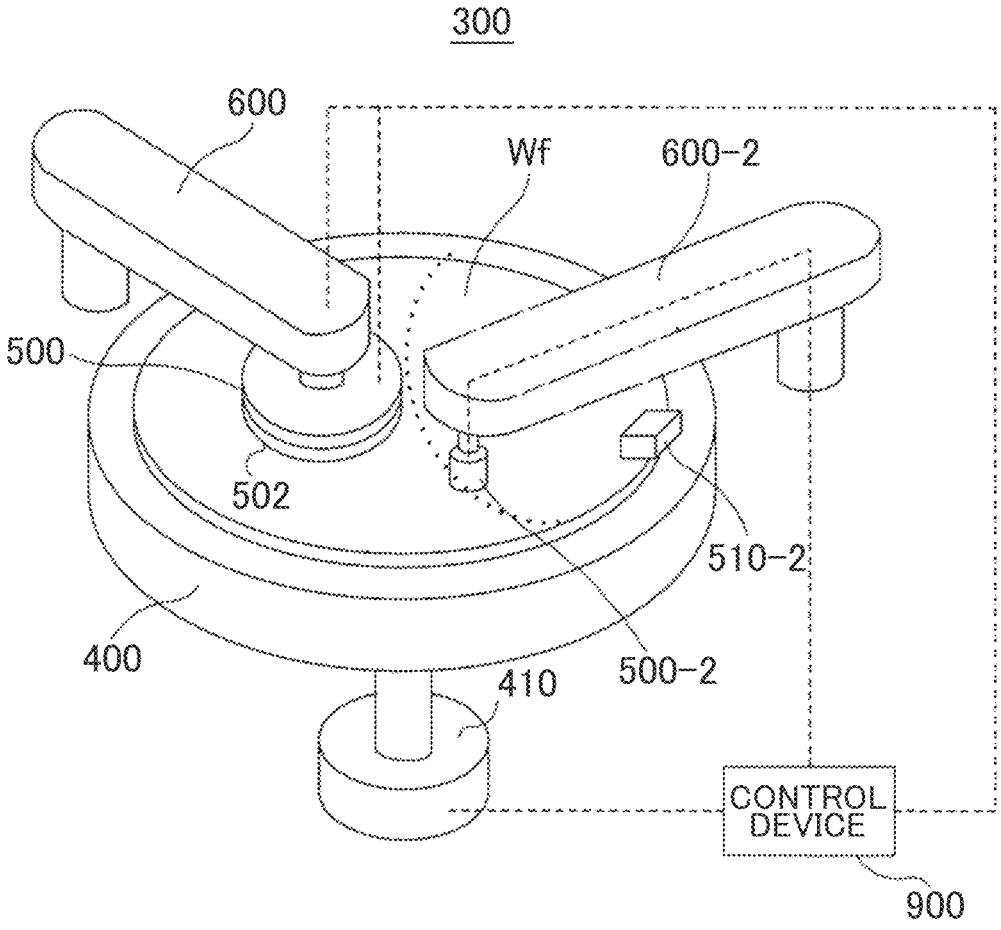
FIG. 3 is a view showing a schematic configuration of a partial polishing module including a detector according to one embodiment.

As one example, the partial polishing module 300 includes a detector for detecting the state of the surface to be polished of a wafer Wf. FIG. 3 is a view showing a schematic configuration of a partial polishing module 300 having a detector according to one embodiment. Note that in FIG. 3, for simplicity of description, configurations of the treatment liquid supply system 700, the conditioning device 800 or the like are not shown.

As shown in FIG. 3, the partial polishing module 300 includes a detection head 500-2. To the detection head 500-2, a detector for detecting the state of the surface to be polished of a wafer Wf is mounted. The detector may be, as one example, Wet-ITM (In-line Thickness Monitor). In Wet-ITM, the detection head 500-2 exists on a wafer in a noncontact state and moves on the whole surface of a wafer, thereby can detect (measure) a film thickness distribution (or distribution information about the film thickness) of a film formed on the wafer Wf. In particular, the detection head 500-2 detects the film thickness distribution on the wafer Wf while moving along a path that passes through the center of the wafer Wf.

Note that as the detector, a detector using an arbitrary method can be used, in addition to Wet-ITM. For example, as an available detection method, a contactless detection method such as a known eddy current and optical methods, can be adopted, and also a contact detection method may be adopted. As the contact detection method, for example, an electric resistance method can be adopted in which a detection head having an energizable probe is provided, and in the state where the probe contacts a wafer Wf and the wafer Wf is energized, the probe detects a distribution of film resistance while scanning the surface of the wafer Wf. Also, as another contact detection method, a step detection method can be adopted in which in the state where a probe contacts the surface of a wafer Wf and scans the surface of the wafer Wf, up-and-down motions of the probe are monitored, thus a distribution of concavity and convexity of the surface is detected. In any of the contact or contactless detection methods, an output from detection is a film thickness or a signal corresponding to the film thickness. In the optical detection method, differences among film thicknesses may be recognized from an amount of reflected light of projected light, and further from differences among tones on the surface of a wafer Wf. These detectors may be disposed in the detection head 500-2 of FIG. 3, or otherwise may be disposed at another arbitrary location.

Figure 4:
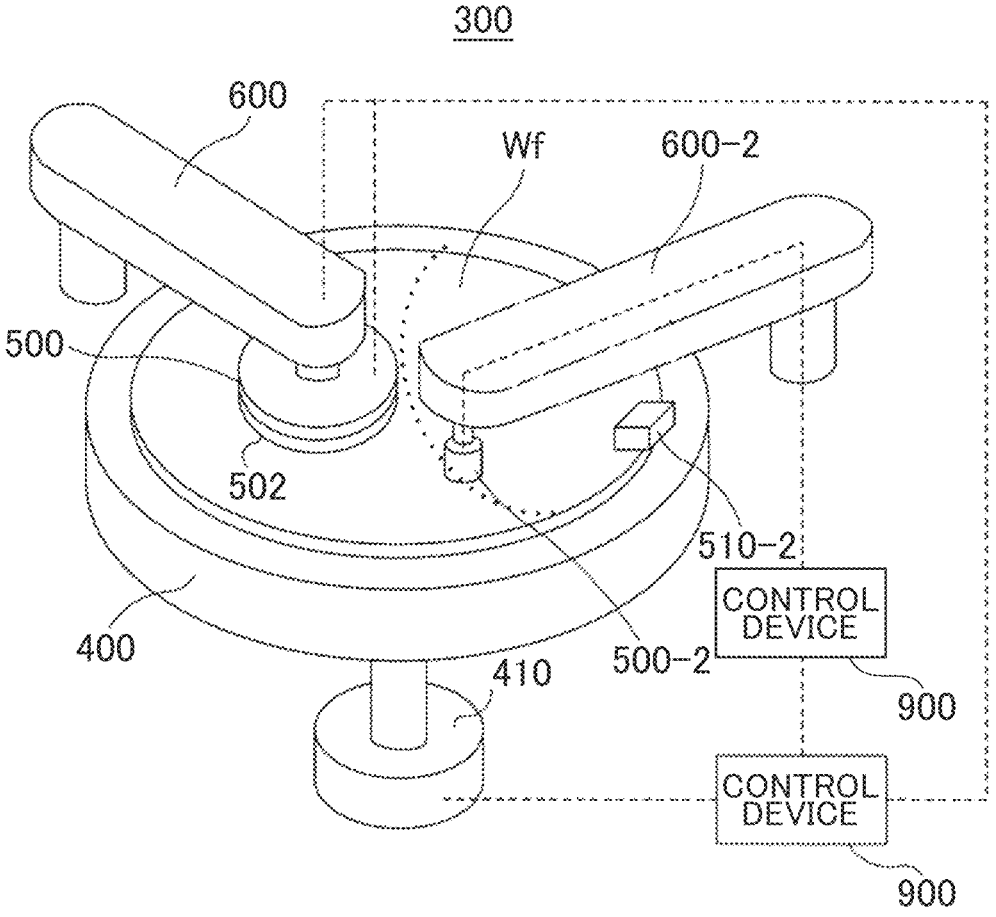
FIG. 4 is a view showing a schematic configuration of a partial polishing module including a detector according to one embodiment.

The detector is connected to a control device 900, and a signal detected by the detector is processed by the control device 900. As the control device 900 for the detector, the same hardware as that of the control device 900 to control motion of the table 400, the head 500 and the arm 600 may be used, or another hardware may be used. FIG. 3 is a view showing an example where the same hardware is used. FIG. 4 is a view showing an example where another hardware is used. As shown in FIG. 4, with use of hardware different between the control device 900 of controlling motion of the table 400, the head 500 and the arm 600, and the control device 900 for the detector, hardware resources to be used can be distributed between a system for polishing a wafer Wf and a system for detecting the state of the surface of the wafer Wf and subsequently processing a signal, so that process can be performed at a higher speed as a whole.

As shown in FIG. 3, the detection head 500-2 is mounted independently of an arm 600 in the partial polishing module 300. The detection head 500-2 is mounted on the arm 600-2. The arm 600-2 is configured to be able to swing in a circular arc, thereby the detection head 500-2 can move along a path (dotted line) that passes through the center of a wafer Wf. The detection head 500-2 can behave independently of the arm 600. The detection head 500-2 is configured to acquire a signal about a film thickness distribution or a film thickness of a film formed on a wafer Wf by scanning the wafer Wf. Note that at detecting a film thickness of a wafer Wf, it is desirable that the film thickness is detected while the wafer Wf is rotated, or the detection head 500-2 is swung in a radial direction. This allows film thickness information about the whole surface of a wafer Wf to be acquired. Note that to detect at least one of a notch, an orientation flat and a laser marker formed on a wafer Wf as the reference position, detection part 510-2 disposed in contactless with the wafer Wf may be provided inside or outside the partial polishing module 300, and also a rotating angle detection mechanism may be mounted on the driving mechanism 410 so that the table 400 can angularly rotate from a predetermined position. The detection part 510-2 is disposed not so as to rotate together with the table 400. The detection part 510-2 detects at least one position of a notch, an orientation flat and a laser marker of a wafer Wf, thereby data about a film thickness or the like detected by the detection head 500-2 can be related to not only a position in a radial direction, but a position in a circumferential direction. That is, based on these indications associated with the positions of the driving mechanism 410 and a wafer Wf, the wafer Wf is placed at a predetermined position on the table 400, thereby a distribution of the film thickness or a signal associated with the film thickness of the wafer Wf with respect to the reference position can be acquired.

Also, in this embodiment, the detection head 500-2 is mounted independently of the arm 600, but there may be a configuration in which the detection head 500-2 is mounted to the arm 600, and by using a motion of the arm 600, a signal associated with a film thickness or information about the film thickness, concavity and convexity and a height is acquired. Additionally, a detection timing, in this embodiment, may be before polishing a wafer Wf, during polishing and/or after polishing. If the detection head 500-2 is independently mounted, the detection head 500-2 does not interfere with a motion of the head 500 in the interval of polishing process even if before polishing, after polishing or during polishing. However, while a wafer Wf is processed for acquiring a film thickness or a signal related to the film thickness with as small a time delay as possible in processing the wafer Wf, when processing by the head 500 and simultaneous detection of the film thickness of the wafer Wf are performed, the detection head 500-2 is configured to scan in response to a motion of the arm 600. Note that for state detection of the surface of a wafer Wf, in this embodiment, as a means for acquiring a film thickness or a signal related to information about the film thickness, concavity and convexity and a height, the detection head 500-2 is mounted in the partial polishing module 300, but for example, if polishing process in the partial polishing module 300 takes time, then this detection part may be disposed outside the partial polishing module 300 as a detection unit in terms of productivity. For example, as to ITM, Wet-ITM is good for measurement during performing process, but apart from this, in acquiring a film thickness or a signal corresponding to the film thickness before or after processing, it is not necessarily required to mount Wet-ITM in the partial polishing module 300. ITM may be mounted outside the polishing module, and measurements may be performed when a wafer is delivered to and/or taken out of the polishing machine 1000. Based on a film thickness or a signal related to the film thickness, concavity and convexity and a height acquired by this detection head 500-2, a polishing endpoint of respective areas to be polished may be decided.

Figure 5:
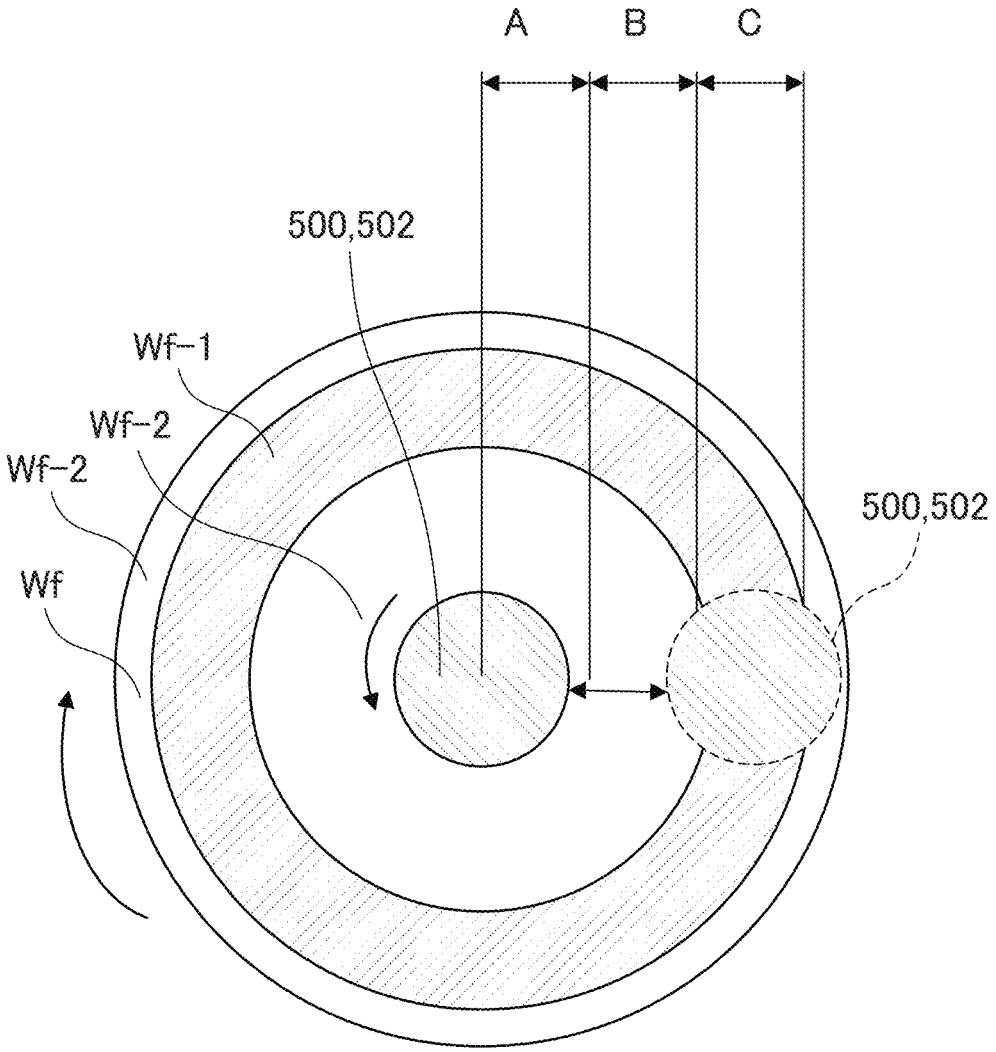
FIG. 5 is a schematic view illustrating one example of polishing control using a partial polishing module.

FIG. 5 is a schematic view illustrating one example of polishing control using the partial polishing module 300. As shown in FIG. 5, supposing that on the surface to be processed of a wafer Wf, portions Wf-1 having a film thickness larger than that of other portions Wf-2 are formed in a concentric fashion. In this case, if the range of swinging of the head 500 is divided into swinging ranges A, B and C, the control device 900 can control the head 500 so that the number of rotation of the head 500 in the swinging range C is larger than those in the swinging ranges A and B. Also, the control device 900 can control the head 500 so that a pressing force applied by the polishing pad 502 in the swinging range C is larger than those in the swinging ranges A and B. Additionally, the control device 900 can control a swinging speed of the arm 600 so that a polishing time (stay time of the polishing pad 502) in the swinging range C is larger than those in the swinging ranges A and B. Consequently, by using the control device 900, the surface to be polished of a wafer Wf can be evenly polished.

Figure 6:
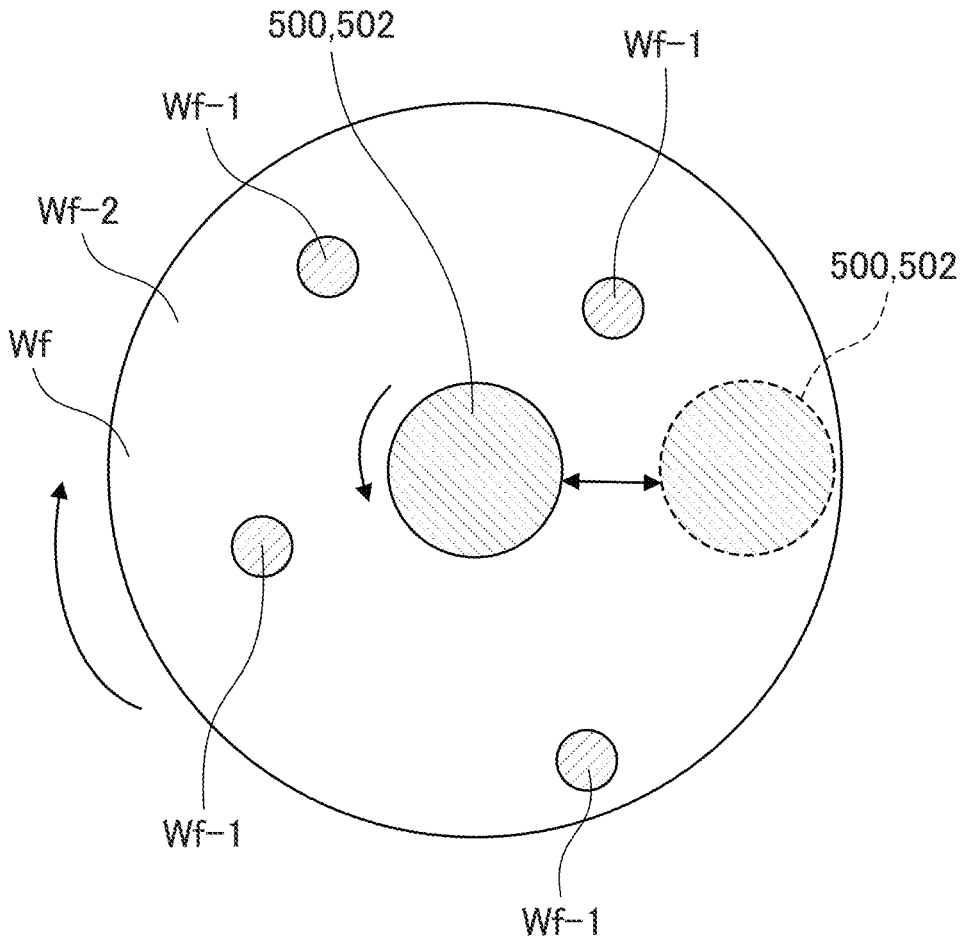
FIG. 6 is a schematic view illustrating one example of polishing control using a partial polishing module.

Further, FIG. 6 is a schematic view illustrating one example of polishing control using the partial polishing module 300. As shown in FIG. 6, supposing that on the surface to be processed of a wafer Wf, portions Wf-1 having a film thickness larger than that of other portions Wf-2 are randomly formed. In this case, the control device 900 can make a polishing amount of the portions Wf-1 having the thicker film thickness of the wafer Wf larger than that of the other portions Wf-2 by angularly rotating the wafer Wf by the driving mechanism 410. For example, the control device 900 can recognize a position of the portions Wf-1 having the thicker film thickness by using a notch, an orientation flat or a laser marker as the reference, and angularly rotate the wafer Wf by the driving mechanism 410 so that this position enters a swinging range of the head 500. In particular, the partial polishing module 300 includes a detection part 510-2 (see FIG. 3, FIG. 4) to detect at least one of a notch, an orientation flat and a laser marker of a wafer Wf, and the wafer Wf is rotated by an arbitrary predetermined angle so that the notch, the orientation flat and the laser marker of the wafer Wf are positioned in the swinging range of the head 500. Note that in this example, the detection part 510-2 of the notch or the like is situated in the partial polishing module 300, but if the detection part 510-2 is outside the partial polishing module 300 and the recognized position information can be referenced by the partial polishing module 300 (for example, in the case where the position of the notch or the like is finally located at the same position even if a motion, such as transport of the wafer Wf, occurs from the detection part to the partial polishing module 300), then the detection part may be provided outside the partial polishing module 300. While the portions Wf-1 having the thicker film thickness of the wafer Wf are positioned in the swinging range of the head 500, the control device 900 can control the head 500 so that the number of rotation of the head 500 is greater than that for the other portions Wf-2. Also, while the portions Wf-1 having the thicker film thickness of the wafer Wf are positioned in the swinging range of the head 500, the control device 900 can control the head 500 so that the pressing force applied by the polishing pad 502 is greater than that for the other portions Wf-2. Additionally, the control device 900 can control the swinging speed of the arm 600 so that the polishing time (stay time of polishing pad 502) during which the portions Wf-1 having the thicker film thickness of the wafer Wf are positioned in the swinging range of the head 500 is greater than that for the other portions Wf-2. Furthermore, the control device 900 can control to polish only the portions Wf-1 having the thicker film thickness of the wafer Wf by rotating the head 500 in the state where the table 400 is stopped at a position at which the polishing pad 502 is disposed over the portions Wf-1 having the thicker film thickness of the wafer Wf. Consequently, by using the control device 900, the surface to be polished can be uniformly polished.

FIG. 43A shows an example of a control circuit for processing a film thickness and information about concavity and convexity and a height of a wafer Wf. First, a control part for partial polishing combines a polishing process recipe and a parameter set in HMI (Human Machine Interface) and determines a basic partial polishing recipe. At this time, a partial polishing recipe and a parameter downloaded from HOST into the partial polishing module 300 may be used. Next, a recipe server combines the basic partial polishing recipe and polishing process information of a process Job, and creates a basic partial polishing recipe for each of wafers Wf to be processed. A partial polishing recipe server combines the partial polishing recipe for each of wafers Wf to be processed, wafer surface shape data stored in a database for partial polishing and also past data about a wafer surface shape or the like after partial polishing of a similar wafer, and creates a partial polishing recipe for each of wafers. At this time, instead of the wafer surface shape data stored in the database for partial polishing, data of a wafer Wf measured in the partial polishing module 300 may be used, or data downloaded in advance from HOST into the partial polishing module 300 may be used. The partial polishing recipe server transmits that partial polishing recipe to the partial polishing module 300 via the recipe server or directly. The partial polishing module 300 partially polishes a wafer Wf according to the received partial polishing recipe. After partial polishing process, the detector measures a surface shape of the wafer Wf and stores the result in the database for partial polishing.

FIG. 43B shows a circuit diagram if a surface state detection part of a wafer is separated from the control part for partial polishing shown in FIG. 43A. The control part for surface state detection of a wafer, for dealing with large amount of data is separated from the control part for partial polishing, so that it may be expected that the control part for partial polishing has a lowered load for data processing, and a create time for creating a process Job and a process time for creating a partial polishing recipe are reduced, accordingly a total throughput of the partial polishing module can be improved.

Figure 7:
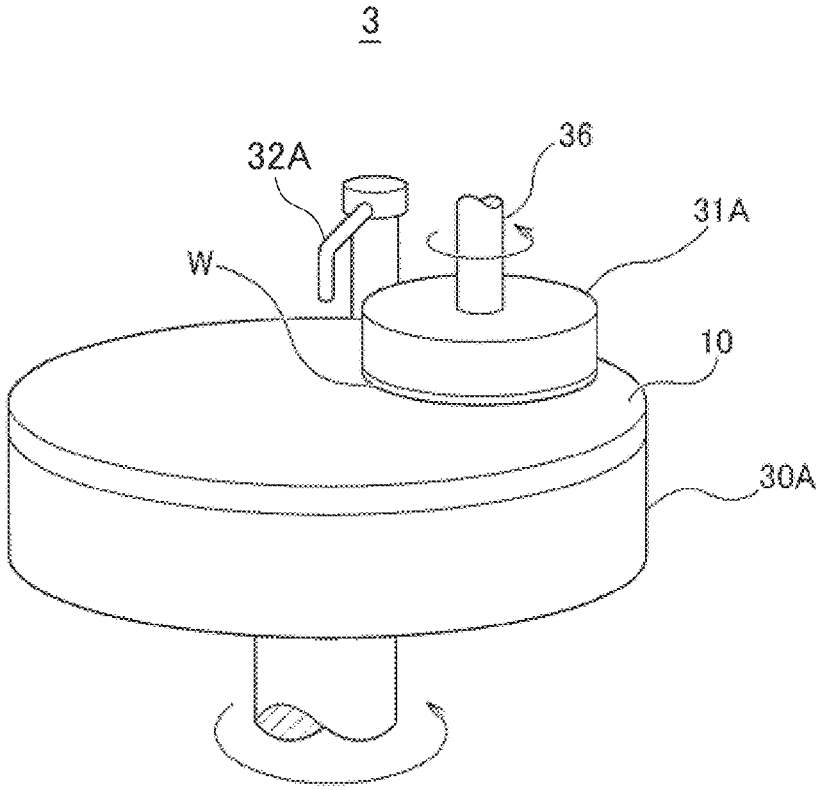
FIG. 7 is a view showing a schematic configuration of one example of a large-diameter polishing module for performing polishing process using a polishing pad having a larger diameter than that of an object.

FIG. 7 is a view showing a schematic configuration of one example of a large-diameter polishing module 3 for polishing process using a polishing pad having a larger diameter than that of an object to be polished. As shown in FIG. 7, the large-diameter polishing module 3 includes: a polishing table 30A to which a polishing pad (polishing tool) 10 having a polishing surface is fixed, a top ring 31A for holding a wafer Wf to polish while pressing the wafer Wf against the polishing pad 10 on the polishing table 30A, and a polishing solution supply nozzle 32A for supplying a polishing solution or a dressing solution (for example, pure water) to the polishing pad 10. Though not shown, the large-diameter polishing module 3 may be configured to further include: a dresser for dressing a polishing surface of the polishing pad 10, and an atomizer of removing slurry, polishing products and pad residues due to dressing on the polishing surface by injecting a mixed fluid of a liquid (for example, pure water), a gas (for example, nitrogen gas) or a liquid (for example, pure water).

As shown in FIG. 7, the top ring 31A is supported by a top ring shaft 36. On the upper surface of the polishing table 30A, the polishing pad 10 is applied. The upper surface of the polishing pad 10 provides a polishing surface to polish a wafer Wf. Note that instead of the polishing pad 10, fixed abrasive grains may be also used. The top ring 31A and the polishing table 30A, as shown by the arrow, are configured to rotate around their shaft center. A wafer Wf is held on the lower surface of the top ring 31A by vacuum suction. At polishing, in the state where a polishing solution is supplied from the polishing solution supply nozzle 32A to the polishing surface of the polishing pad 10, a wafer Wf, which is an object to be polished, is pressed against the polishing surface of the polishing pad 10 by the top ring 31A, thus being polished. The large-diameter polishing module 3 is controlled by a control device 900. Regarding the control device 900 for the large-diameter polishing module 3, the same hardware as that of the control device 900 for the partial polishing module 300 in FIG. 2 may be used, or different hardware may be also used. However, in the case of the different hardware used, two control devices have to be configured to communicate data therebetween.

As one embodiment, as shown in FIG. 1, the partial polishing module 300 and the large-diameter polishing module 3 can be integrated in a single polishing machine 1000. By combining polishing by the partial polishing module 300 (hereinafter, described as "partial polishing"), polishing by the large-diameter polishing module 3 (hereinafter, described as "whole surface polishing") and detection of the surface state of a wafer Wf by the detector, various kinds of polishing process can be performed. Note that in partial polishing by the partial polishing module 300, only a part of the surface of a wafer Wf, not the whole surface, can be polished, or while the whole surface of a wafer Wf is polished, a part of the surface of the wafer Wf can be polished with a changed polishing condition.

Figure 8:
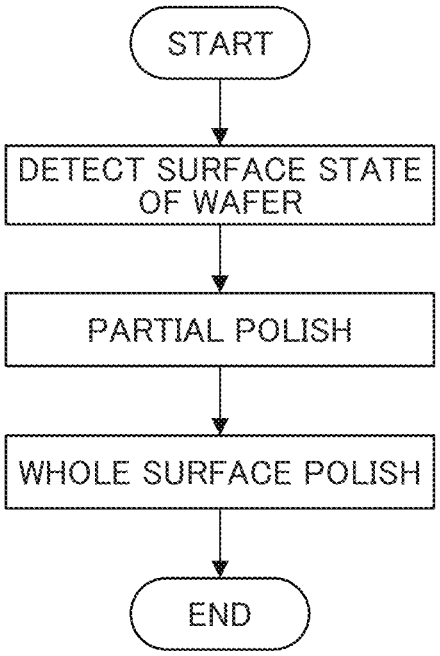
FIG. 8 is a flowchart showing one example of a flow of polishing process using a polishing machine according to one embodiment.

First, a polishing method by which partial polishing is performed before whole surface polishing will be described. FIG. 8 is a flowchart showing one example of a flow for polishing process using a polishing machine 1000. At the beginning, the state of the surface of a wafer Wf that is an object to be polished is detected. The surface state includes information about a film thickness of a film formed on a wafer Wf and concavity and convexity of the surface (position, size, height or the like), and is detected by the above detector and a detection part 510-2. Next, based on the detected surface state of a wafer Wf, a polishing recipe is created. In this example, a polishing recipe is created by which, initially, local protrusions on a wafer Wf are planarized by partial polishing, subsequently, the whole surface of the wafer Wf is polished by whole surface polishing, thereby the wafer Wf achieves a desired surface state. Then, the polishing recipe includes a plurality of processing steps, and a parameter in each step includes, for example, regarding the partial polishing module, a process time, a contact pressure or a load applied by the polishing pad 502 to a wafer Wf and the dresser disposed on a dress table, the number of rotation of the polishing pad 502 and a wafer Wf, a moving pattern and a moving speed of the head 500, selection of a polishing pad treatment liquid and a flow rate, the number of rotation of the dress table 810, and a detection condition for a polishing endpoint. Also, in partial polishing, based on information about a film thickness, and concavity and convexity on the surface of a wafer Wf acquired by the detector and the detection part 510-2 described above, a motion of the polishing head on the surface of the wafer Wf has to be determined. For example, a parameter for determining a stay time of the head 500 in each area to be polished on the surface of a wafer Wf includes, for example, a desired film thickness, a target value corresponding to the state of concavity and convexity, and a polishing rate in the above polishing condition. Then, because a polishing rate varies depending on a polishing condition, the polishing rate may be stored in the control part as a database, and when a polishing condition is set, the polishing rate may be automatically calculated. From these parameters and the acquired information about a film thickness, and concavity and convexity on the surface of a wafer Wf, the stay time of the head 500 on the surface of a wafer Wf can be calculated. Also, as described below, because a route of the above measurement, partial polishing, whole surface polishing and cleaning varies depending on the state of a wafer Wf and a treatment liquid used, a transport route of these components may be set. Additionally, a condition for acquiring data about a film thickness of the surface of a wafer Wf, and concavity and convexity may be also set. Further, as described below, if the state of a wafer Wf after processing does not reach an acceptable level, re-polishing has to be performed, and a processing condition (repeat count of re-polishing or the like) in this case may be set. Subsequently, according to the created polishing recipe, partial polishing and whole surface polishing are performed. Note that in this example and other examples described below, a wafer Wf can be cleaned at an arbitrary timing. For example, if a treatment liquid used in partial polishing is different from that in whole surface polishing, and if it is not negligible that the treatment liquid in partial polishing contaminates whole surface polishing, then to prevent this, after each process of partial polishing and whole surface polishing is performed, the wafer Wf may be cleaned. Also, in contrast, if a treatment liquid is the same, or if contamination of a treatment liquid is negligible, then after both partial polishing and whole surface polishing are performed, the wafer Wf may be cleaned.

Figure 9:
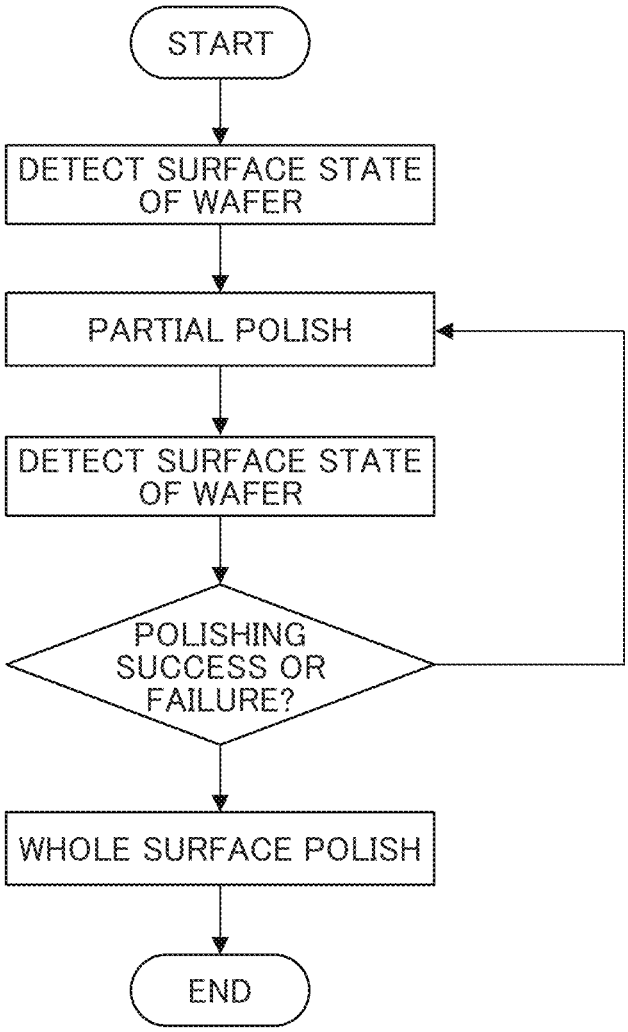
FIG. 9 is a flowchart showing one example of a flow of polishing process using a polishing machine according to one embodiment.

FIG. 9 is a flowchart showing one example of a flow of polishing process using the polishing machine 1000. Similarly to the example of FIG. 8, initially, the state of the surface of a wafer Wf that is an object to be polished is detected, and based on the surface state of the wafer Wf, a polishing recipe is created. In this example, after partial polishing, the surface state of the wafer Wf is detected again. Subsequently, the control device 900 determines whether the surface state of the wafer reaches an acceptable level or not. For example, based on the number of local protrusions on the surface of a wafer Wf and their sizes, the determination can be carried out. If the acceptable level is not reached, then based on the detected surface state, a polishing recipe is created again and partial polishing is performed. If the surface state of the wafer Wf reaches the acceptable level, next, whole surface polishing is performed.

Figure 10:
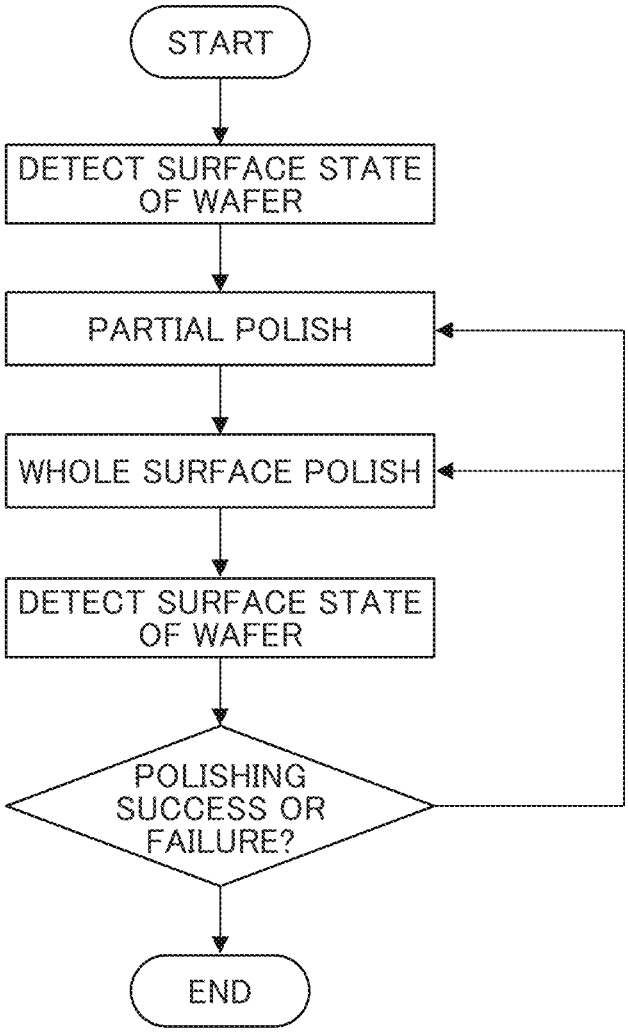
FIG. 10 is a flowchart showing one example of a flow of polishing process using a polishing machine according to one embodiment.

FIG. 10 is a flowchart showing one example of a flow of polishing process using the polishing machine 1000. Similarly to the examples of FIG. 8 and FIG. 9, initially, the state of the surface of a wafer Wf that is an object to be polished is detected, and based on the surface state of the wafer Wf, a polishing recipe is created. In this example, after partial polishing and whole surface polishing are performed according to the polishing recipe, the surface state of the wafer Wf is detected. Subsequently, the control device 900 determines whether the surface state of the wafer reaches an acceptable level or not. If the surface state of the wafer does not reach the acceptable level, both partial polishing and whole surface polishing, or whole surface polishing is further performed. Determination which of both partial polishing and whole surface polishing, or whole surface polishing is performed can be carried out based on the detected surface state. For example, if there is a local protrusion out of the acceptable level on the wafer Wf, then both partial polishing and whole surface polishing, or only partial polishing is performed, and if there is not a local protrusion on the wafer Wf, but an overall film thickness on the wafer is larger than a target film thickness, then only whole surface polishing is performed.

Figure 11:
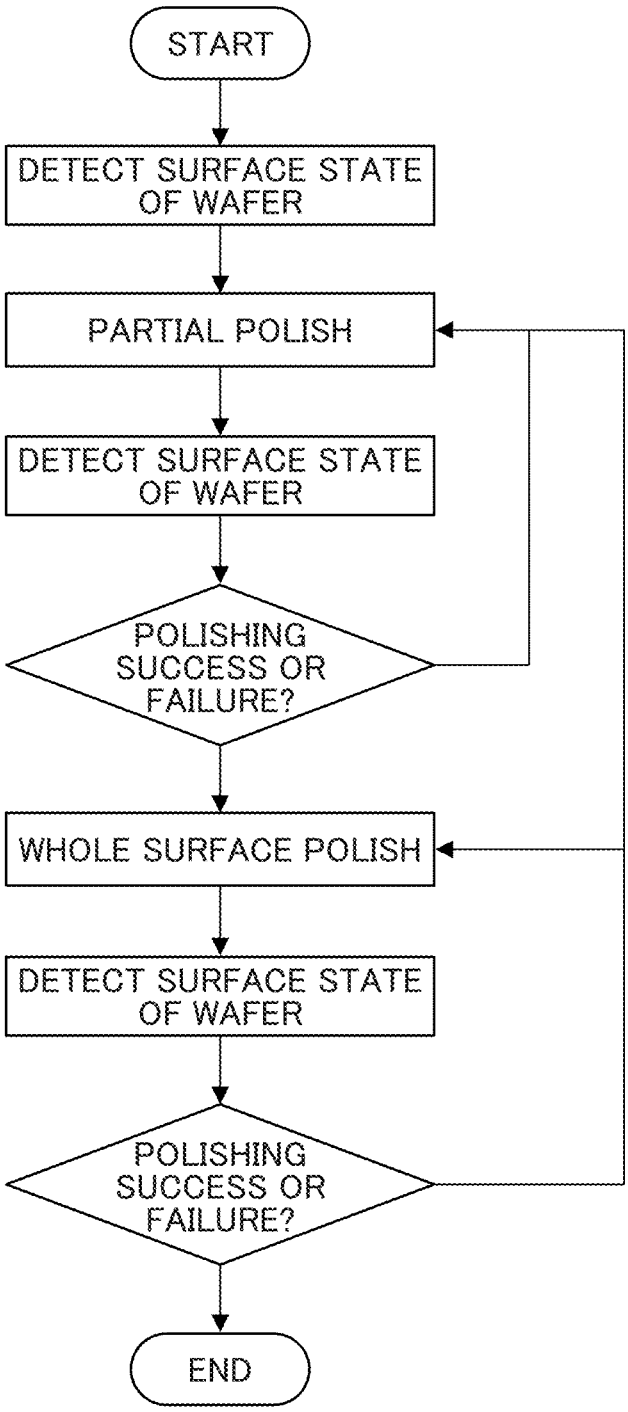
FIG. 11 is a flowchart showing one example of a flow of polishing process using a polishing machine according to one embodiment.

FIG. 11 is a flowchart showing one example of a flow of polishing process using the polishing machine 1000. Similarly to the examples of FIG. 8 to FIG. 10, initially, the state of the surface of a wafer Wf that is an polished is detected, and based on the surface state of the wafer Wf, a polishing recipe is created. In this example, partial polishing is performed, subsequently, the surface state of the wafer Wf is detected. Based on the detected surface state, it is determined whether the surface state reaches an acceptable level or not. If the surface state of the wafer Wf does not reach the acceptable level, partial polishing is performed again according to a polishing recipe based on the detected surface state, and if the acceptable level is reached, proceed to whole surface polishing. When whole surface polishing ends, the state of the surface of the water Wf is detected again. If the surface state of the wafer Wf does not reach the acceptable level, return to partial polishing or whole surface polishing, and polishing is performed again according to a polishing recipe based on the detected surface state.

In any of the above examples, partial polishing is executed before whole surface polishing. Execution of partial polishing before whole surface polishing has advantages as follows. Partial polishing process provides a polishing effect to only an area having local variations in film thickness on a substrate, and if there is a plurality of areas having variations in film thickness, it is necessary to shorten a process time for respective areas having variations in film thickness. One countermeasure is to use a polishing slurry in polishing process (for example, a polishing slurry capable of providing high polishing rate) different from that used in a process of subsequent whole surface polishing. However, if partial, polishing is performed after whole surface polishing, and slurry used in whole surface polishing is different from slurry used in partial polishing, then different kinds of slurry simultaneously stay behind on the wafer surface after partial polishing, which may lead to lowered cleaning performance in a process of subsequent cleaning. By contrast, if partial polishing is performed before whole surface polishing, slurry that stays behind on the wafer surface after partial polishing process is removed by polishing in a process of subsequent whole surface polishing, so that an impact on cleaning performance in a process of subsequent cleaning can be more lowered than in the case where partial polishing is performed after whole surface polishing.

On the one hand, a polishing machine 1000 including the partial polishing module 300 with a polishing pad for partial polishing and the large-diameter polishing module 3 with a large-diameter polishing pad for whole surface polishing can also control so that partial polishing is performed after whole surface polishing.

Figure 12:
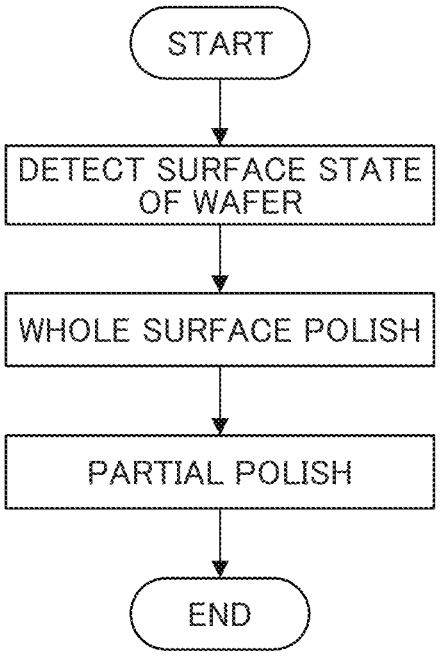
FIG. 12 is a flowchart showing one example of a flow of polishing process using a polishing machine according to one embodiment.

FIG. 12 is a flowchart showing one example of a flow of polishing process using the polishing machine 1000. First, the state of the surface of a wafer Wf, which is an object to be polished, is detected. The surface state includes information about a film thickness of a film formed on a wafer Wf, and concavity and convexity on the surface (position, size, height or the like), and is detected by the above detector. Next, based on the detected surface state of the wafer Wf, a polishing recipe is created. In this example, a polishing recipe is created by which, first, whole surface polishing is performed, and subsequently partial polishing is performed to planarize local protrusions, thus providing the wafer Wf with a desired surface state. Subsequently, according to the created polishing recipe, whole surface polishing and partial polishing are performed.

Figure 13:
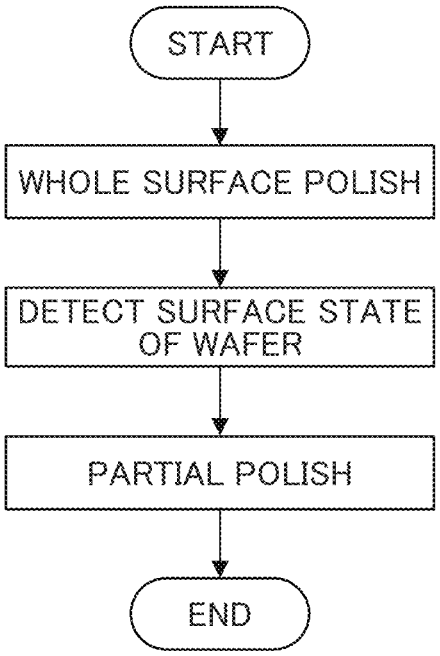
FIG. 13 is a flowchart showing one example of a flow of polishing process using a polishing machine according to one embodiment.

FIG. 13 is a flowchart showing one example of a flow of polishing process using the polishing machine 1000. Differently from the example of FIG. 12, first, whole surface polishing is performed according to a predetermined recipe. The predetermined recipe may be a recipe set for removing a film thickness that is expected in advance from a manufacturing process for semiconductor devices, regardless of the surface state of respective wafers Wf. Subsequently, the state of the surface of a wafer Wf is detected. Based on the detected surface state of the wafer Wf, a recipe for partial polishing is created, and partial polishing is performed.

Figure 14:
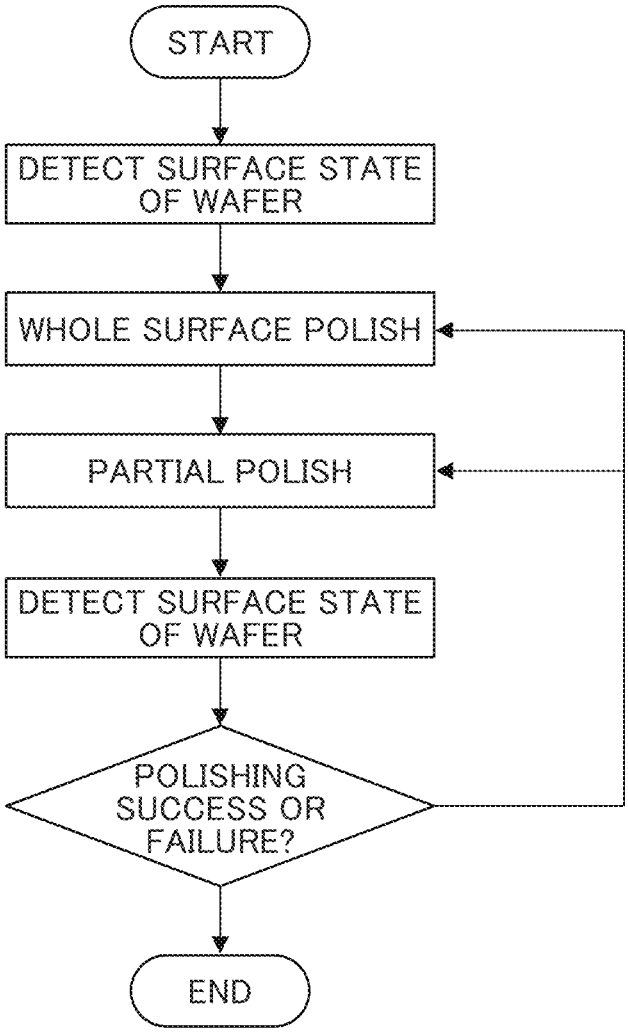
FIG. 14 is a flowchart showing one example of a flow of polishing process using a polishing machine according to one embodiment.

FIG. 14 is a flowchart showing one example of a flow of polishing process using the polishing machine 1000. In this example, similarly to the example in FIG. 12, first, the state of the surface of a wafer Wf is detected. Subsequently, based on the detected surface state of the wafer Wf, a polishing recipe is created, and whole surface polishing and partial polishing are performed sequentially. Subsequently, the surface state is detected again, and it is determined whether the surface state reaches an acceptable level. If the surface state of the wafer Wf does net reach the acceptable level, return to a process for whole surface polishing or partial polishing, and based on the detected surface state, a polishing recipe is created and polishing process is performed again.

Figure 15:
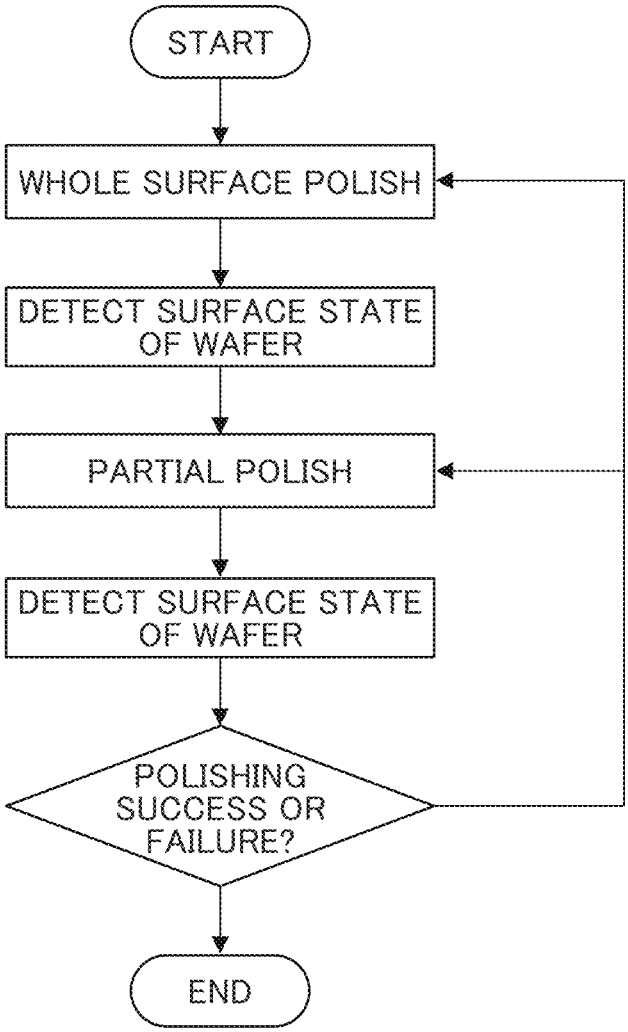
FIG. 15 is a flowchart showing one example of a flow of polishing process using a polishing machine according to one embodiment.
Figure 16A:
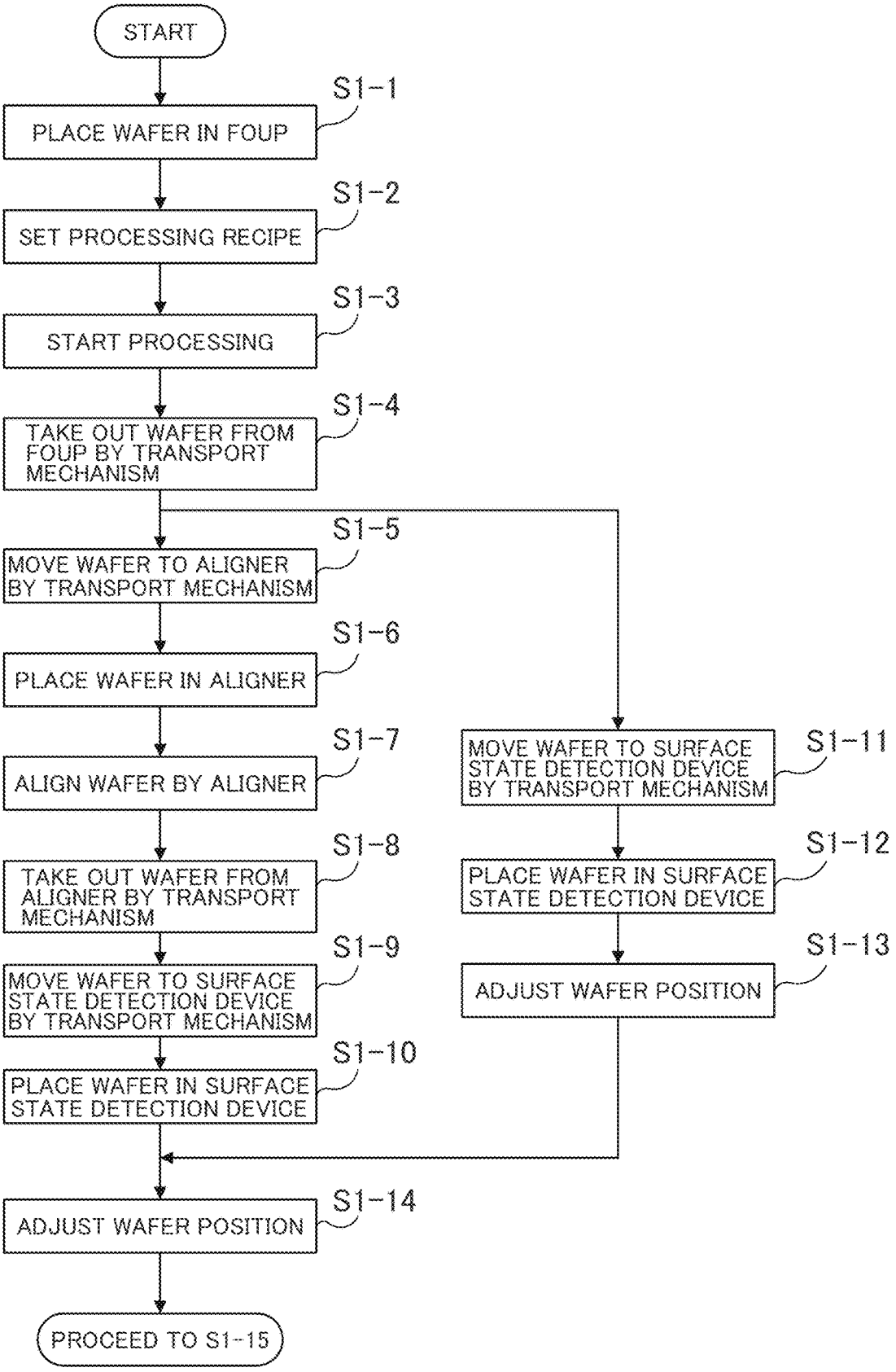
FIG. 16A is a flowchart showing a flow of polishing process according to an example 1, using a polishing machine according to one embodiment.
Figure 16B:
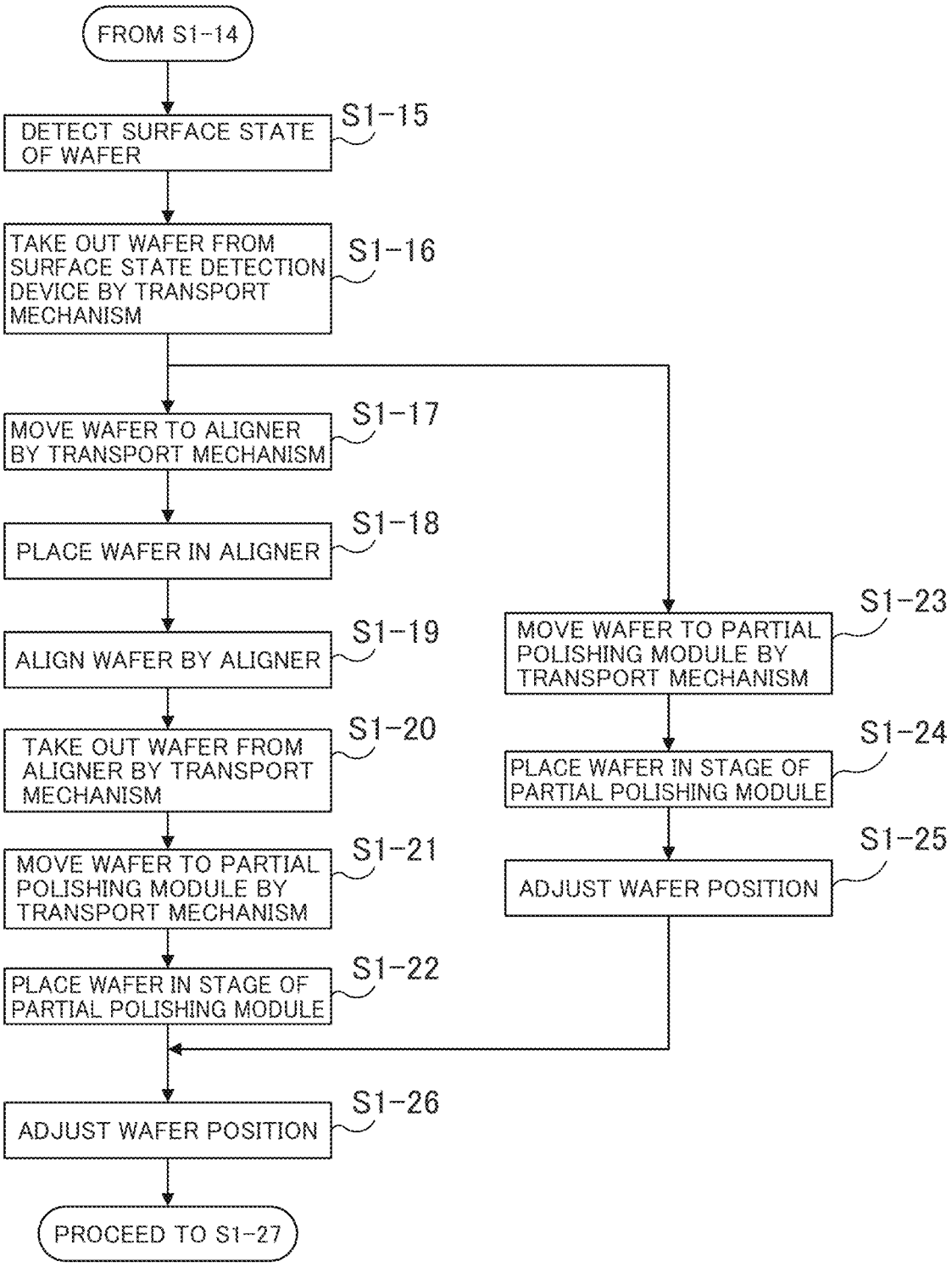
FIG. 16B is a flowchart showing the flow of polishing process according to the example 1, using the polishing machine according to one embodiment.
Figure 16C:
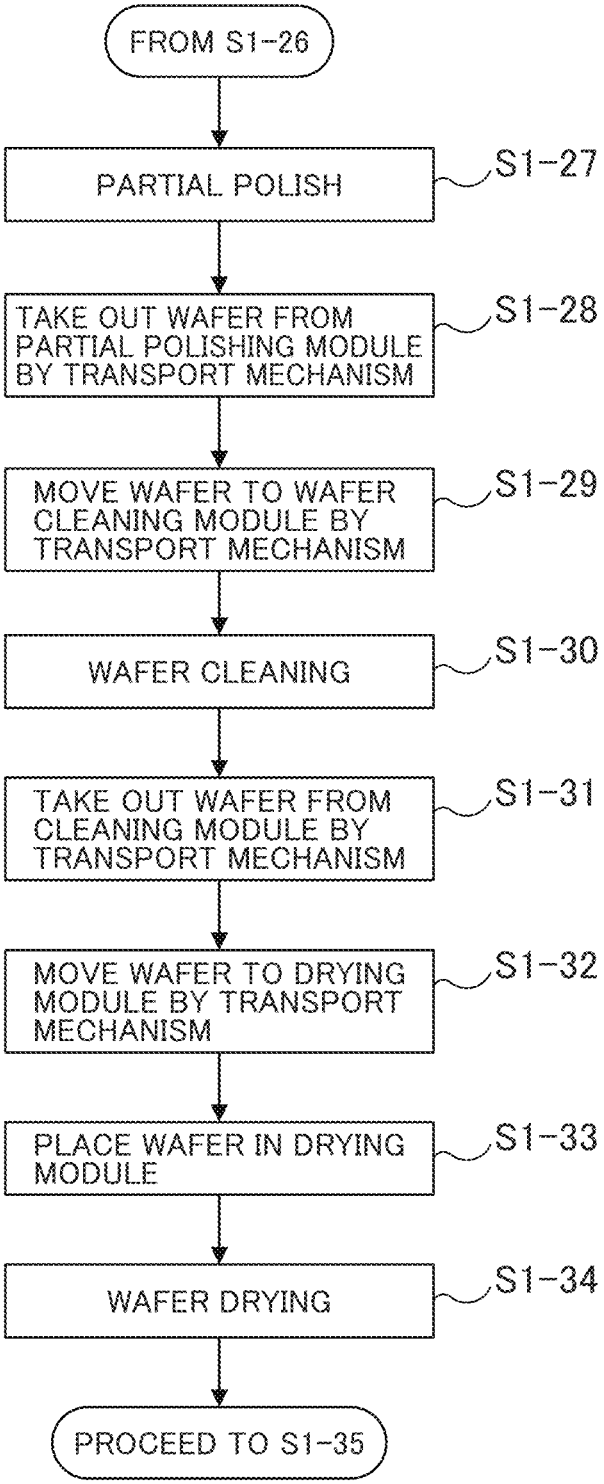
FIG. 16C is a flowchart showing the flow of polishing process according to the example 1, using the polishing machine according to one embodiment.
Figure 16D:
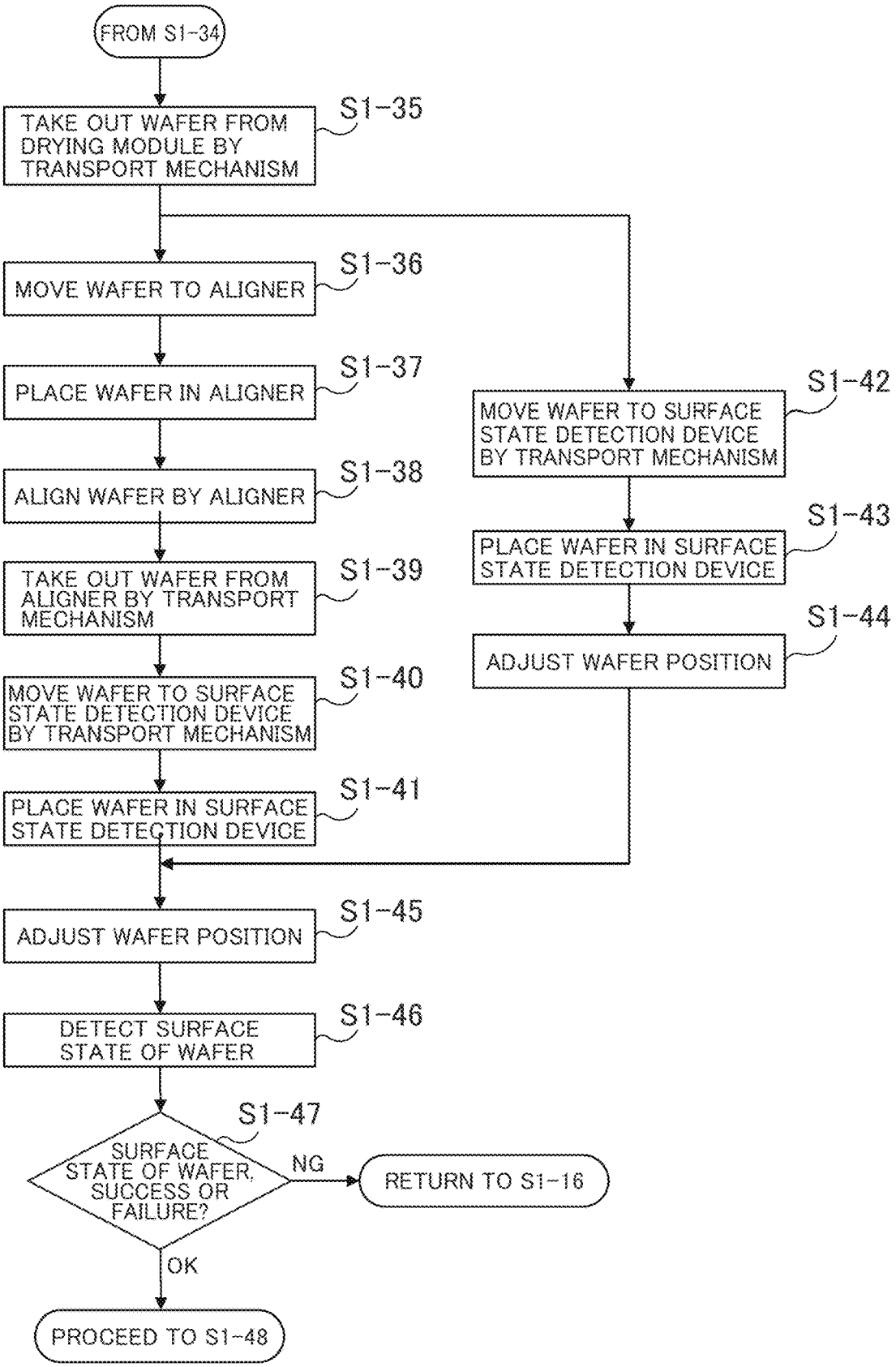
FIG. 16D is a flowchart showing the flow of polishing process according to the example 1, using the polishing machine according to one embodiment.
Figure 16E:
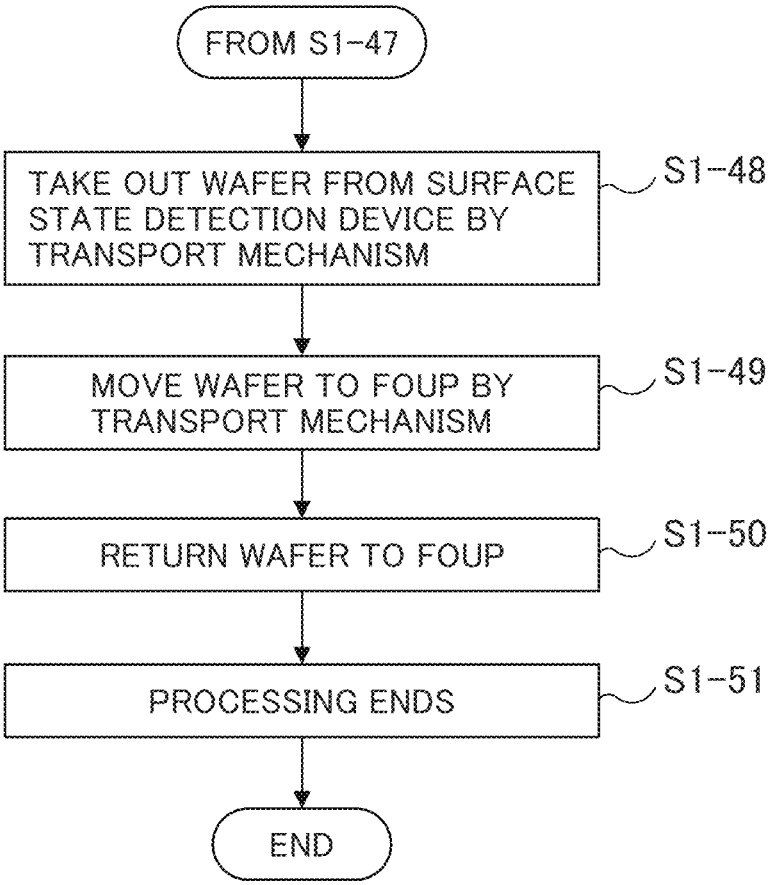
FIG. 16E is a flowchart showing the flow of polishing process according to the example 1, using the polishing machine according to one embodiment.
Figure 17A:
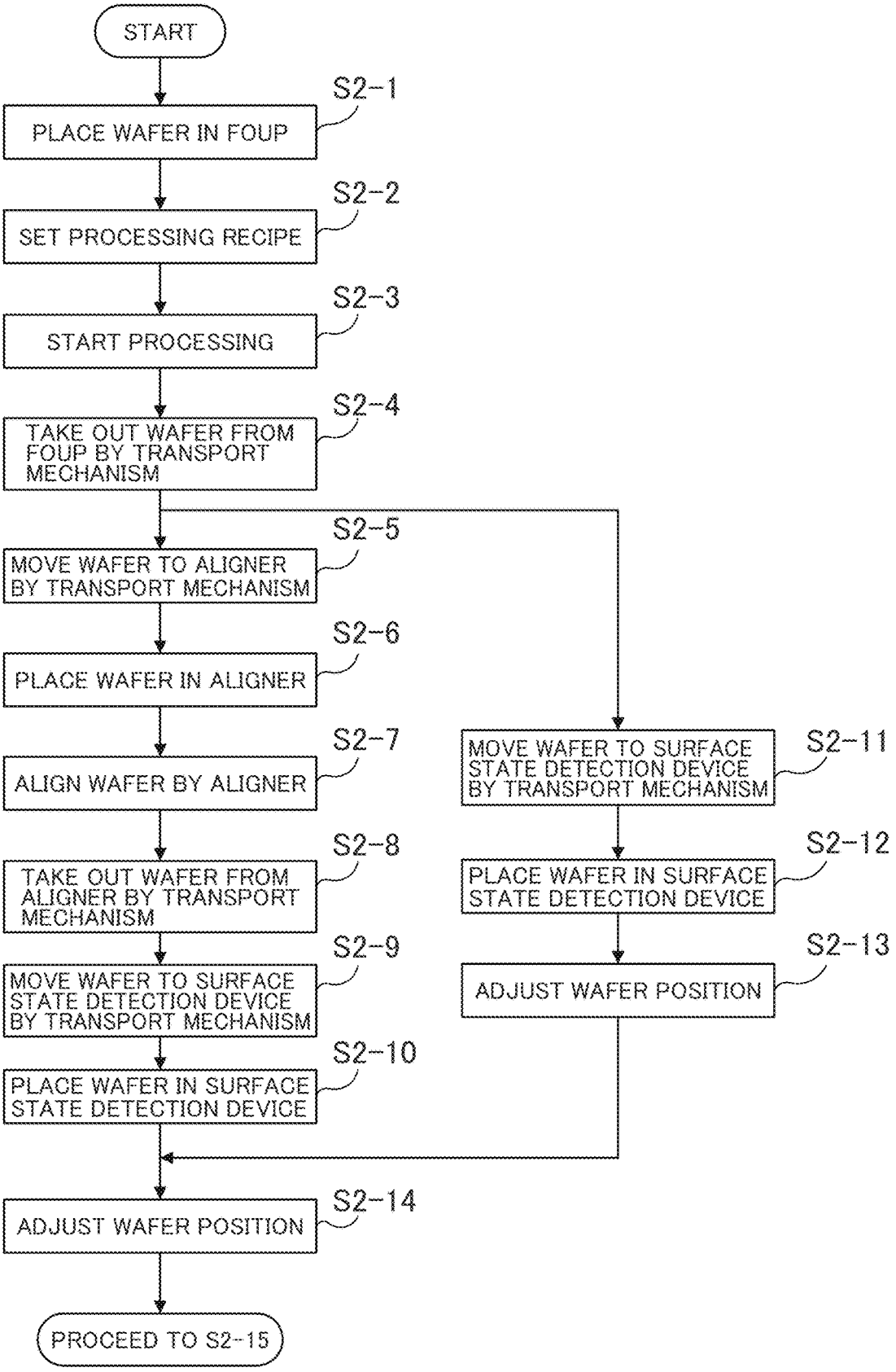
FIG. 17A is a flowchart showing a flow of polishing process according to an example 2, using a polishing machine according to one embodiment.
Figure 17B:
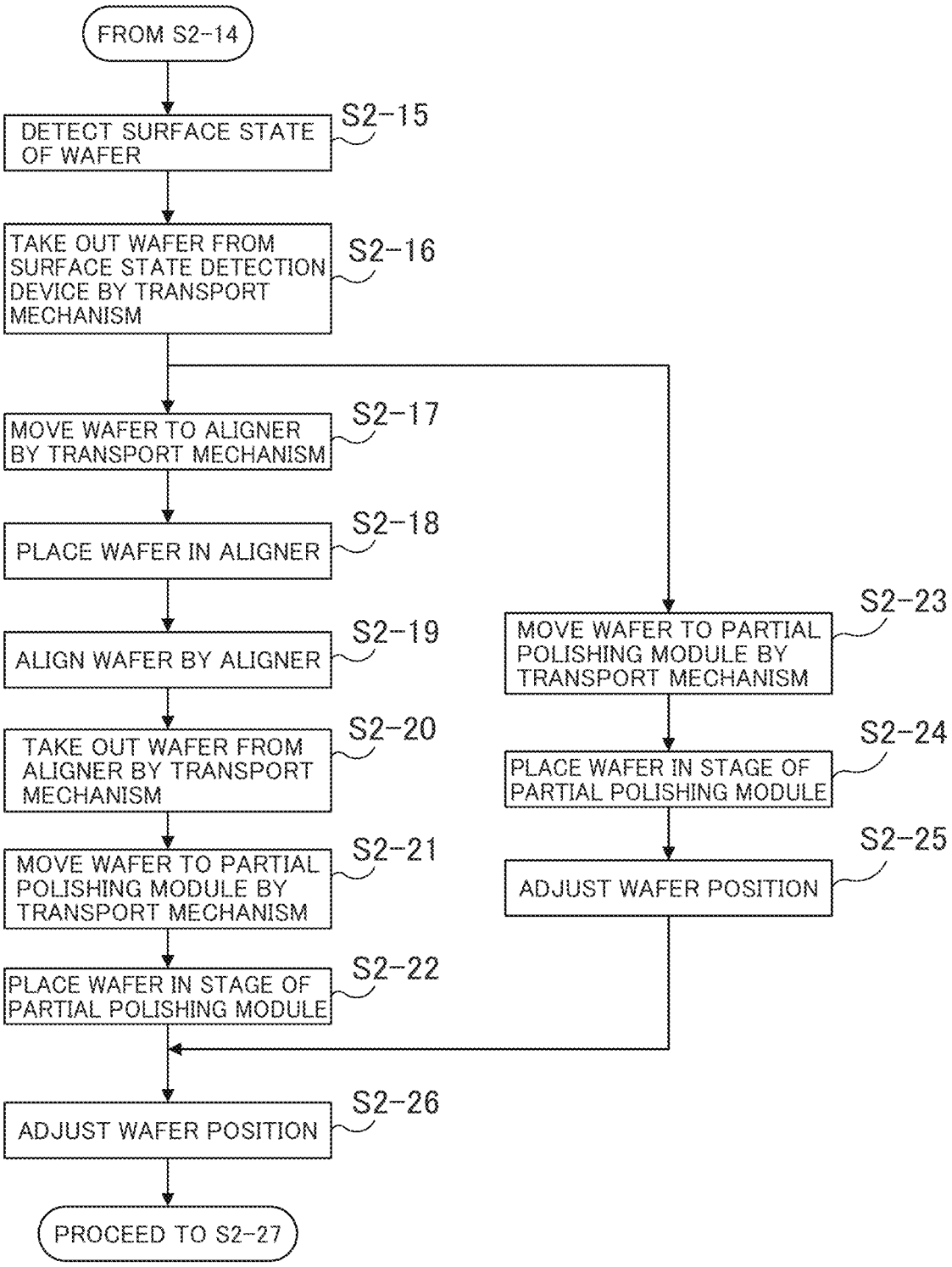
FIG. 17B is a flowchart showing the flow of polishing process according to the example 2, using the polishing machine according to one embodiment.
Figure 17C:
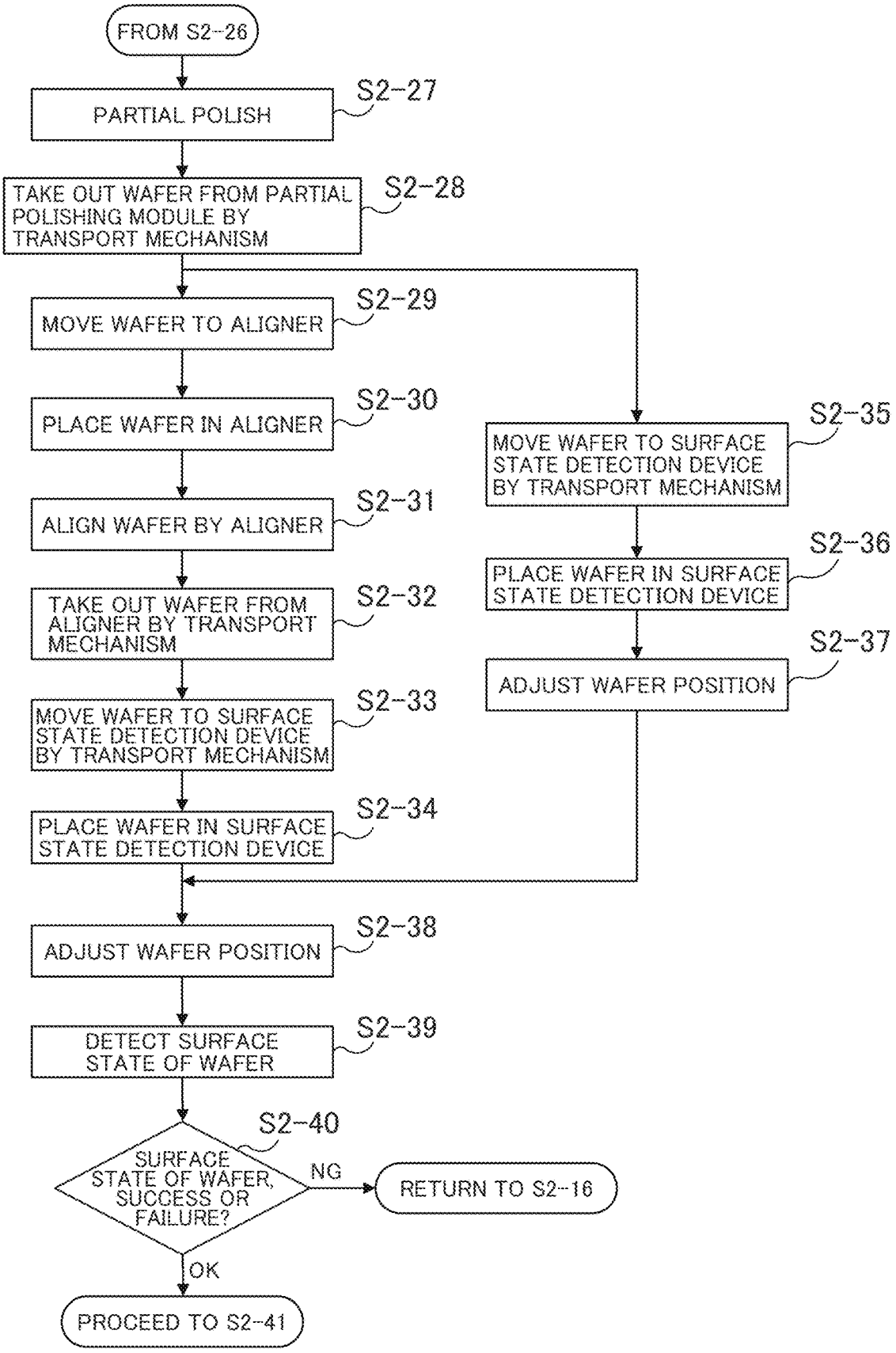
FIG. 17C is a flowchart showing the flow of polishing process according to the example 2, using the polishing machine according to one embodiment.
Figure 17D:
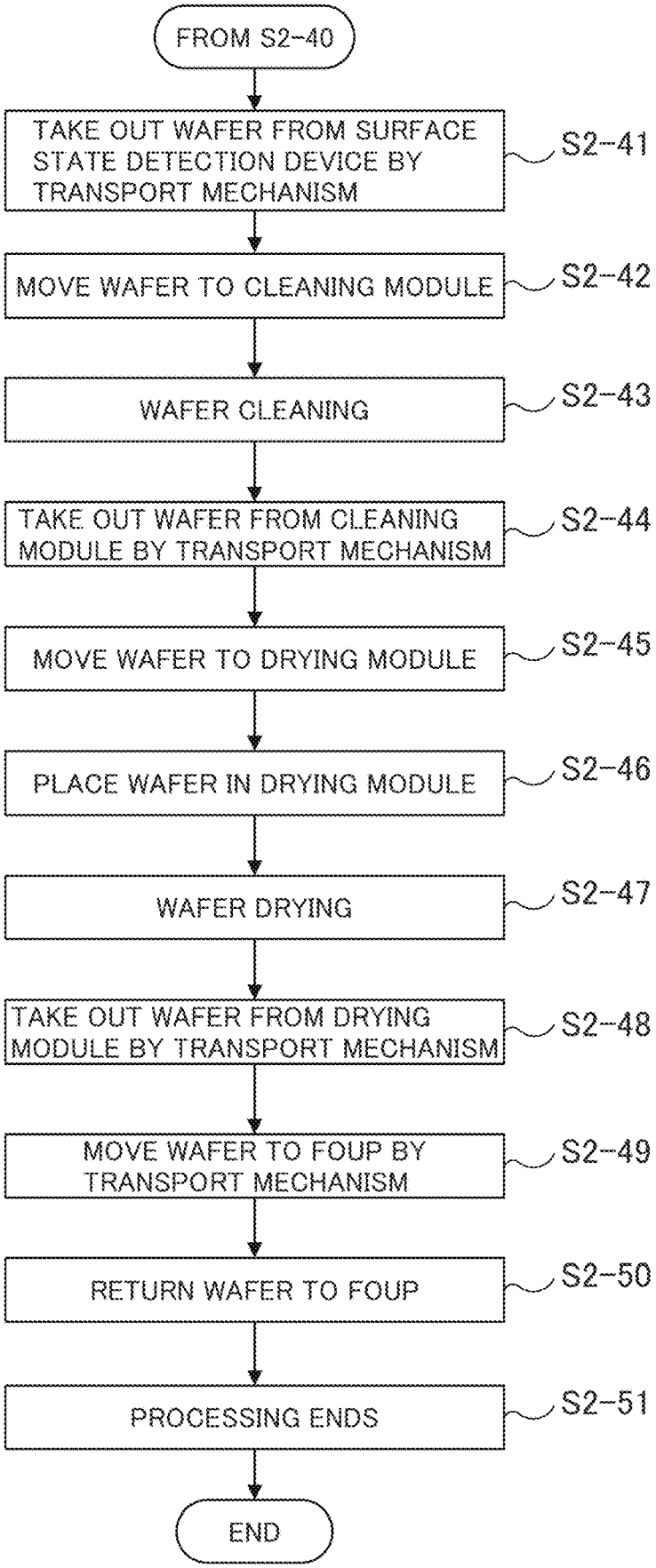
FIG. 17D is a flowchart showing the flow of polishing process according to the example 2, using the polishing machine according to one embodiment.

FIG. 15 is a flowchart showing one example of a flow of polishing process using the polishing machine 1000. In this example, similarly to the example in FIG. 13, first, according to a predetermined recipe, whole surface polishing is performed. After the whole surface polishing is performed, the surface state of the wafer Wf is detected. Subsequently, based on the detected surface state of the wafer Wf, a partial polishing recipe is created and partial polishing is performed. After the partial polishing, the surface state of the wafer Wf is detected again, and it is determined whether the surface state reaches an acceptable level. If the surface state of the wafer Wf does not reach the acceptable level, then based on the detected surface state, a polishing recipe is created, and return to a process for whole surface polishing or partial polishing.

Polishing process other than the polishing process described above may be performed by changing a timing of partial polishing, whole surface polishing, detection of the surface state of a wafer Wf and a cleaning process.

As mentioned above, because the polishing machine 1000 includes the partial polishing module 300 and the large-diameter polishing module 3, it can polish the whole substrate and also only the particular portion of the substrate. Accordingly, local variations in film thickness and shape can be reduced or eliminated, and an ideal distribution of polishing amounts can be realized. Note that an example where both the partial polishing module and the large-diameter polishing module are integrated in a simple polishing machine has been described here, but the partial polishing module and the large-diameter polishing module are configured as a separate polishing machine, respectively, and a wafer Wf can be delivered to and taken out of between two polishing machines to implement the polishing process described here.

A polishing machine using the partial polishing module and a processing example of the polishing machine will be described below.

Example 1

FIGS. 16A to 16E are a flowchart showing process of a polishing machine according to one example. The polishing machine according to Example 1 is a polishing machine including: a load/unload unit having FOUP (Front Opening Unified Pod) that is a closed container containing a wafer Wf and capable of keeping an environment independently, a transport mechanism for transporting a wafer Wf in the polishing machine, an aligner for aligning a wafer Wf, a detector for detecting the surface state of a water Wf, a partial polishing module, a wafer cleaning module, a wafer drying module, and a control device. These modules of the polishing machine according to this example may be the mentioned above. Note that the polishing machine according to this example does not include the large-diameter polishing module.

A behavior of the polishing machine of this example will be described with reference to FIGS. 16A to 16E.

First, a water Wf to be processed is placed in FOUP of the polishing machine (S1-1). The wafer Wf is placed in FOUP in advance by a transport mechanism or the like outside the polishing machine. Next, a processing recipe applied to a wafer Wf is set (S1-2). The processing recipe may include, for example, a process time, a referenced polishing rate, a pressing force or a polishing pressure at polishing, a rotating speed of a wafer (in the case of rotating a wafer), a moving speed of a wafer (in the case of moving a wafer in XY directions), a rotating speed of a polishing head, setting of a liquid used (slurry, a chemical solution, pure water or the like), a swinging speed of a polishing head, a rotating speed of a dresser, the number of feedback times (the number of times limited in the case of re-polishing), an end condition for polishing, a transport route of a wafer or the like.

From now on, process starts according the processing recipe (S1-3). A wafer Wf is taken out of FOUP by the transport mechanism (S1-4). Subsequently, the wafer Wf is moved to the aligner by the transport mechanism (S1-5). Subsequently, the wafer Wf is placed in the aligner (S1-6). The wafer Wf is aligned by the aligner (S1-7). In the aligner the wafer Wf is aligned, for example, by using at least one of a notch, an orientation flat and a laser marker of the wafer Wf as a reference position. Subsequently, the wafer Wf is taken out of the aligner by the transport mechanism (S1-8). Subsequently, the wafer Wf is moved to the surface state detection device (S1-9). Subsequently, the wafer Wf is placed in the surface state detection device (S1-10). Note that if the surface state detection device includes the alignment function for a wafer Wf, then alignment in the aligner may be omitted and the wafer Wf may be moved from FOUP to the surface state detection device (from S1-11 to S1-13).

Subsequently, on the surface state detection device, the wafer Wf is finely aligned (S1-14). Note that this process may be omitted if not required. Subsequently, the surface state of the wafer Wf is detected (S1-15). Subsequently, the wafer Wf is taken out of the surface state detection device by the transport mechanism (S1-16). Subsequently, the wafer Wf is moved to the aligner (S1-17). Subsequently, the wafer Wf is placed in the aligner (S1-18). Subsequently, the wafer Wf is aligned by the aligner (S1-19). Subsequently, the wafer Wf is taken out of the aligner by the transport mechanism (S1-20). Subsequently, the wafer Wf is moved to the partial polishing module (S1-21). Subsequently, the wafer Wf is placed in the stage of the partial polishing module (S1-22). Note that if the partial polishing module includes the alignment mechanism for a wafer Wf, then alignment in the aligner may be omitted and the wafer Wf may be moved from the surface state detection device to the partial polishing module (from S1-23 to S1-25).

Subsequently, on the partial polishing module, the wafer Wf is finely aligned (S1-26). Not that this process may be omitted if not required. Subsequently, the wafer Wf is partially polished (S1-27). At this time, from the processing recipe set at step S1-2 and the surface state of the wafer Wf detected at step S1-15, a target distribution of polishing amounts is calculated, and based on that, a partial polishing condition is determined, and according to the determined condition, partial polishing is performed. Subsequently, the wafer Wf is taken out of the partial polishing module by the transport mechanism (S1-28). Subsequently, the wafer Wf is moved to the cleaning module (S1-29). Subsequently, the wafer Wf is cleaned (S1-30). Subsequently, the wafer Wf is taken out of the cleaning module by the transport mechanism (S1-31). Subsequently, the wafer Wf is moved to drying module (S1-32). Subsequently, the wafer Wf is placed in the drying module (S1-33). Subsequently, the wafer Wf is dried (S1-34). Subsequently, the wafer Wf is taken out of the drying module by the transport mechanism (S1-35). Subsequently, the wafer Wf is moved to the aligner (S1-36). Subsequently, the wafer Wf is placed in the aligner (S1-37). Subsequently, the wafer Wf is aligned by the aligner (S1-38). Subsequently, the wafer Wf is taken out of the aligner by transport mechanism (S1-39). Subsequently, the wafer Wf is moved to the surface state detection device (S1-40). Subsequently, the wafer Wf is placed in the surface state detection device (S1-41). Note that if the surface state detection device includes the alignment function for a wafer, then alignment in the aligner may be omitted and the wafer Wf may be moved from the drying module to the surface state detection device (from S1-42 to S1-44). Subsequently, on the surface state detection device, the wafer Wf is finely aligned (S1-45). Note that this process may be omitted if not required. Subsequently, the surface state of the wafer Wf is detected (S1-46). Subsequently, it is determined whether the surface state of the wafer Wf passes or fails (S1-47). Indications of a criterion for judging whether the surface state passes or fails include, for example, a residual film of the surface to be polished, a surface shape and a distribution of signals corresponding to those on the surface of a wafer Wf or a distribution of polishing amounts on the surface of a wafer Wf, and at least one of those is the judgment criterion. For example, by comparing at least one of the residual film state, the shape state and the polishing amount measured at step S1-46 with a corresponding one of a residual film state, a shape state and a polishing amount that are set as a target, it is determined whether the surface state of the wafer passes or fails. If these indications neither reach a target value nor fall within a target range, return to step S1-16, and partial polishing is performed again. At this time, if partial polishing is performed again, then from the processing recipe set at step S1-2 and the surface state of the wafer Wf detected at step S1-46, a target distribution of polishing amounts is calculated again, and based on this, a partial polishing condition is determined, and according to the determined condition, partial polishing is performed. At step S1-47, if it is determined that the indication reaches the target value or falls within the target range, the wafer Wf is taken out of the surface state detection device by the transport mechanism (S1-48). Subsequently, the wafer Wf is moved to FOUP (S1-49). Subsequently, the wafer Wf is stored in FOUP (S1-50). Subsequently, process in the polishing machine is terminated (S1-51).

Example 2

FIGS. 17A to 17D are a flowchart showing process of a polishing machine according to one example. A hardware configuration of the polishing machine of Example 2 is similar to that of the polishing machine of Example 1. A behavior of the polishing machine of this example will be described with reference to FIGS. 17A to 17D.

Steps S2-1 to S2-28 are similar to steps S1-1 to S1-23 of Example 1, and description thereof will be omitted. At step S2-28, after the wafer Wf is taken out of the partial polishing module by the transport mechanism, the wafer Wf is moved to the aligner (S2-29). Subsequently, the wafer Wf is placed in the aligner (S2-30). Subsequently, the wafer Wf is aligned by the aligner (S2-3). Subsequently, the wafer Wf is taken out of the aligner by transport mechanism (S2-32). Subsequently, the wafer Wf is moved to the surface state detection device (S2-33). Subsequently, the wafer Wf is placed in the surface state detection device (S2-34). Note that if the surface state detection device includes the alignment function for a wafer Wf, then alignment in the aligner may be omitted and the wafer Wf may be moved from the partial polishing module to the surface state detection device (from S2-35 to S2-37). Subsequently, on the surface state detection device, the wafer Wf is finely aligned (S2-38). Note that this process may be omitted if not required. Subsequently, the surface state of the wafer Wf is detected (S2-39). Subsequently, it is determined whether the surface state of the wafer Wf passes or fails (S2-40). Indications of a criterion for judging whether the surface state passes or fails include, for example, a residual film of the surface to be polished, a surface shape and a distribution of signals corresponding to those on the surface of a wafer Wf or a distribution of polishing amounts on the surface of a wafer Wf, and at least one of those is the judgment criterion. For example, by comparing at least one of the residual film state, the shape state and the polishing amount measured at step S2-39 with a corresponding one of a residual film state, a shape state and a polishing amount that are set as a target, it is determined whether the surface state of the wafer passes or fails. If the indication neither reaches a target value nor falls within a target range, return to step S2-16, and partial polishing is performed again. At this time, if partial polishing is performed again, then from the processing recipe set at step S2-2 and the surface state of the wafer Wf detected at step S2-39, a target distribution of polishing amounts is calculated again, and based on this, a partial polishing condition is determined, and according to the determined condition, partial polishing is performed. At step S2-40, if it is determined that the indication reaches the target value or falls within the target range, the wafer Wf is taken out of the surface state detection device by the transport mechanism (S2-41).

Subsequently, the wafer Wf is moved to the cleaning module (S2-42). Subsequently, the wafer Wf is cleaned (S2-43). Subsequently, the wafer Wf is taken out of the cleaning module by the transport mechanism (S2-44). Subsequently, the wafer Wf is moved to the drying module (S2-45). Subsequently, the wafer Wf is placed in the drying module (S2-46). Subsequently, the wafer Wf is dried (S2-47). Subsequently, the wafer Wf is taken out of the drying module by the transport mechanism (S2-48). Subsequently, the wafer Wf is moved to FOUP (S2-49). Subsequently, the wafer Wf is stored in FOUP (S2-50). Subsequently, process in the polishing machine is terminated (S2-51).

Example 3

Figure 18A:
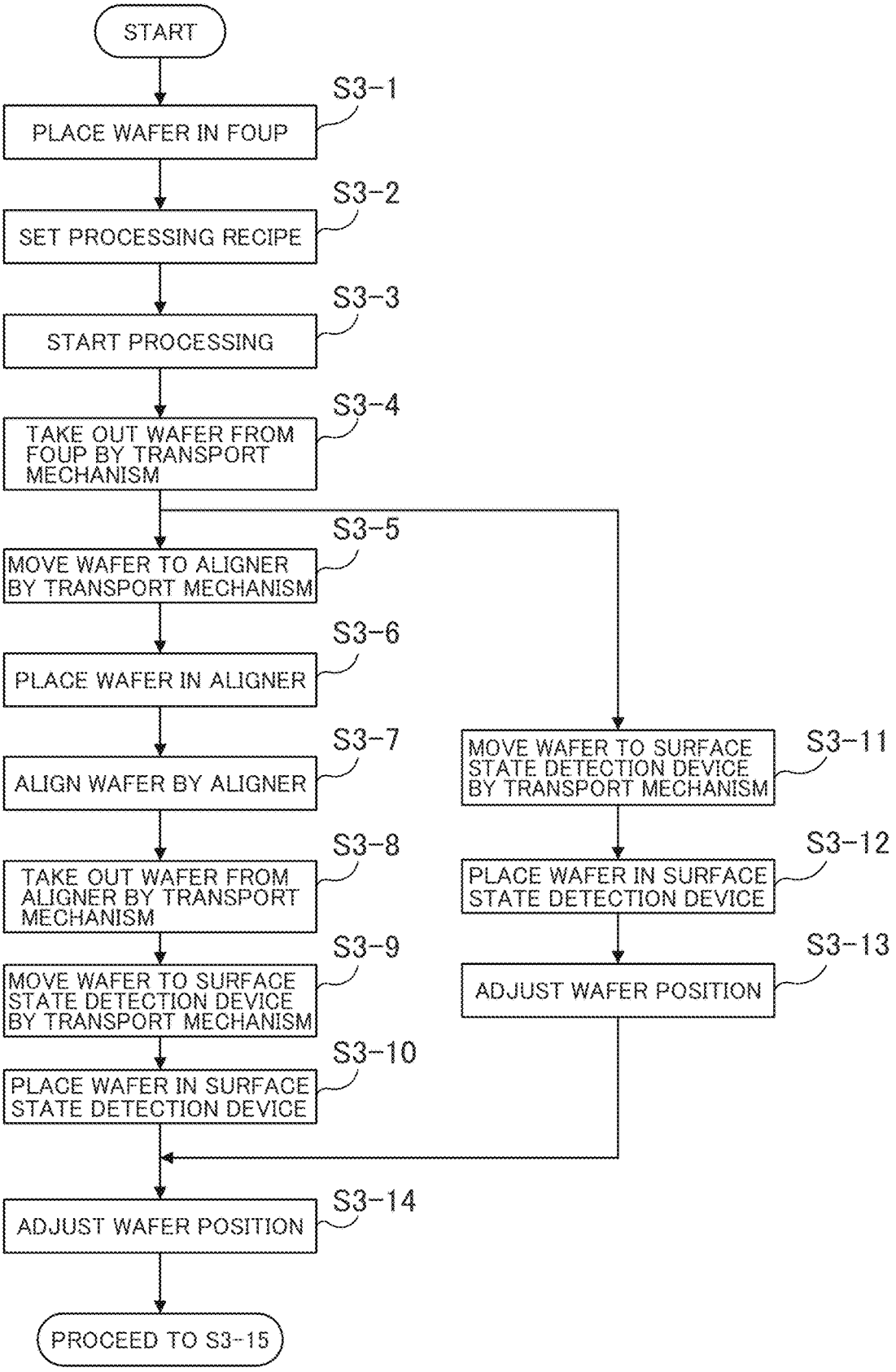
FIG. 18A is a flowchart showing a flow of polishing process according to an example 3, using a polishing machine according to one embodiment.
Figure 18B:
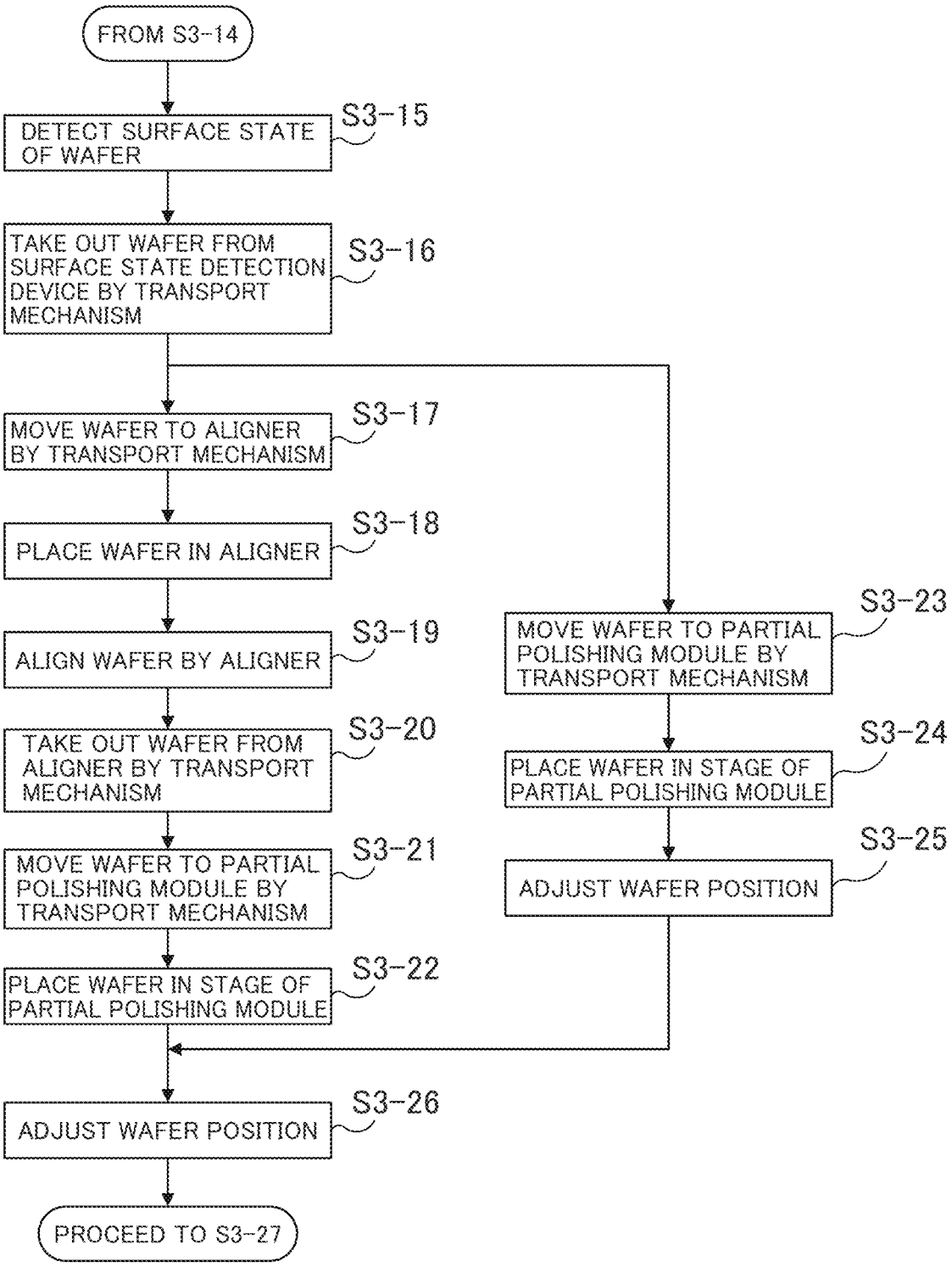
FIG. 18B is a flowchart showing the flow of polishing process according to the example 3, using the polishing machine according to one embodiment.
Figure 18C:
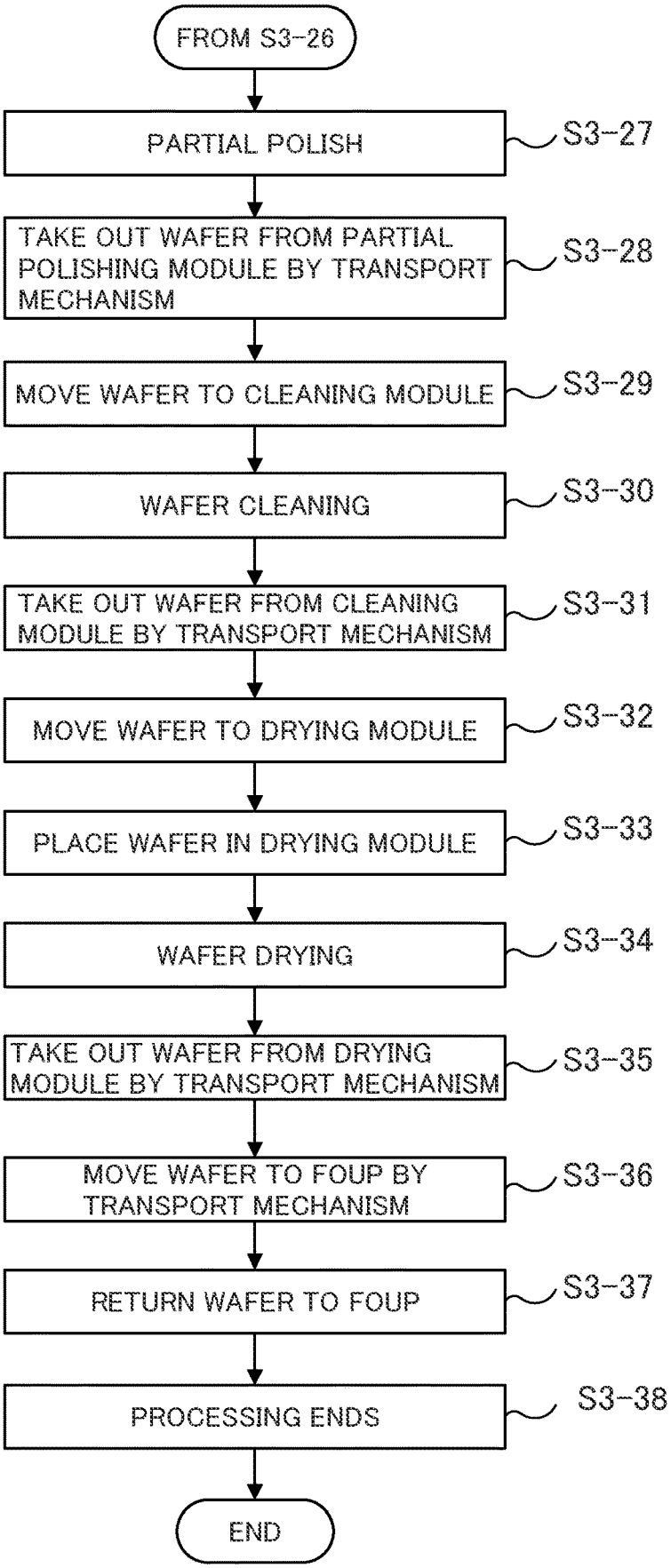
FIG. 18C is a flowchart showing the flow of polishing process according to the example 3, using the polishing machine according to one embodiment.
Figure 19A:
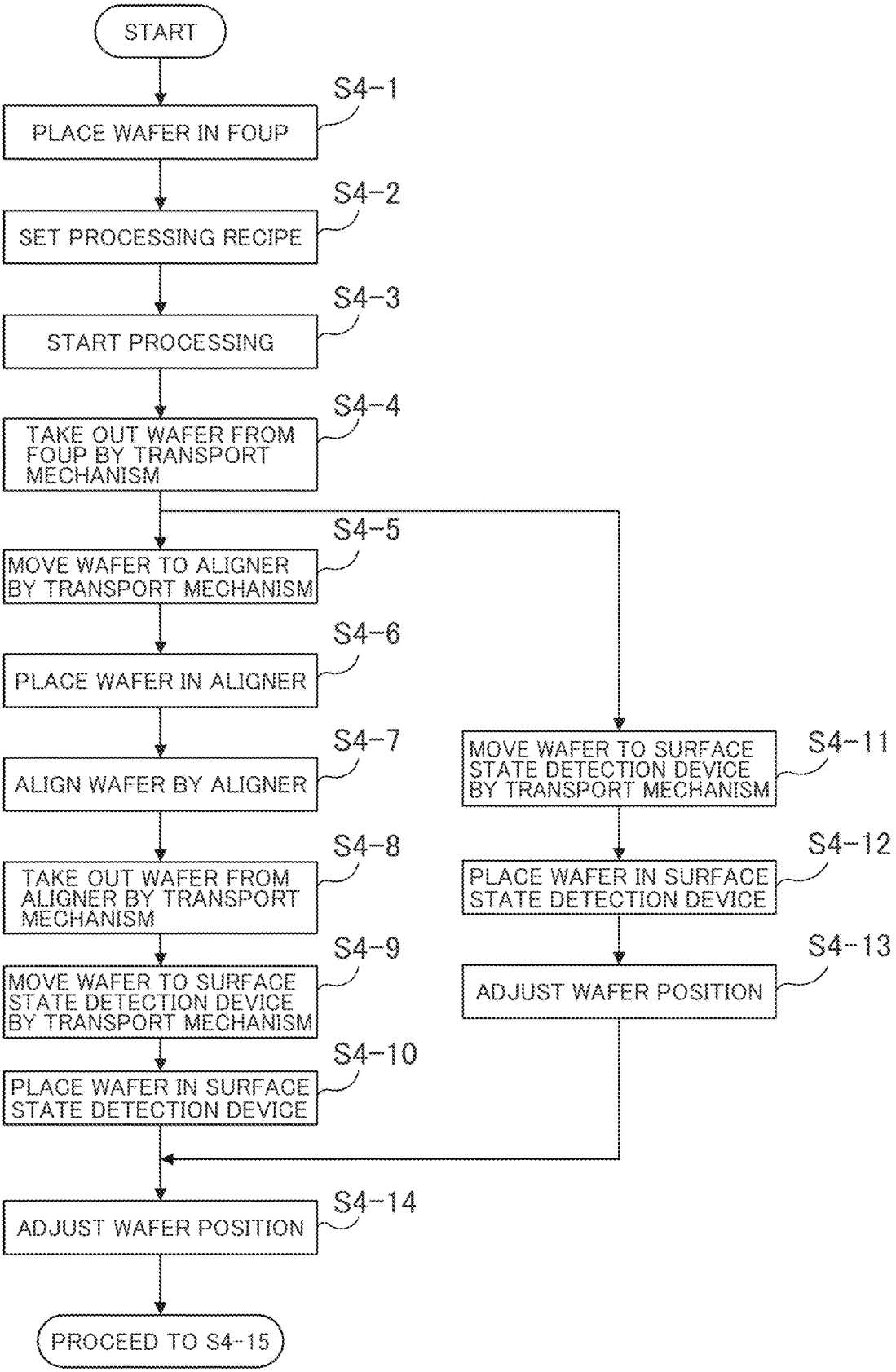
FIG. 19A is a flowchart showing a flow of polishing process according to an example 4, using a polishing machine according to one embodiment.
Figure 19B:
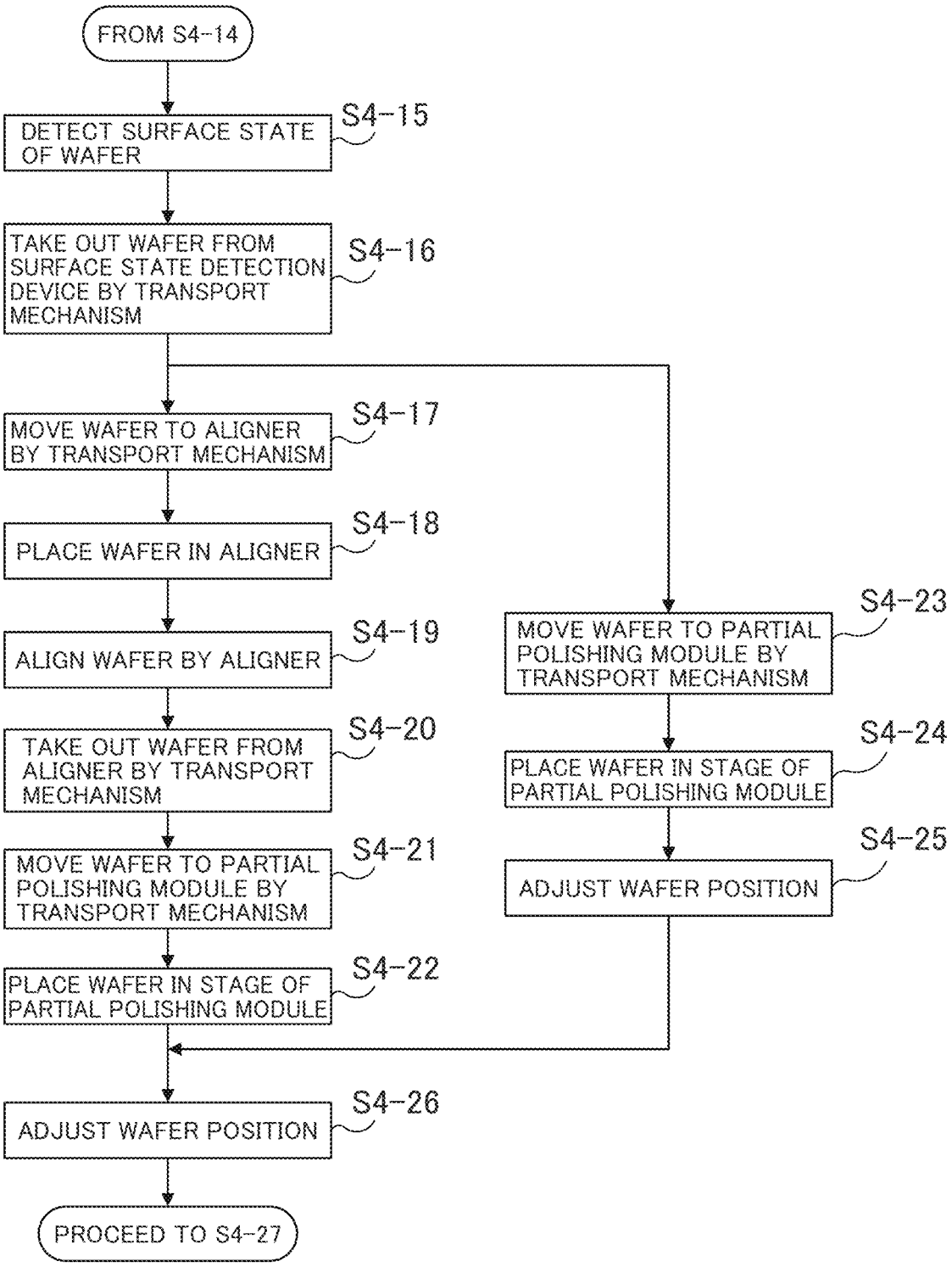
FIG. 19B is a flowchart showing the flow of polishing process according to the example 4, using the polishing machine according to one embodiment.
Figure 19C:
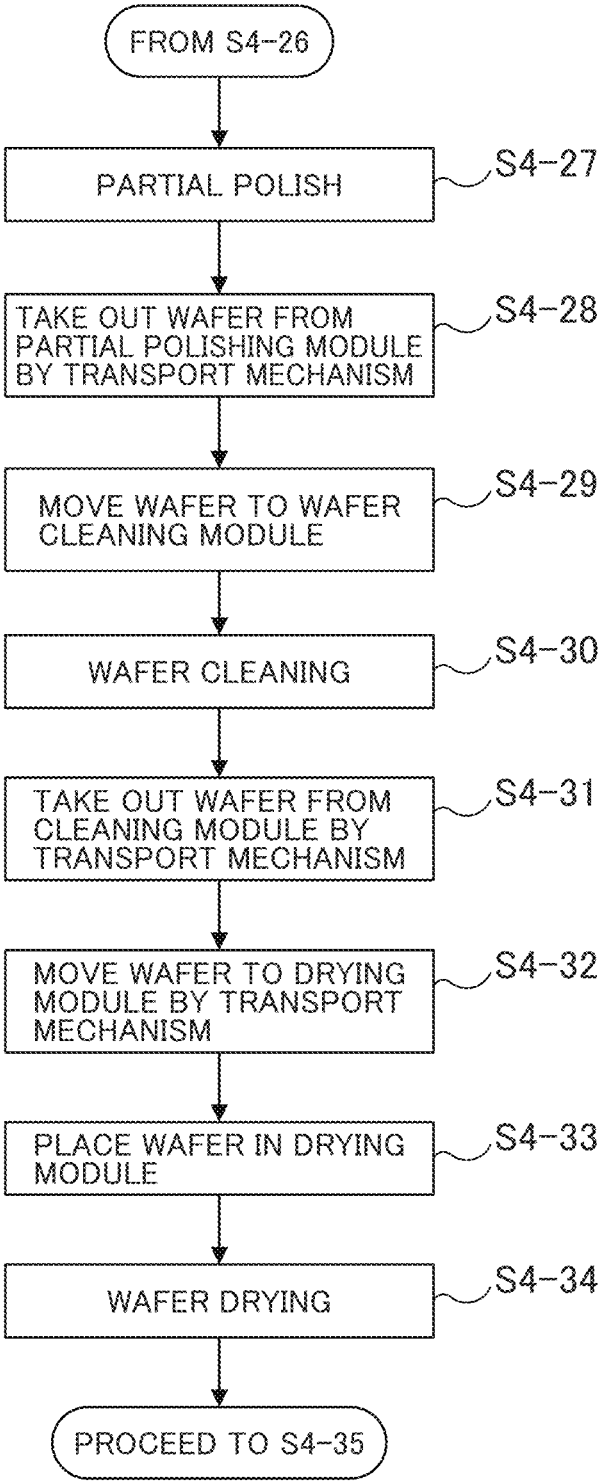
FIG. 19C is a flowchart showing the flow of polishing process according to the example 4, using the polishing machine according to one embodiment.
Figure 19D:
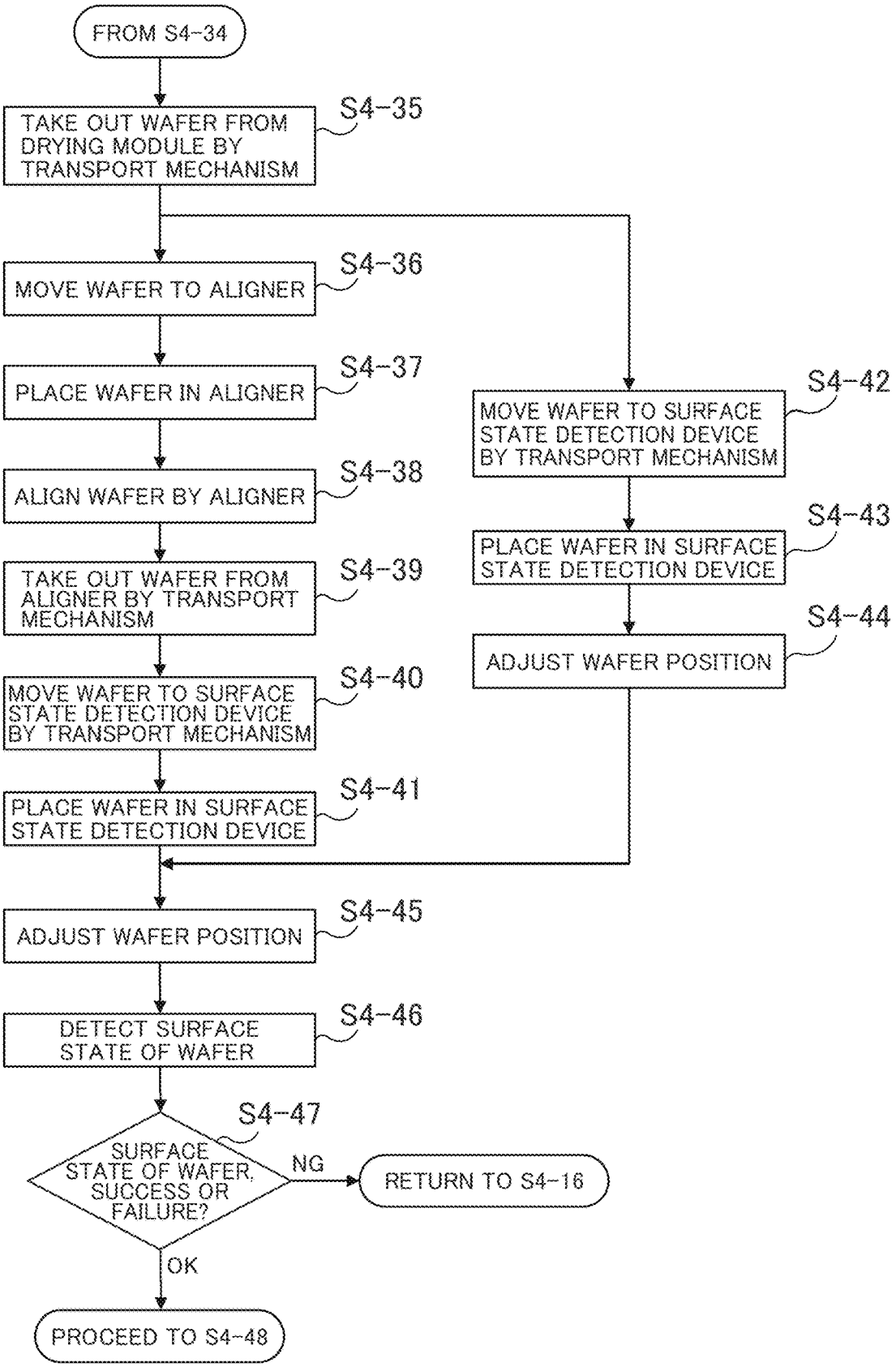
FIG. 19D is a flowchart showing the flow of polishing process according to the example 4, using the polishing machine according to one embodiment.
Figure 19E:
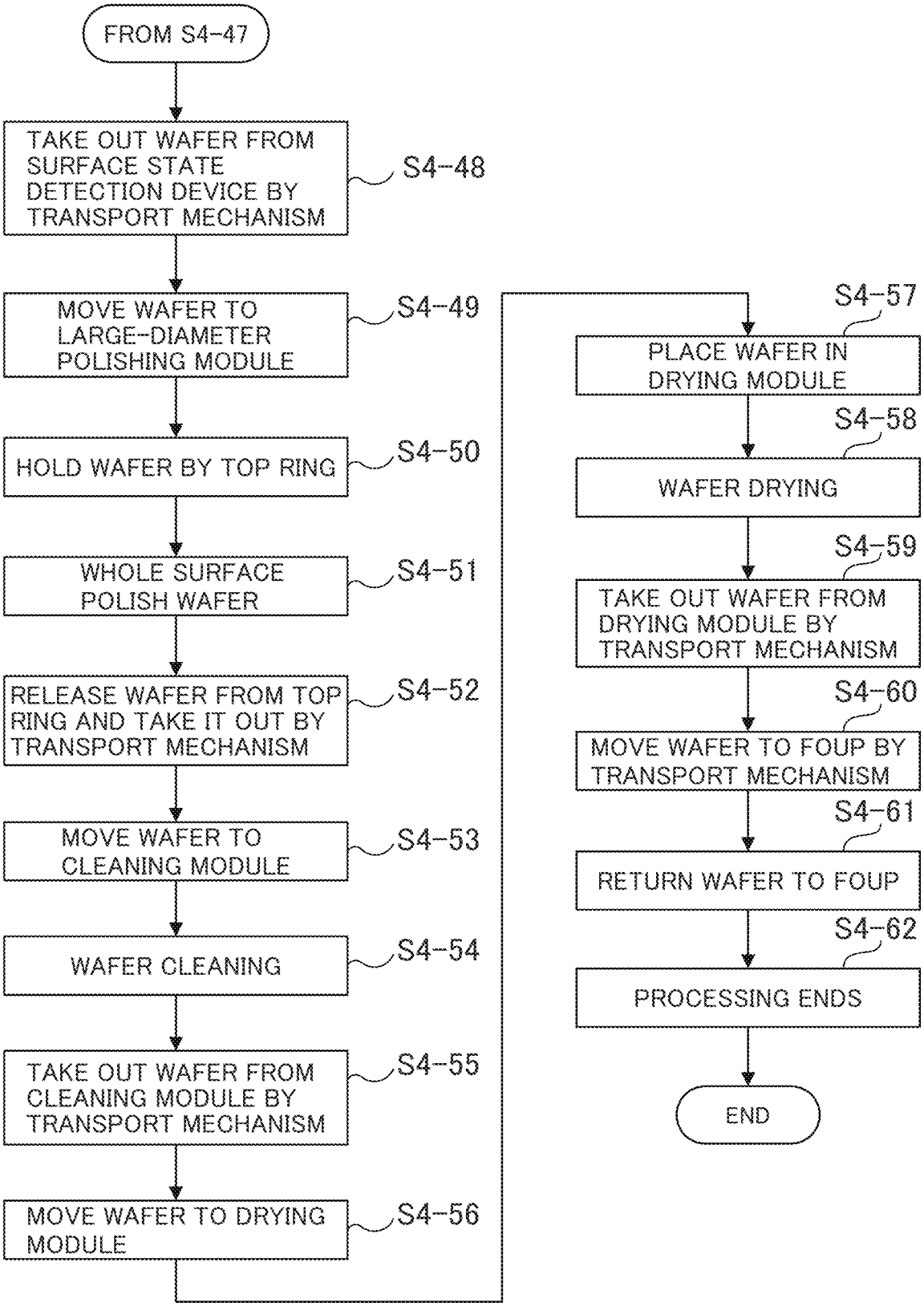
FIG. 19E is a flowchart showing the flow of polishing process according to the example 4, using the polishing machine according to one embodiment.
Figure 20A:
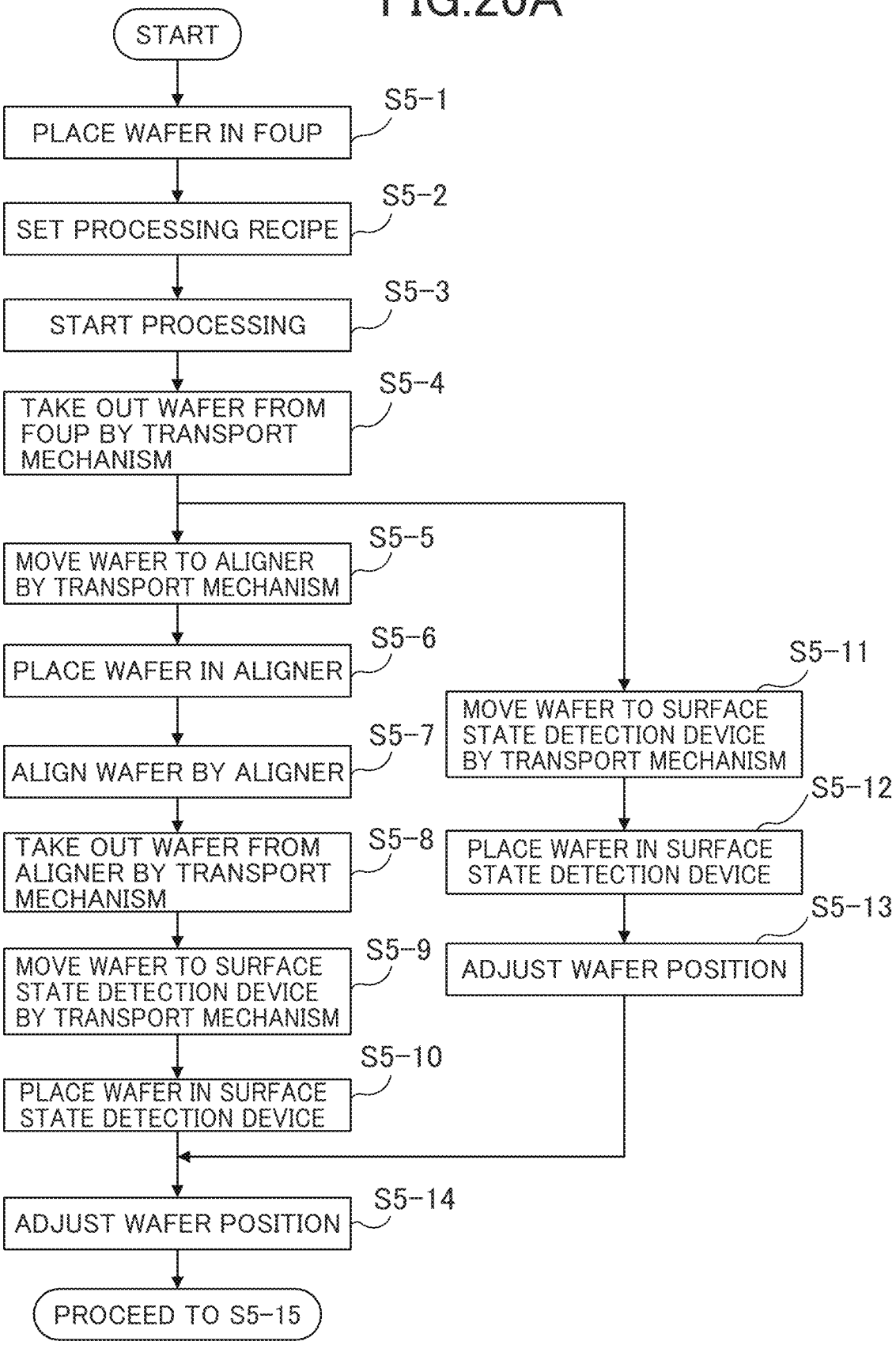
FIG. 20A is a flowchart showing a flow of polishing process according to an example 5, using a polishing machine according to one embodiment.
Figure 20B:
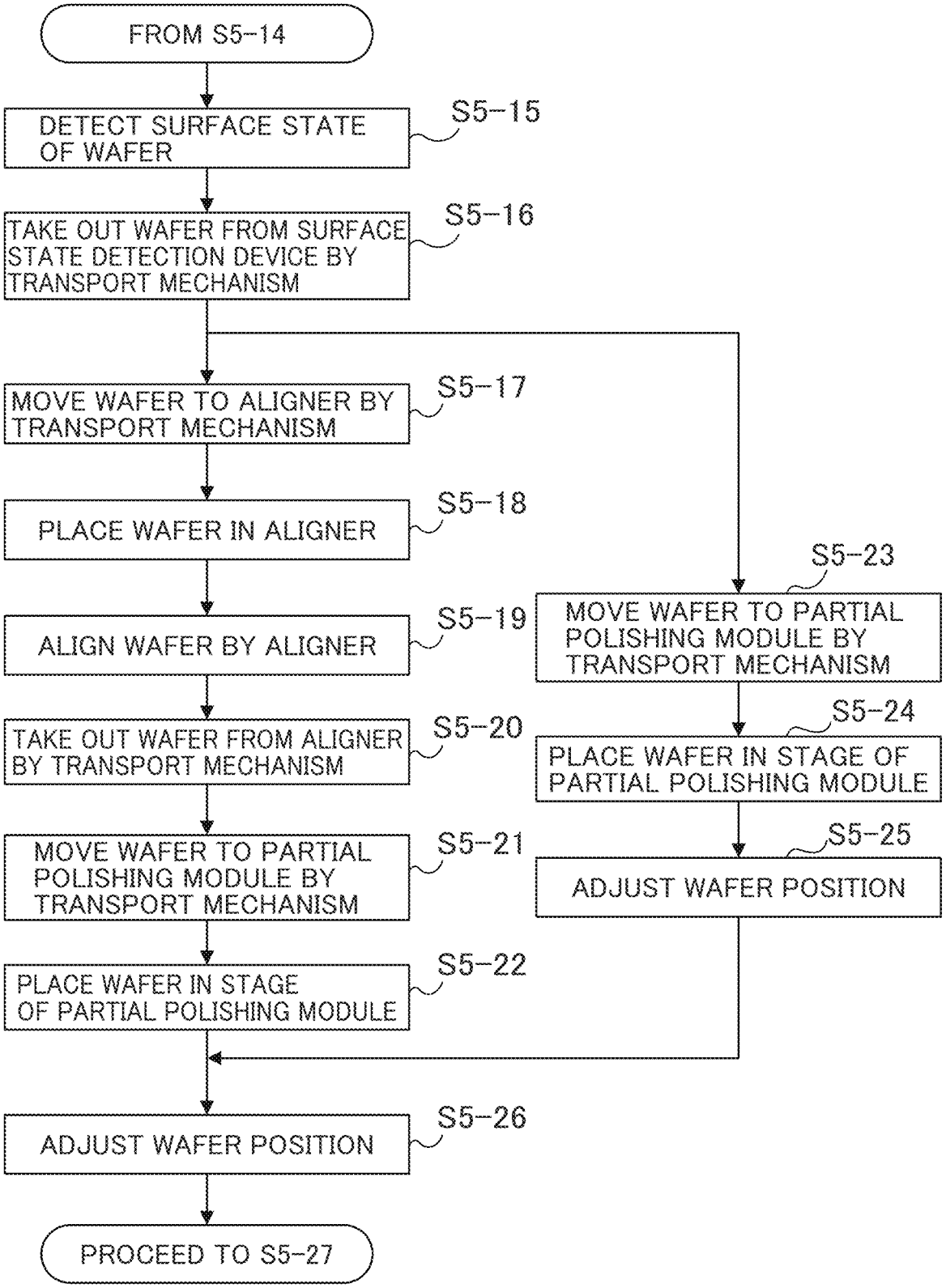
FIG. 20B is a flowchart showing the flow of polishing process according to the example 5, using the polishing machine according to one embodiment.
Figure 20C:
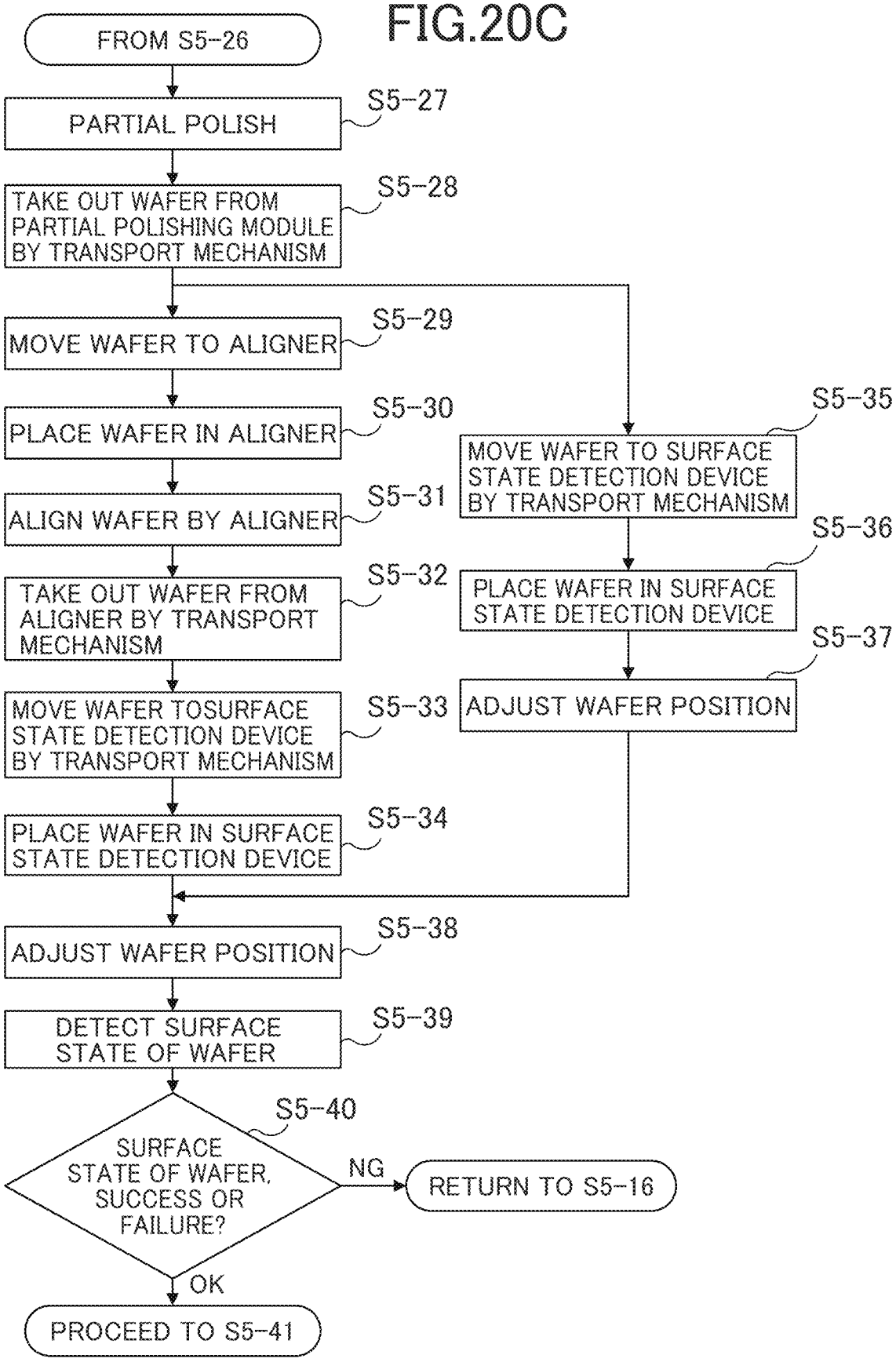
FIG. 20C is a flowchart showing the flow of polishing process according to the example 5, using the polishing machine according to one embodiment.
Figure 20D:
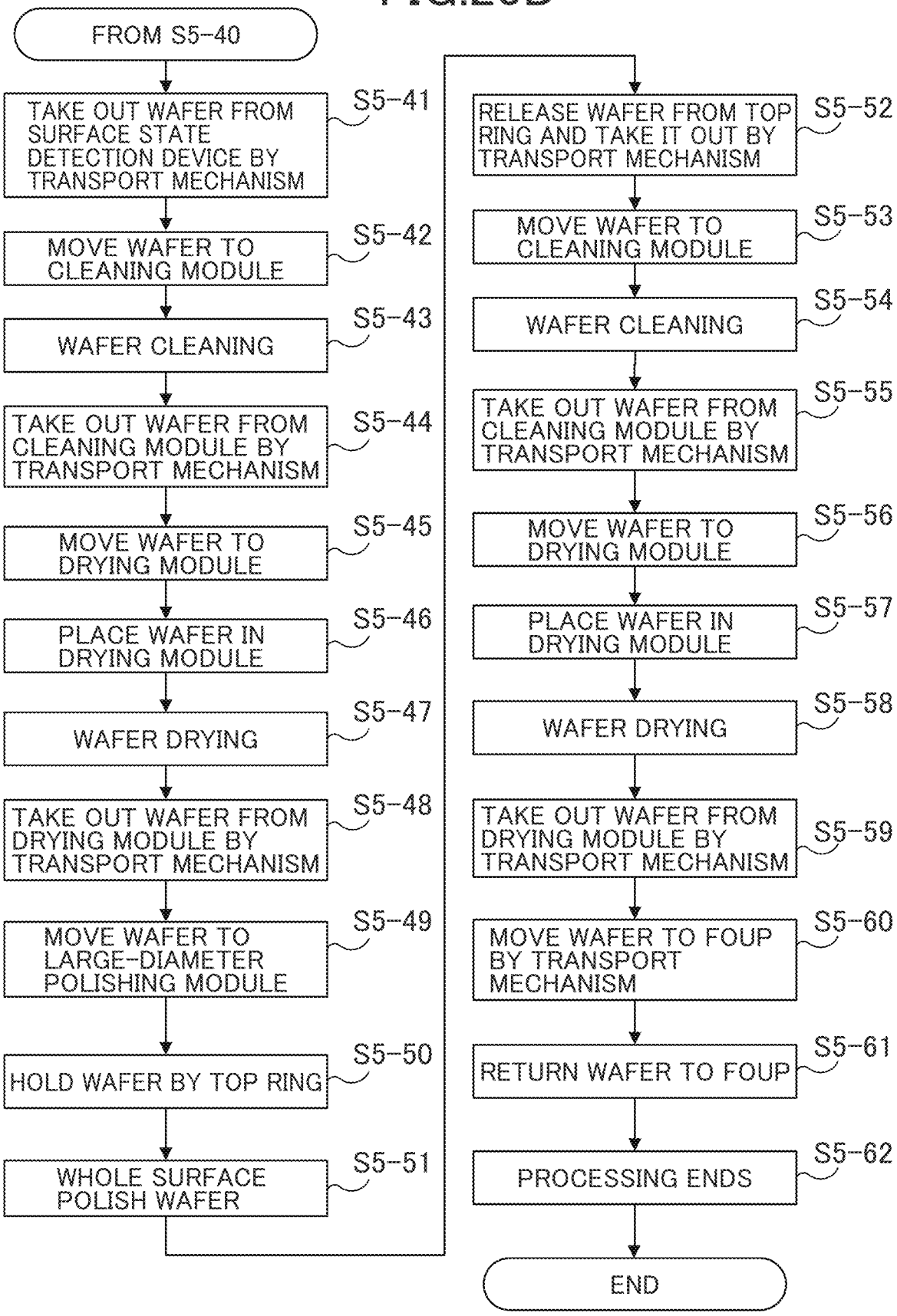
FIG. 20D is a flowchart showing the flow of polishing process according to the example 5, using the polishing machine according to one embodiment.
Figure 21A:
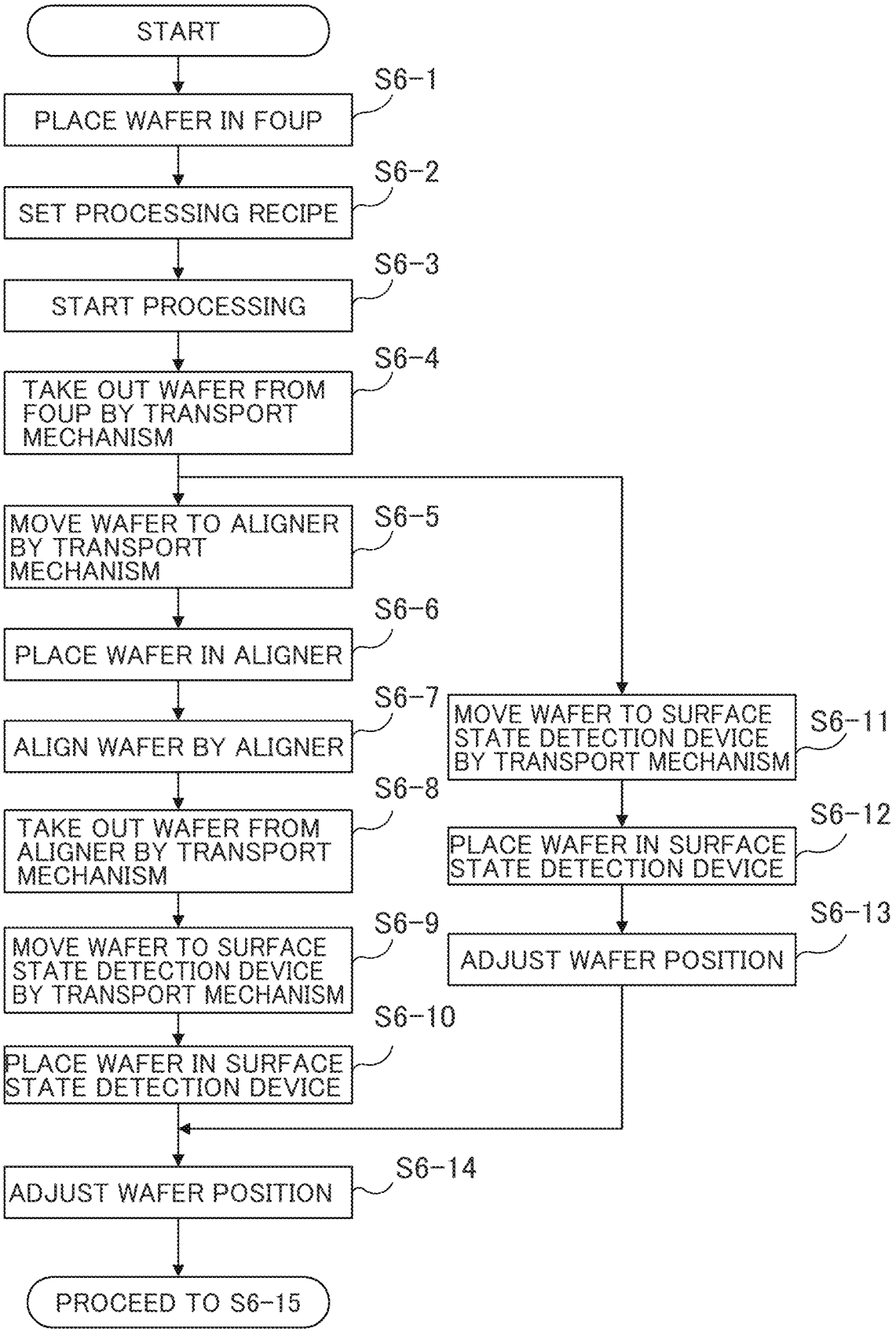
FIG. 21A is a flowchart showing a flow of polishing process according to an example 6, using a polishing machine according to one embodiment.
Figure 21B:
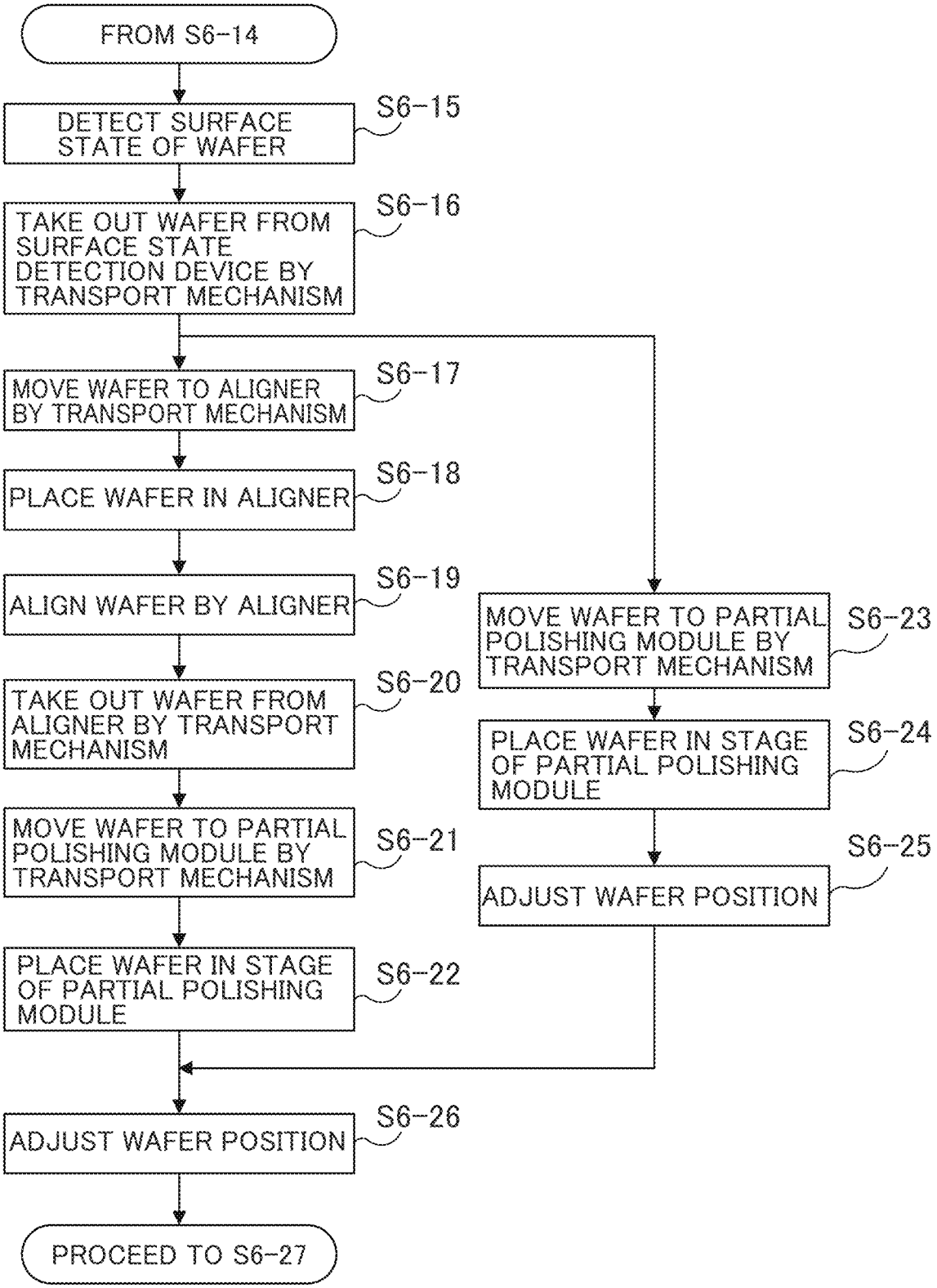
FIG. 21B is a flowchart showing the flow of polishing process according to the example 6, using the polishing machine according to one embodiment.
Figure 21C:
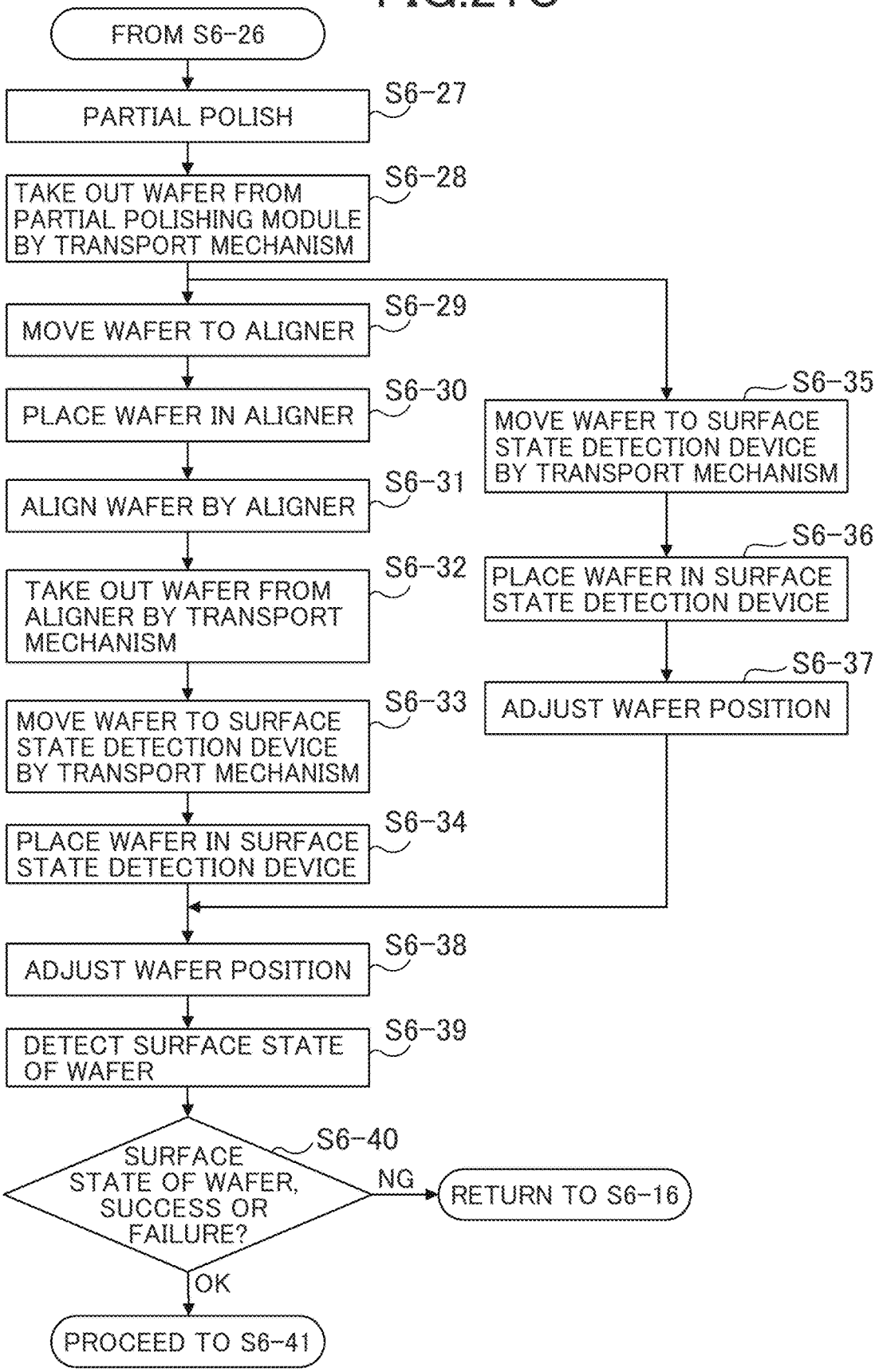
FIG. 21C is a flowchart showing the flow of polishing process according to the example 6, using the polishing machine according to one embodiment.
Figure 21D:
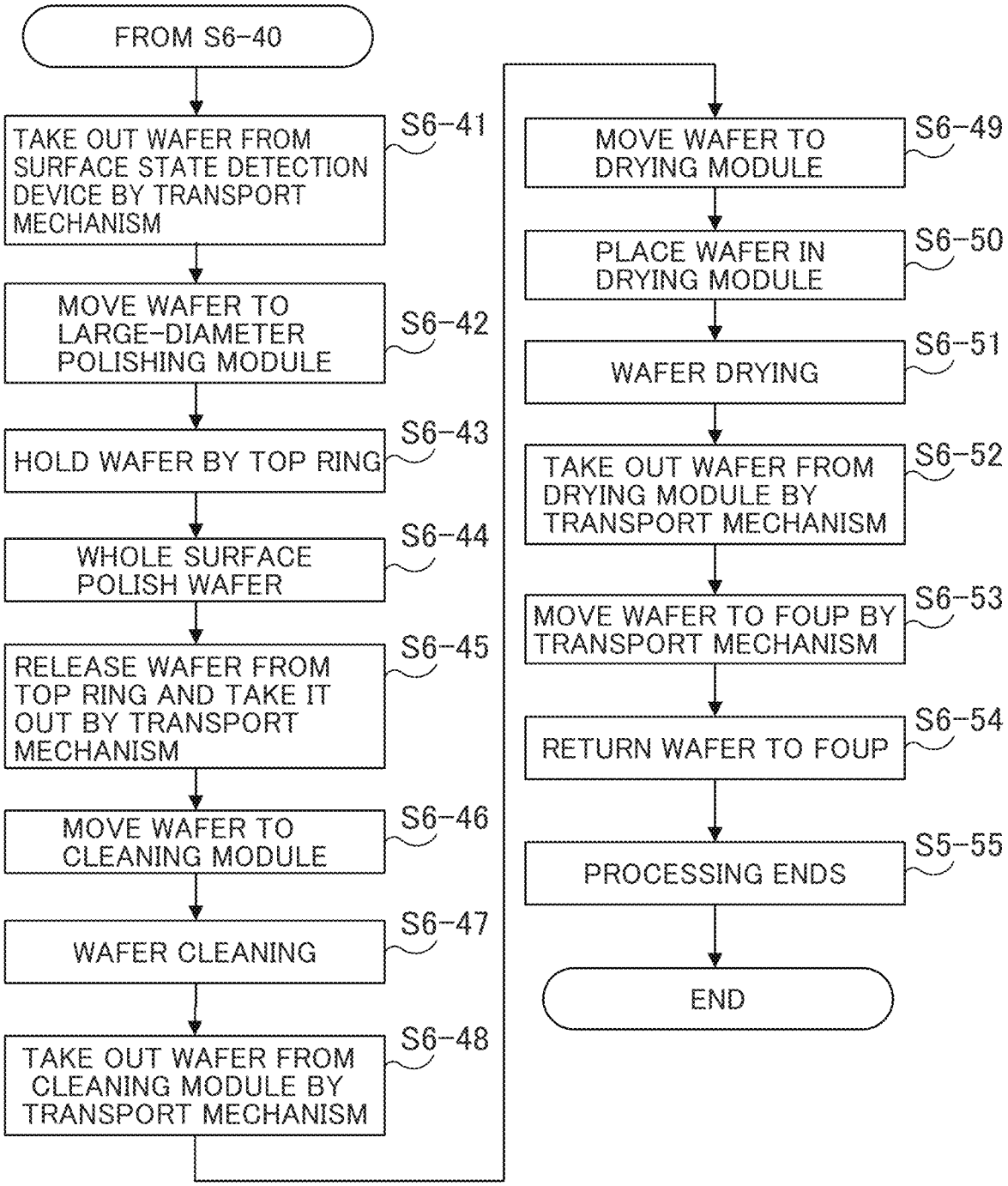
FIG. 21D is a flowchart showing the flow of polishing process according to the example 6, using the polishing machine according to one embodiment.
Figure 22A:
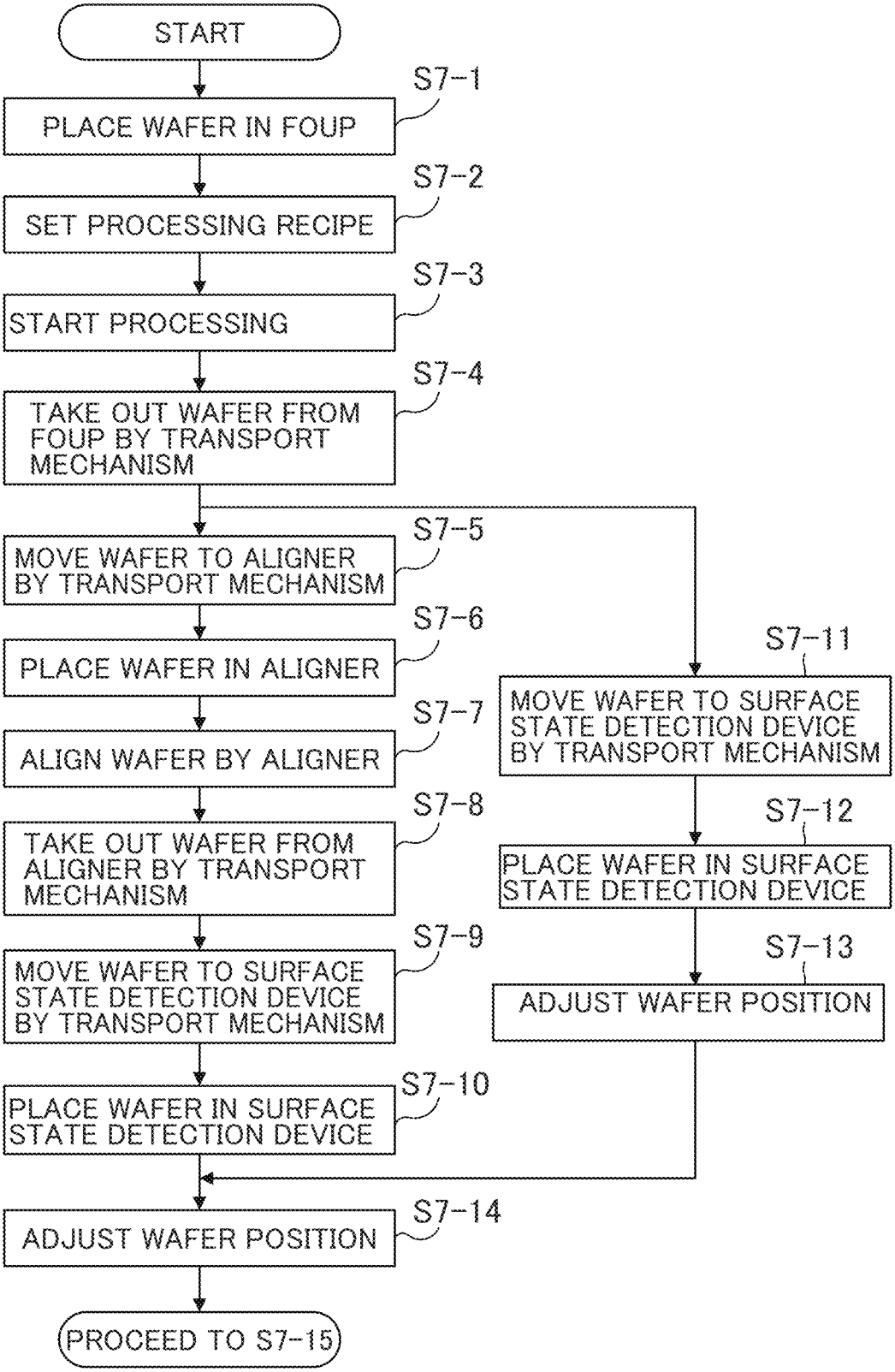
FIG. 22A is a flowchart showing a flow of polishing process according to an example 7, using a polishing machine according to one embodiment.
Figure 22B:
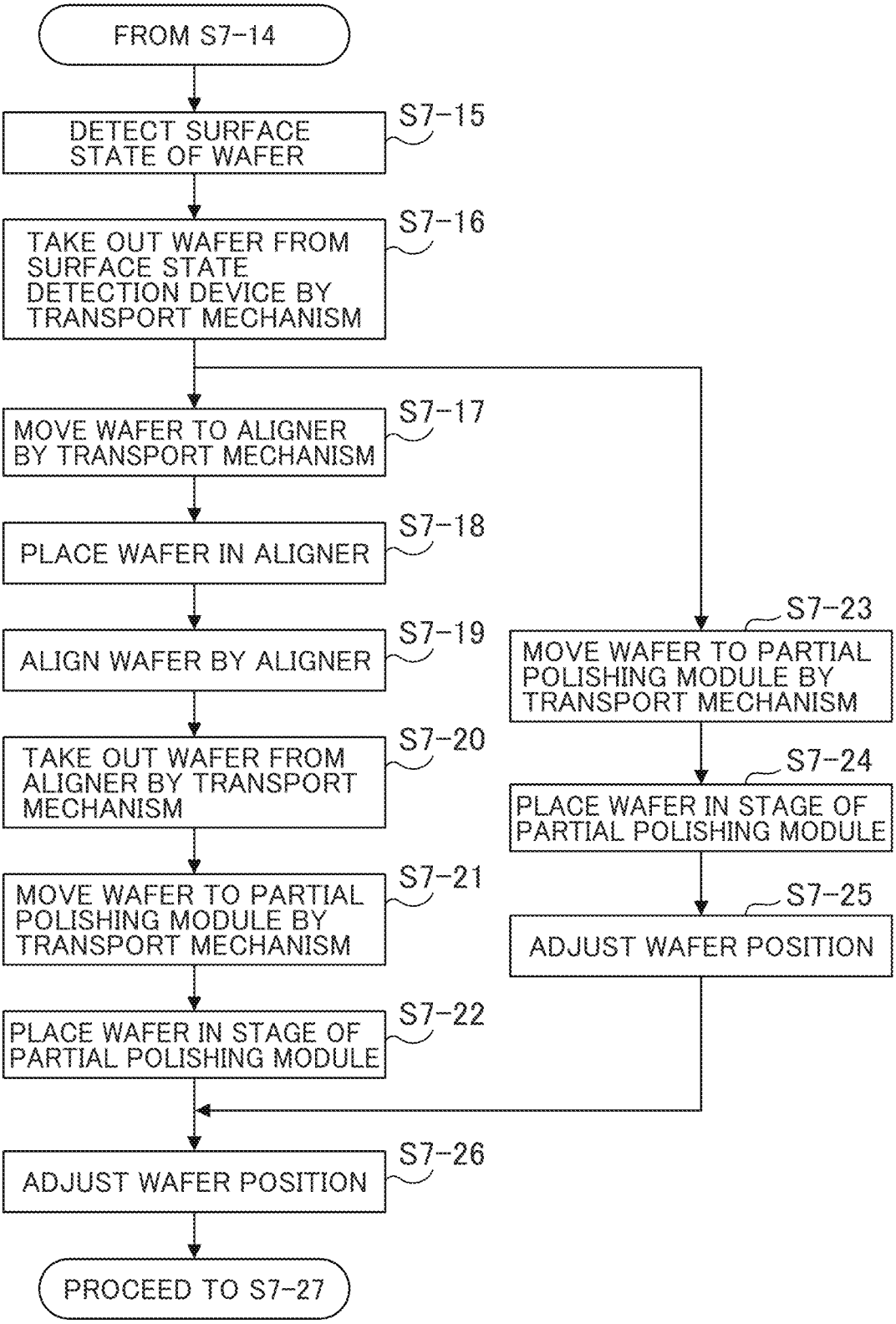
FIG. 22B is a flowchart showing the flow of polishing process according to the example 7, using the polishing machine according to one embodiment.
Figure 22C:
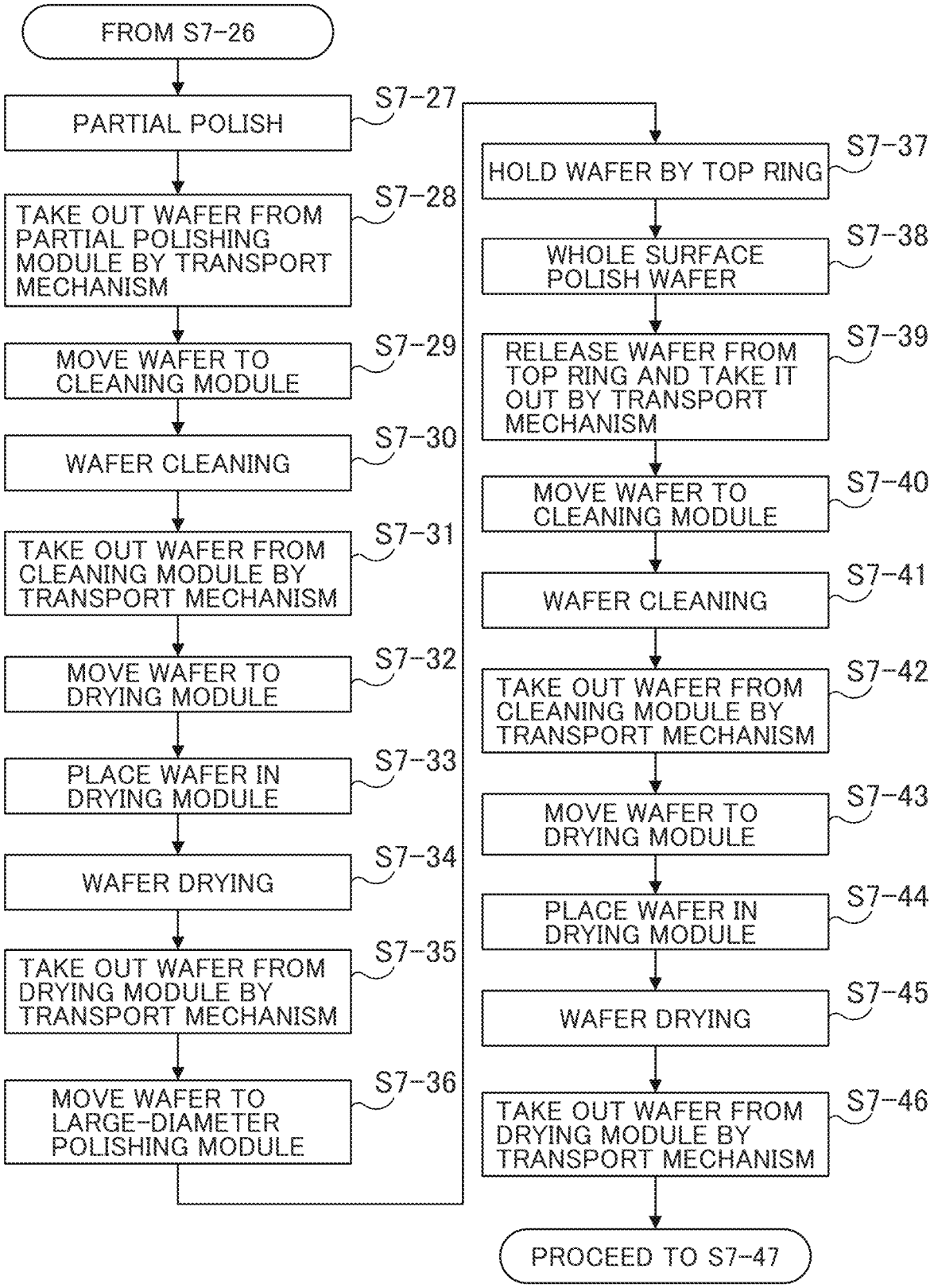
FIG. 22C is a flowchart showing the flow of polishing process according to the example 7, using the polishing machine according to one embodiment.
Figure 22D:
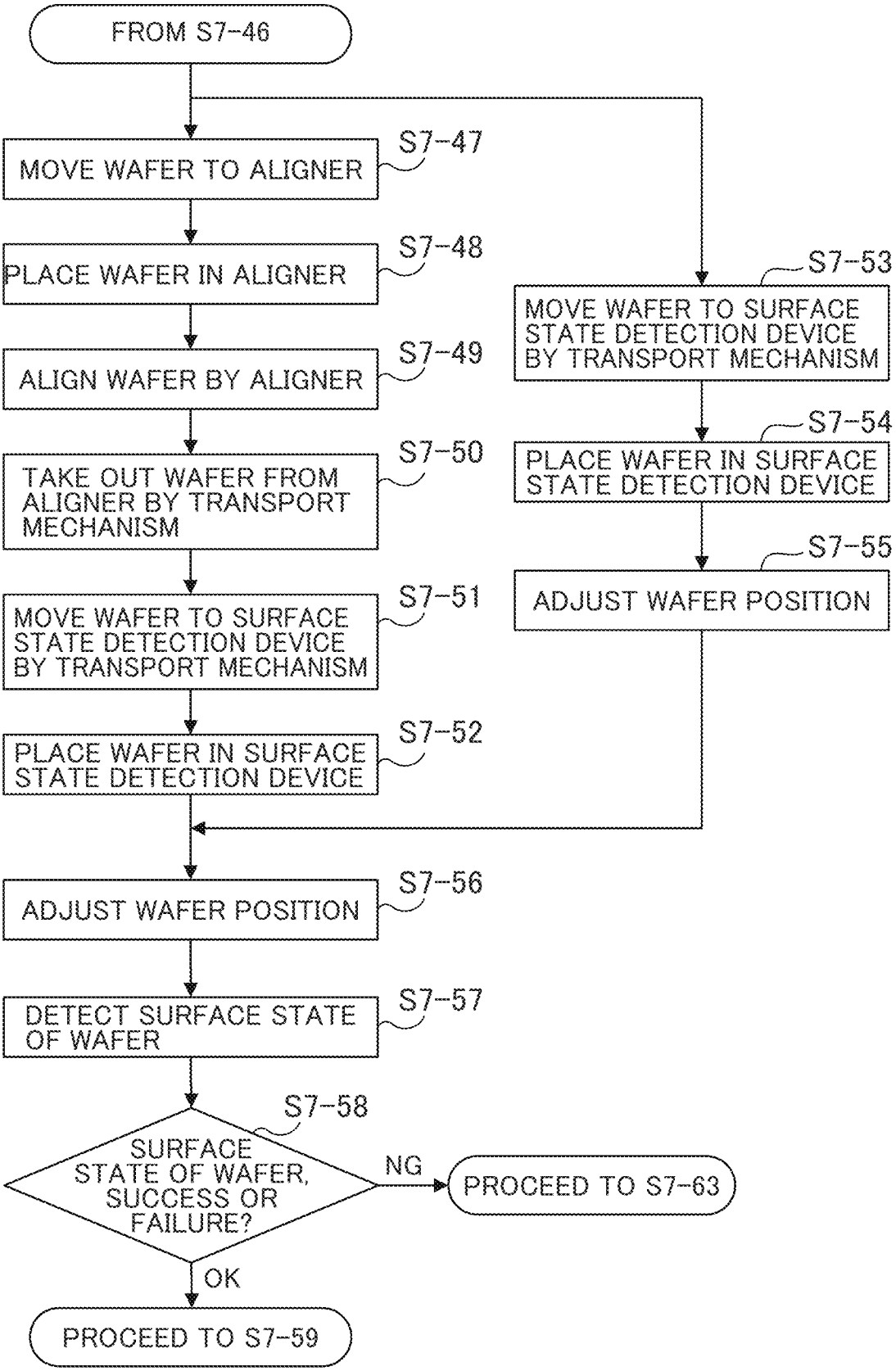
FIG. 22D is a flowchart showing the flow of polishing process according to the example 7, using the polishing machine according to one embodiment.
Figure 22E:
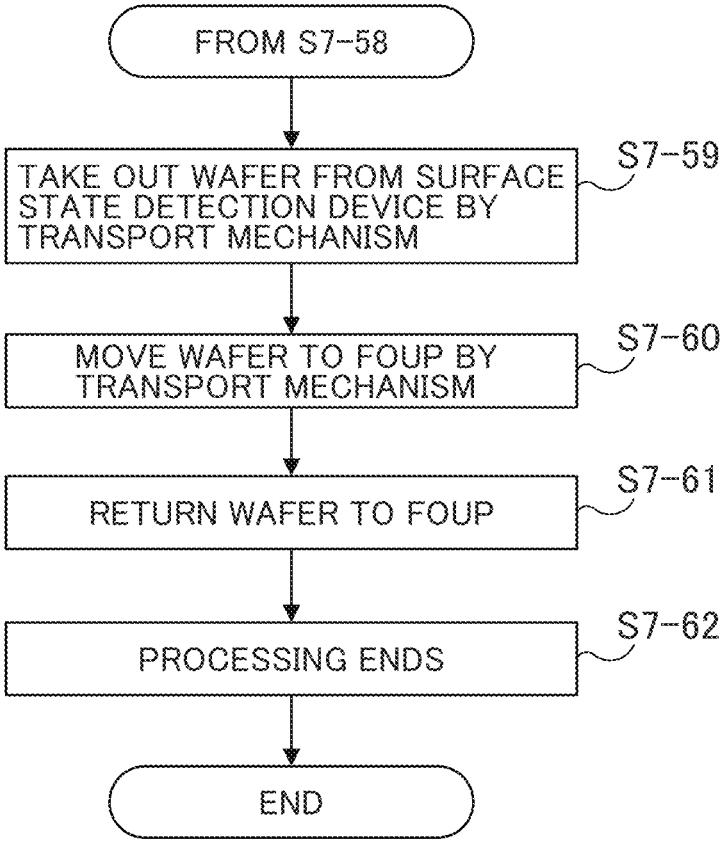
FIG. 22E is a flowchart showing the flow of polishing process according to the example 7, using the polishing machine according to one embodiment.
Figure 22F:
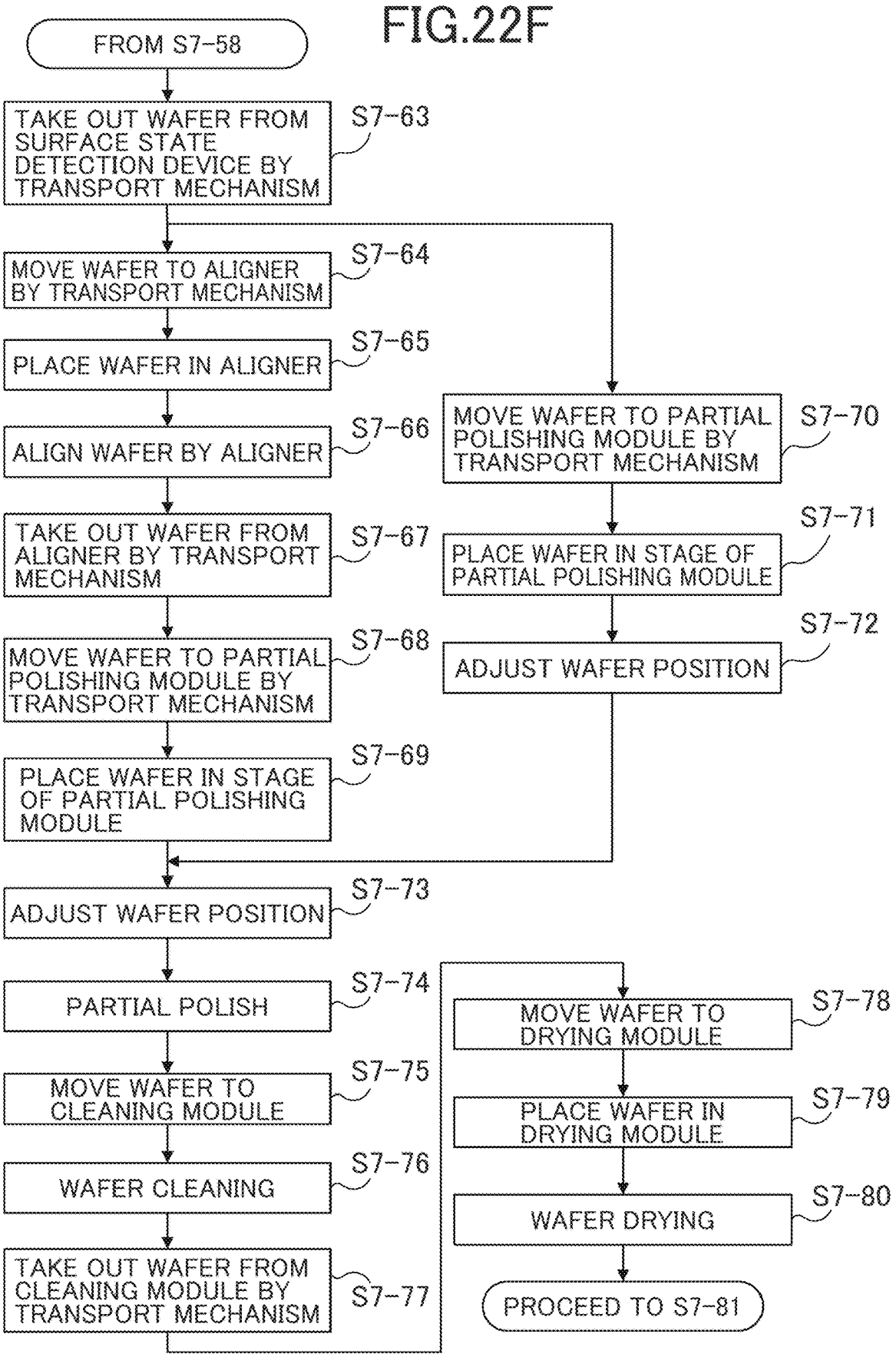
FIG. 22F is a flowchart showing the flow of polishing process according to the example 7, using the polishing machine according to one embodiment.
Figure 22G:
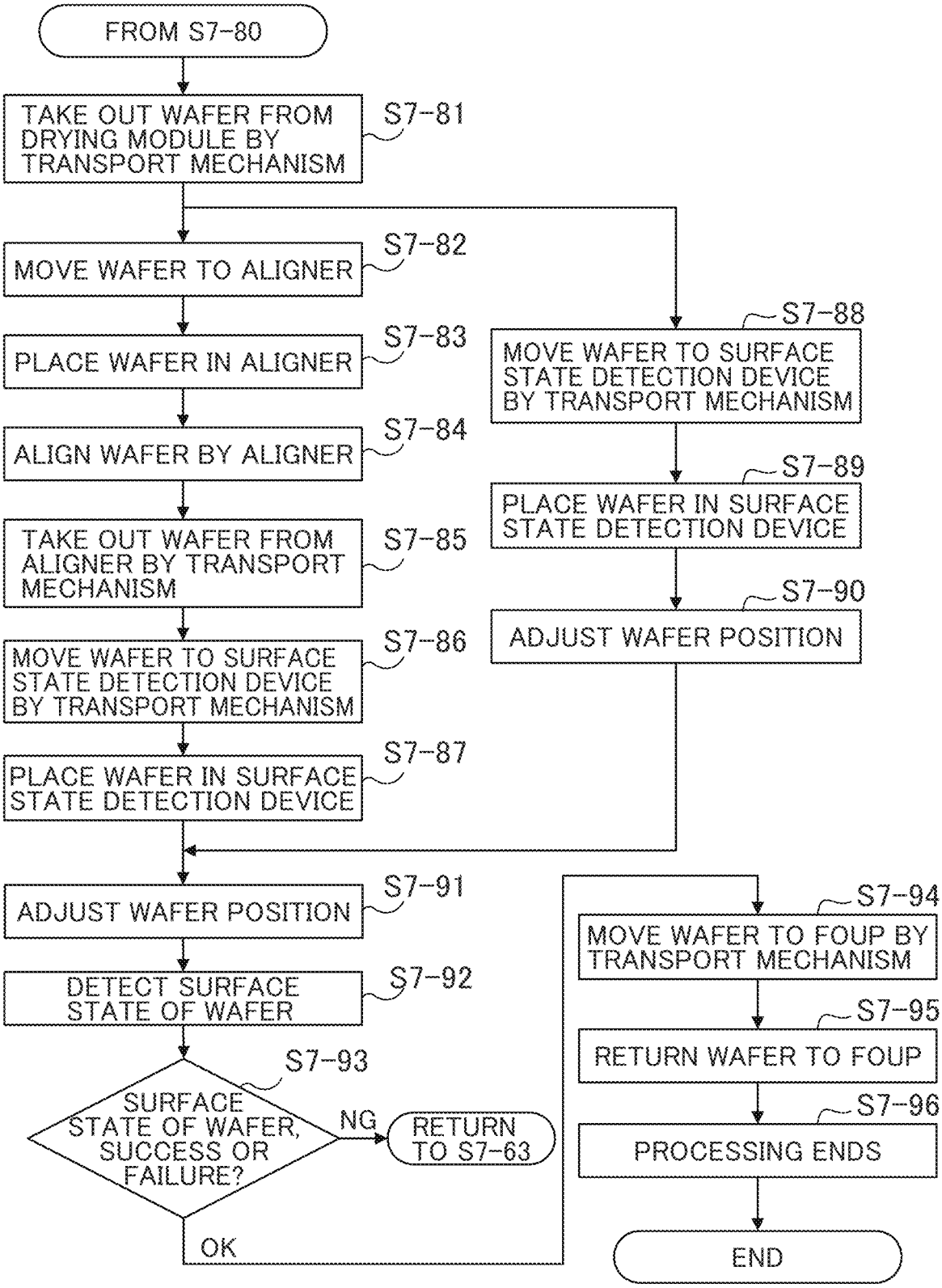
FIG. 22G is a flowchart showing the flow of polishing process according to the example 7, using the polishing machine according to one embodiment.
Figure 23A:
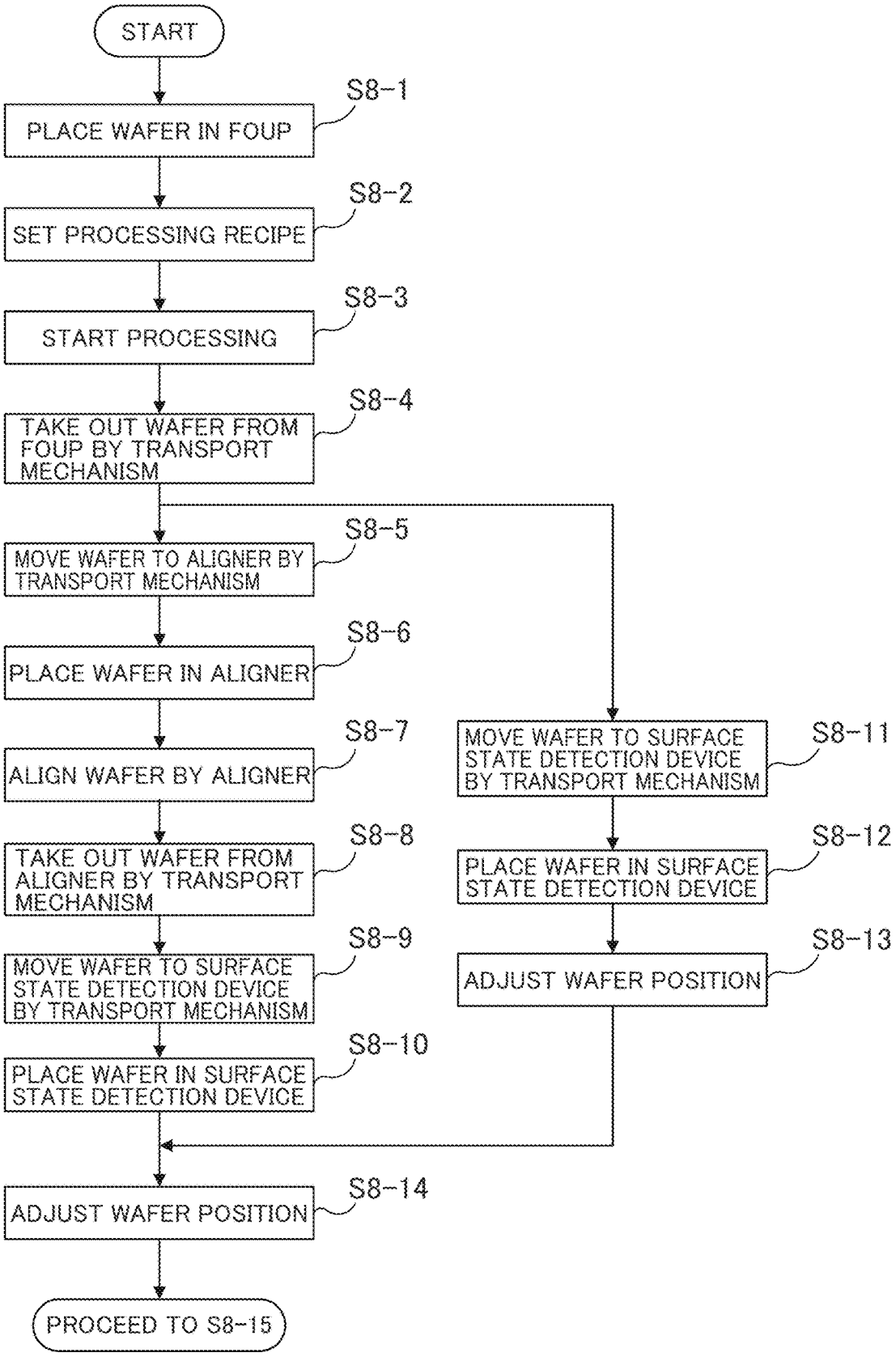
FIG. 23A is a flowchart showing a flow of polishing process according to an example 8, using a polishing machine according to one embodiment.
Figure 23B:
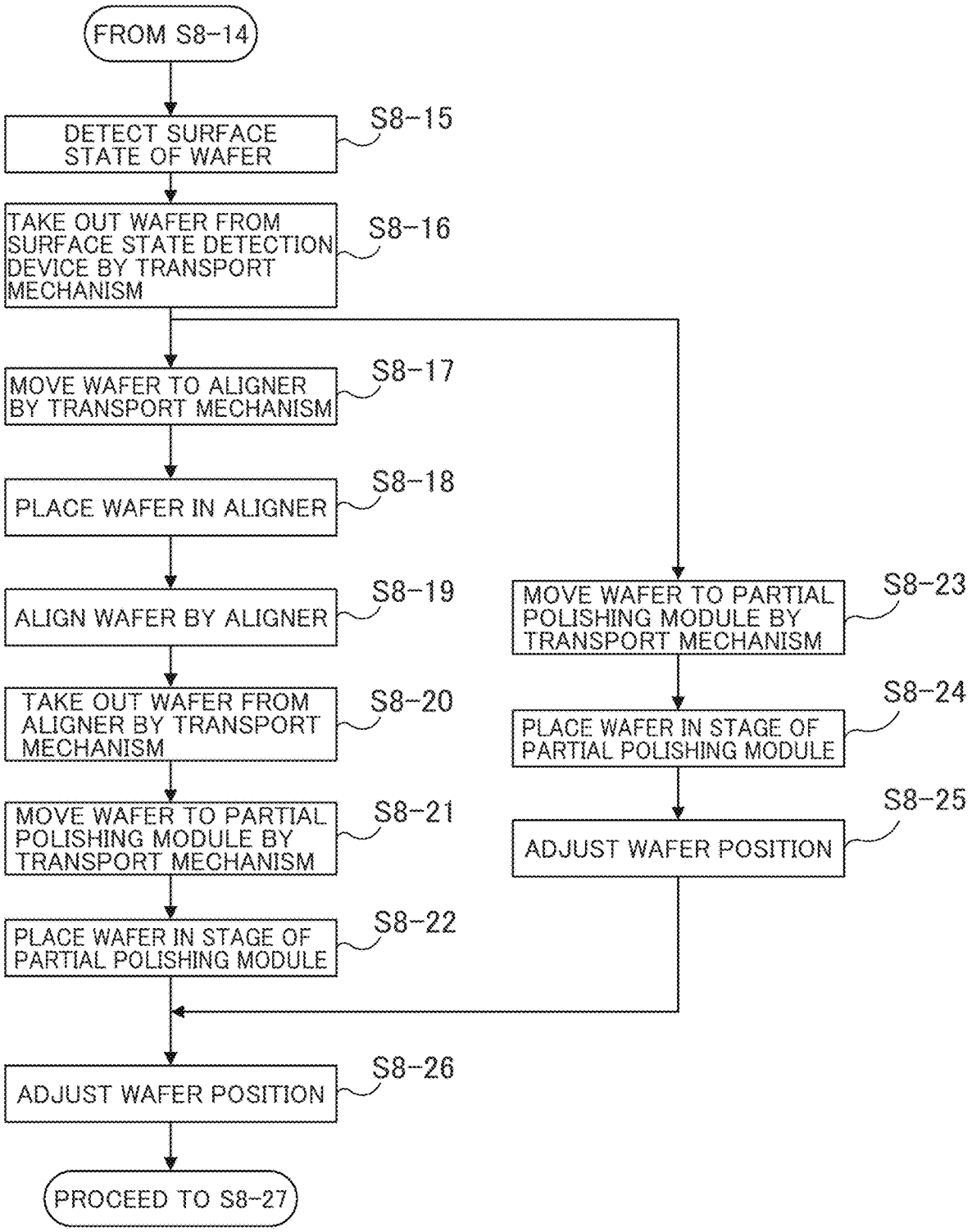
FIG. 23B is a flowchart showing the flow of polishing process according to the example 8, using the polishing machine according to one embodiment.
Figure 23C:
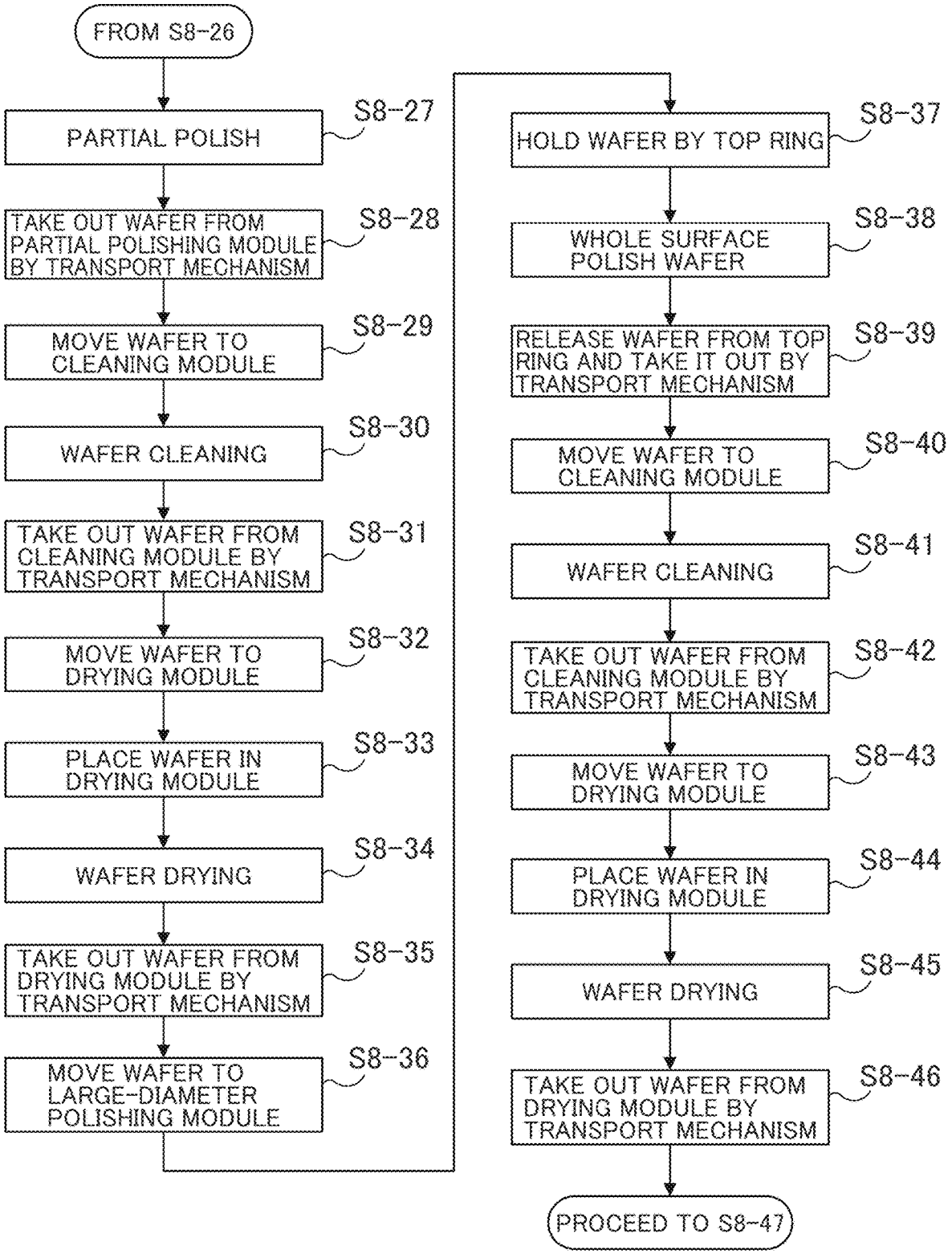
FIG. 23C is a flowchart showing the flow of polishing process according to the example 8, using the polishing machine according to one embodiment.
Figure 23D:
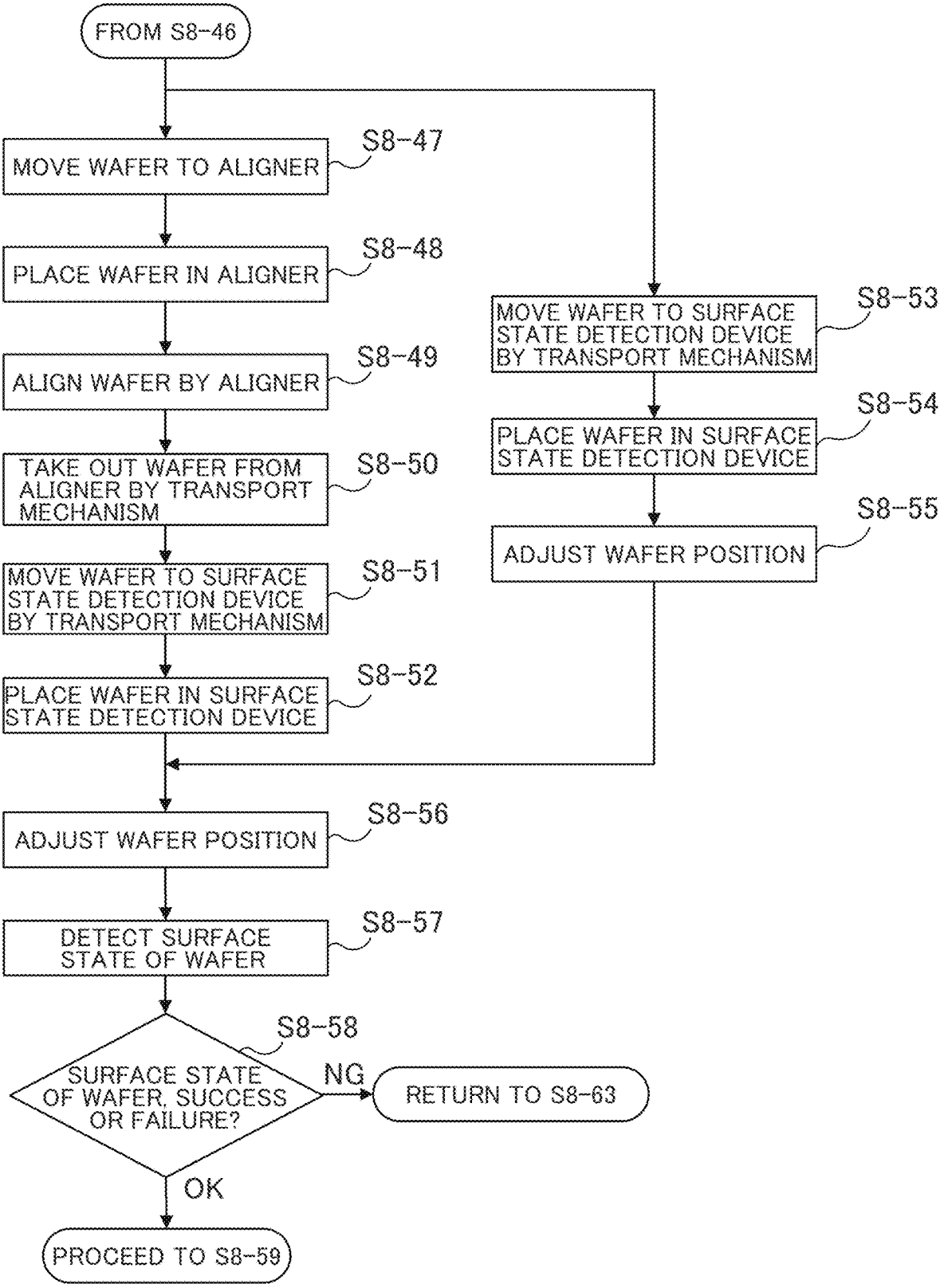
FIG. 23D is a flowchart showing the flow of polishing process according to the example 8, using the polishing machine according to one embodiment.
Figure 23E:
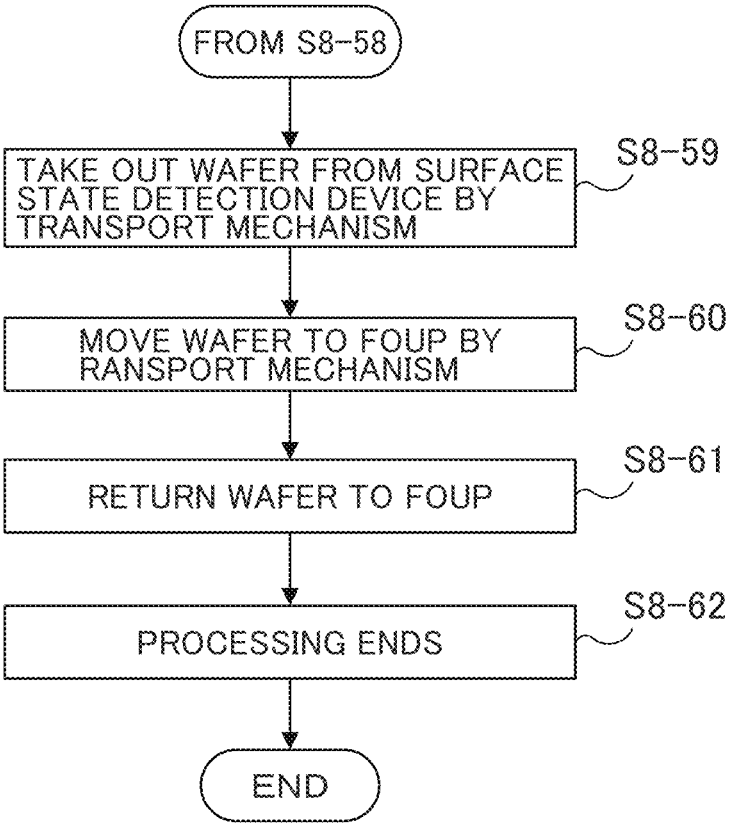
FIG. 23E is a flowchart showing the flow of polishing process according to the example 8, using the polishing machine according to one embodiment.
Figure 23F:
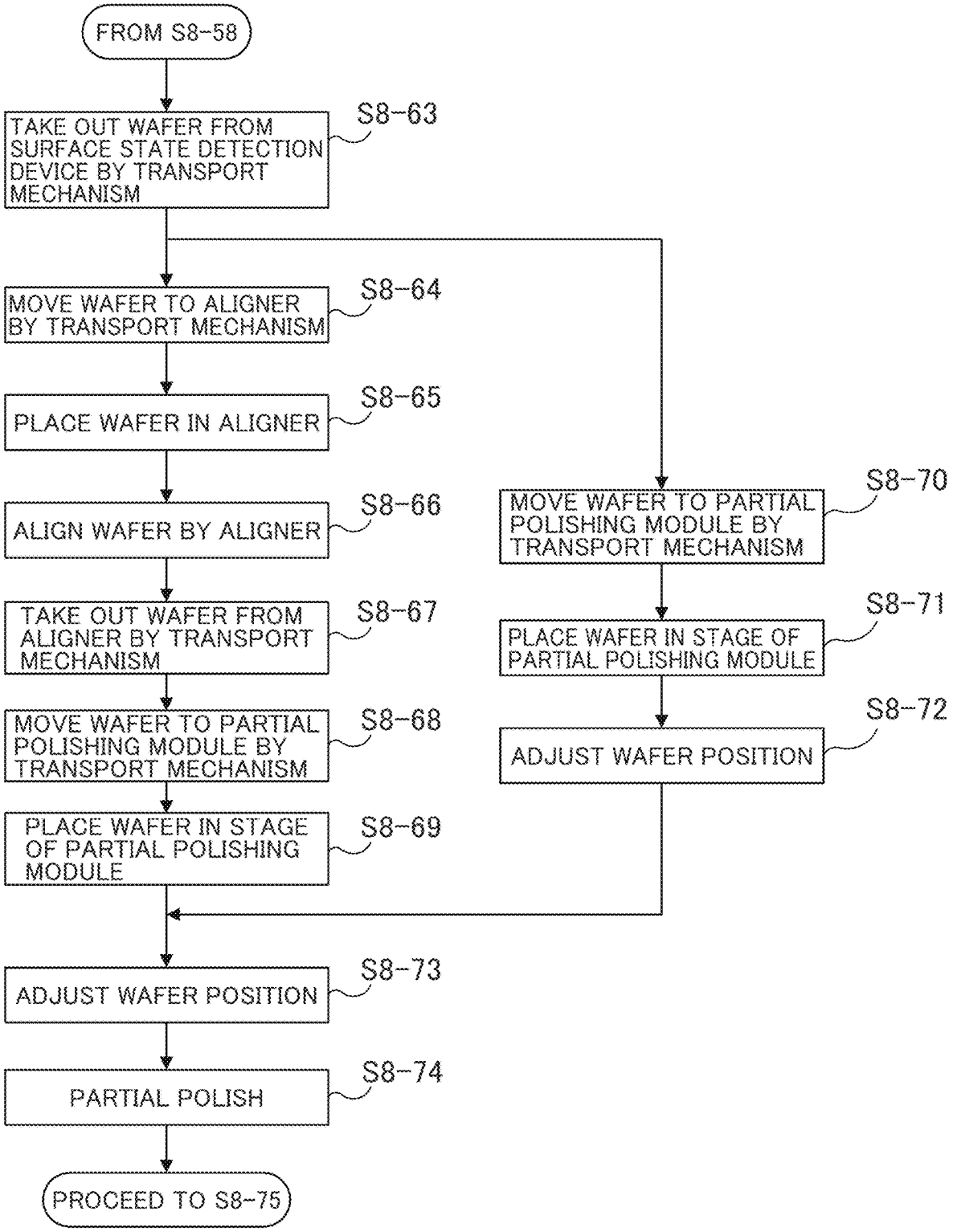
FIG. 23F is a flowchart showing the flow of polishing process according to the example 8, using the polishing machine according to one embodiment.
Figure 23G:
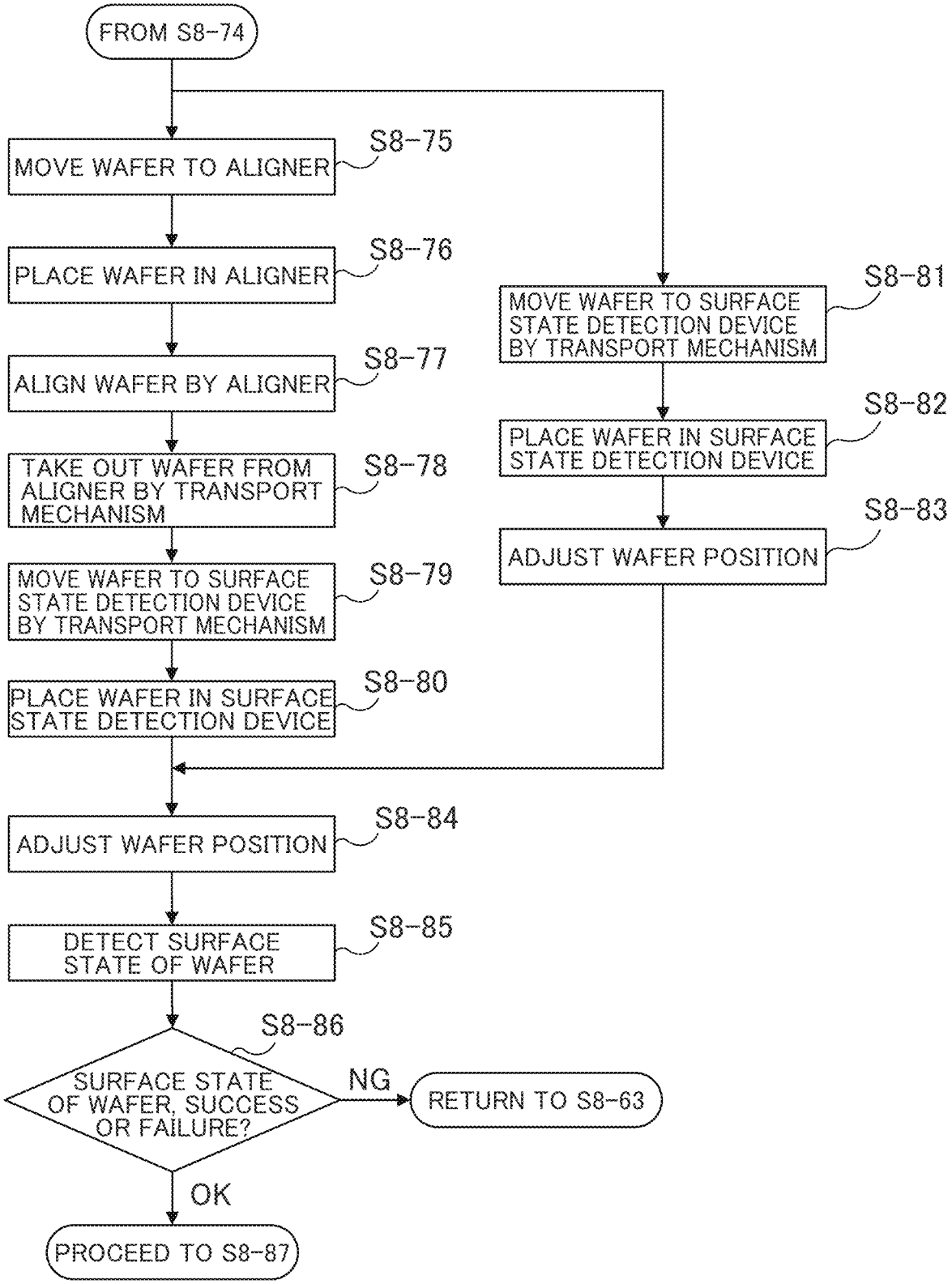
FIG. 23G is a flowchart showing the flow of polishing process according to the example 8, using the polishing machine according to one embodiment.
Figure 23H:
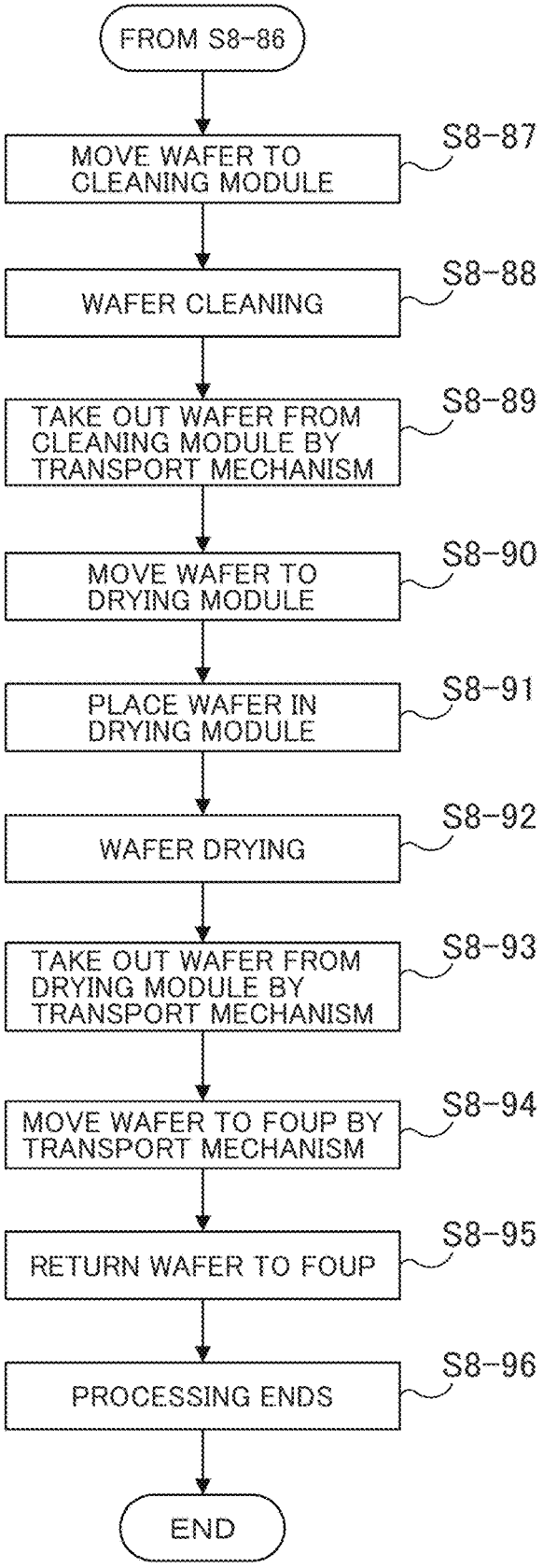
FIG. 23H is a flowchart showing the flow of polishing process according to the example 8, using the polishing machine according to one embodiment.
Figure 24A:
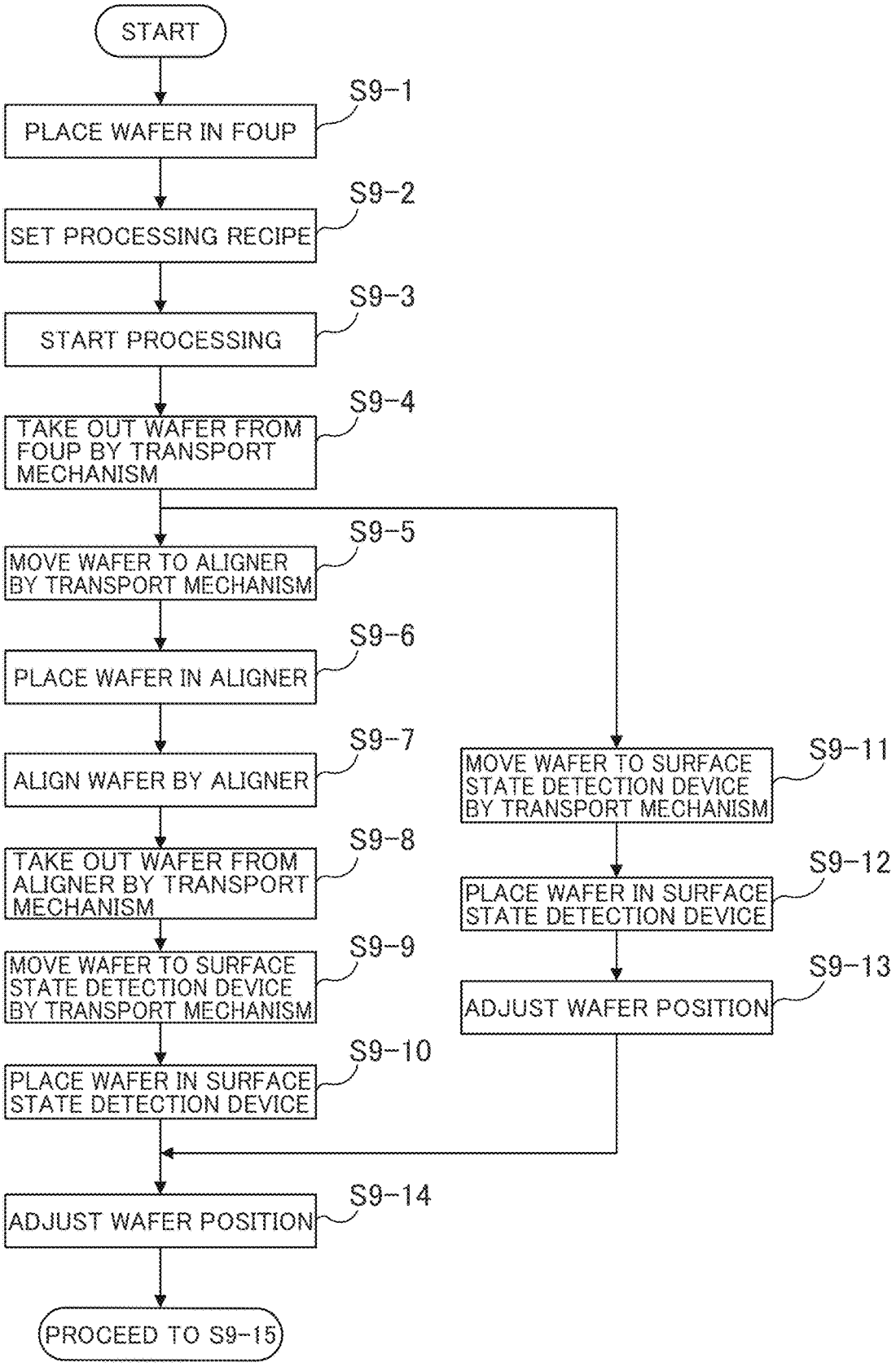
FIG. 24A is a flowchart showing a flow of polishing process according to an example 9, using a polishing machine according to one embodiment.
Figure 24B:
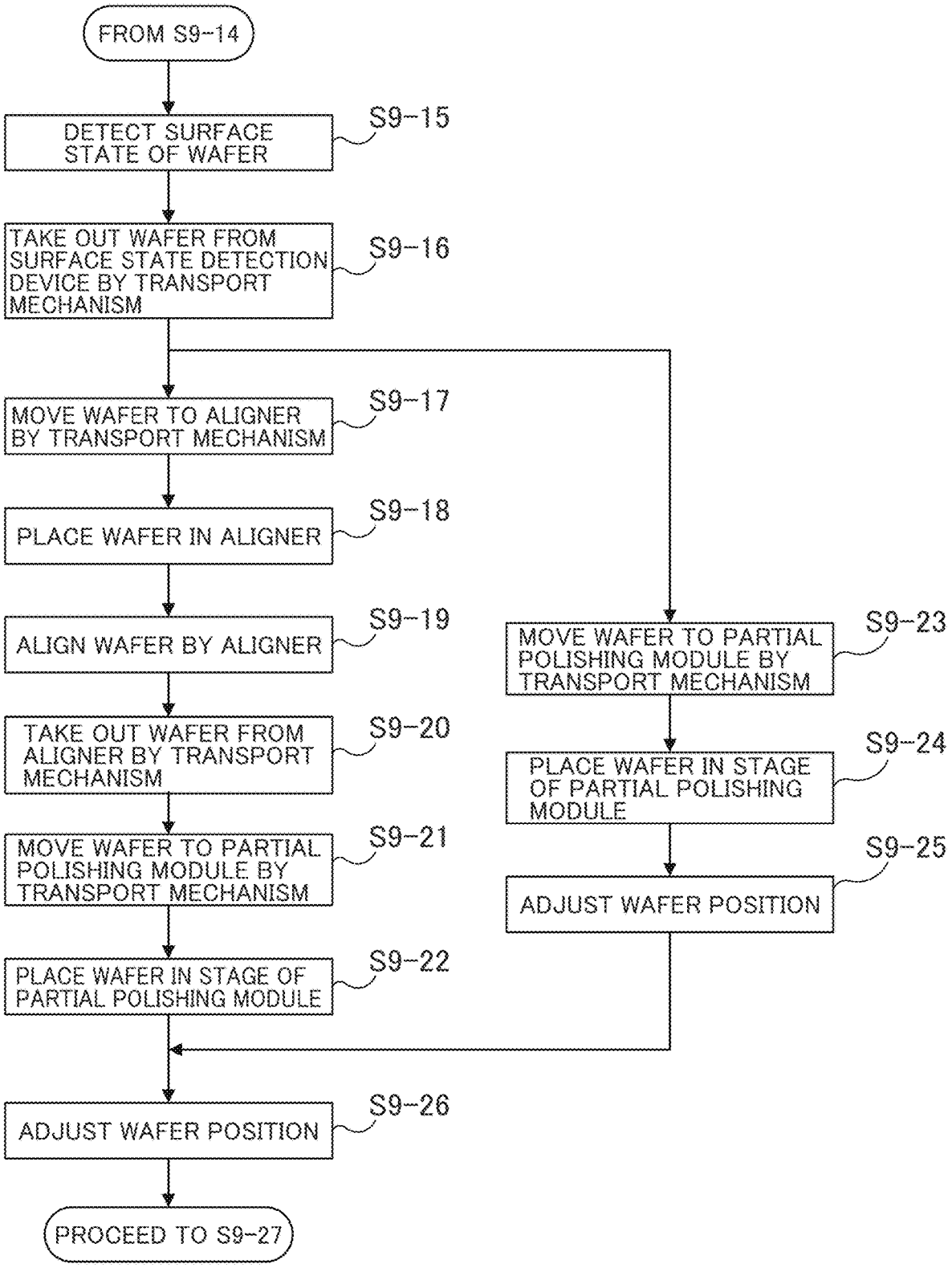
FIG. 24B is a flowchart showing the flow of polishing process according to the example 9, using the polishing machine according to one embodiment.
Figure 24C:
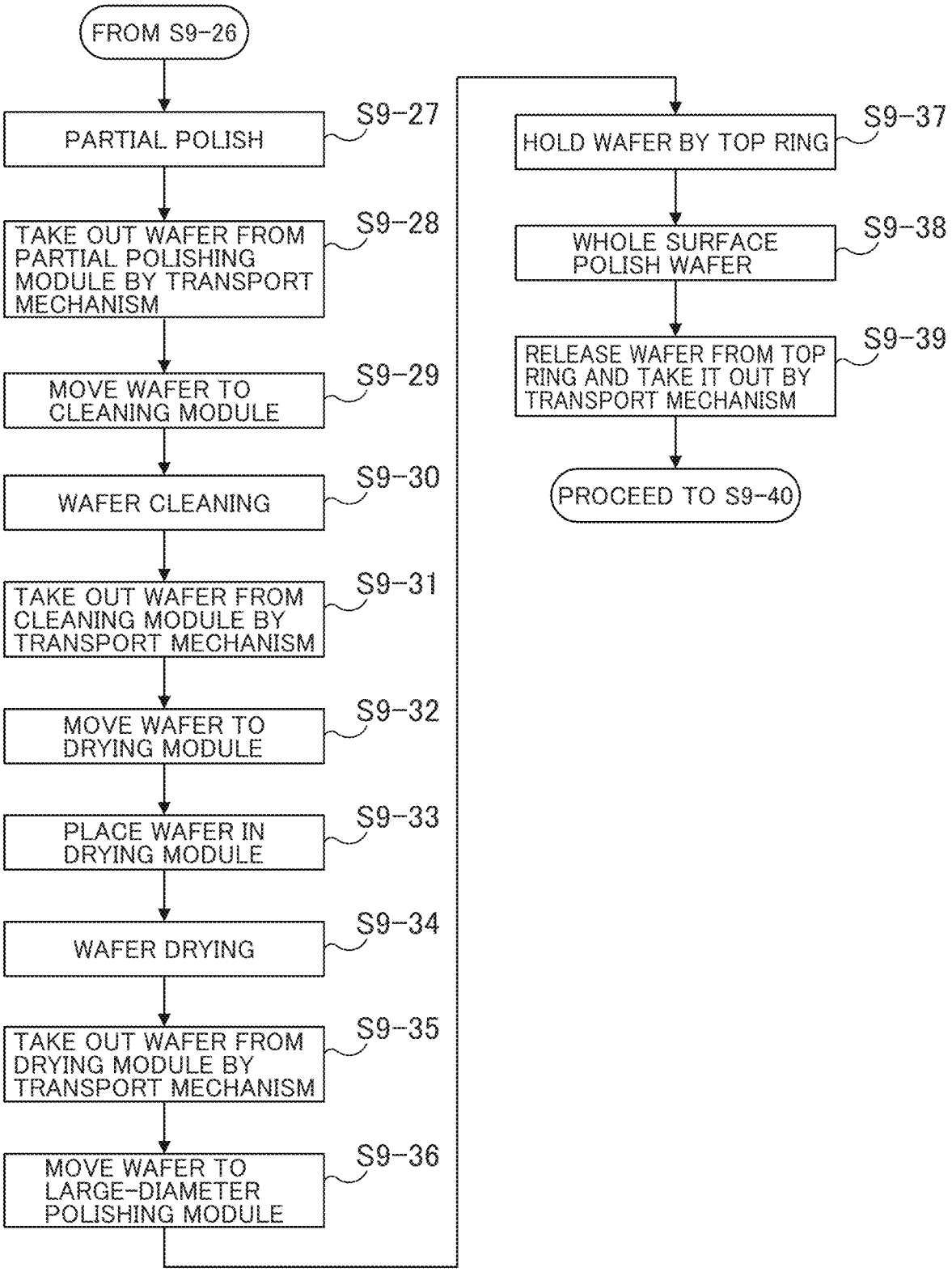
FIG. 24C is a flowchart showing the flow of polishing process according to the example 9, using the polishing machine according to one embodiment.
Figure 24D:
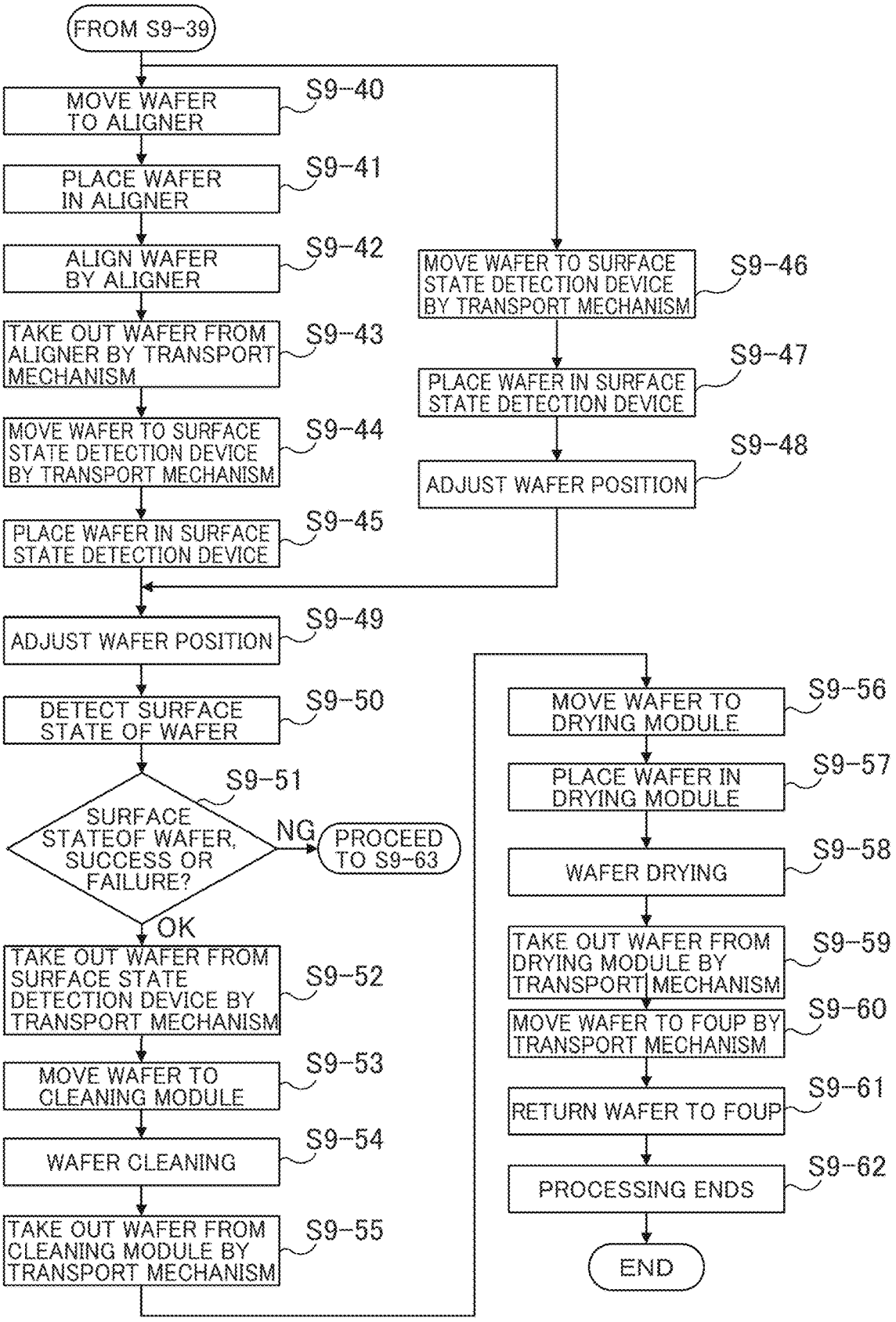
FIG. 24D is a flowchart showing the flow of polishing process according to the example 9, using the polishing machine according to one embodiment.
Figure 24E:
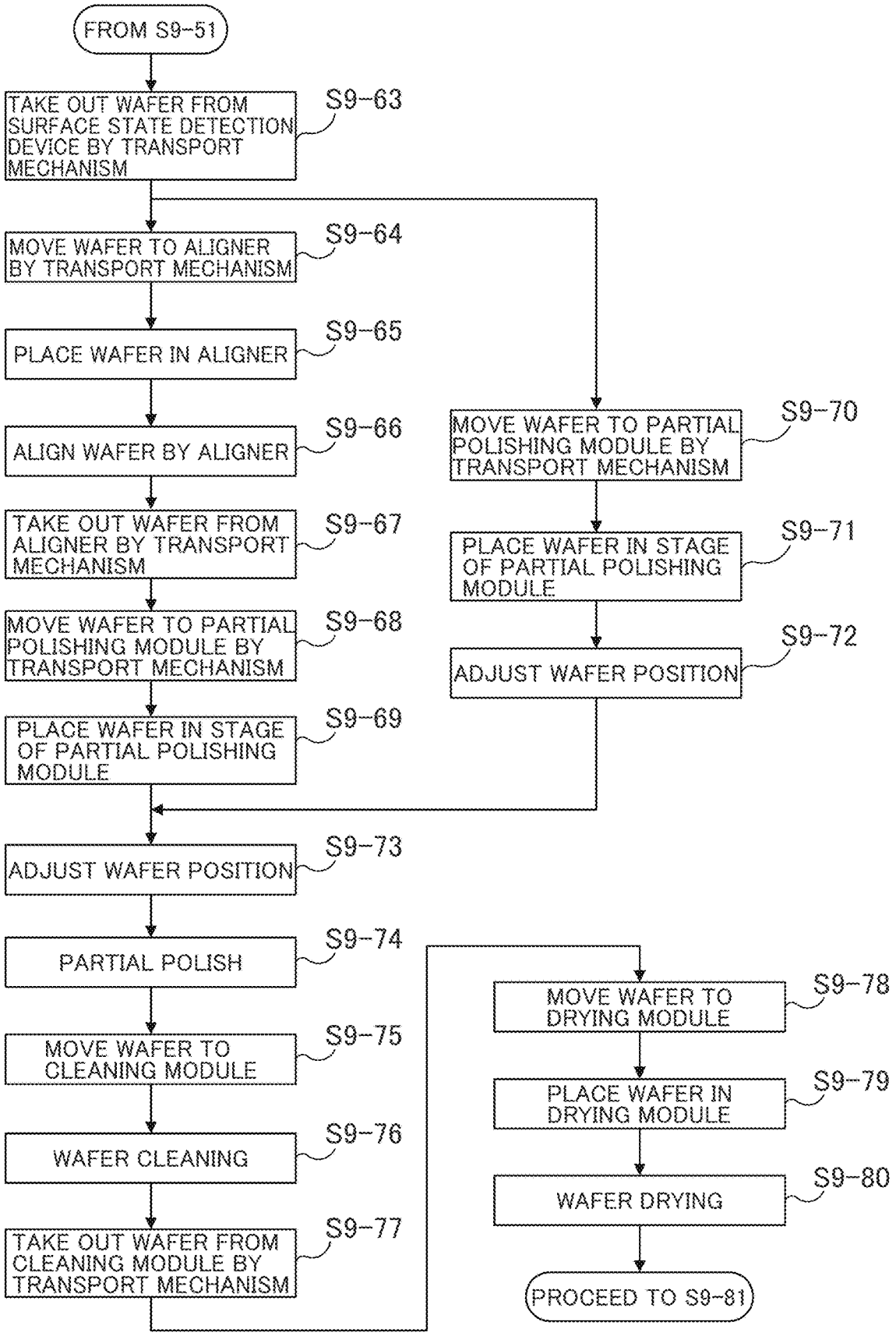
FIG. 24E is a flowchart showing the flow of polishing process according to the example 9, using the polishing machine according to one embodiment.
Figure 24F:
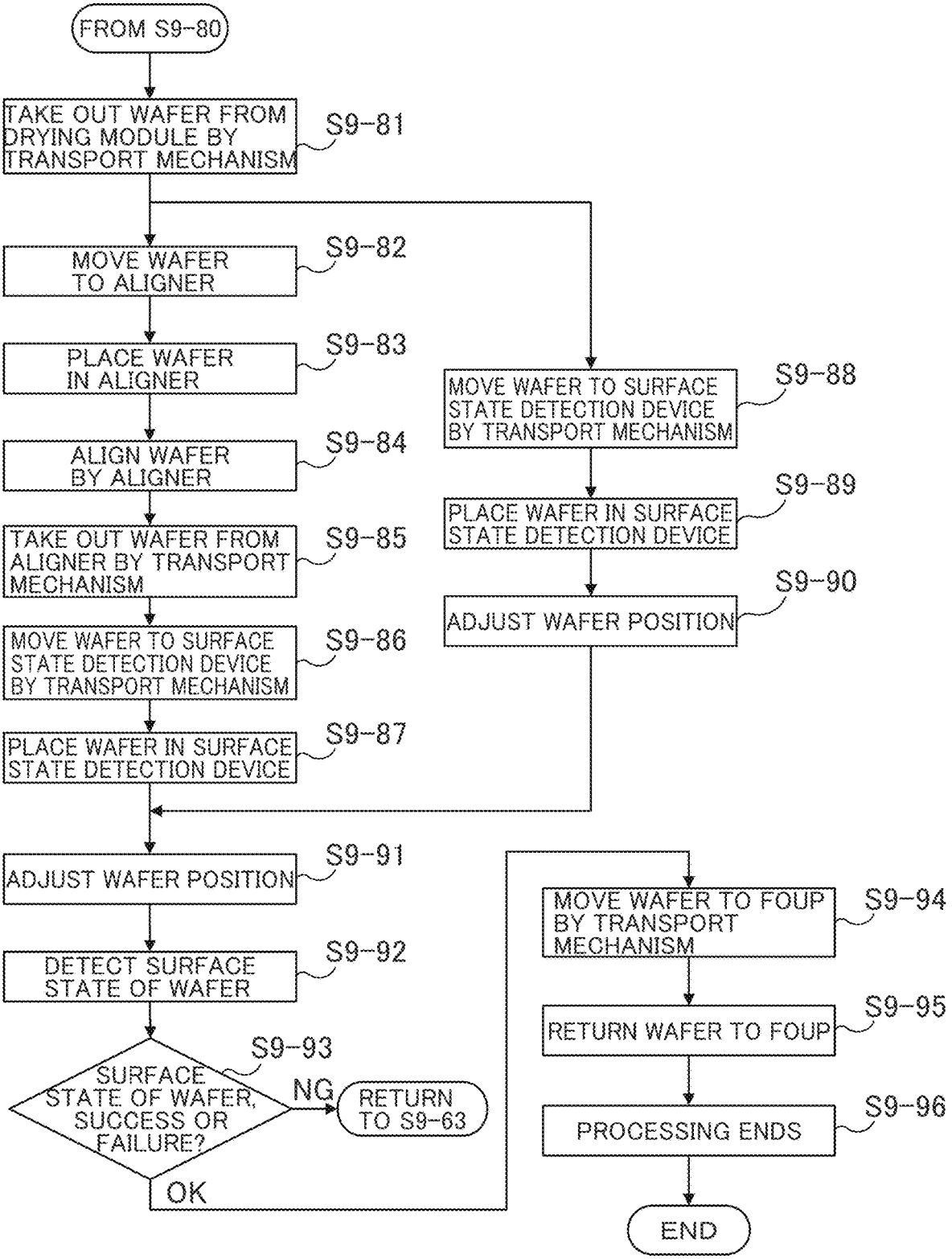
FIG. 24F is a flowchart showing the flow of polishing process according to the example 9, using the polishing machine according to one embodiment.
Figure 25A:
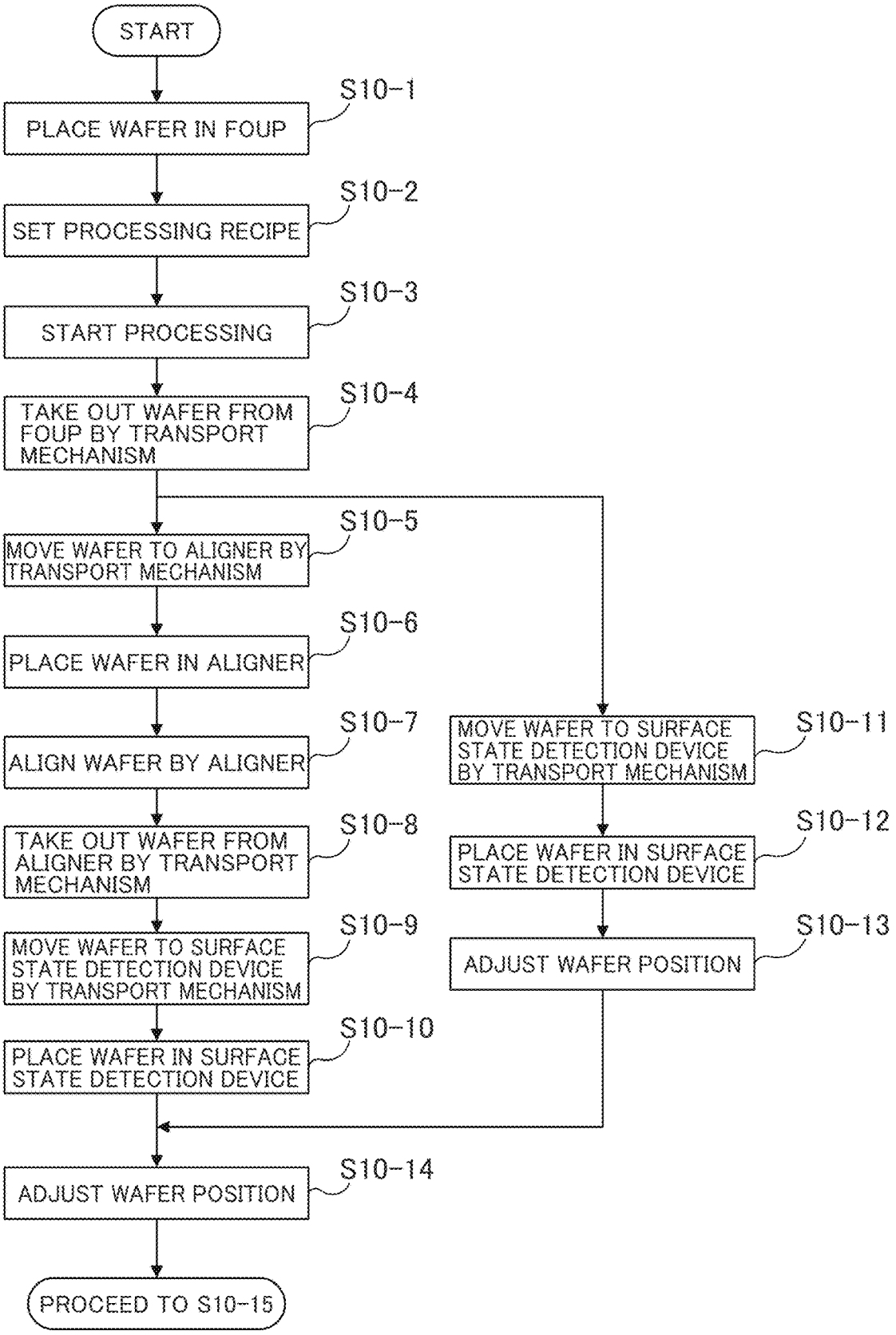
FIG. 25A is a flowchart showing a flow of polishing process according to an example 10, using a polishing machine according to one embodiment.
Figure 25B:
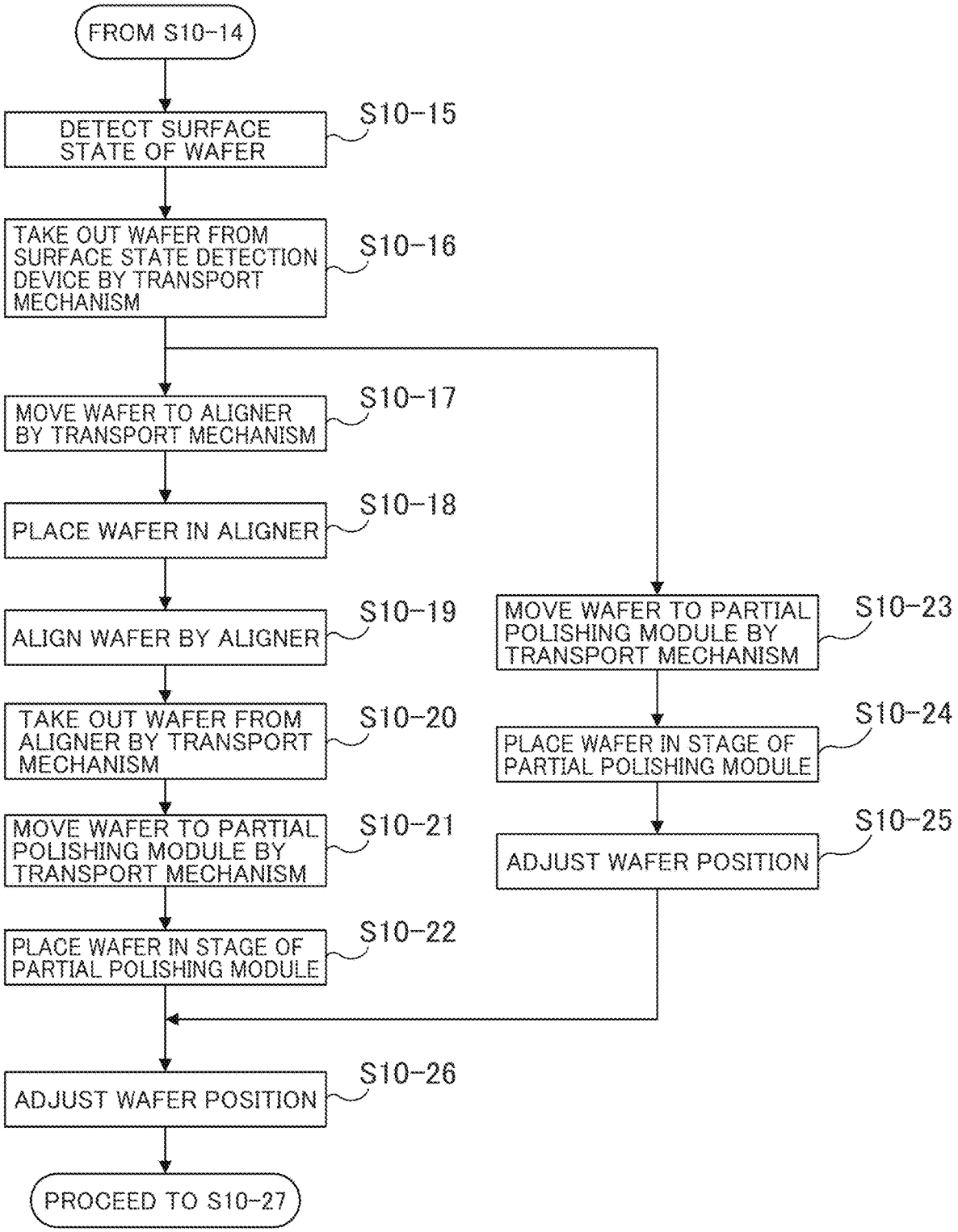
FIG. 25B is a flowchart showing the flow of polishing machine according to one embodiment.
Figure 25C:
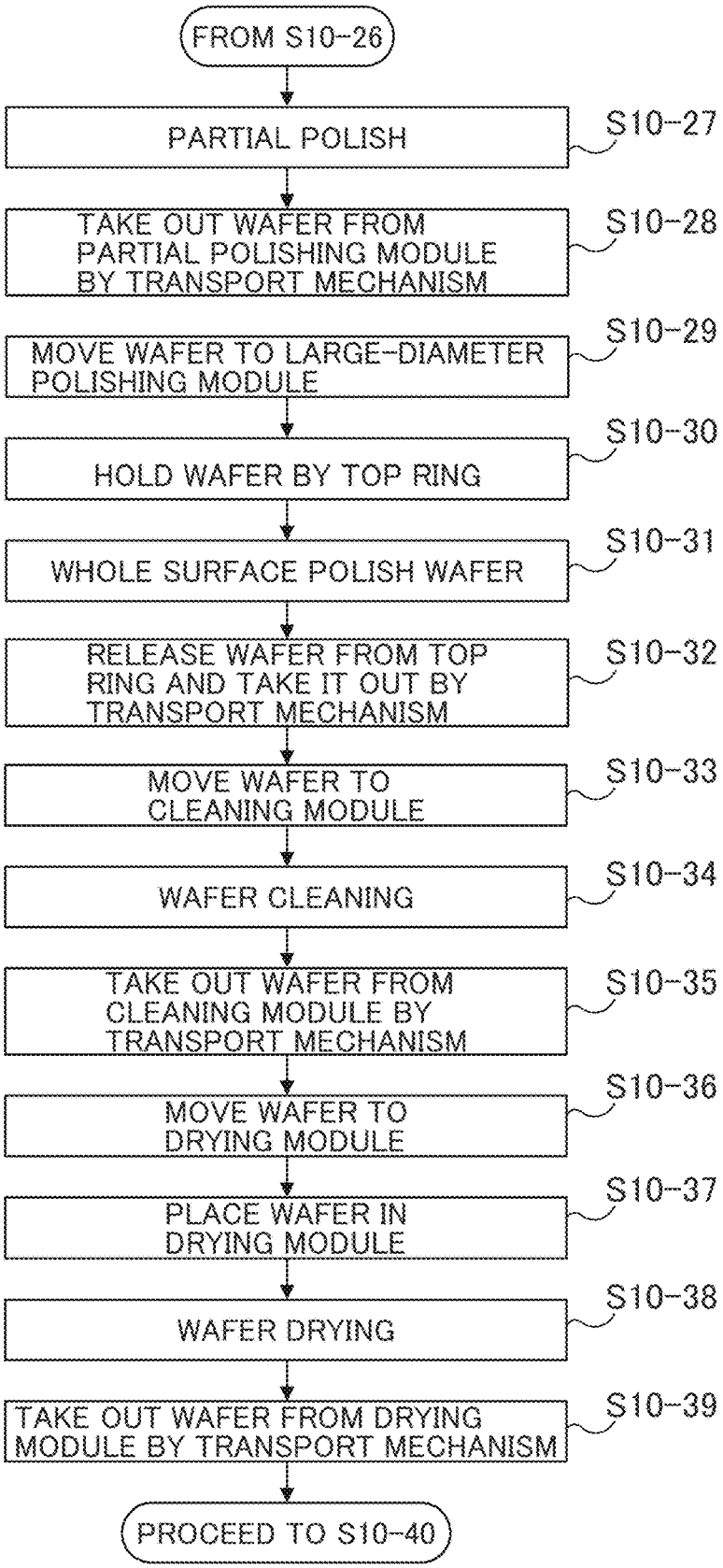
FIG. 25C is a flowchart showing the flow of polishing process according to the example 10, using the polishing machine according to one embodiment.
Figure 25D:
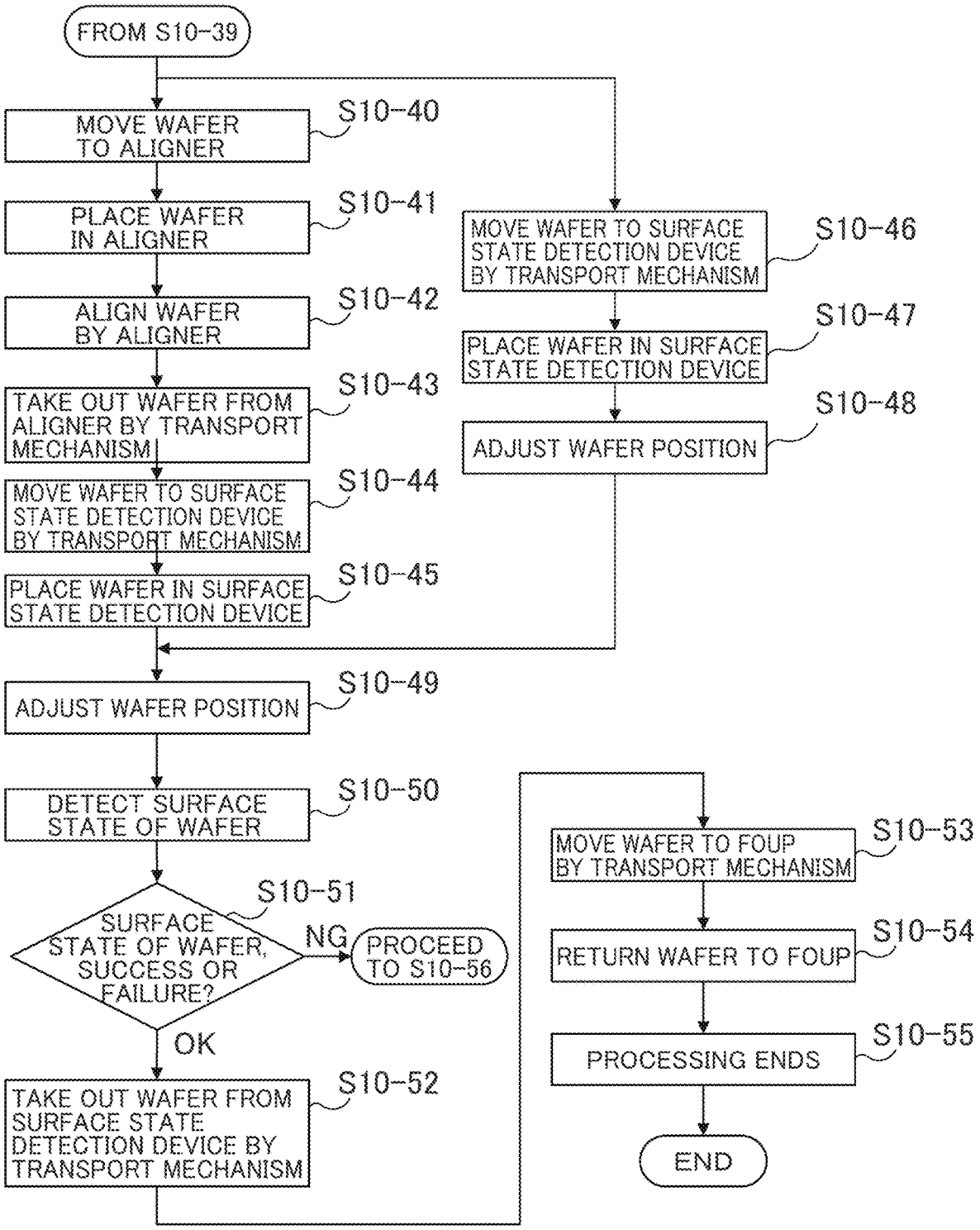
FIG. 25D is a flowchart showing the flow of polishing process according to the example 10, using the polishing machine according to one embodiment.
Figure 25E:
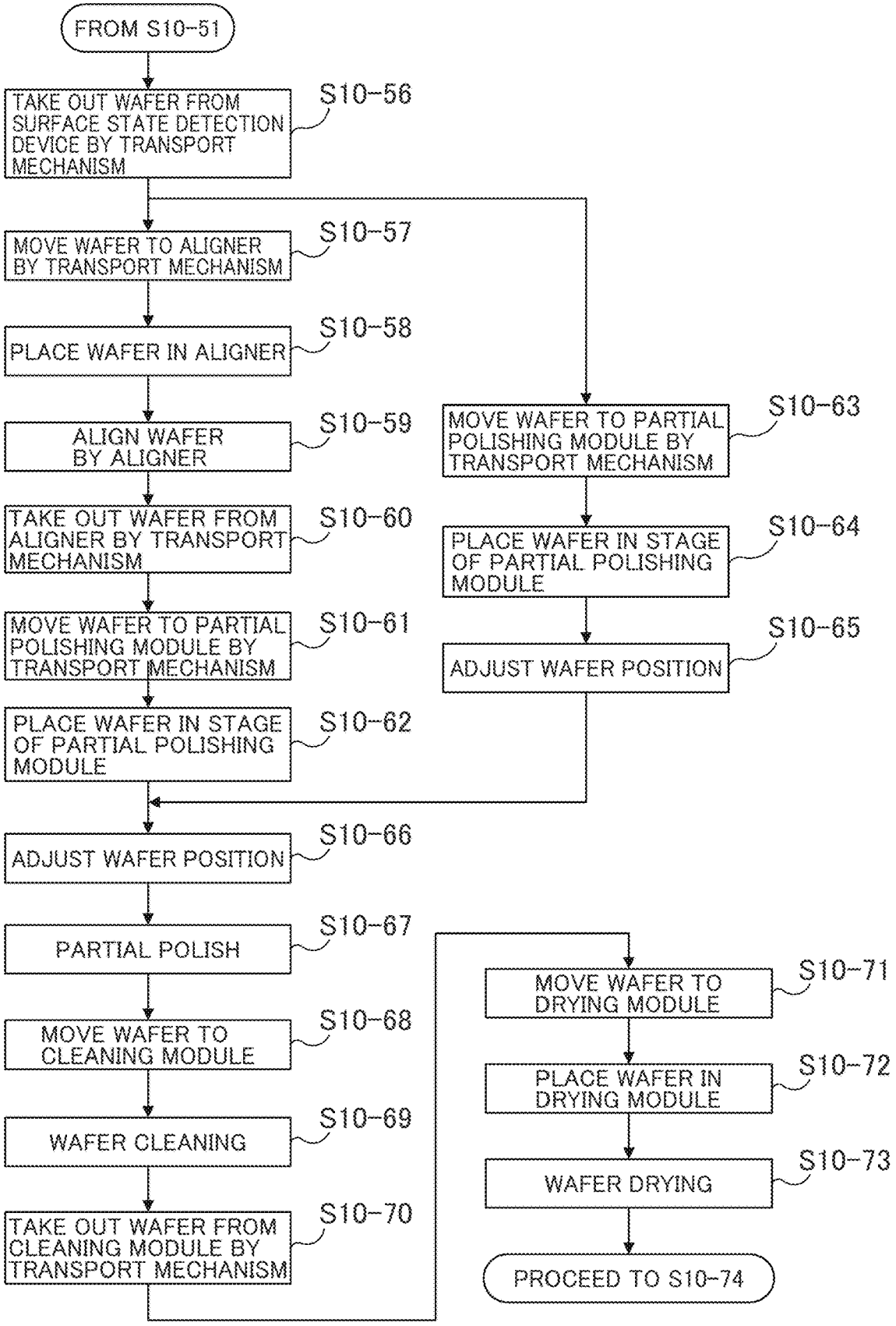
FIG. 25E is a flowchart showing the flow of polishing process according to the example 10, using the polishing machine according to one embodiment.
Figure 25F:
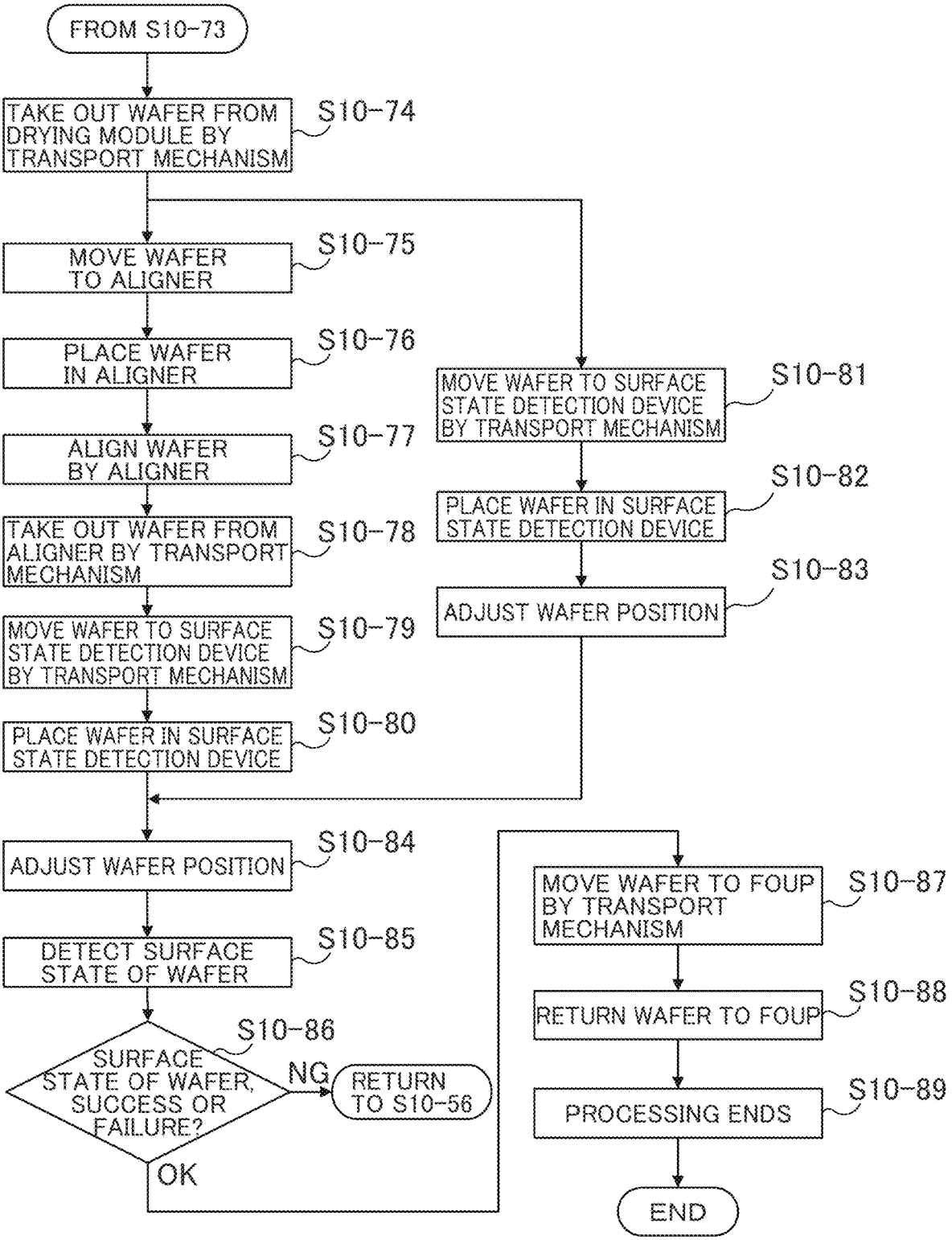
FIG. 25F is a flowchart showing the flow of polishing process according to the example 10, using the polishing machine according to one embodiment.
Figure 26A:
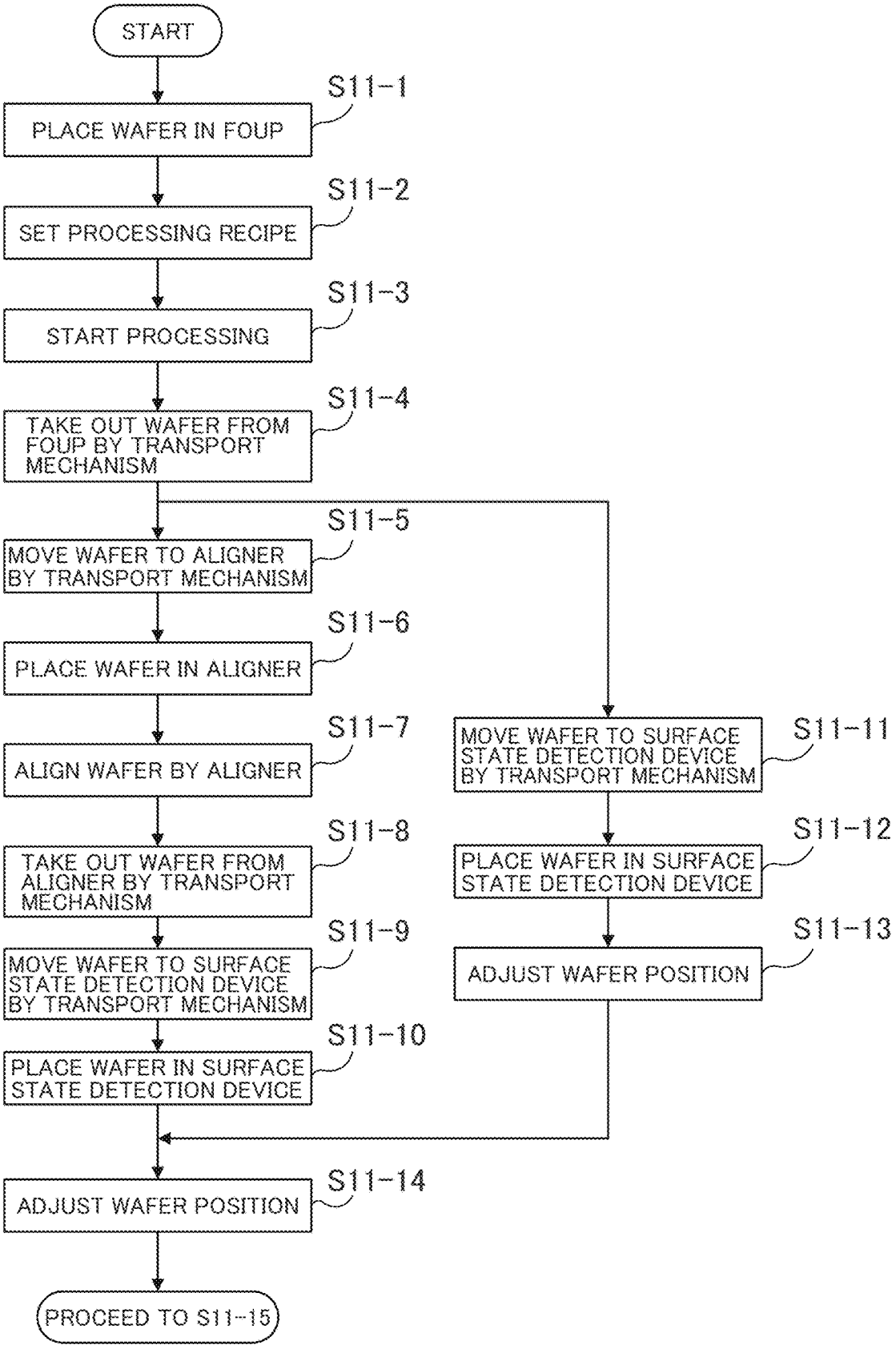
FIG. 26A is a flowchart showing a flow of polishing process according to an example 11, using a polishing machine according to one embodiment.
Figure 26B:
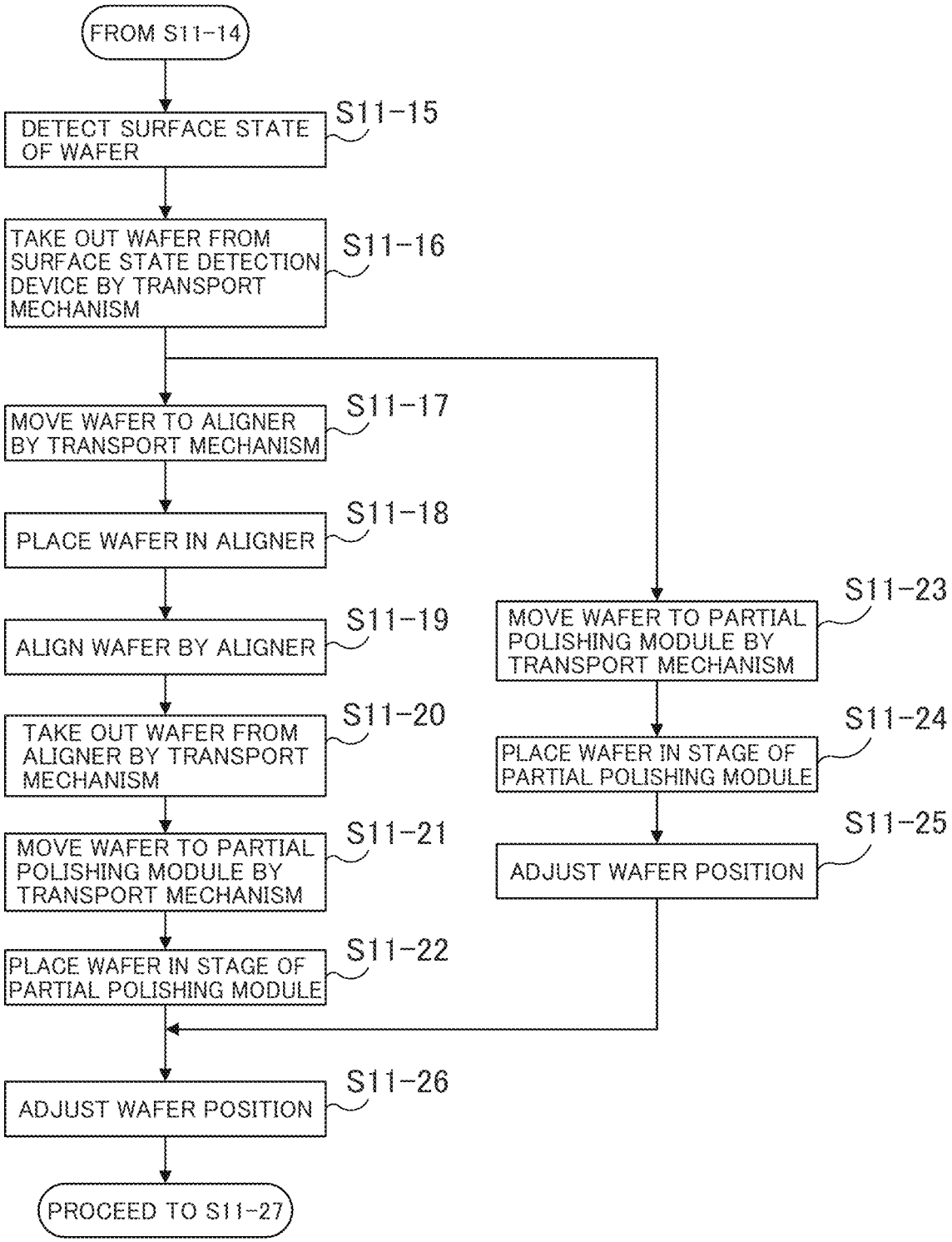
FIG. 26B is a flowchart showing the flow of polishing process according to the example 11, using the polishing machine according to one embodiment.
Figure 26C:
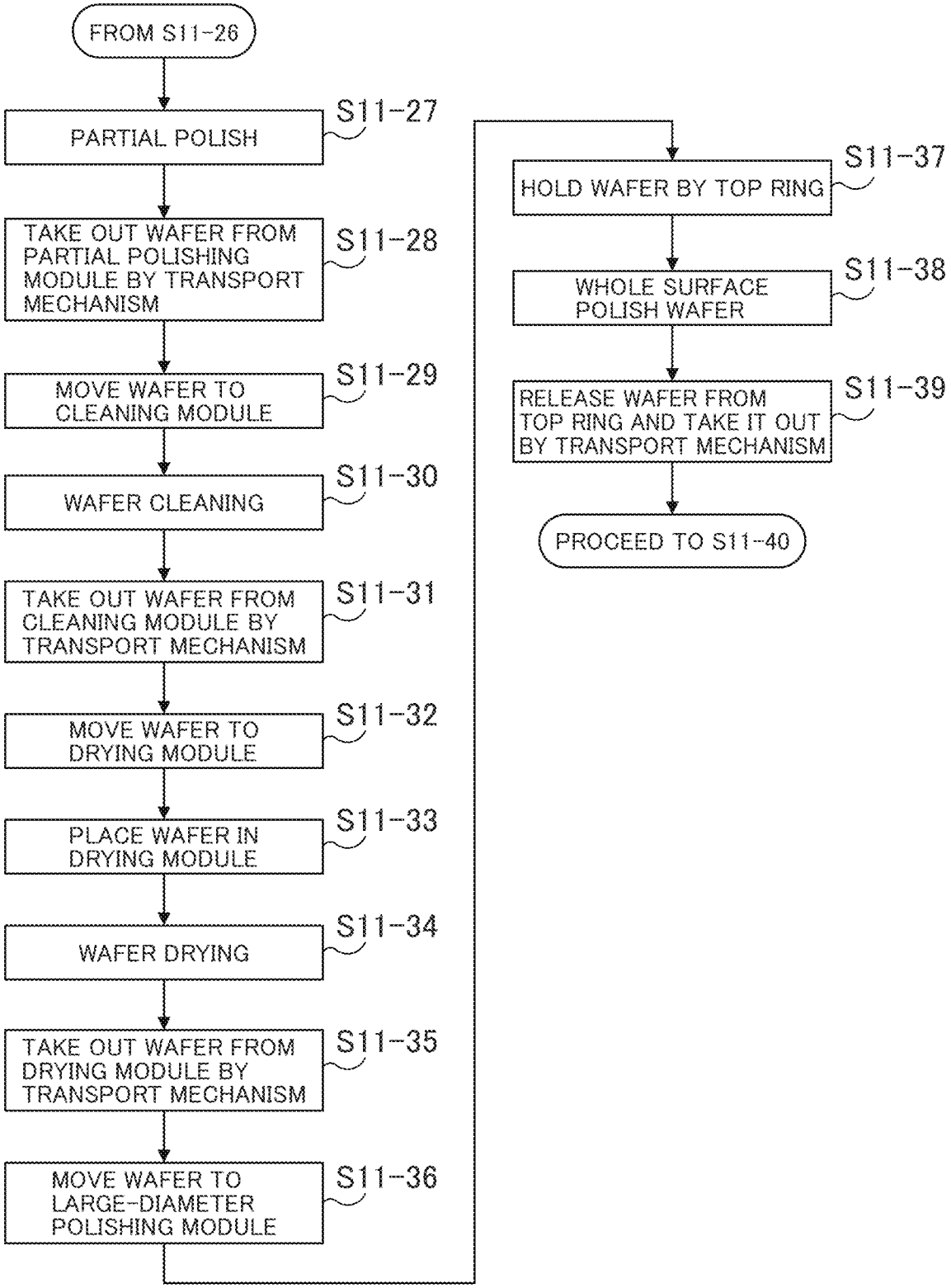
FIG. 26C is a flowchart showing the flow of polishing process according to the example 11, using the polishing machine according to one embodiment.
Figure 26D:
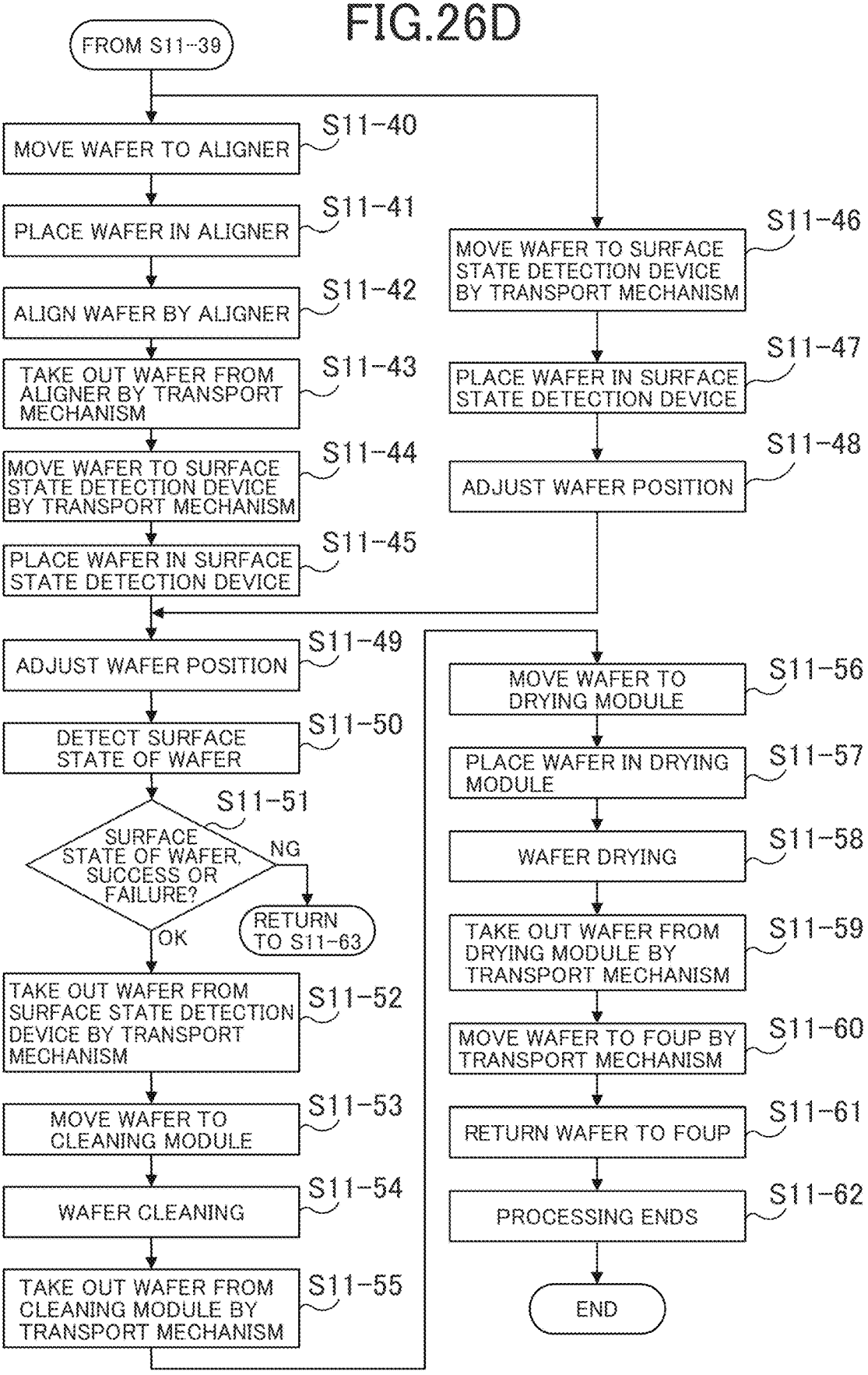
FIG. 26D is flowchart showing the flow of polishing process according to the example 11, using the polishing machine according to one embodiment.
Figure 26E:
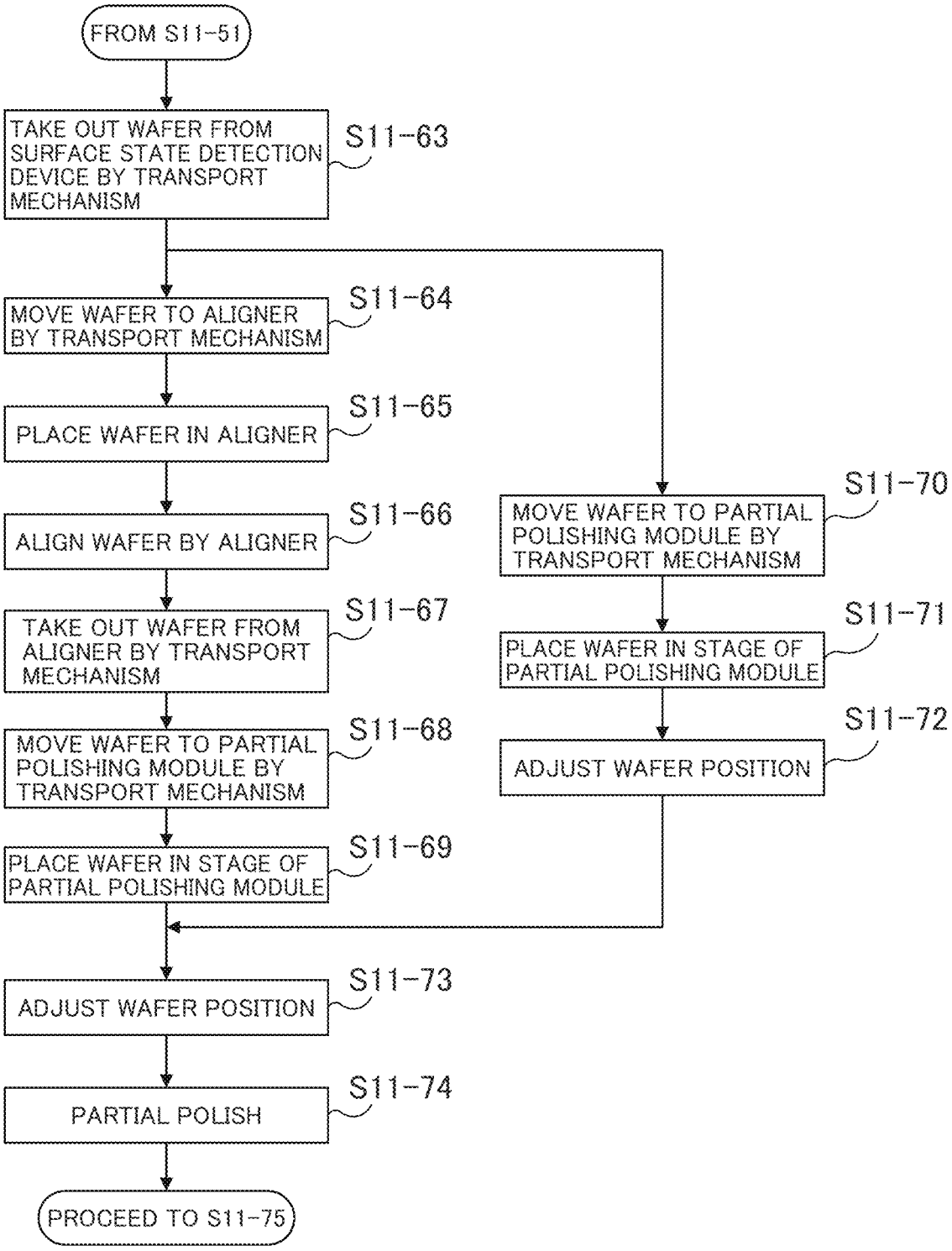
FIG. 26E is a flowchart showing the flow of polishing process according to the example 11, using the polishing machine according to one embodiment.
Figure 26F:
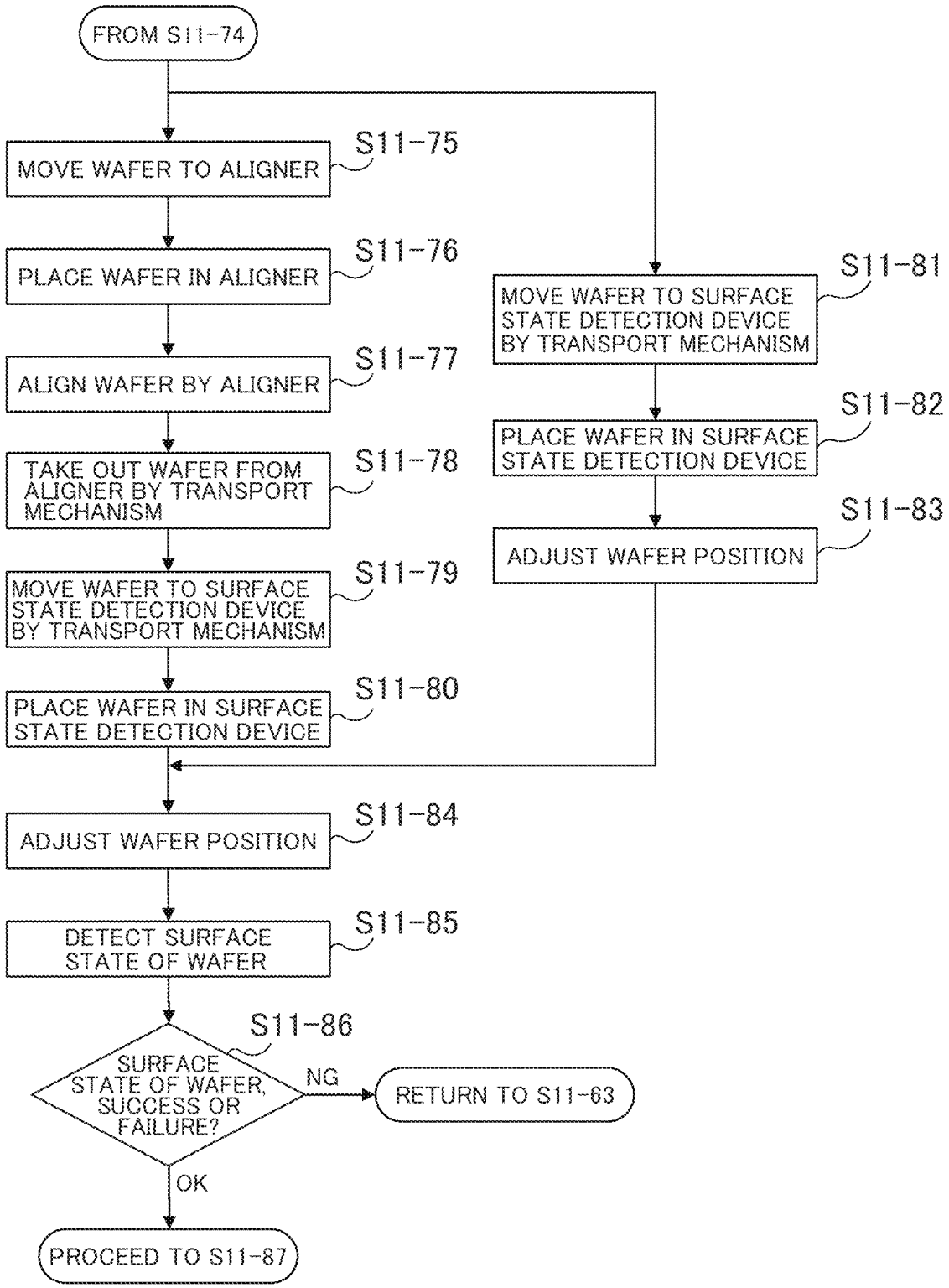
FIG. 26F is a flowchart showing the flow of polishing process according to the example 11, using the polishing machine according to one embodiment.
Figure 26G:
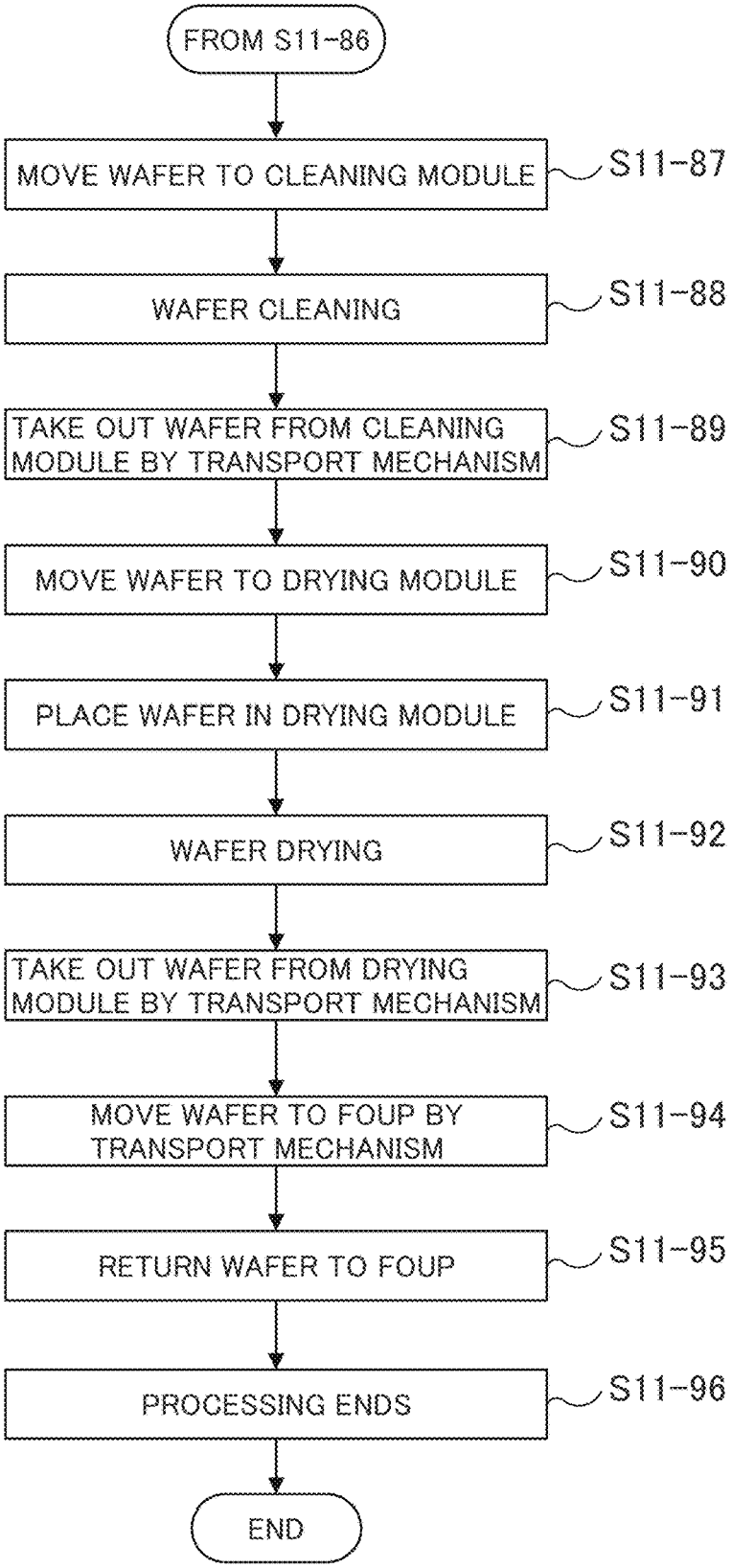
FIG. 26G is a flowchart showing the flow of polishing process according to the example 11, using the polishing machine according to one embodiment.
Figure 27A:
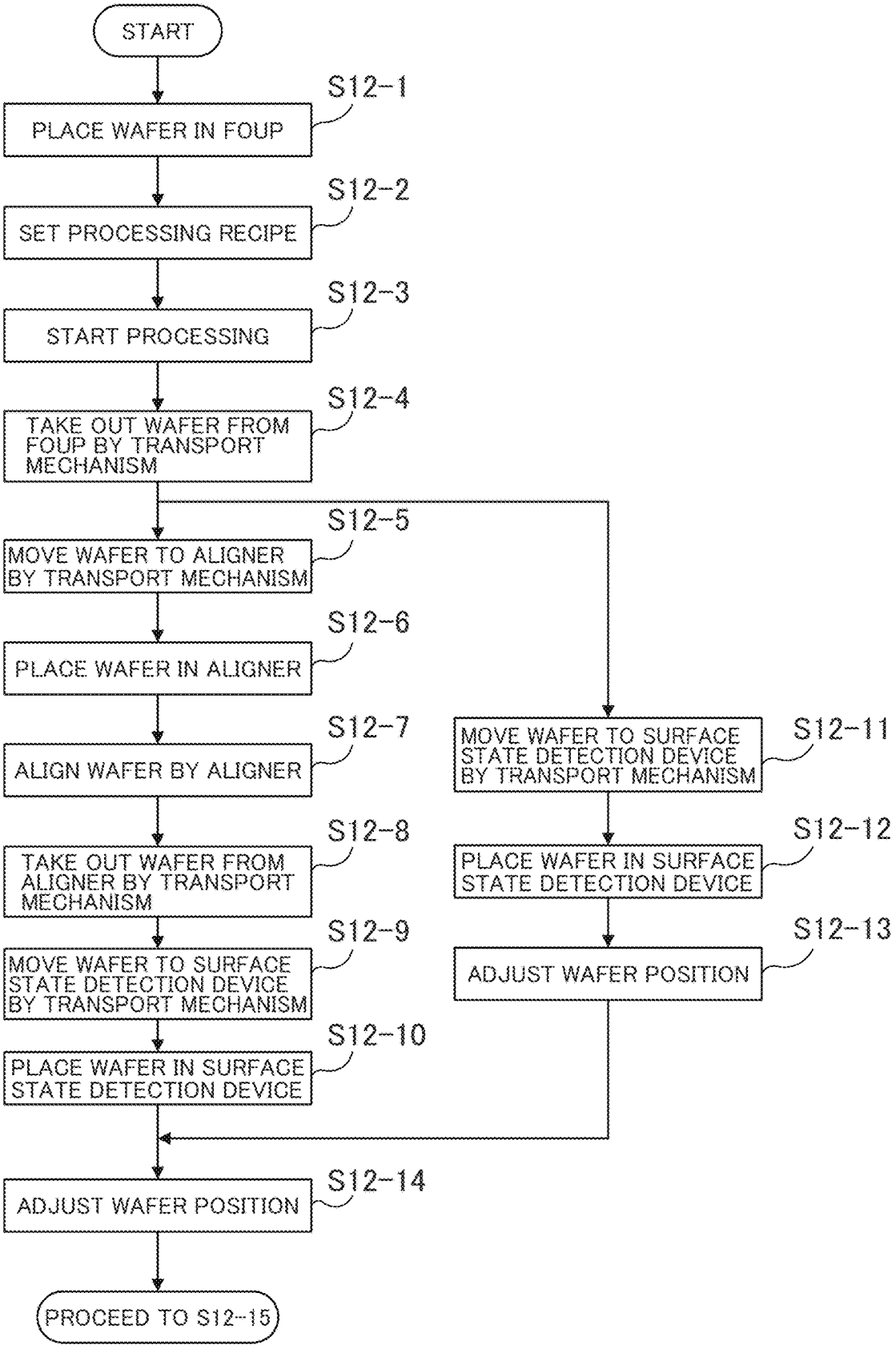
FIG. 27A is a flowchart showing a flow of polishing process according to an example 12, using a polishing machine according to one embodiment.
Figure 27B:
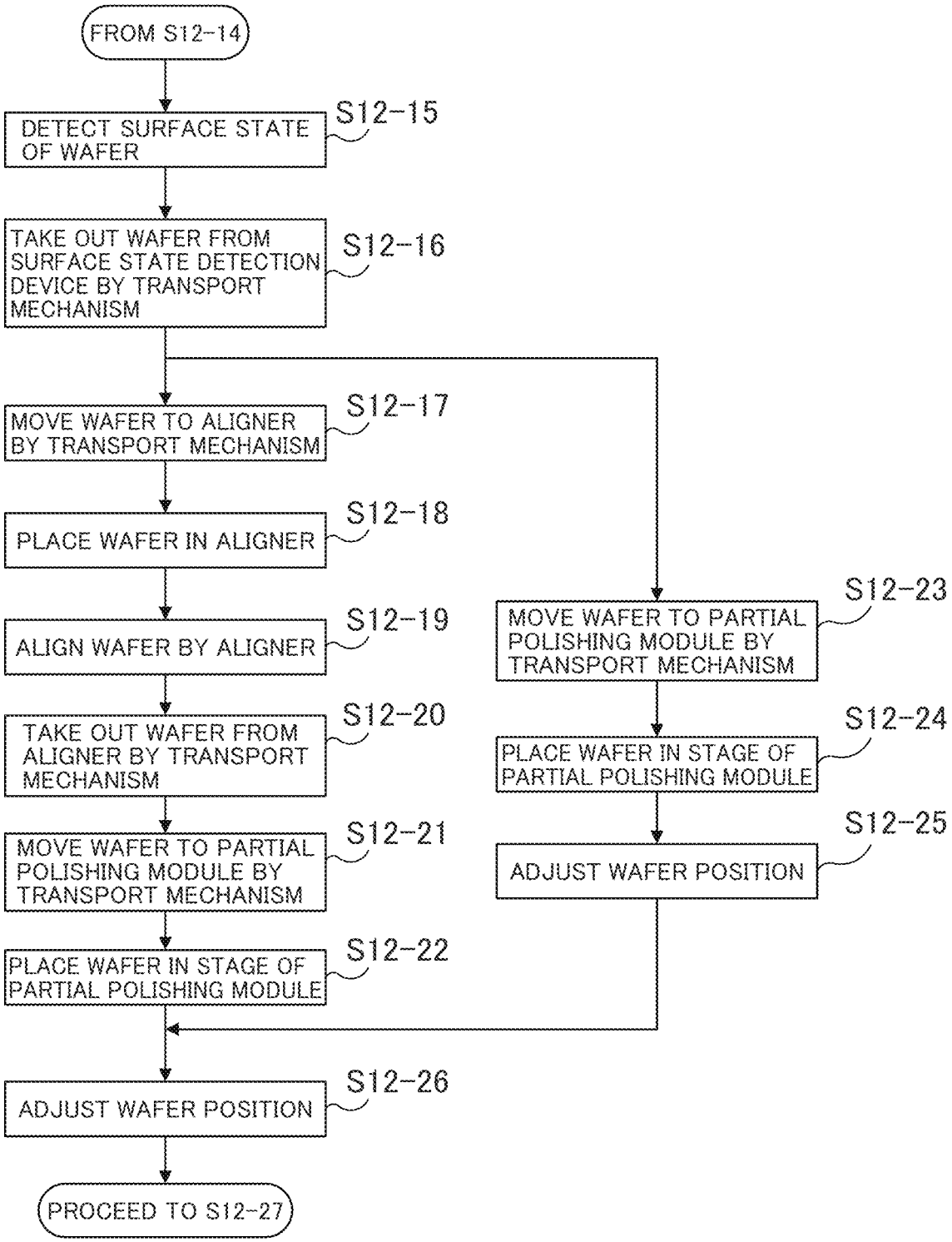
FIG. 27B is a flowchart showing the flow of polishing process according to the example 12, using the polishing machine according to one embodiment.
Figure 27C:
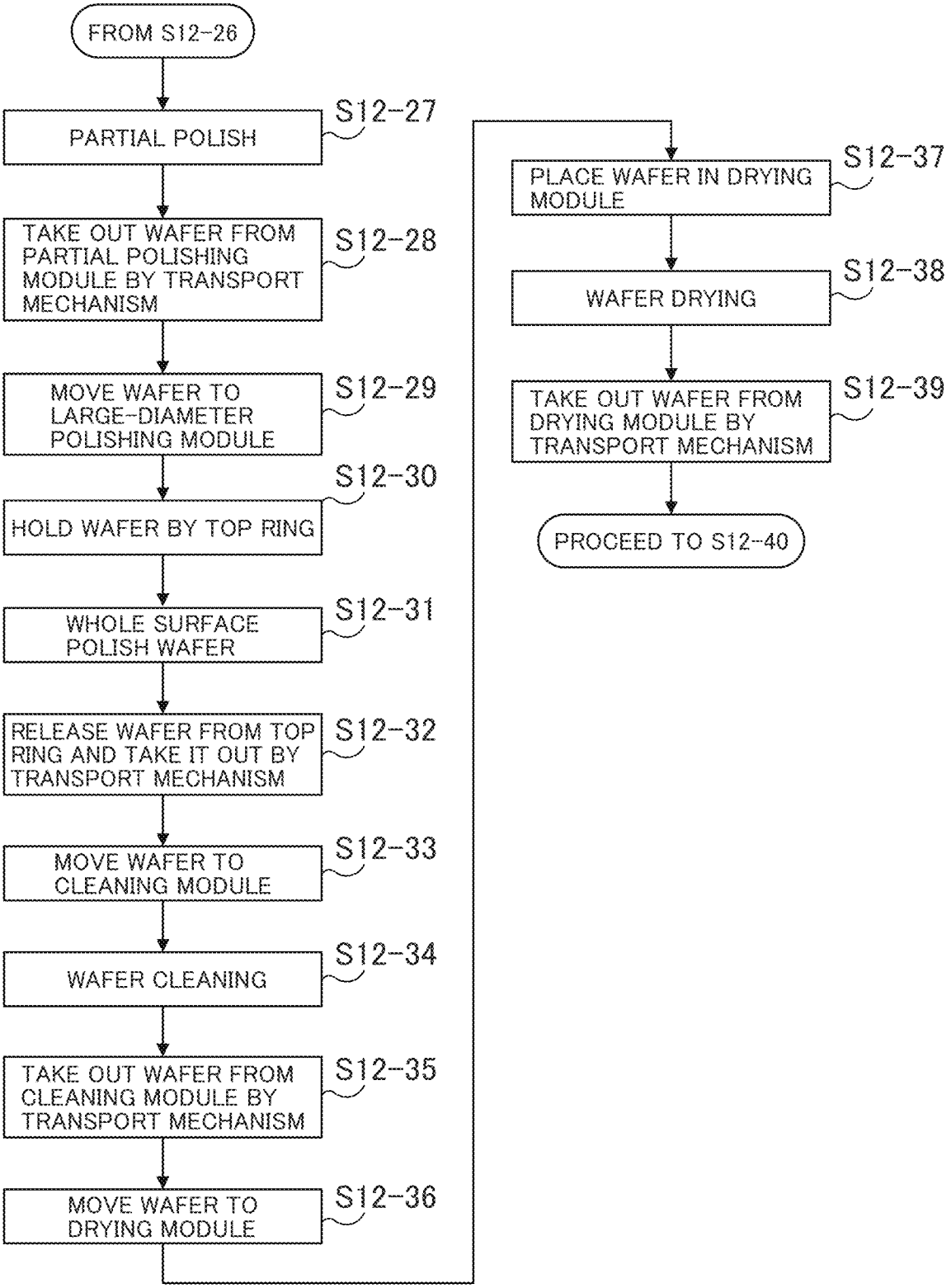
FIG. 27C is a flowchart showing the flow of polishing process according to the example 12, using the polishing machine according to one embodiment.
Figure 27D:
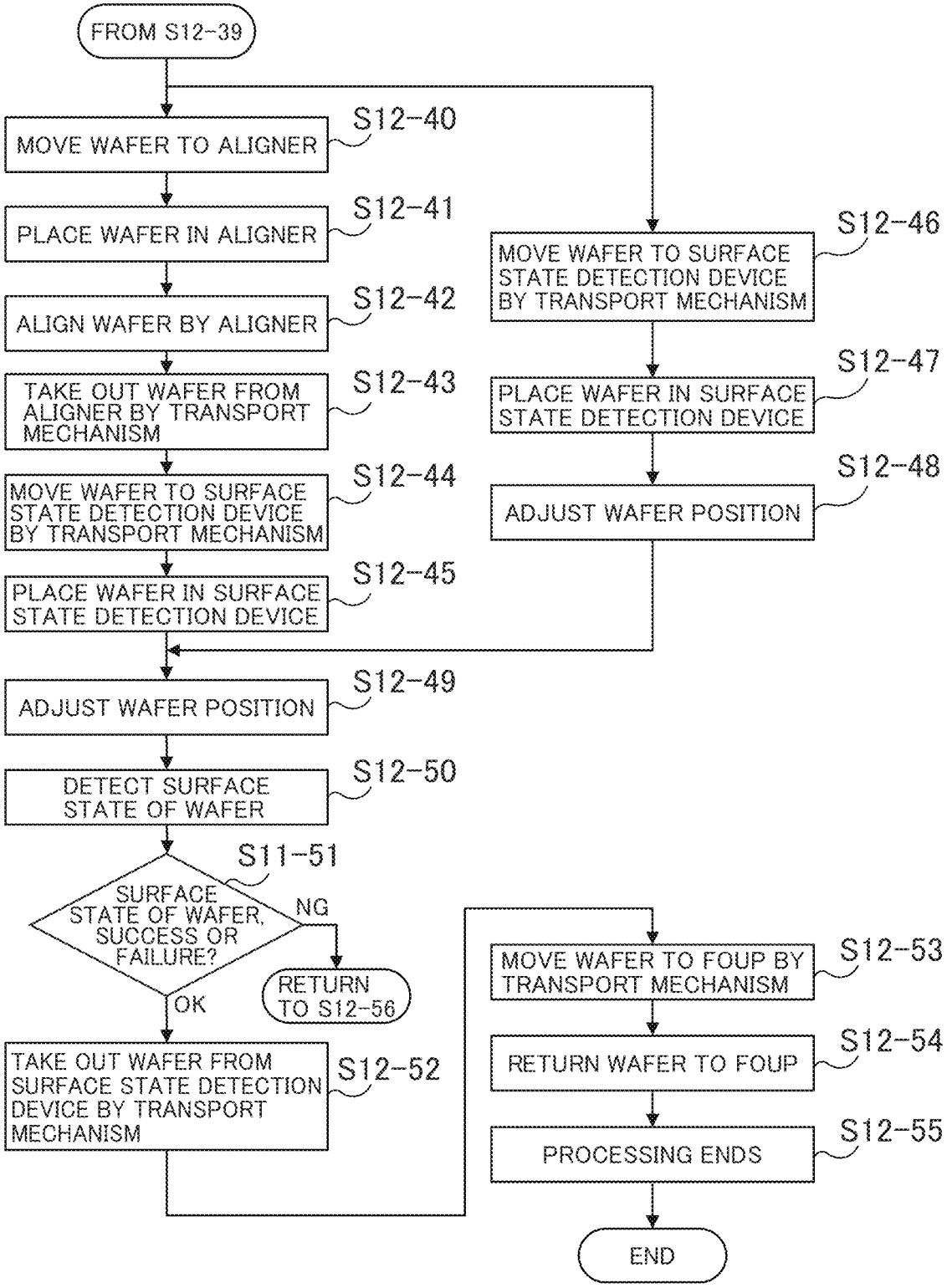
FIG. 27D is a flowchart showing the flow of polishing process according to the example 12, using the polishing machine according to one embodiment.
Figure 27E:
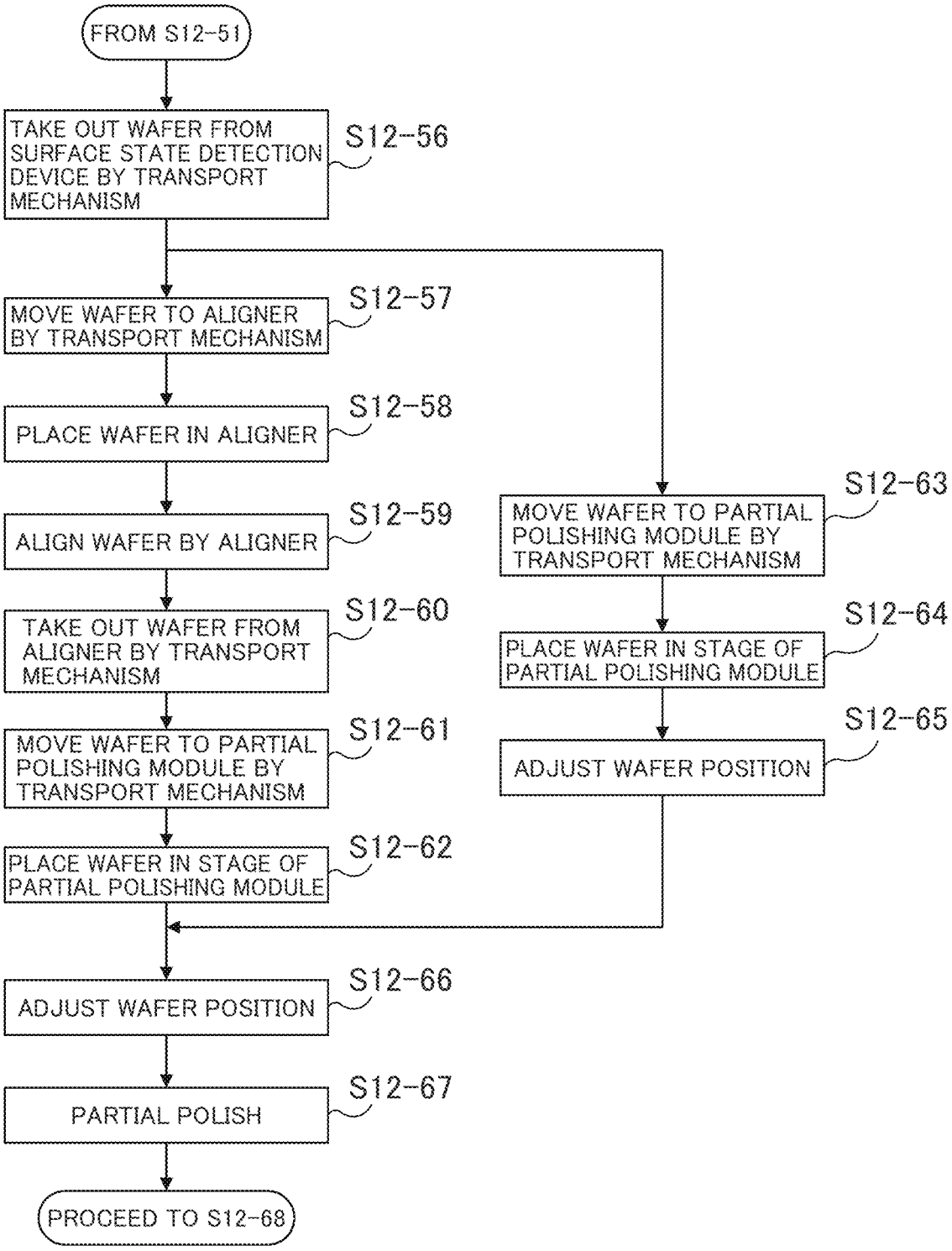
FIG. 27E is a flowchart showing the flow of polishing process according to an example 12, using the polishing machine according to one embodiment.
Figure 27F:
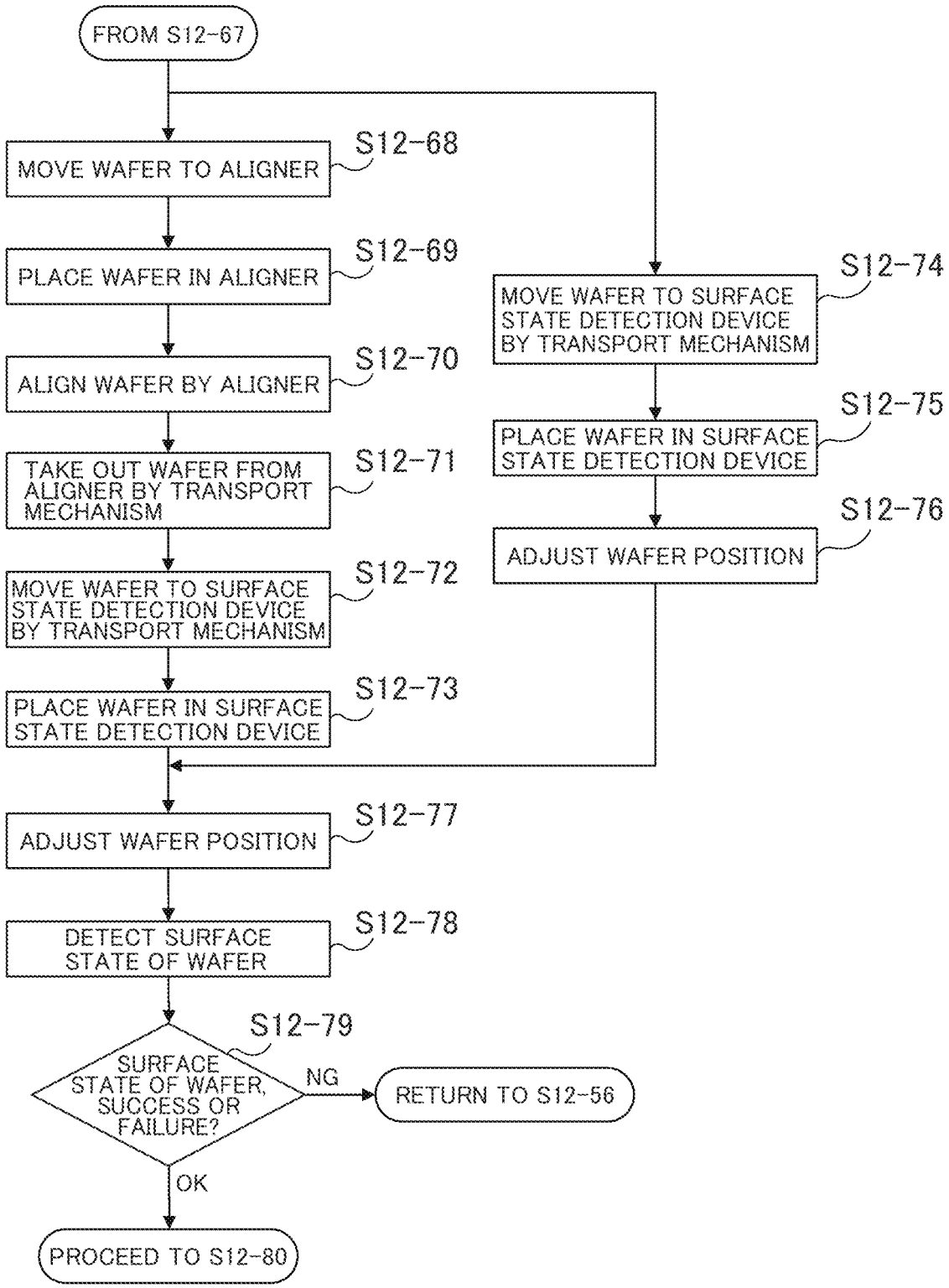
FIG. 27F is a flowchart showing the flow of polishing process according to the example 12, using the polishing machine according to one embodiment.
Figure 27G:
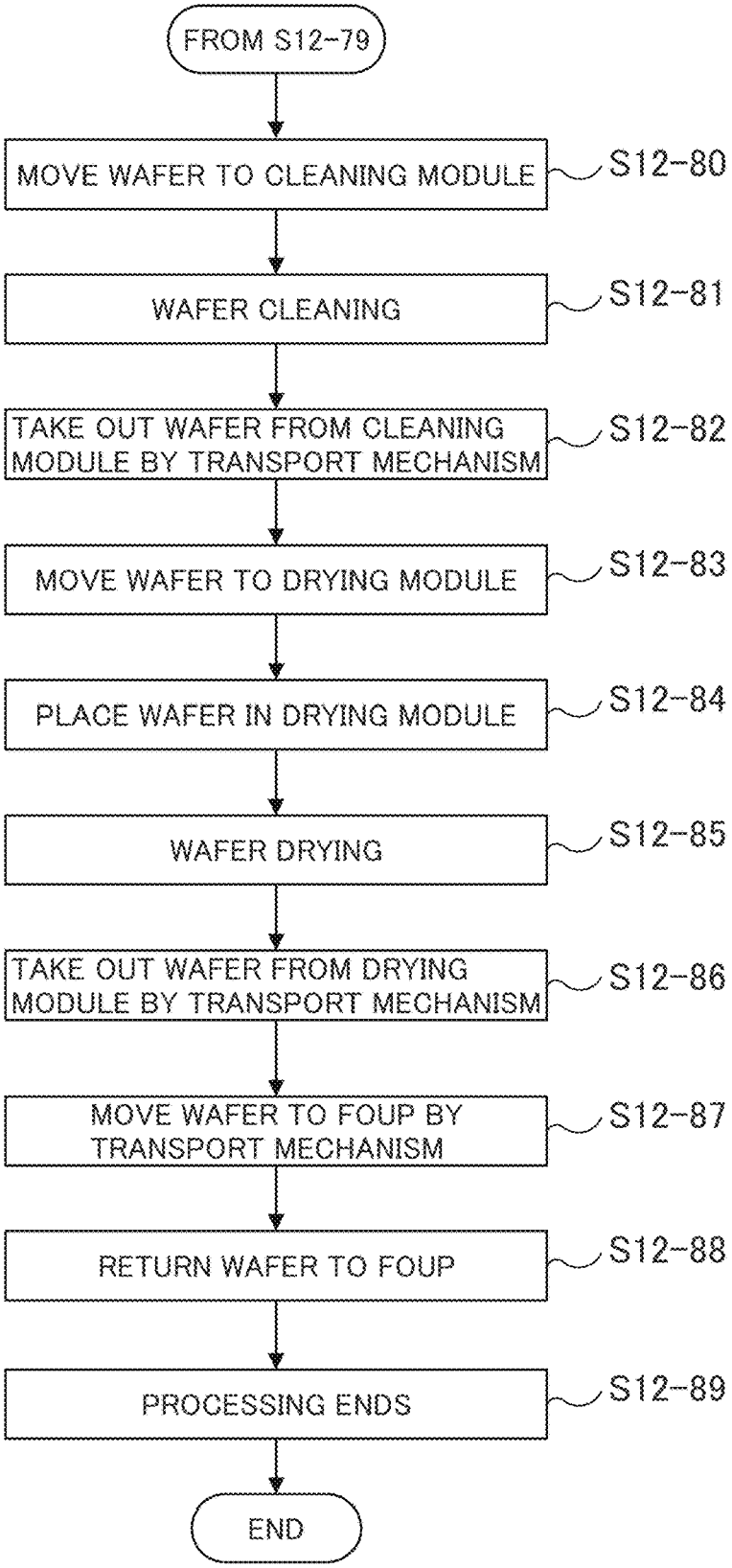
FIG. 27G is a flowchart showing the flow of polishing process according to the example 12, using the polishing machine according to one embodiment.
Figure 28A:
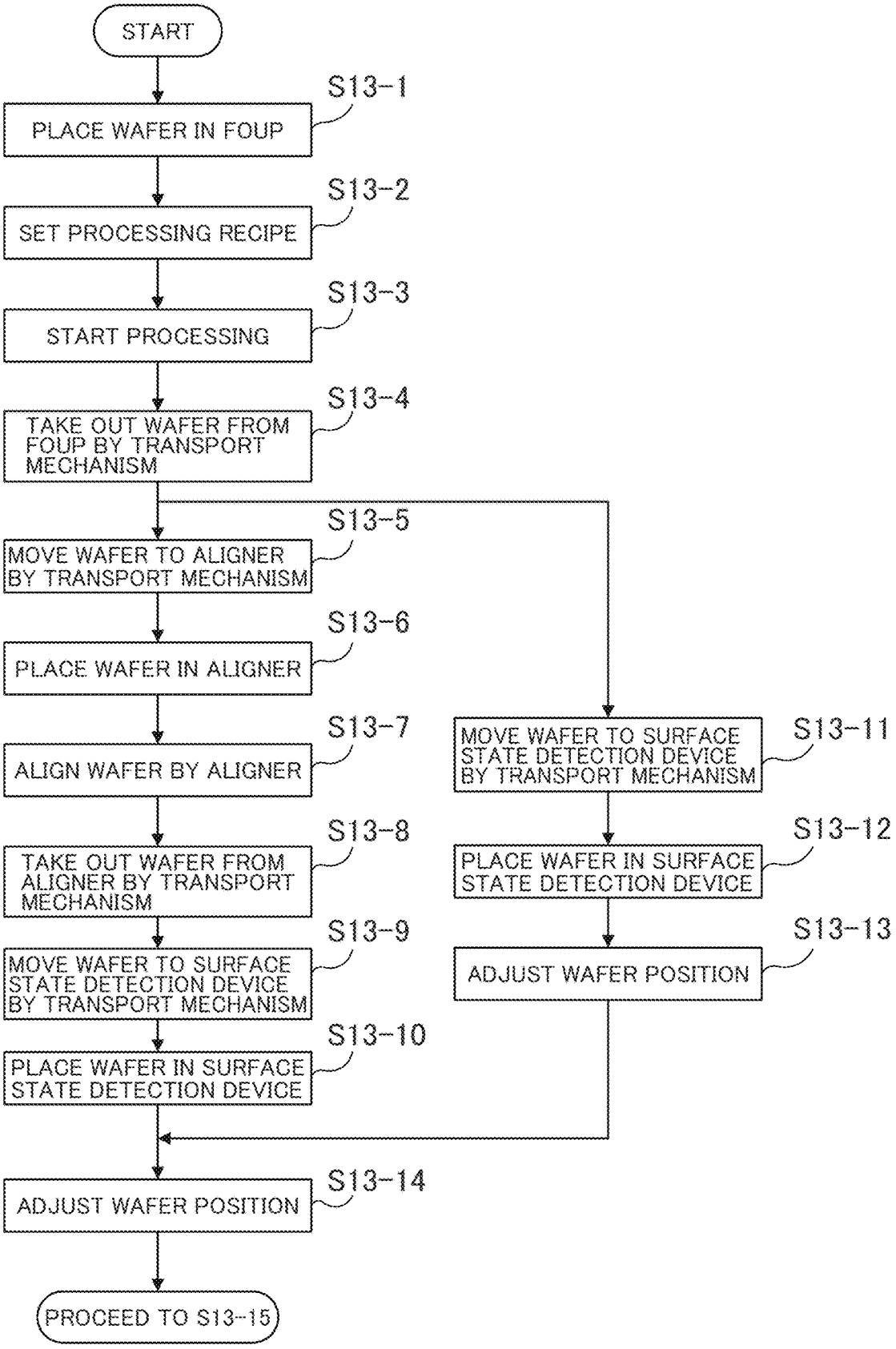
FIG. 28A is a flowchart showing a flow of polishing process according to an example 13, using a polishing machine according to one embodiment.
Figure 28B:
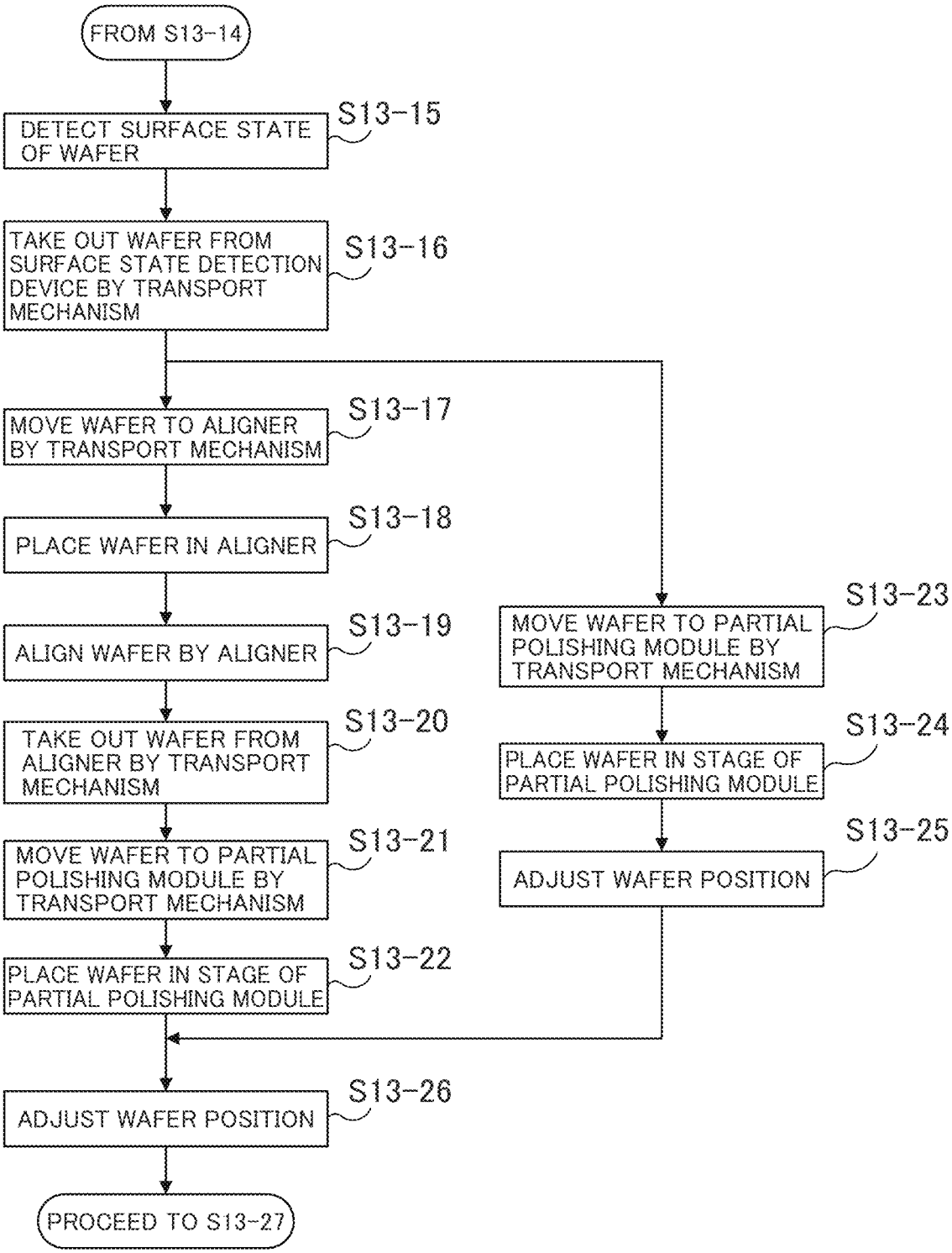
FIG. 28B is a flowchart showing the flow of polishing process according to the example 13, using the polishing machine according to one embodiment.
Figure 28C:
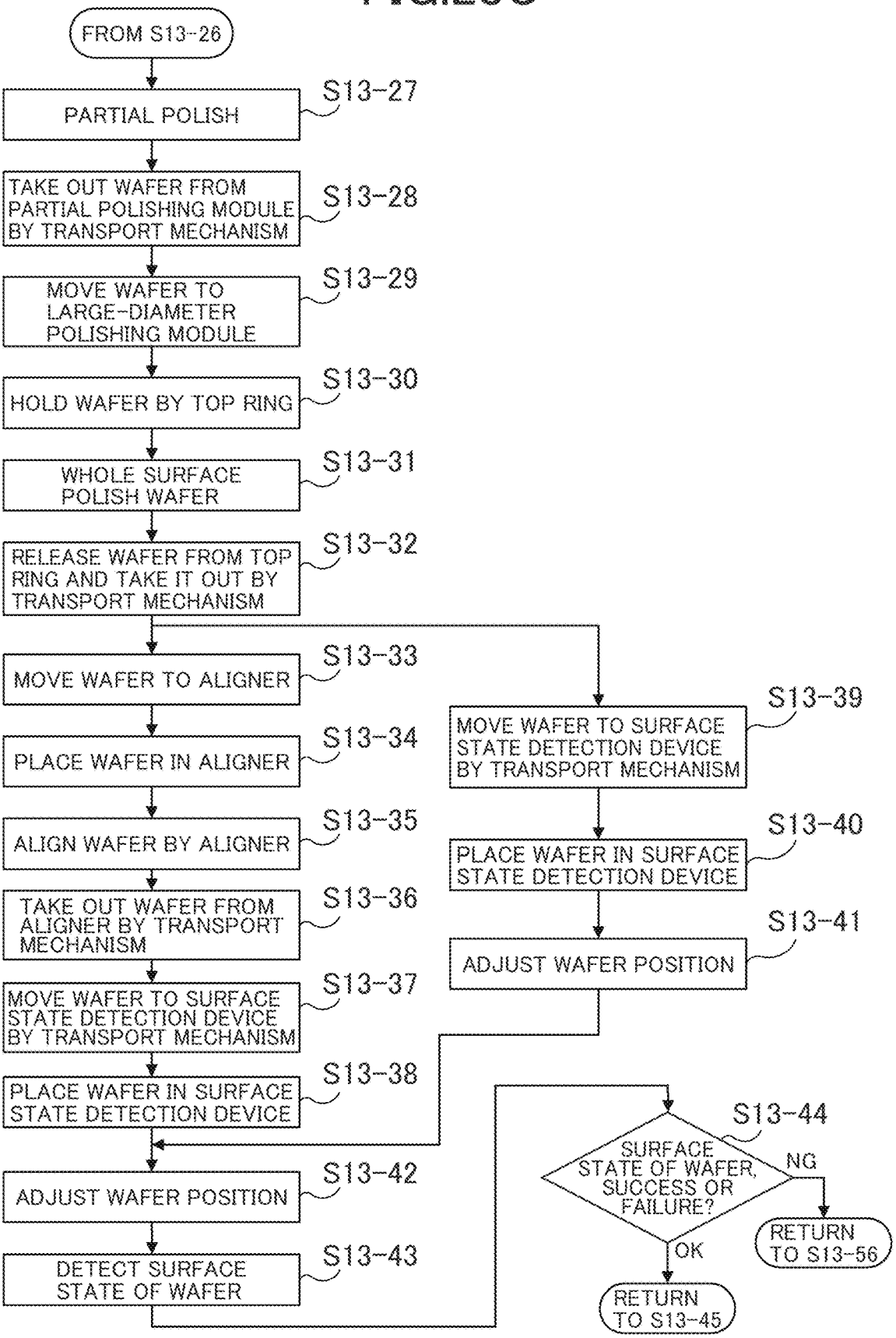
FIG. 28C is a flowchart showing the flow of polishing process according to the example 13, using the polishing machine according to one embodiment.
Figure 28D:
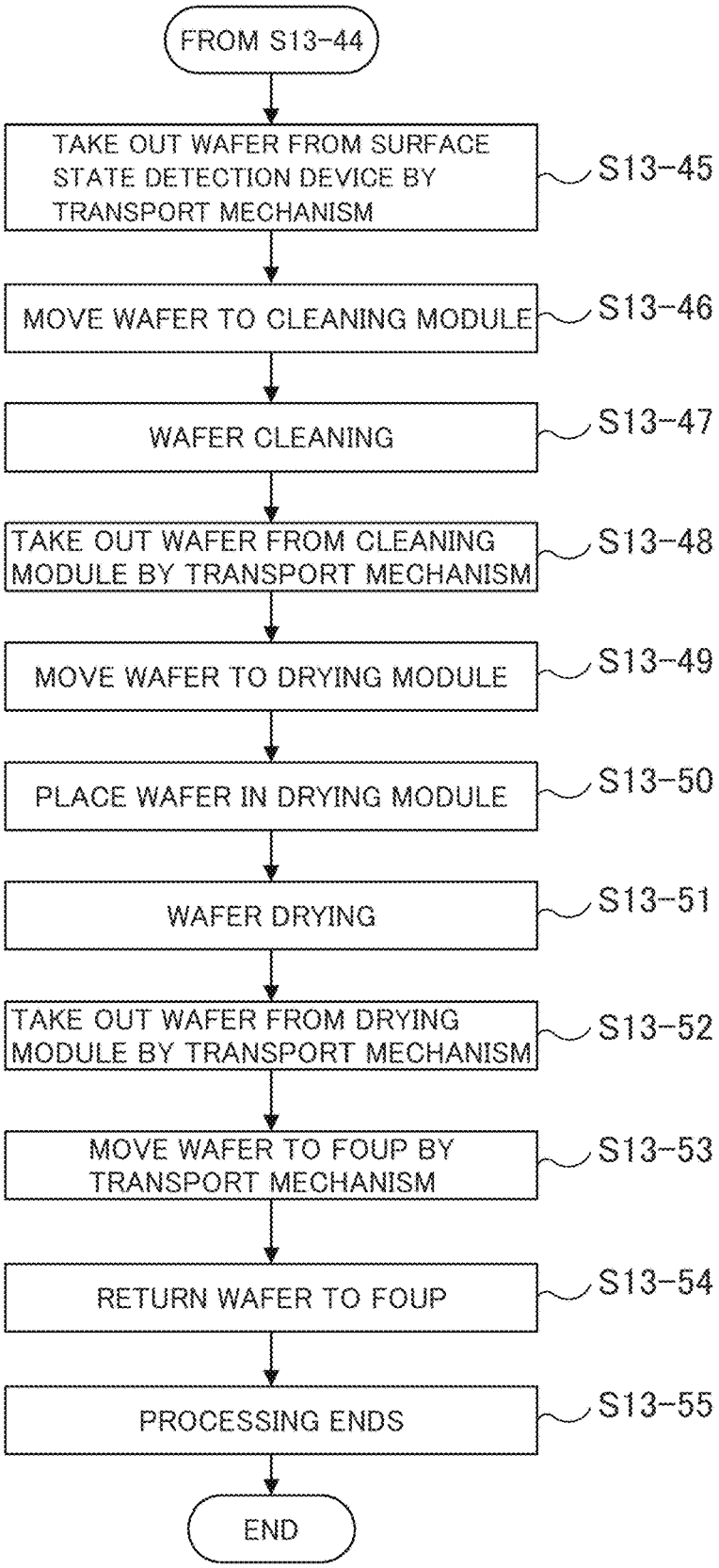
FIG. 28D is a flowchart showing the flow of polishing process according to the example 13, using the polishing machine according to one embodiment.
Figure 28E:
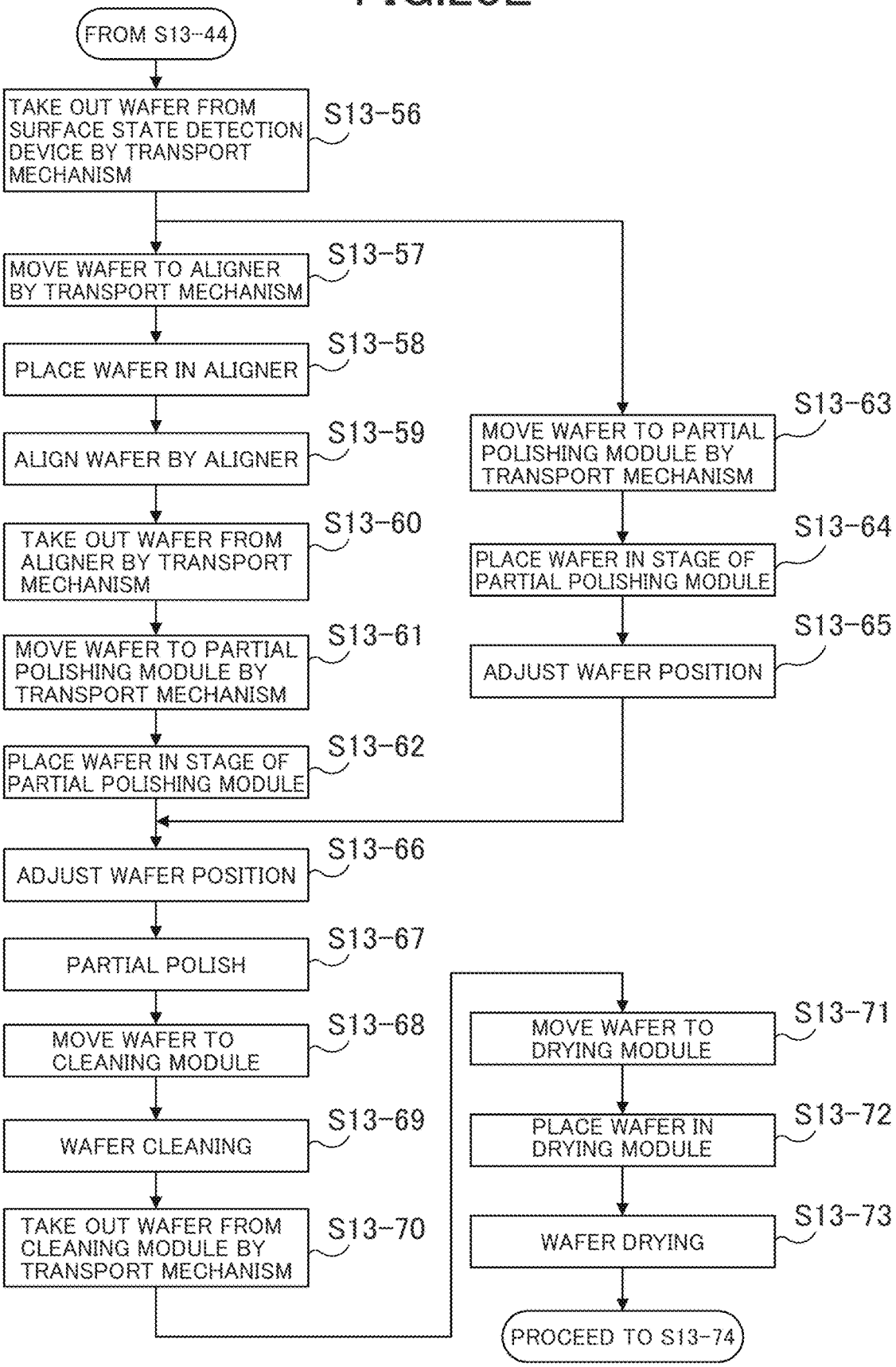
FIG. 28E is a flowchart showing the flow of polishing process according to an example 13, using the polishing machine according to one embodiment.
Figure 28F:
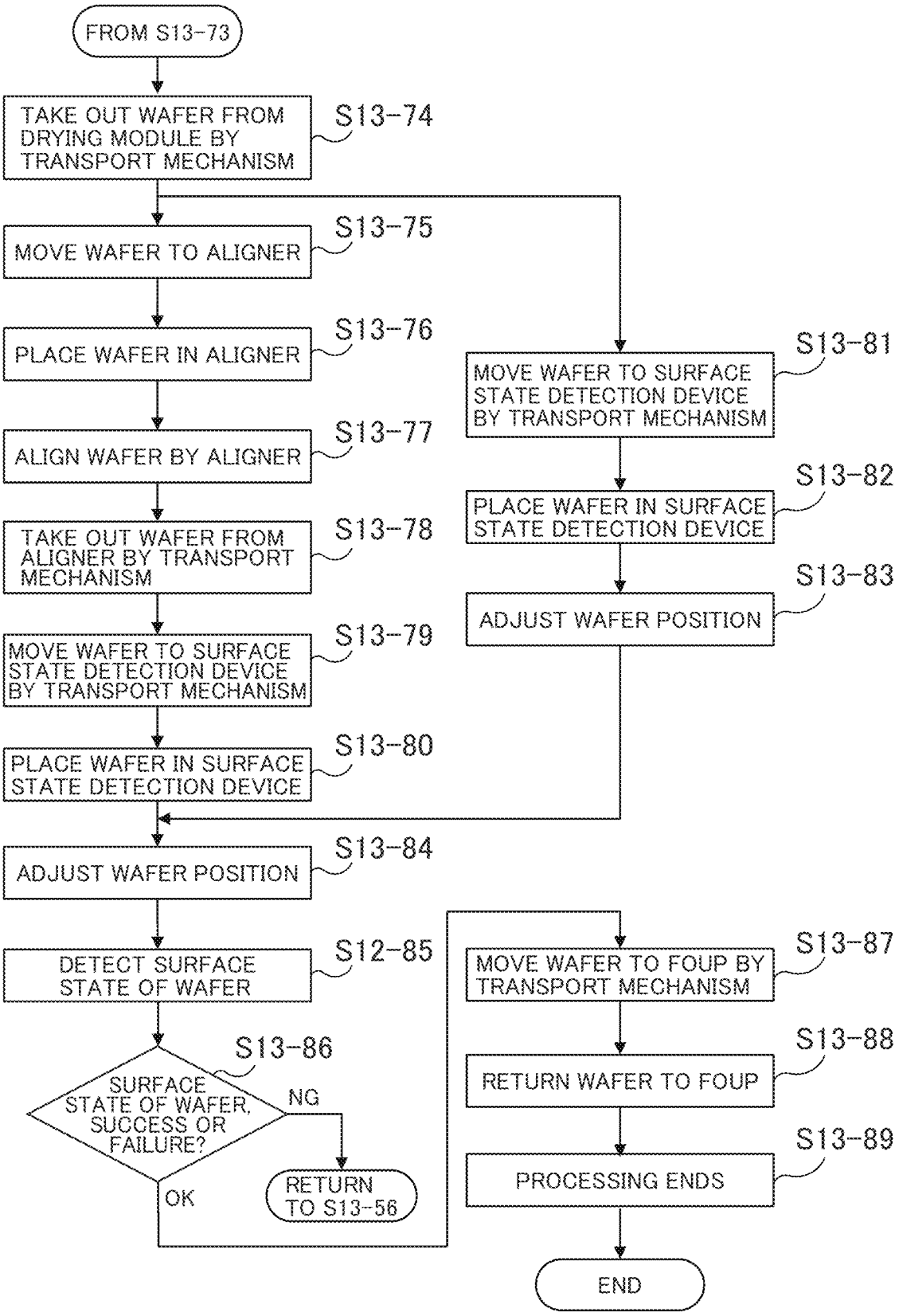
FIG. 28F is a flowchart showing the flow of polishing process according to the example 13, using the polishing machine according to one embodiment.
Figure 29A:
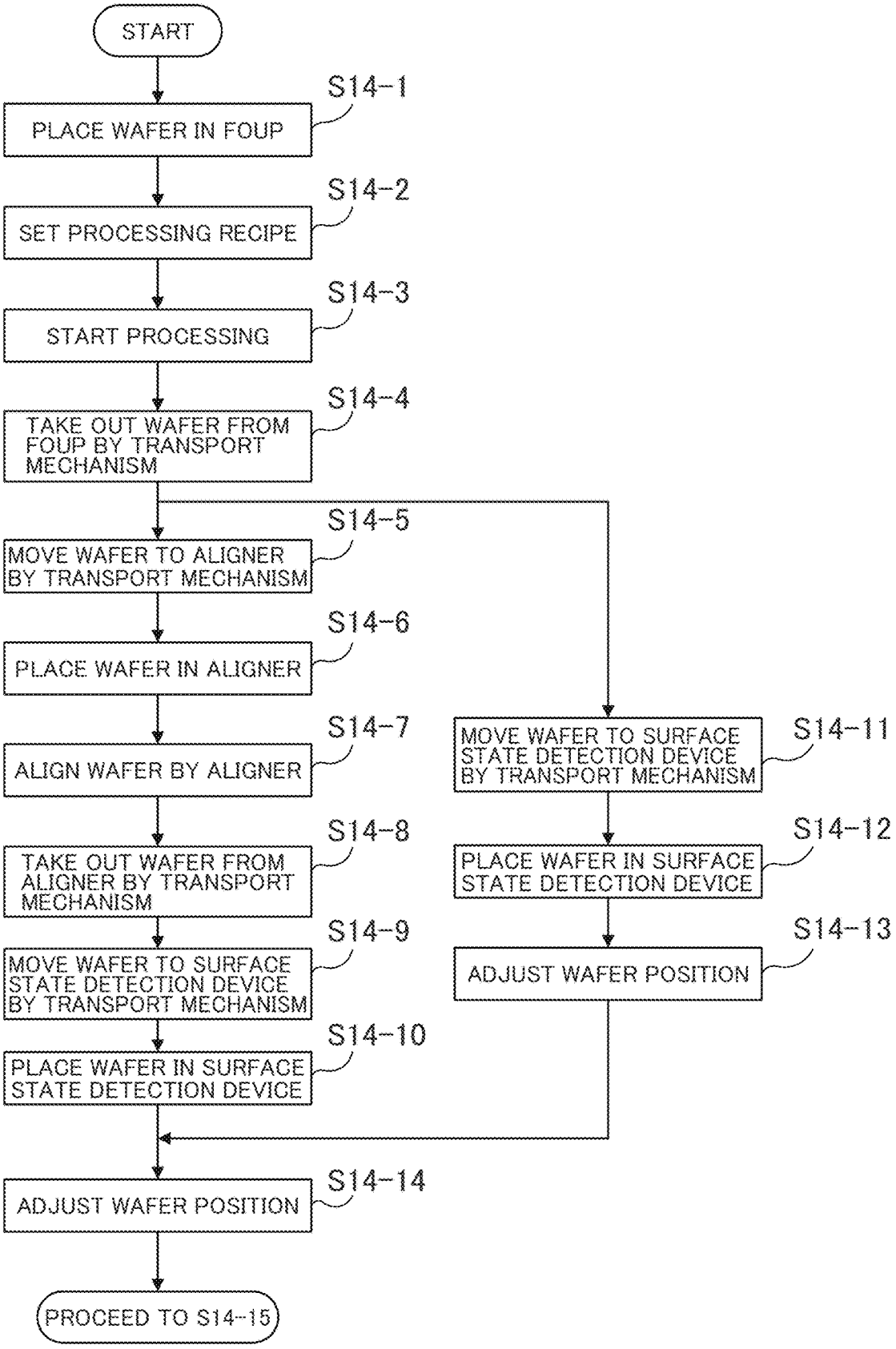
FIG. 29A is a flowchart showing a flow of polishing process according to an example 14, using a polishing machine according to one embodiment.
Figure 29B:
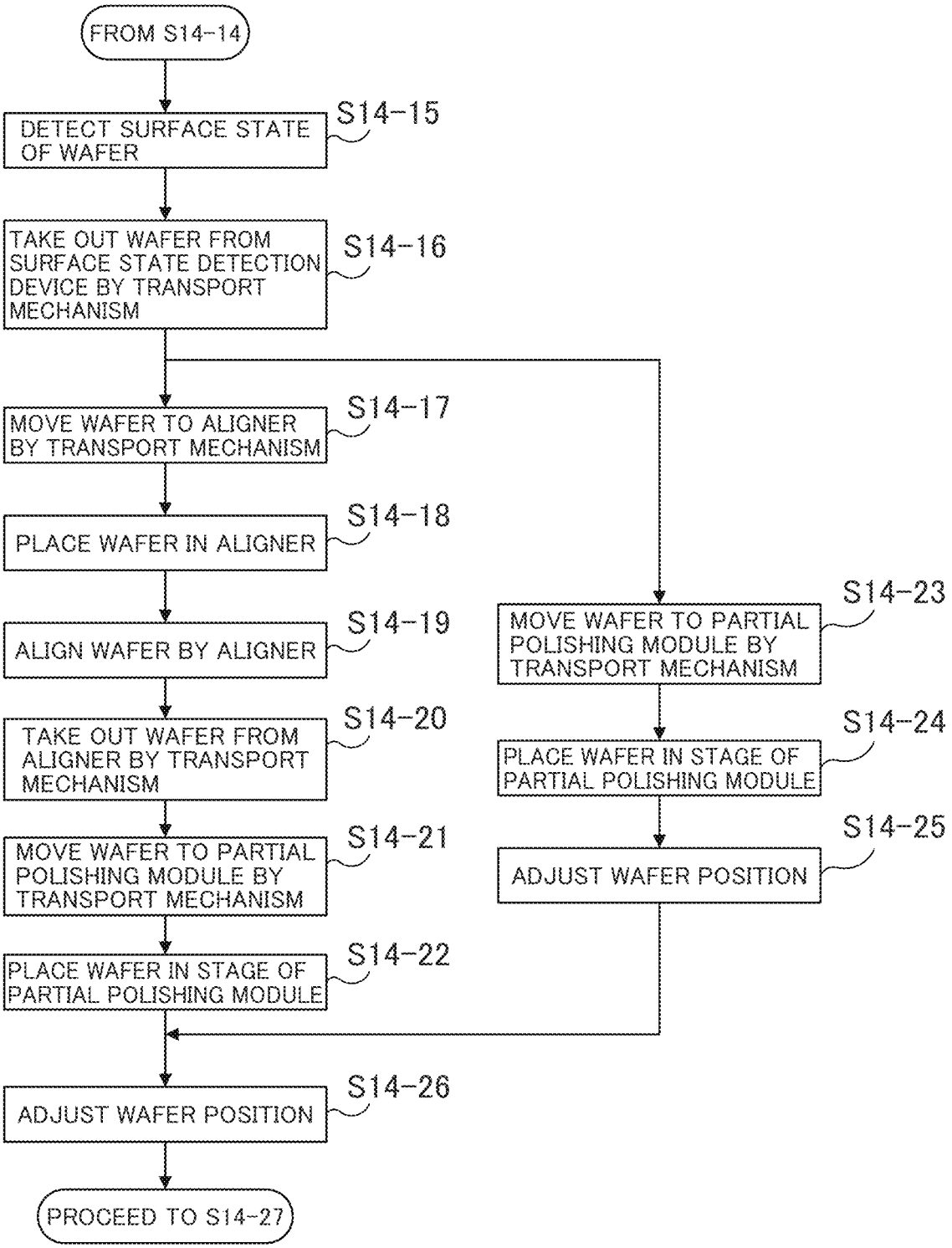
FIG. 29B is a flowchart showing the flow of polishing process according to the example 14, using the polishing machine according to one embodiment.
Figure 29C:
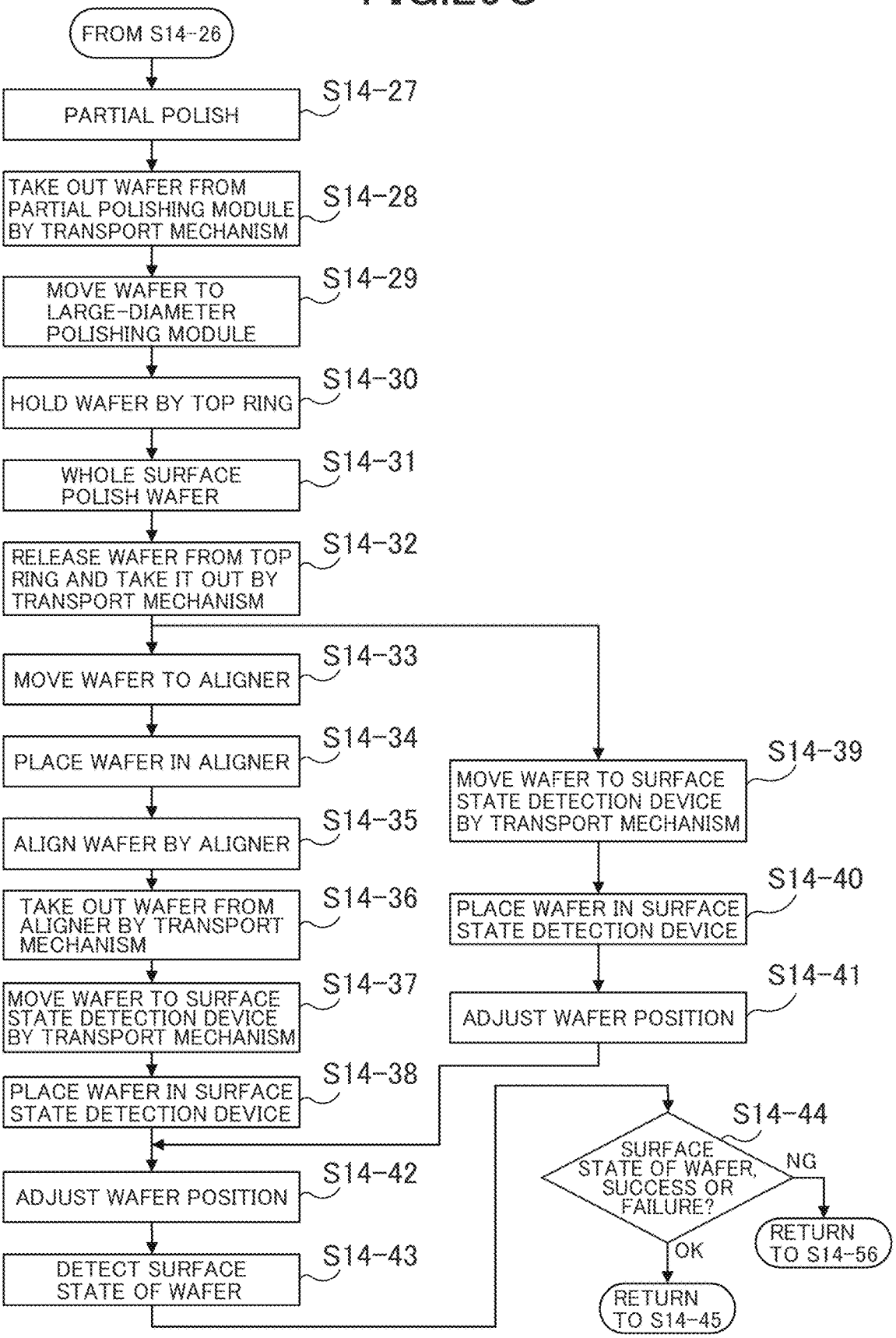
FIG. 29C is a flowchart showing the polishing process according to the example 14, using the polishing machine according to one embodiment.
Figure 29D:
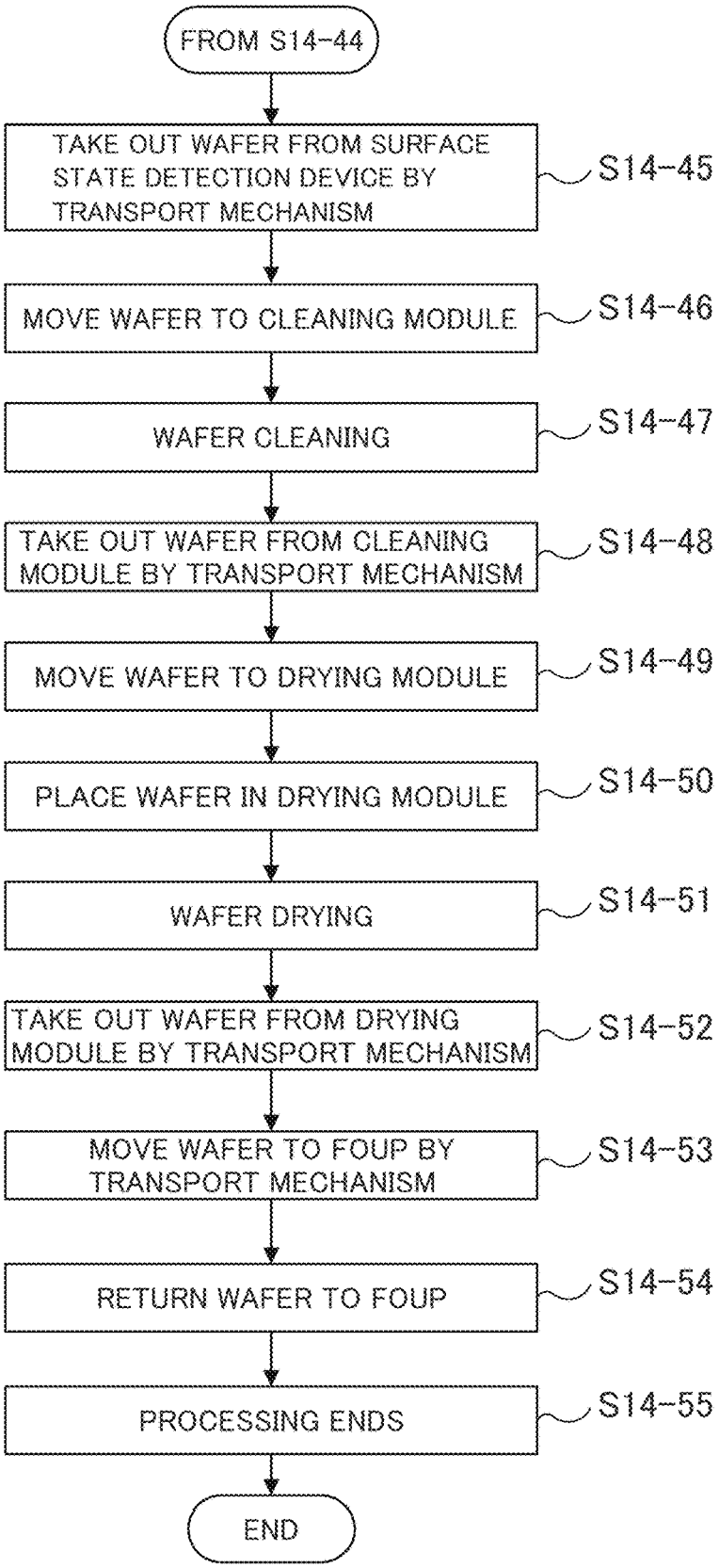
FIG. 29D is a flowchart showing the flow of polishing process according to the example 14, using the polishing machine according to one embodiment.
Figure 29E:
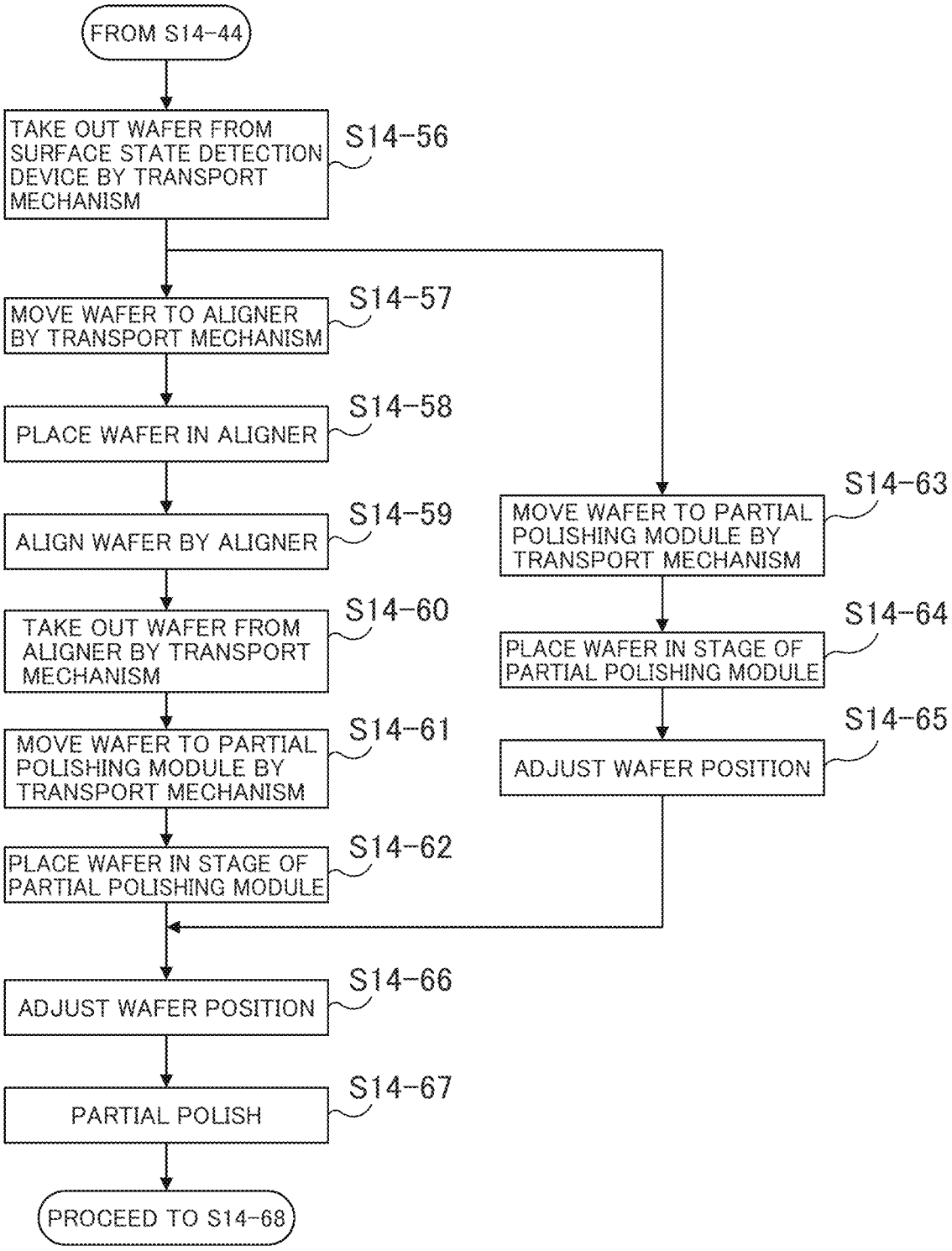
FIG. 29E is a flowchart showing the flow of polishing process according to the example 14, using the polishing machine according to one embodiment.
Figure 29F:
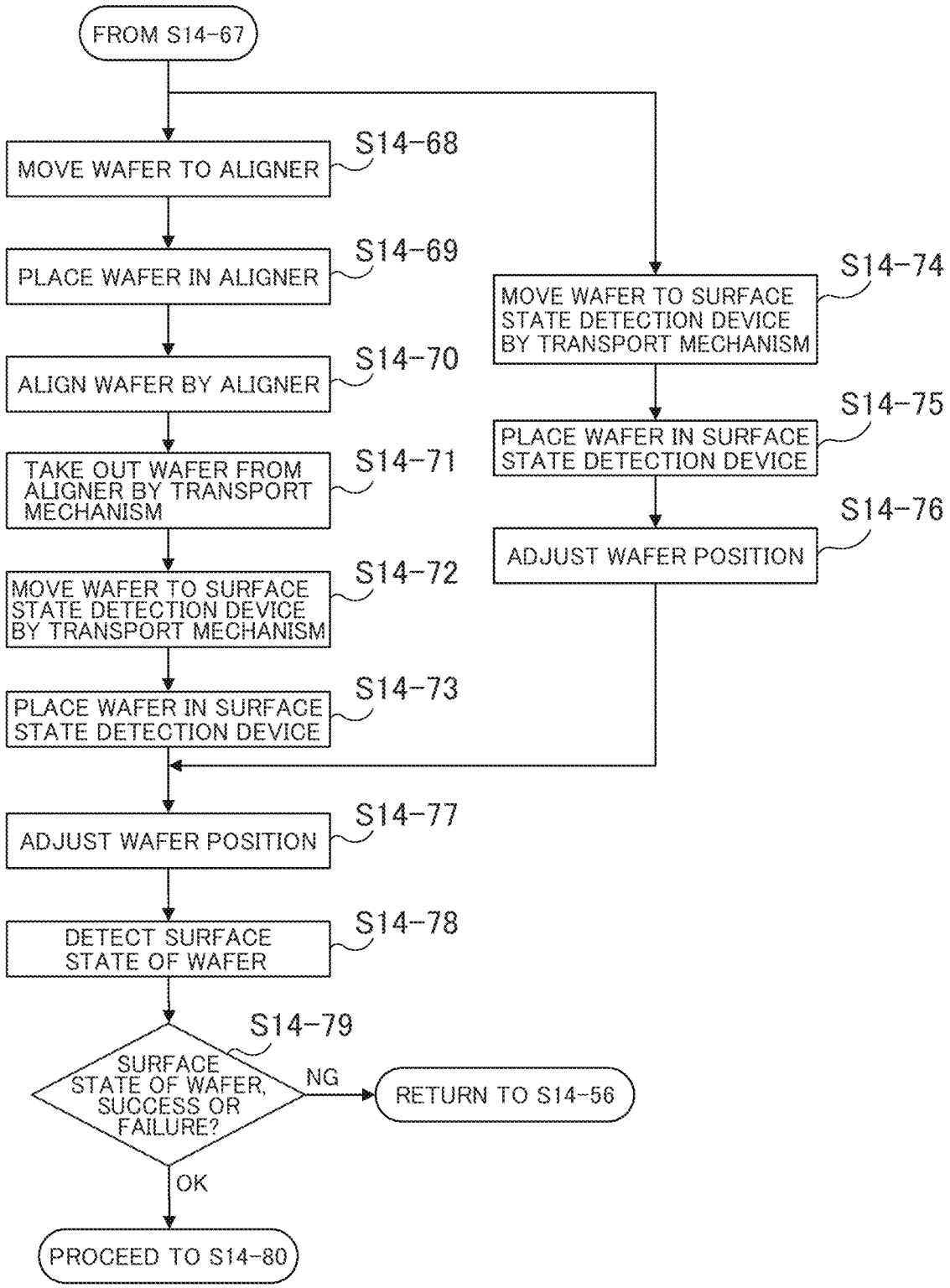
FIG. 29F is a flowchart showing the flow of polishing process according to the example 14, using the polishing machine according to one embodiment.
Figure 29G:
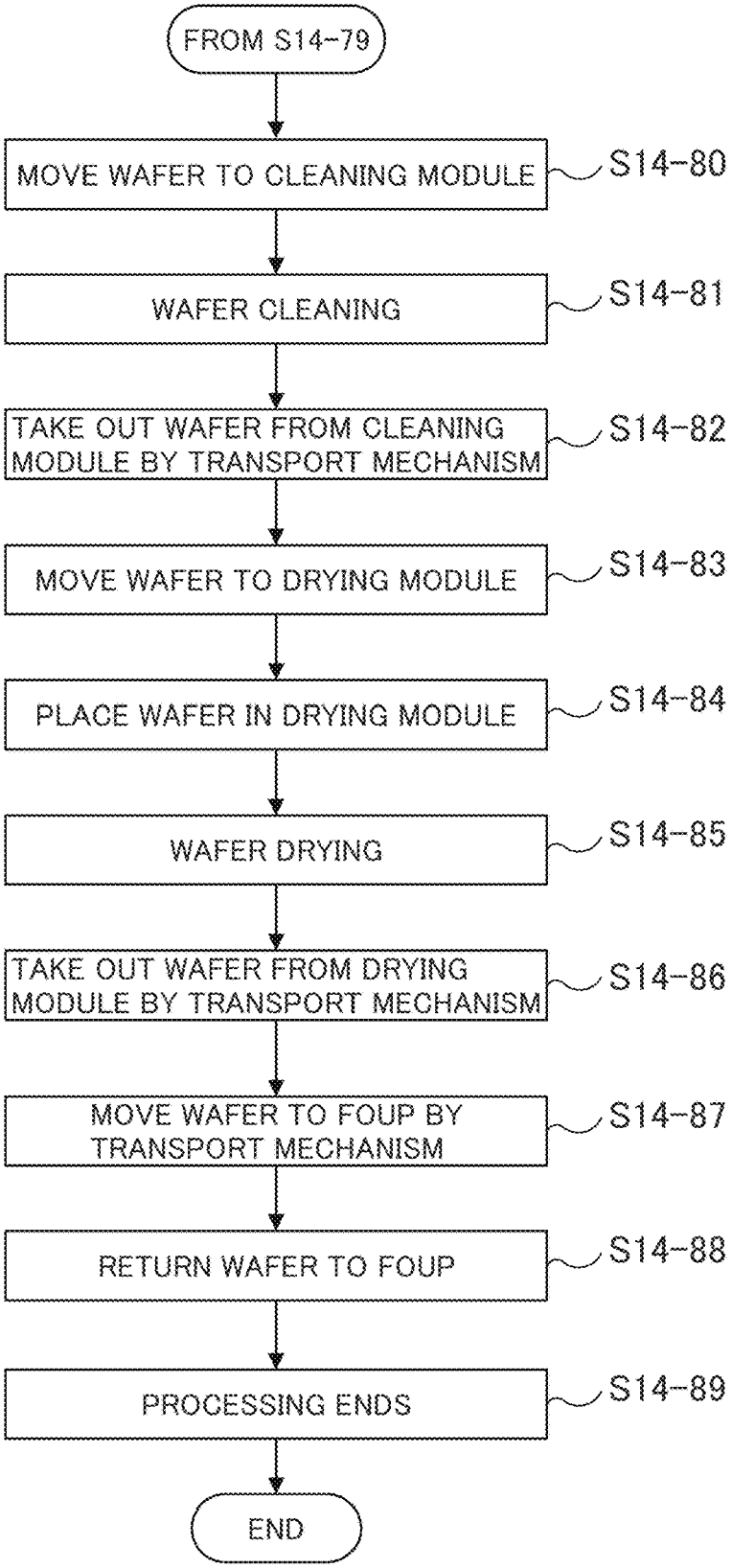
FIG. 29G is a flowchart showing the flow of polishing process according to the example 14, using the polishing machine according to one embodiment.

FIGS. 18A to 18C are a flowchart showing process of a polishing machine according to one example. A hardware configuration of the polishing machine of Example 3 is similar to that of the polishing machine of Examples 1 and 2. A behavior of the polishing machine of this example will be described with reference to FIGS. 18A to 18C.

Steps S3-1 to S3-28 are similar to steps S1-1 to S1-28 of Example 1, and description thereof will be omitted. After the wafer Wf is taken out of the partial polishing module by the transport mechanism, the wafer Wf is moved to the cleaning module (S3-29). Subsequently, the wafer Wf is cleaned (S3-30). Subsequently, the wafer Wf is taken out of the cleaning module by the transport mechanism (S3-31). Subsequently, the wafer Wf is moved to the drying module (S3-32). Subsequently, the wafer Wf is placed in the drying module (S3-33). Subsequently, the wafer Wf is dried (S3-34). Subsequently, the wafer Wf is taken out of the drying module by the transport mechanism (S3-35). Subsequently, the wafer Wf is moved to FOUP (S3-36). Subsequently, the wafer Wf is stored in FOUP (S3-37). Subsequently, process in the polishing machine is terminated (S3-38).

Example 4

FIGS. 19A to 19E are a flowchart showing process of a polishing machine according to one example. The polishing machine according to Example 4 is a polishing machine including: a load/unload unit having FOUP (Front Opening Unified Pod) that is a closed container containing a wafer Wf and capable of keeping an environment independently, a transport mechanism for transporting a wafer in the polishing machine, an aligner for aligning a wafer Wf, a detector for detecting the surface state of a wafer Wf, a partial polishing module, a large-diameter polishing module, a wafer cleaning module, a wafer drying module, and a control device. These modules included in the polishing machine according to this example may be the above mentioned modules.

A behavior of the polishing machine of this example will be described with reference to FIGS. 19A to 19E. Steps S4-1 to S4-48 are similar to steps S1-1 to S1-48 of Example 1, and description thereof will be omitted. After partial polishing by the partial polishing module is terminated (from S4-1 to S4-48), the wafer Wf held by the transport mechanism is moved to the large-diameter polishing module (S4-49). Subsequently, the wafer Wf is held by the top ring in the large-diameter polishing module (S4-50). Subsequently, according to the processing recipe set at step S4-2, the wafer Wf is completely polished (S4-51). Subsequently, the wafer is released from the top ring and the wafer Wf is received and delivered to the transport mechanism (S4-52). Subsequently, the wafer Wf is moved to the cleaning module (S4-53). Subsequently, the wafer Wf is cleaned (S4-54). Subsequently, the wafer Wf is taken out of the cleaning module by the transport mechanism (S4-55). Subsequently, the wafer Wf is moved to the drying module (S4-56). Subsequently, the wafer Wf is placed in the drying module (S4-57). Subsequently, the wafer Wf is dried (S4-58). Subsequently, the wafer Wf is taken out of the drying module by the transport mechanism (S4-59). Subsequently, the wafer Wf is moved to FOUP (S4-60). Subsequently, the wafer Wf is stored in FOUP (S4-61). Subsequently, process in the polishing machine is terminated (S4-62).

Example 5

FIGS. 20A to 20D are a flowchart showing process of a polishing machine according to one example. A hardware configuration of the polishing machine of Example 5 is similar to that of the polishing machine of Example 4. A behavior of the polishing machine of this example will be described with reference to FIGS. 20A to 20D. Steps S5-1 to S5-48 are similar to steps S2-1 to S2-48 of Example 2. Also, steps S5-49 to S5-62 of this example are similar to steps S4-49 to S4-62 of Example 4.

Example 6

FIGS. 21A to 21D are a flowchart showing process of a polishing machine according to one example. A hardware configuration of the polishing machine of Example 6 is similar to that of the polishing machine of Example 4, behavior of the polishing machine of this example will be described with reference to FIGS. 21A to 21D. Steps S6-1 to S6-41 are similar to steps S2-1 to S2-41 of Example 2. After partial polishing by the partial polishing module is terminated (from S6-1 to S6-41), the wafer Wf held by the transport mechanism is moved to the large-diameter polishing module (S6-42). Subsequently, the wafer Wf is held by the top ring in the large-diameter polishing module (S6-43). Subsequently, according to the processing recipe set at step S6-2, the wafer Wf is completely polished (S6-44). Subsequently, the wafer is released from the top ring and the wafer Wf is received and delivered to the transport mechanism (S6-45). Subsequently, the wafer Wf is moved to the cleaning module (S6-46). Subsequently, the wafer Wf is cleaned (S6-47). Subsequently, the wafer Wf is taken out of the cleaning module by the transport mechanism (S6-48). Subsequently, the wafer Wf is moved to the drying module (S6-49). Subsequently, the wafer Wf is placed in the drying module (S6-50). Subsequently, the wafer Wf is dried (S6-51). Subsequently, the wafer Wf is taken out of the drying module by the transport mechanism (S6-52). Subsequently, the wafer Wf is moved to FOUP (S6-53). Subsequently, the wafer Wf is stored in FOUP (S6-54). Subsequently, process in the polishing machine is terminated (S6-55).

Example 7

FIGS. 22A to 22G are a flowchart showing process of a polishing machine according to one example. A hardware configuration of the polishing machine of Example 7 is similar to that of the polishing machine of Example 4. A behavior of the polishing machine of this example will be described with reference to FIGS. 22A to 22G. Steps S7-1 to S7-35 are similar to steps S4-1 to S4-35 of Example 4. At step S7-35, after the wafer Wf is received from the drying module and delivered to the transport mechanism, the wafer Wf is moved to the large-diameter polishing module (S7-36). Subsequently, the wafer Wf is held by the top ring in the large-diameter polishing module (S7-37). Subsequently, according to the processing recipe set at step S7-2, the wafer Wf is completely polished (S7-38). Subsequently, the wafer is released from the top ring and the wafer Wf is received and delivered to the transport mechanism (S7-39). Subsequently, the wafer Wf is moved to the cleaning module (S7-40). Subsequently, the wafer Wf is cleaned (S7-41). Subsequently, the wafer Wf is taken out of the cleaning module by the transport mechanism (S7-42). Subsequently, the wafer Wf is moved to the drying module (S7-43). Subsequently, the wafer Wf is placed in the drying module (S7-44). Subsequently, the wafer Wf is dried (S7-45). Subsequently, the wafer Wf is taken out of the drying module by the transport mechanism (S7-46).

Subsequently, the wafer Wf is moved to the aligner (S7-47). Subsequently, the wafer Wf is placed in the aligner (S7-48). Subsequently, the wafer Wf is aligned by the aligner (S7-49). Subsequently, the wafer Wf is taken out of the aligner by transport mechanism (S7-50). Subsequently, the wafer Wf is moved to the surface state detection device (S7-51). Subsequently, the wafer Wf is placed in the surface state detection device (S7-52). Note that if the surface state detection device includes the alignment function for a wafer Wf, the alignment in the aligner may be omitted and the water Wf may be moved from the drying module to the surface state detection device (from S7-53 to S7-55). Subsequently, on the surface state detection device, the wafer Wf is finely aligned (S7-56). Note that this process may be omitted if not required. Subsequently, the surface state of the wafer Wf is detected (S7-57). Subsequently, it is determined whether the surface state of the wafer Wf passes or fails (S7-58). Indications of a criterion for judging whether the surface state passes or fails include, for example, a residual film of the surface to be polished, a surface shape and a distribution of signals corresponding to those on the surface of a wafer Wf or a distribution of polishing amounts on the surface of a wafer Wf, and at least one of those is the judgment criterion. For example, by comparing at least one of the residual film state, the shape state and the polishing amount measured at step S7-57 with a corresponding one of a residual film state, a shape state and a polishing amount that are set as a target, it is determined whether the surface state of the wafer passes or fails. At step S7-53, if it is determined that the indication reaches a target value or fails within a target range, the wafer Wf is taken out of the surface state detection device by the transport mechanism (S7-59). Subsequently, the wafer Wf is moved to FOUP (S7-60). Subsequently, the wafer Wf is stored in FOUP (S7-61). Subsequently, process in the polishing machine is terminated (S7-62).

At step S7-58, if the indication neither reaches the target value nor falls within the target range, proceed to step S7-63, and partial polishing is performed again. A feedback control of partial polishing, cleaning, drying and measurement performed at steps from S7-63 to S7-96 in Example 7 is similar to that described in steps from S1-16 to S1-51 of Example 1, and description thereof will be omitted.

Example 8

FIGS. 23A to 23H are a flowchart showing process of a polishing machine according to one example. A hardware configuration of the polishing machine of Example 8 is similar to that of the polishing machine of Example 4. A behavior of the polishing machine of this example will be described with reference to FIGS. 23A to 23H. Steps S8-1 to S8-74 are similar to steps S7-1 to S7-74 of Example 7. In Example 8, after partial polishing is performed at step S8-74, different from Example 7, without the cleaning process and the drying process, the surface state of the wafer Wf is detected (from S8-75 to S8-85). Subsequently, it is determined whether the surface state of the wafer Wf passes or fails (S8-86). Indications of a criterion for judging whether the surface state passes or fails include, for example, a residual film of the surface to be polished, a surface shape and a distribution of signals corresponding to those on the surface of a wafer Wf or a distribution of polishing amounts on the surface of a wafer Wf, and at least one of those is the judgment criterion. For example, by comparing at least one of the residual film state, the shape state and the polishing amount measured at step S8-85 with a corresponding one of a residual film state, a shape state and a polishing amount that are set as a target, it is determined whether the surface state of the wafer passes or fails. At step S8-86, if it is determined that the indication neither reaches a target value nor fails within a target range, then proceed to S8-63, and partial polishing is performed again. At step S8-86, if it is determined that the indication reaches the target value or falls within the target range, the wafer Wf is cleaned and dried, and the wafer Wf is returned to FOUP, and process is at (from S8-87 to S8-96).

FIGS. 24A to 24F are a flowchart showing process of a polishing machine according to one example. A hardware configuration of the polishing machine of Example 9 is similar to that of the polishing machine of Example 4. A behavior of the polishing machine of this example will be described with reference to FIGS. 24A to 24F. Steps S9-1 to S9-39 are similar to steps S7-1 to S7-39 of Example 7. In Example 9, after whole surface polishing is performed at step S9-38, without the cleaning process and the drying process, the surface state of the wafer Wf is detected (from S9-40 to S9-50). Subsequently, it is determined whether the surface state of the wafer Wf passes or fails (S9-51). Indications of a criterion for judging whether the surface state passes or fails include, for example, a residual film of the surface to be polished, a surface shape and a distribution of signals corresponding to those on the surface of a wafer Wf or a distribution of polishing amounts on the surface of a wafer Wf, and at least one of those is the judgment criterion. For example, by comparing at least one of the residual film state, the shape state and the polishing amount measured at step S9-50 with a corresponding one of a residual film state, a shape state and a polishing amount that are set as a target, it is determined whether the surface state of the wafer passes or fails. At step S9-51, if it is determined that the indication neither reaches a target value nor falls within a target range, proceed to step S9-63, and partial polishing is performed again. At step S9-51, if it is determined that the indication reaches the target value or falls within the target range, the wafer Wf is cleaned and dried, and the wafer Wf is returned to FOUP and process is terminated (from S9-52 to S9-62). A feedback control of partial polishing, cleaning, drying and detection after step S9-63 is similar to that in steps from S7-63 to S7-96 of Example 7, and description thereof will be omitted.

Example 10

FIGS. 25A to 25F are a flowchart showing process of a polishing machine according to one example. A hardware configuration of the polishing machine of Example 10 is similar to that of the polishing machine of Example 4. A behavior of the polishing machine of this example will be described with reference to FIGS. 25A to 25F. Steps S10-1 to S10-2 are similar to steps S7-1 to S7-28 of Example 7. In Example 10, after partial polishing is performed at step S10-27, without other processes, whole surface polishing is performed immediately (from S10-29 to S10-31). Subsequently, after the cleaning process and the drying process are gone through, the surface state of the wafer Wf is detected (from S10-32 to S10-50). Subsequently, it is determined whether the surface state of the wafer Wf passes or fails (S10-51). Indications of a criterion for judging whether the surface state passes or fails include, for example, a residual film of the surface to be polished, a surface shape and a distribution of signals corresponding to those on the surface of a wafer Wf or a distribution of polishing amounts on the surface of a wafer Wf, and at least one of those is the judgment criterion. For example, by comparing at least one of the residual film state, the shape state and the polishing amount measured at step S10-50 with a corresponding one of a residual film state, a shape state and a polishing amount that are set as a target, it is determined whether the surface state of the wafer passes or fails. At step S10-51, if it is determined that the indication neither reaches a target value nor falls within a target range, proceed to step S10-56, and partial polishing is performed again. At step 10-51, if it is determined that the indication reaches the target value or falls within the target range, the wafer Wf is returned to FOUP and process is terminated (from S10-52 to S10-55). A feedback control of partial polishing, cleaning, drying and detection after step S10-56 is similar to that in steps from S7-63 to S7-96 of Example 7, and description thereof will be omitted.

Example 11

FIGS. 26A to 26G are a flowchart showing process of a polishing machine according to one example. A hardware configuration of the polishing machine of Example 11 is similar to that of the polishing machine of Example 4. A behavior of the polishing machine of this example will be described with reference to FIGS. 26A to 26G. Steps S11-1 to S11-62 are similar to steps S9-1 to S9-62 of Example 9. Also, steps S11-63 to S11-96 are similar to steps S8-63 to S8-96 of Example 8.

Example 12

FIGS. 27A to 27G are a flowchart showing process of a polishing machine according to one example. A hardware configuration of the polishing machine of Example 12 is similar to that of the polishing machine of Example 4. A behavior of the polishing machine of this example will be described with reference to FIGS. 27A to 27G. Steps S12-1 to S12-55 are similar to steps S10-1 to S10-55 of Example 10. Also, steps S12-56 to S12-89 are similar to steps S8-63 to S8-96 of Example 8.

Example 13

FIGS. 28A to 28F are a flowchart showing process of a polishing machine according to one example. A hardware configuration of the polishing machine of Example 13 is similar to that of the polishing machine of Example 4. A behavior of the polishing machine of this example will be described with reference to FIGS. 28A to 28F. Steps S13-1 to S13-32 are similar to steps S10-1 to S10-32 of Example 10. Also, steps S13-33 to S13-55 are similar to steps S11-40 to S11-62 of Example 11. Further, steps S13-56 to S13-89 are similar to steps S10-56 to S10-89 of Example 10.

Example 14

FIGS. 29A to 29G are a flowchart showing process of a polishing machine according to one example. A hardware configuration of the polishing machine of Example 14 is similar to that of the polishing machine of Example 4. A behavior of the polishing machine of this example will be described with reference to FIGS. 29A to 29G. Steps S14-1 to S14-55 are similar to steps S13-1 to S13-55 of Example 13. Also, steps S14-56 to S14-89 are similar to steps S8-63 to S8-96 of Example 8.

Example 15

Figure 30A:
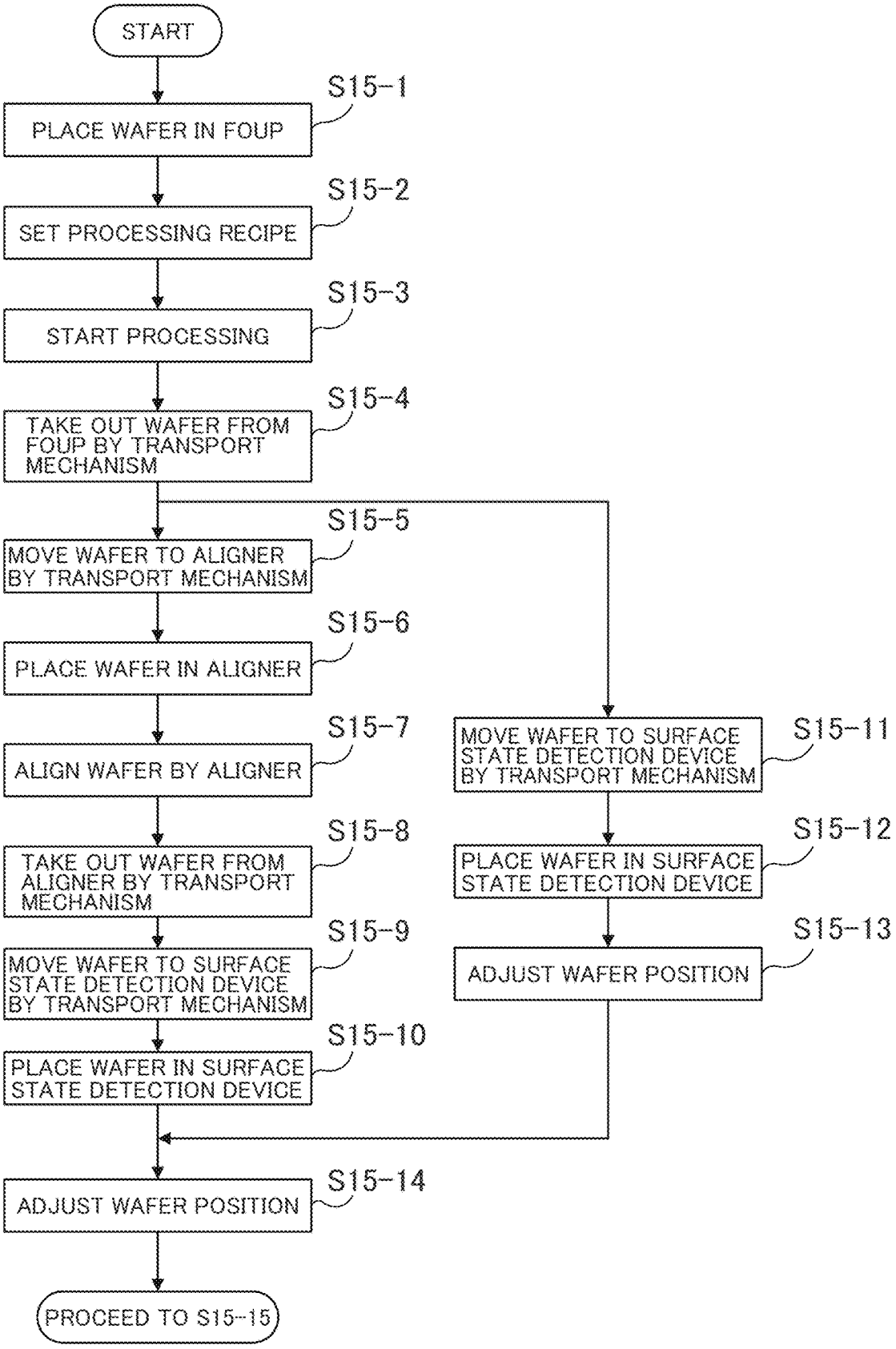
FIG. 30A is a flowchart showing a flow of polishing process according to an example 15, using a polishing machine according to one embodiment.
Figure 30B:
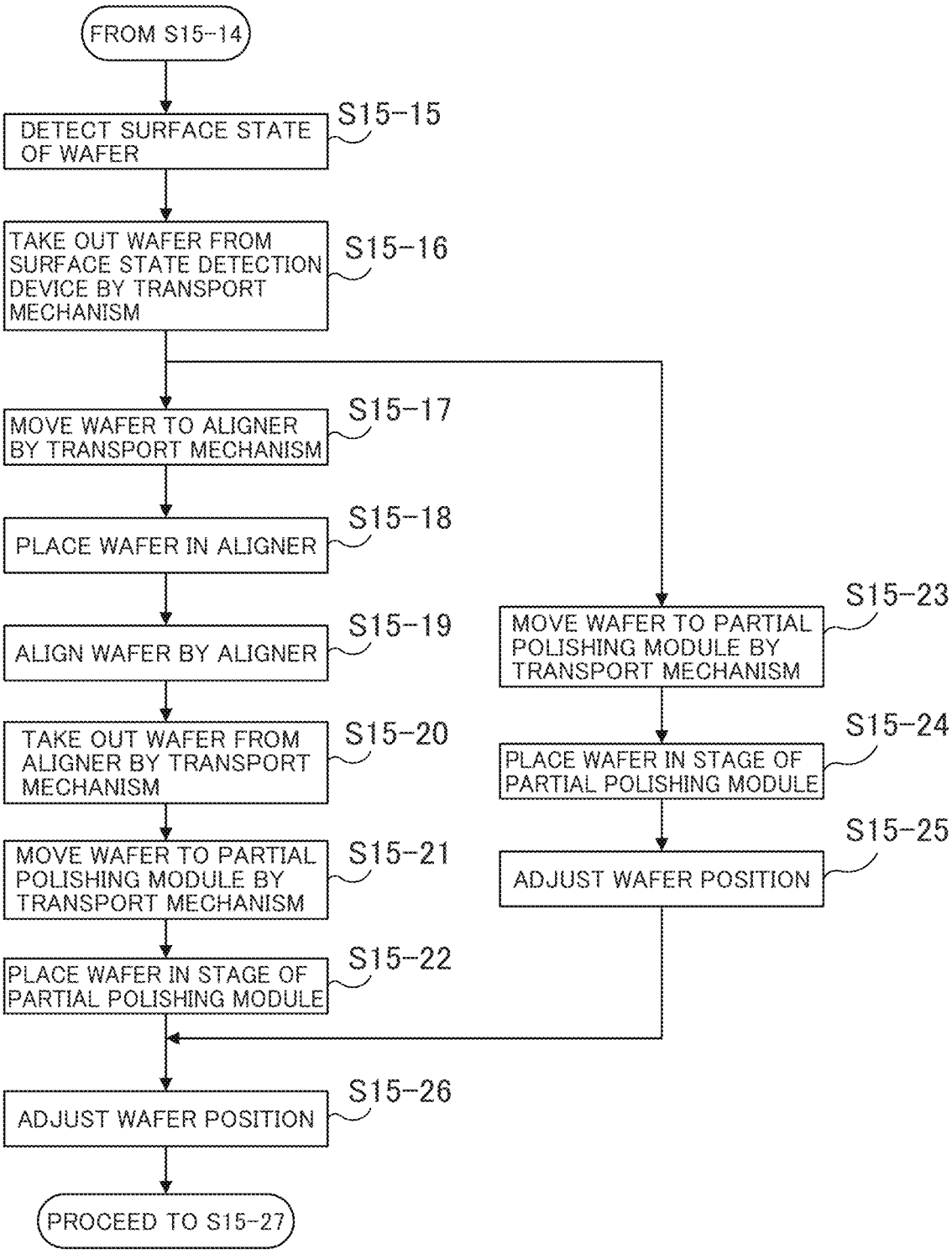
FIG. 30B is a flowchart showing the flow of polishing process according to the example 15, using the polishing machine according to one embodiment.
Figure 30C:
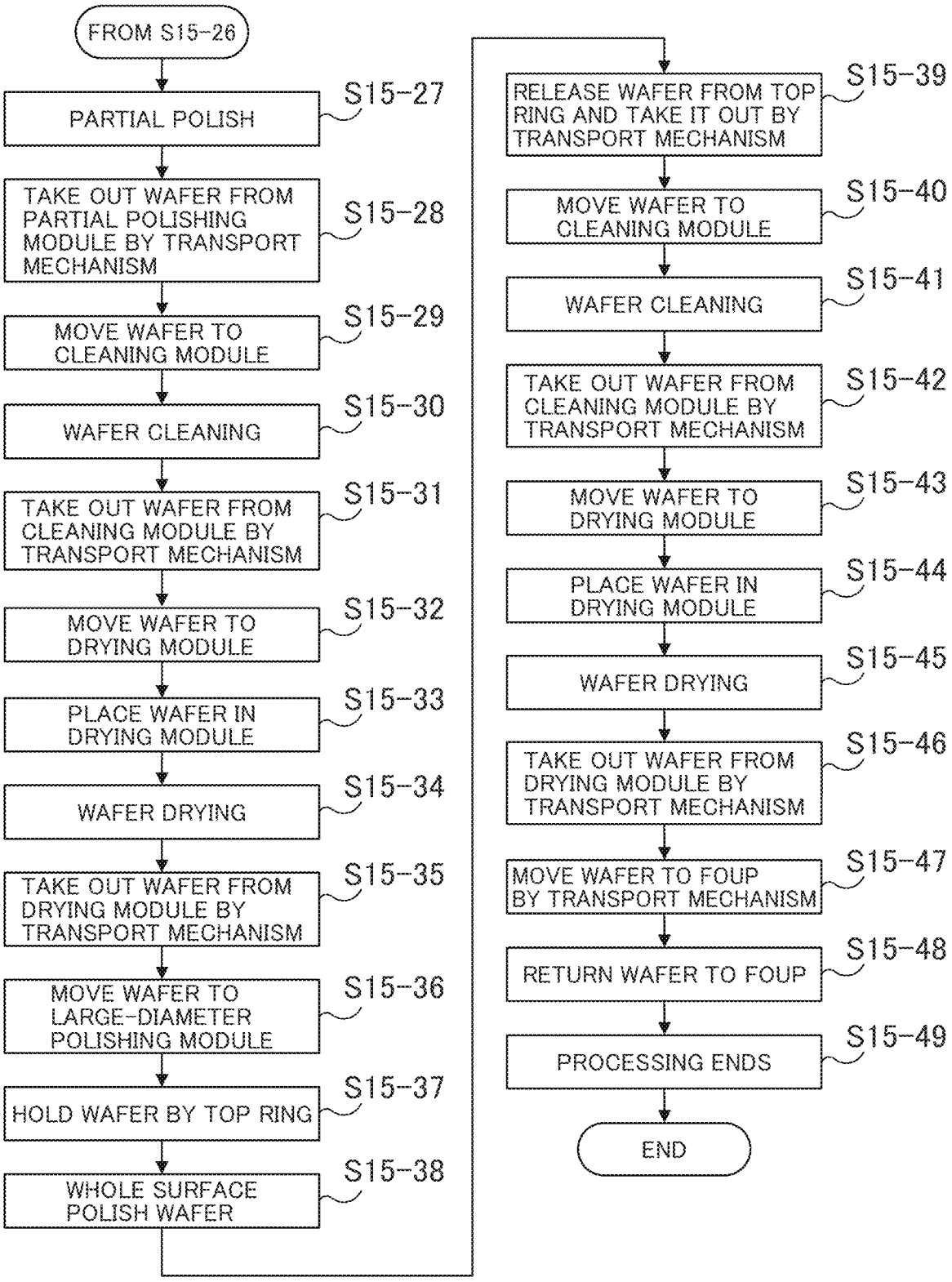
FIG. 30C is a flowchart showing the flow of polishing process according to the example 15, using the polishing machine according to one embodiment.

FIGS. 30A to 30C are a flowchart showing process of a polishing machine according to one example. A hardware configuration of the polishing machine of Example 15 is similar to that of the polishing machine of Example 4. A behavior of the polishing machine of this example will be described with reference to FIGS. 30A to 30C. Steps S15-1 to S15-46 are similar to steps S7-1 to S7-46 of Example 7. Subsequently, the wafer Wf is moved to FOUP (S15-47). Subsequently, the wafer Wf is stored in FOUP (S15-48). Subsequently, process in the polishing machine is terminated (S15-49).

Example 16

Figure 31A:
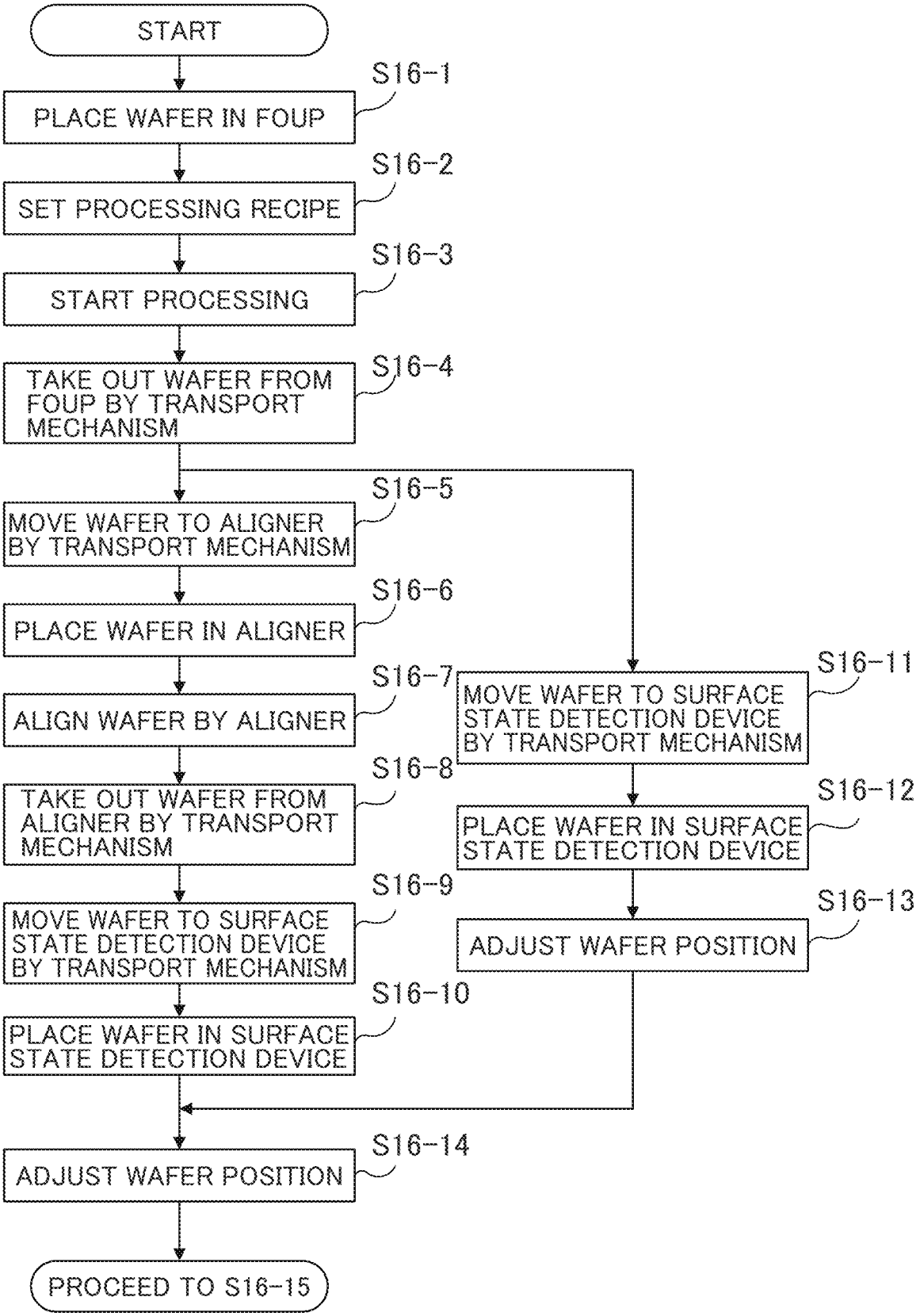
FIG. 31A is a flowchart showing a flow of polishing process according to an example 16, using a polishing machine according to one embodiment.
Figure 31B:
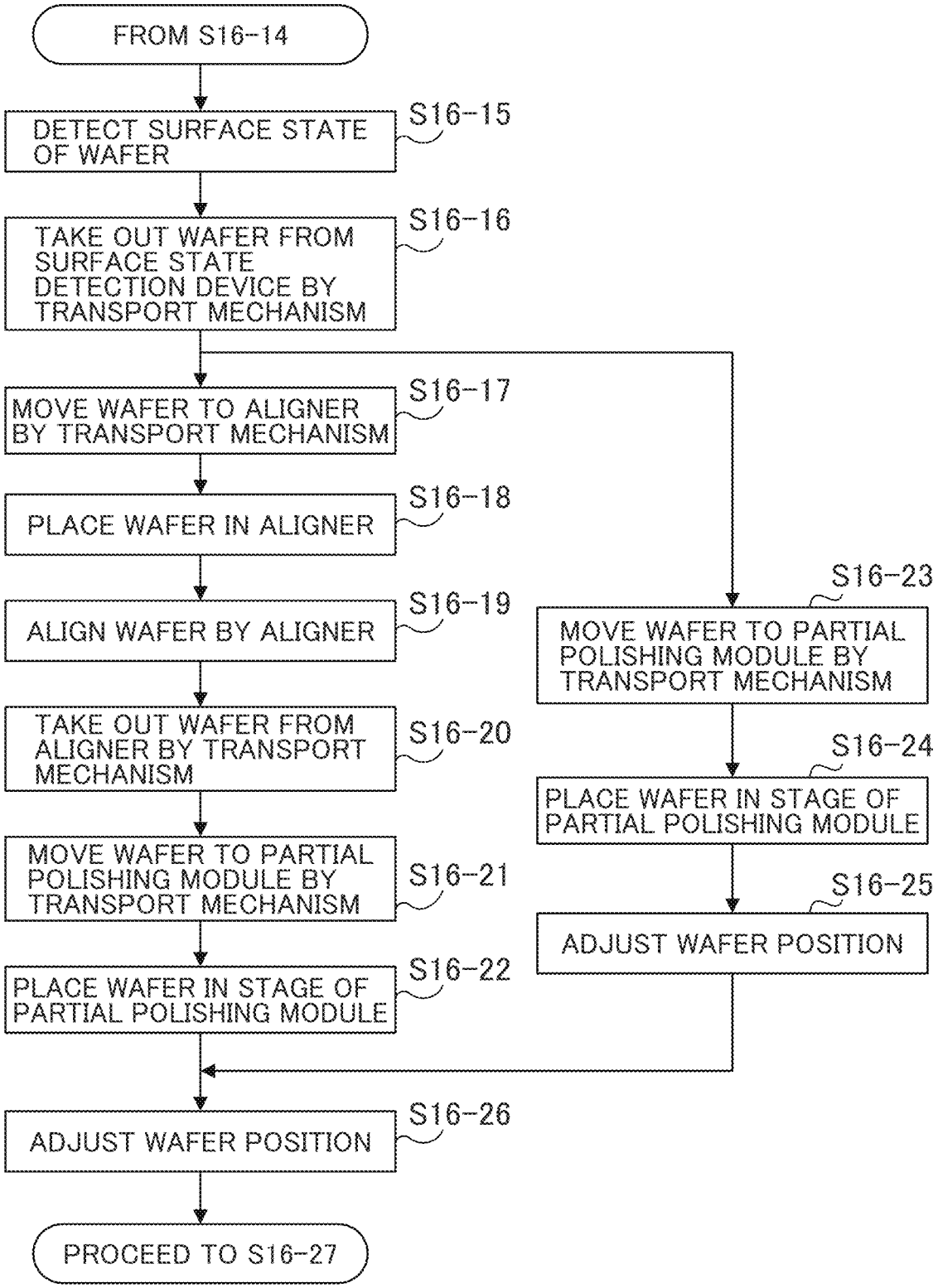
FIG. 31B is a flowchart showing the flow of polishing process according to the example 16, using the polishing machine according to one embodiment.
Figure 31C:
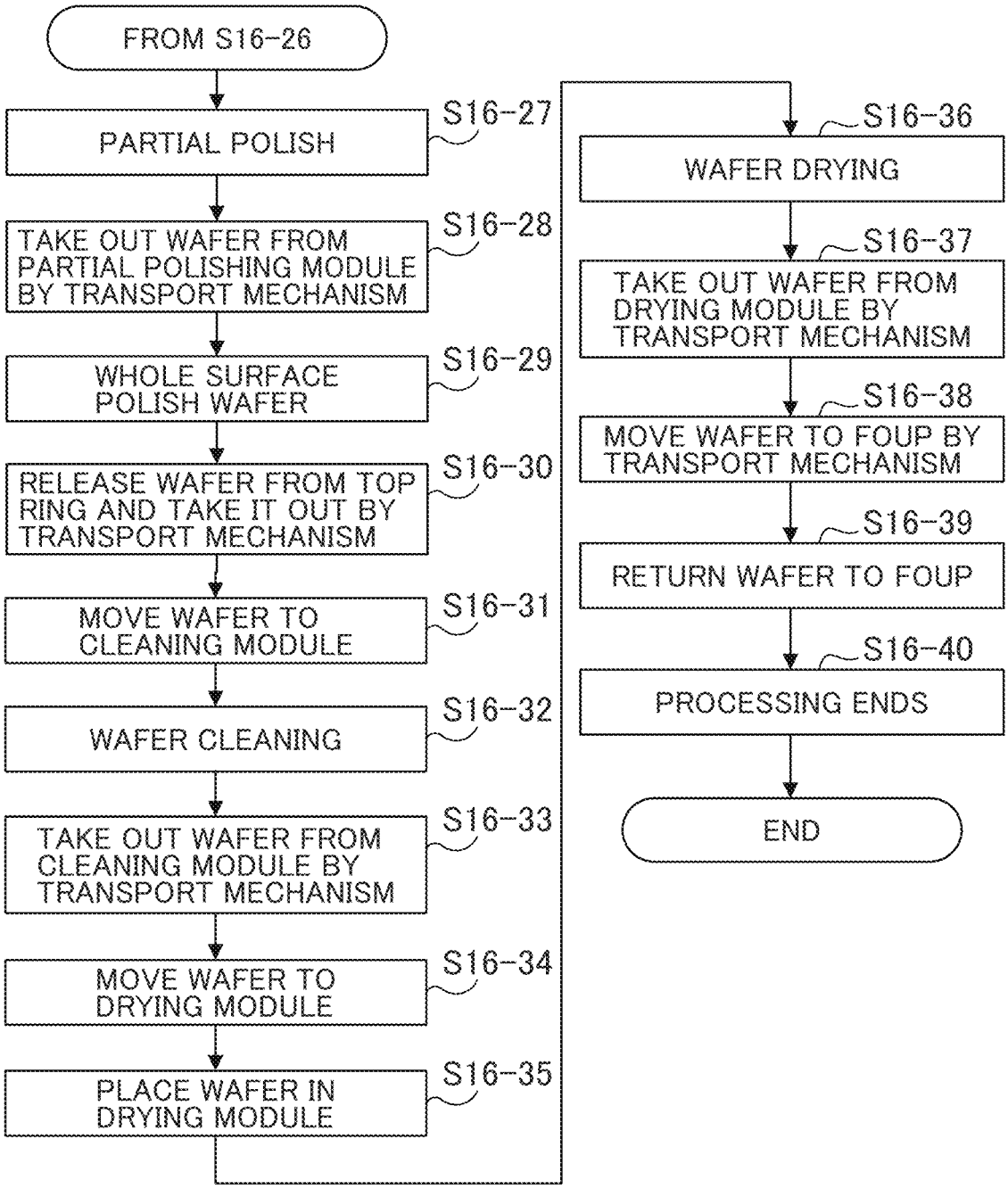
FIG. 31C is a flowchart showing the flow of polishing process according to the example 16, using the polishing machine according to one embodiment.
Figure 32A:
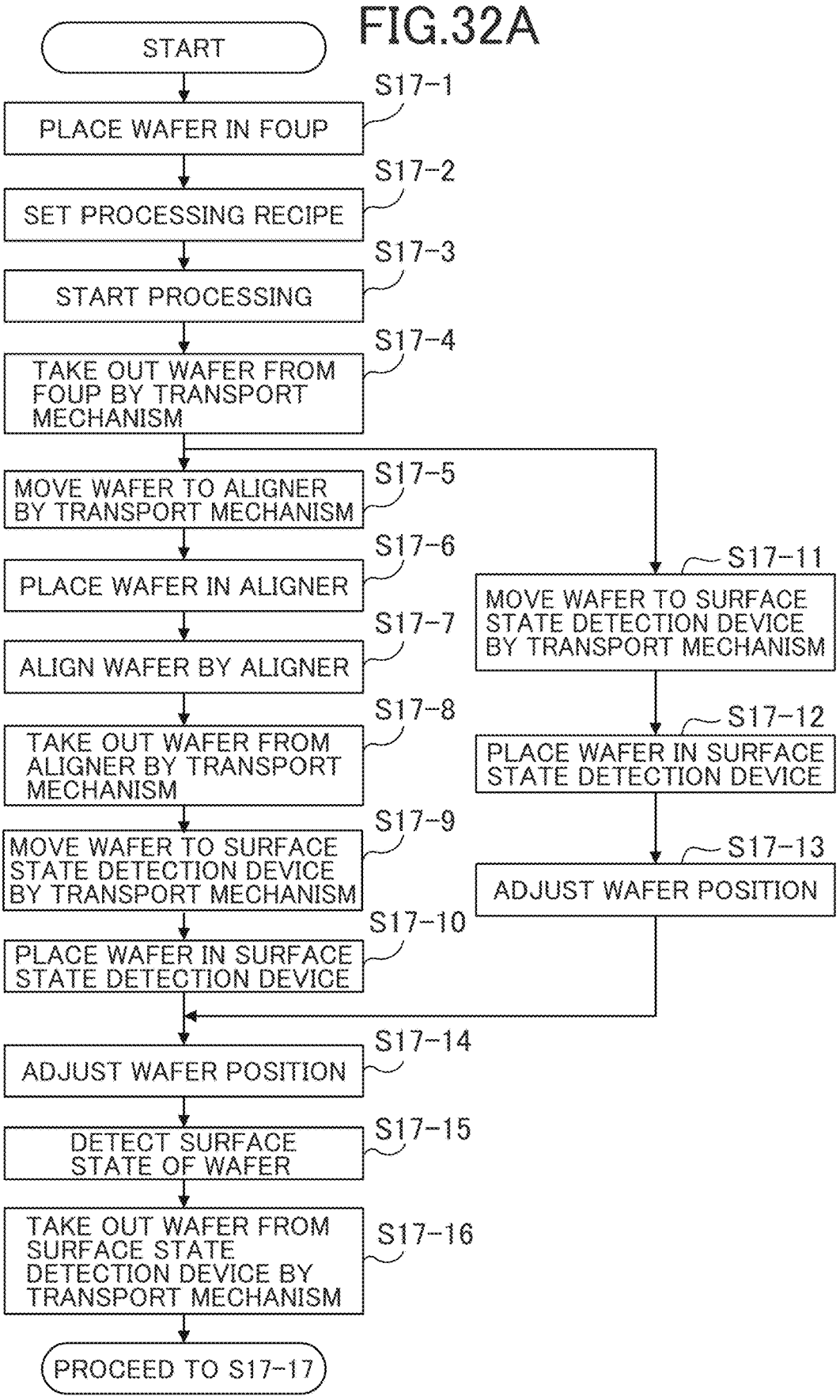
FIG. 32A is a flowchart showing a flow of polishing process according to an example 17, using a polishing machine according to one embodiment.
Figure 32B:
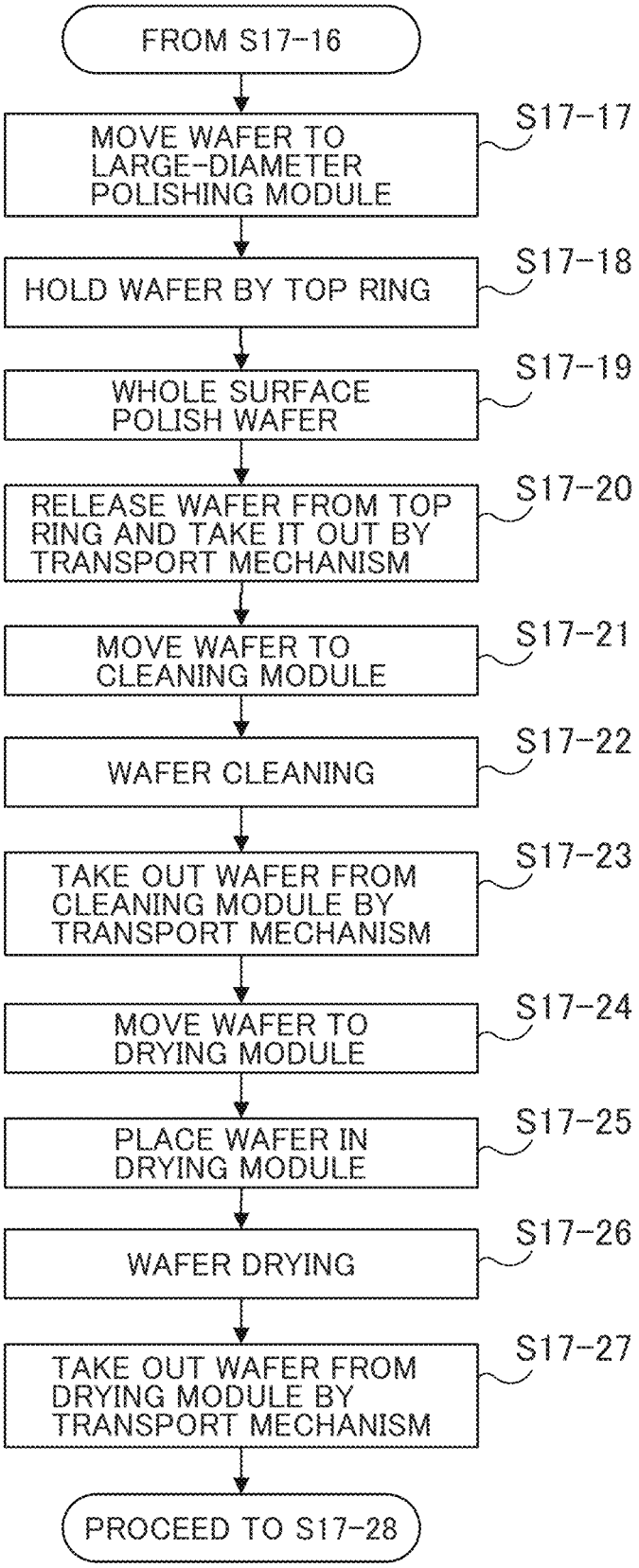
FIG. 32B is a flowchart showing the flow of polishing process according to the example 17, using the polishing machine according to one embodiment.
Figure 32C:
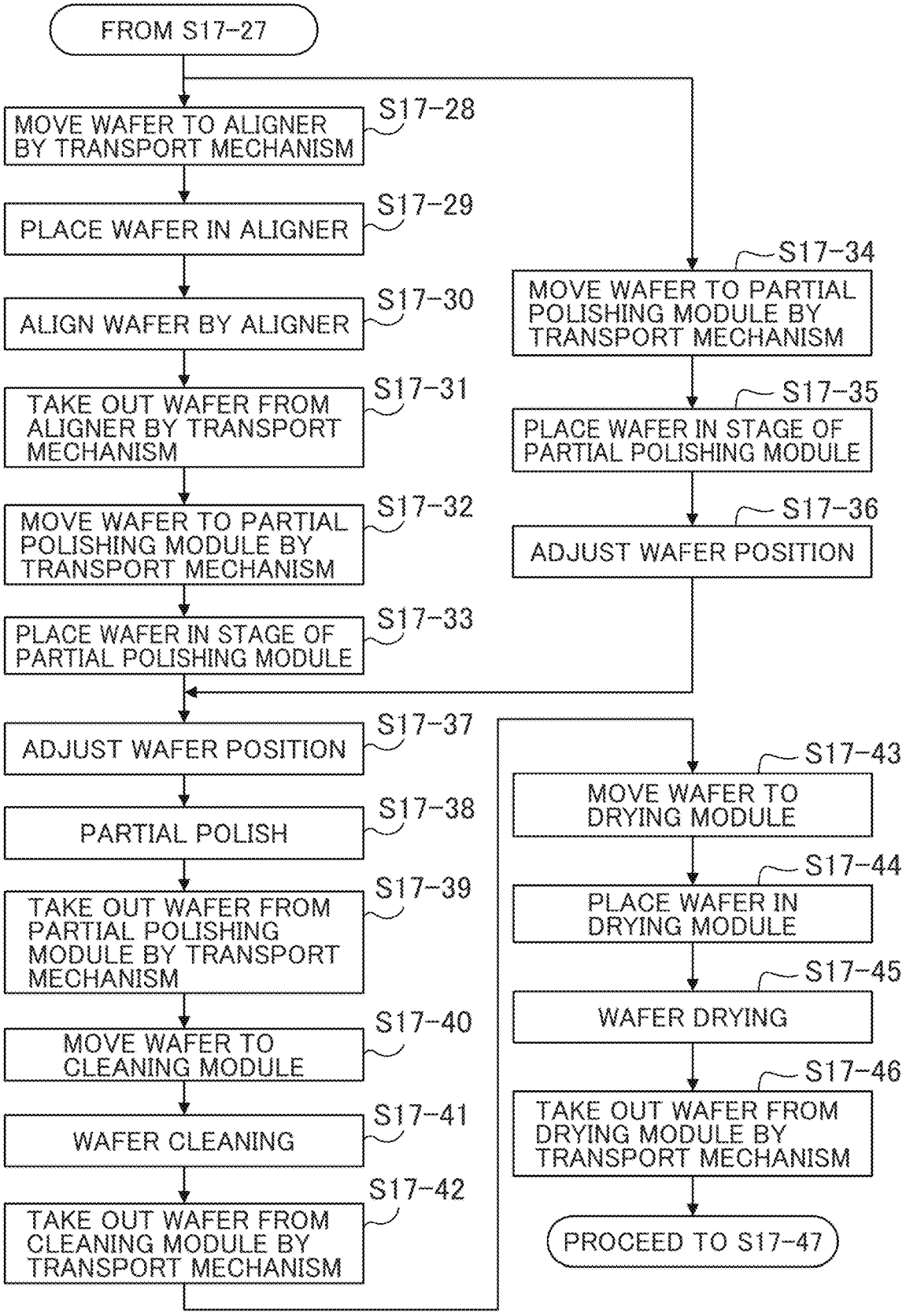
FIG. 32C is a flowchart showing the flow of polishing process according to the example 17, using the polishing machine according to one embodiment.
Figure 32D:
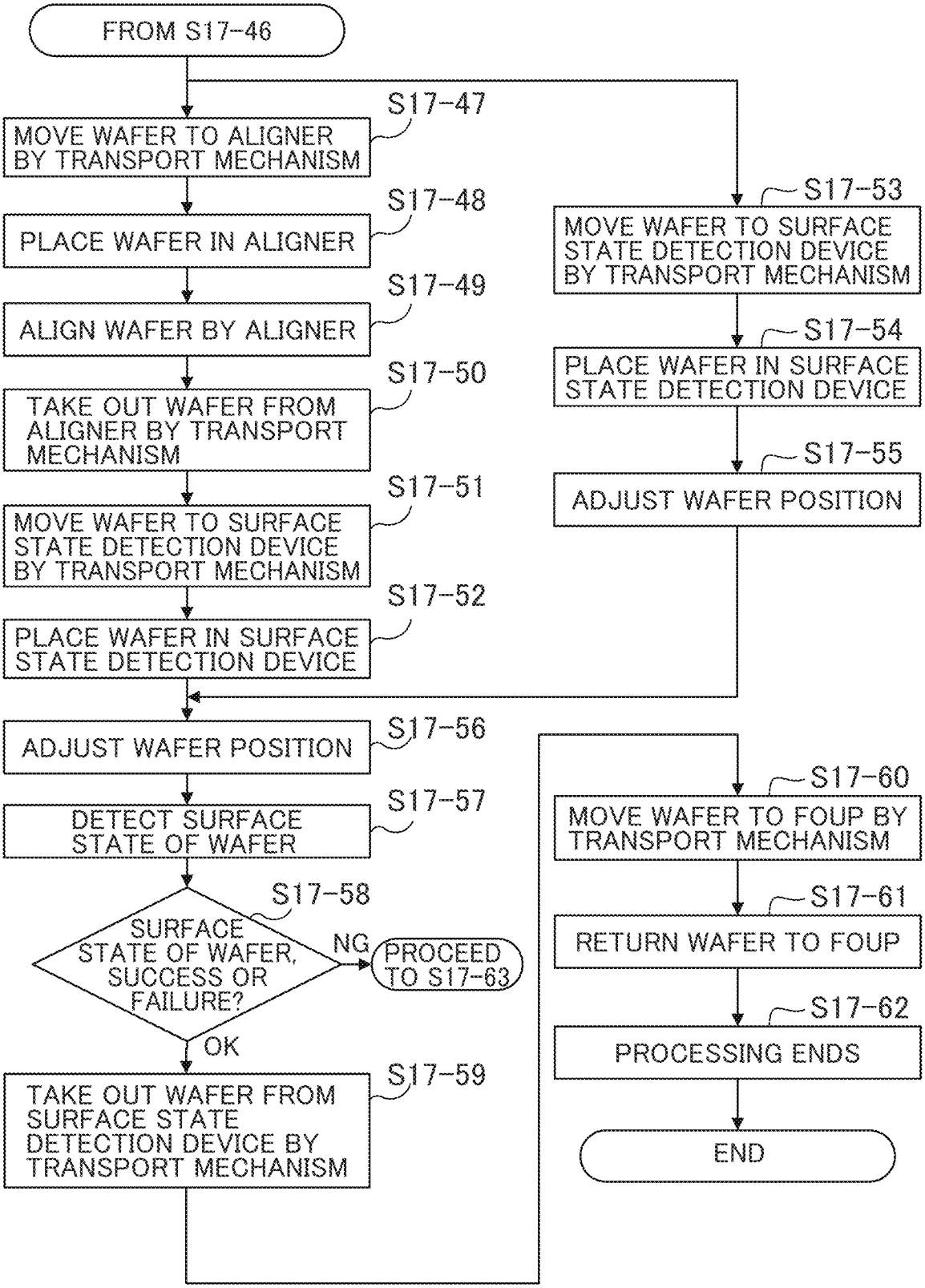
FIG. 32D is a flowchart showing the flow of polishing process according to the example 17, using the polishing machine according to one embodiment.
Figure 32E:
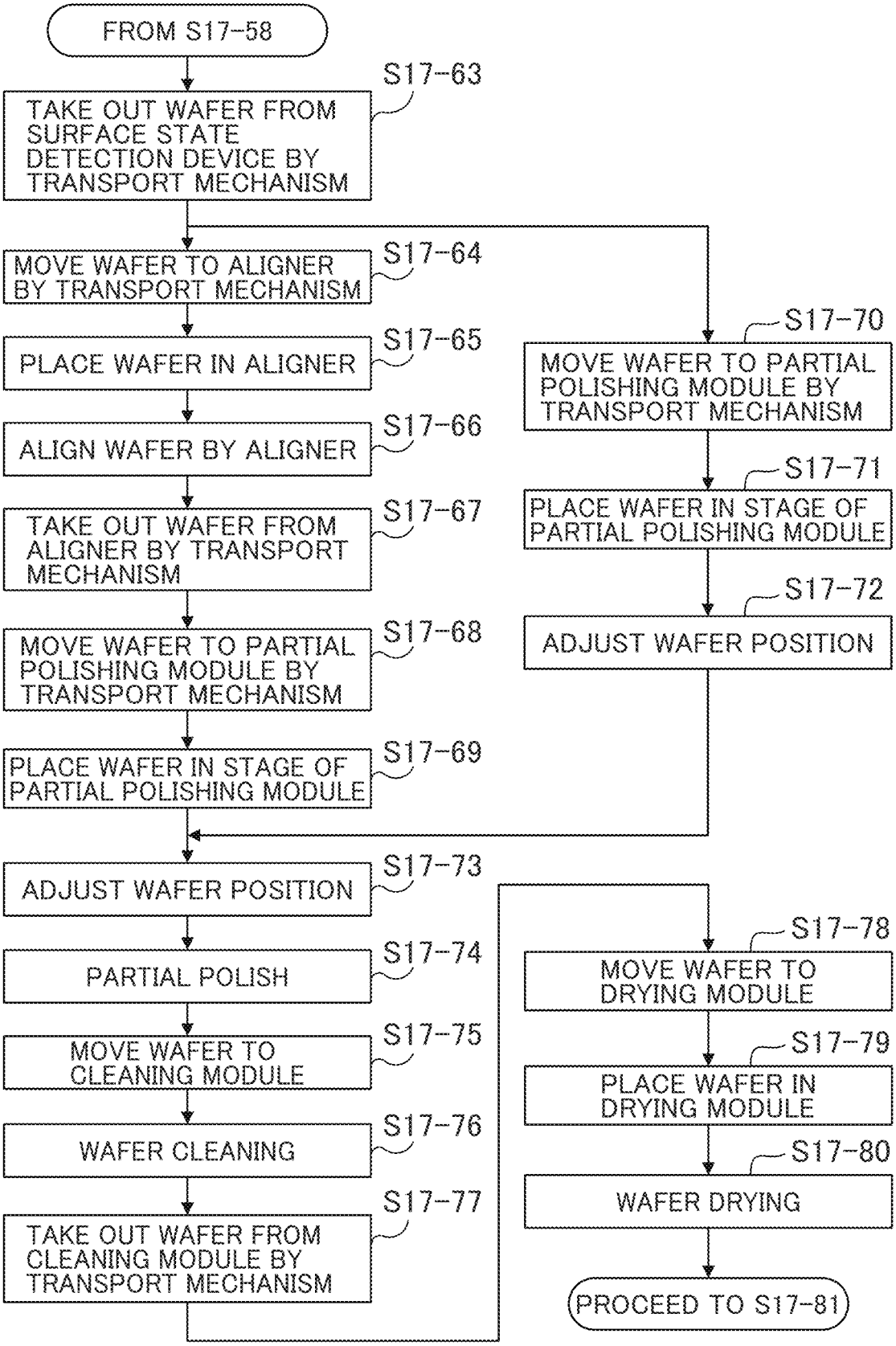
FIG. 32E is a flowchart showing the flow of polishing process according to the example 17, using the polishing machine according to one embodiment.
Figure 32F:
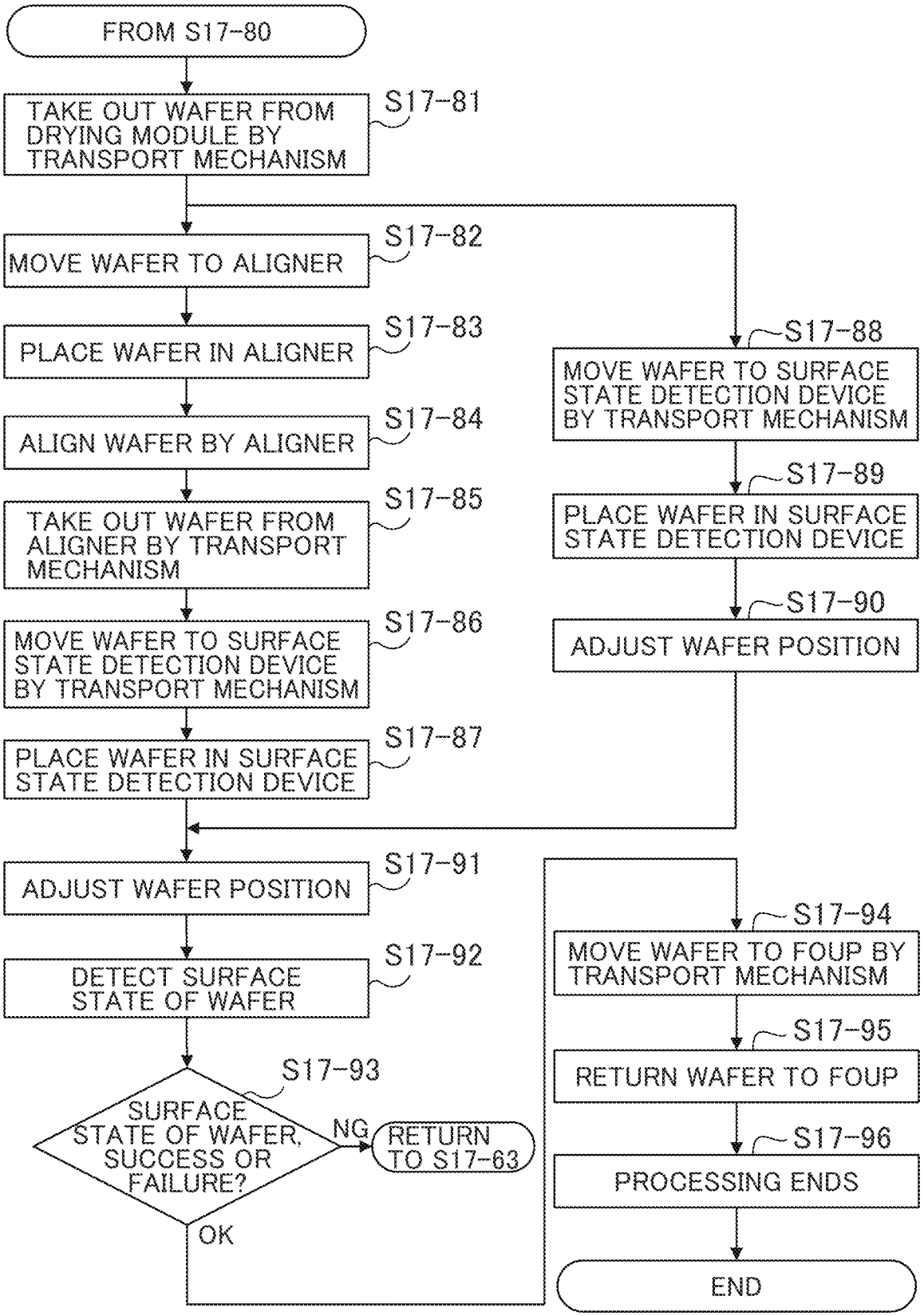
FIG. 32F is a flowchart showing the flow of polishing process according to the example 17, using the polishing machine according to one embodiment.
Figure 33A:
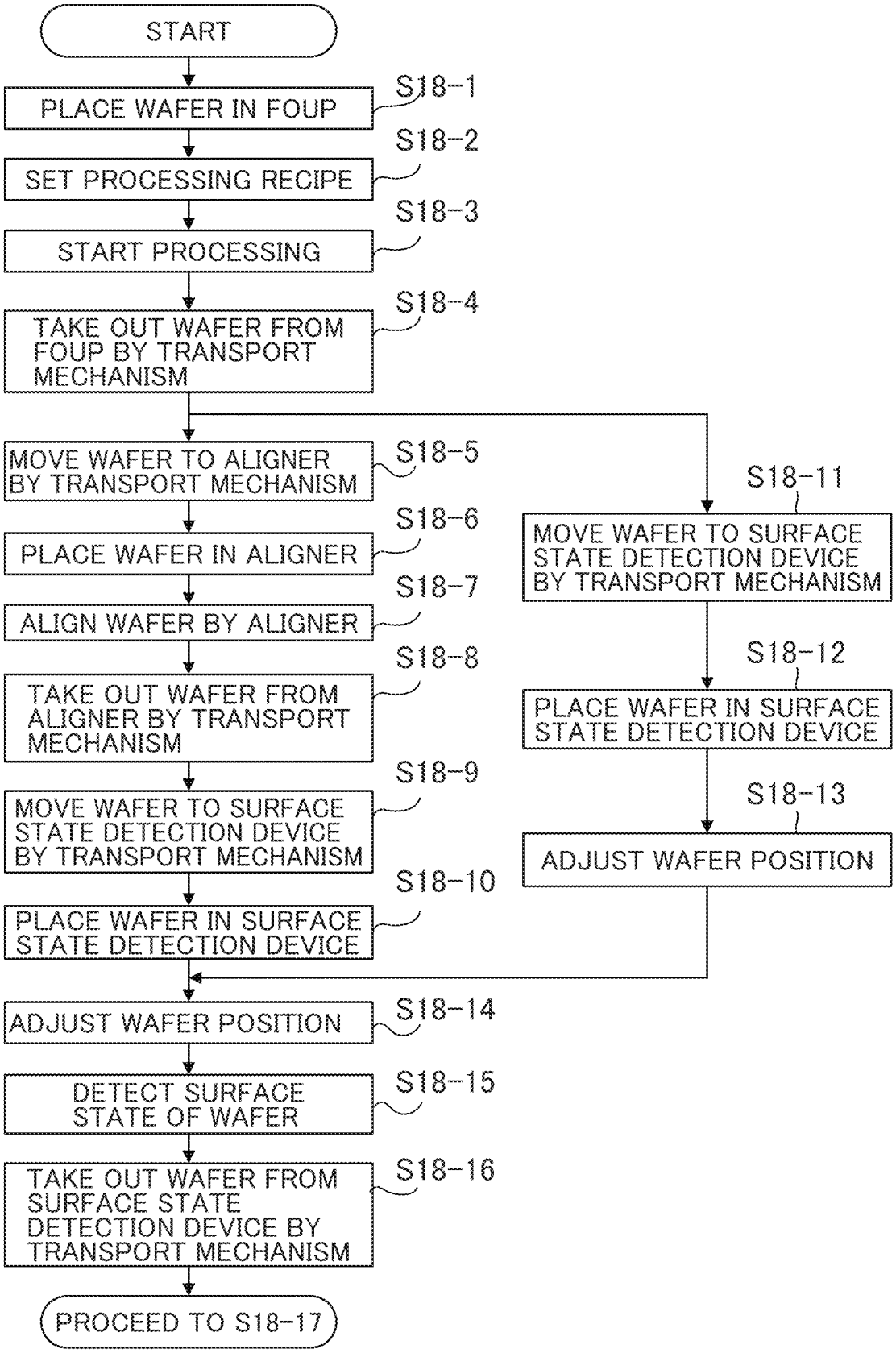
FIG. 33A is a flowchart showing a flow of polishing process according to an example 18, using a polishing machine according to one embodiment.
Figure 33B:
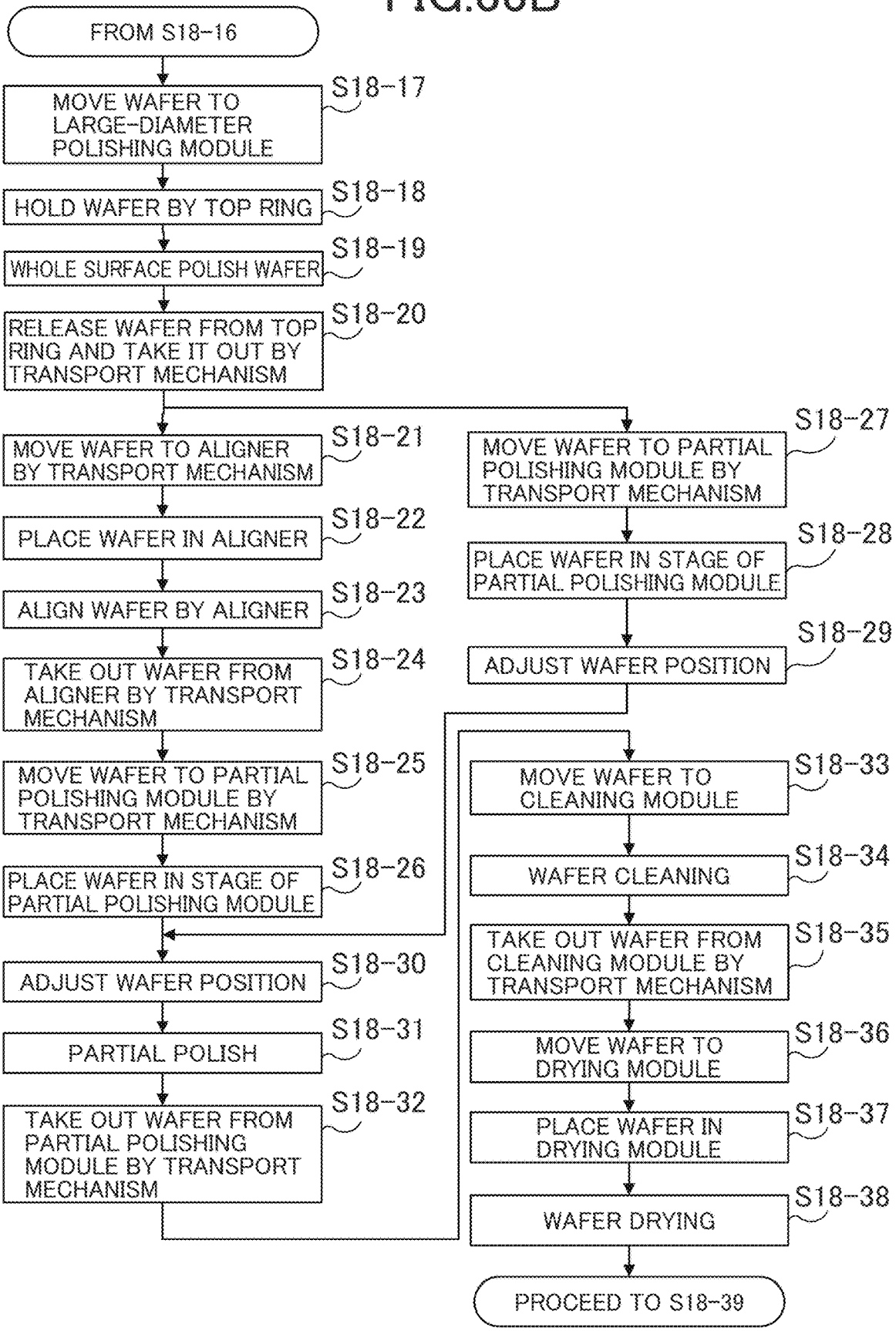
FIG. 33B is a flowchart showing the flow of polishing process according to the example 18, using the polishing machine according to one embodiment.
Figure 33C:
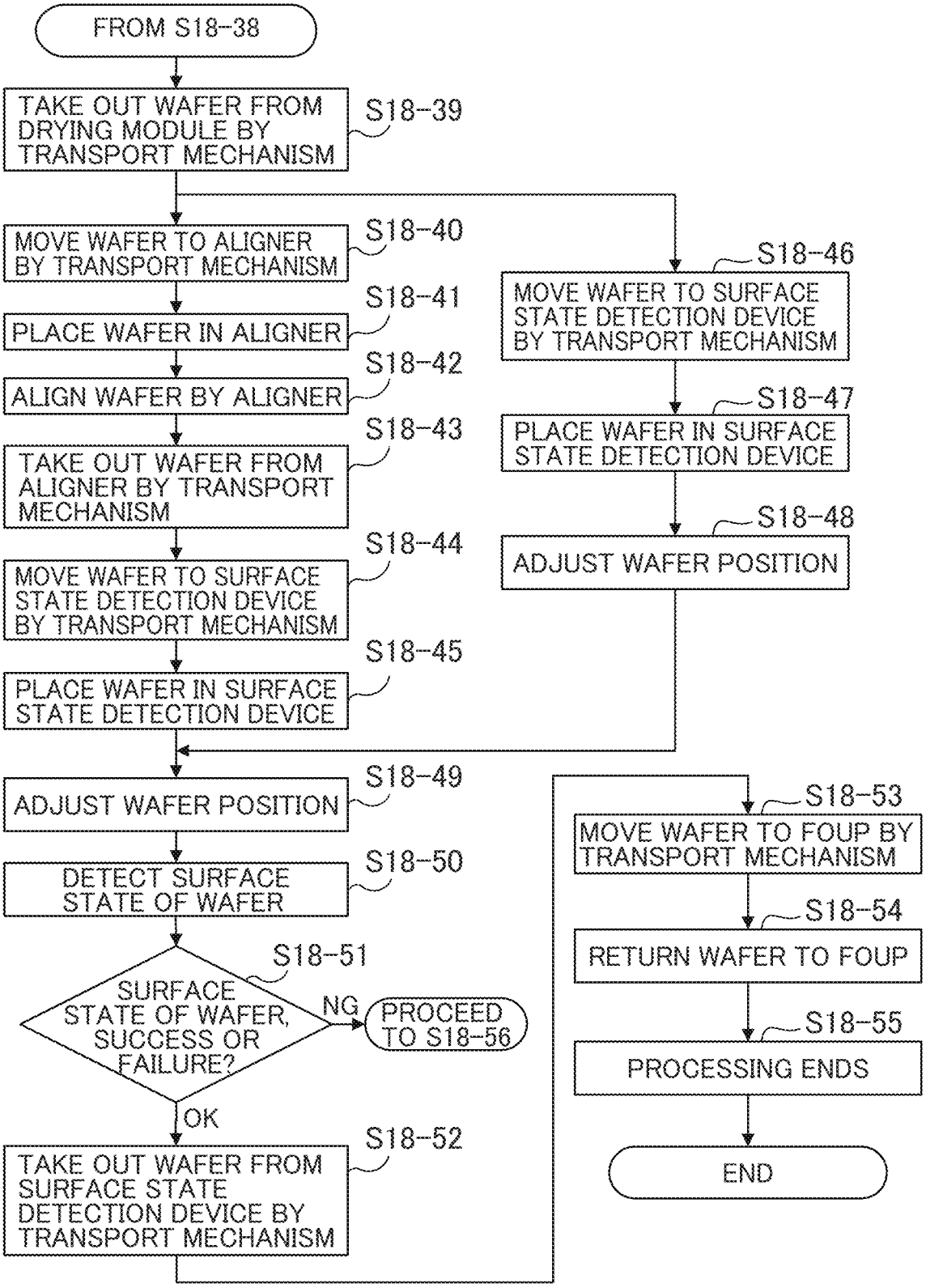
FIG. 33C is a flowchart showing the flow of polishing process according to the example 18, using the polishing machine according to one embodiment.
Figure 33D:
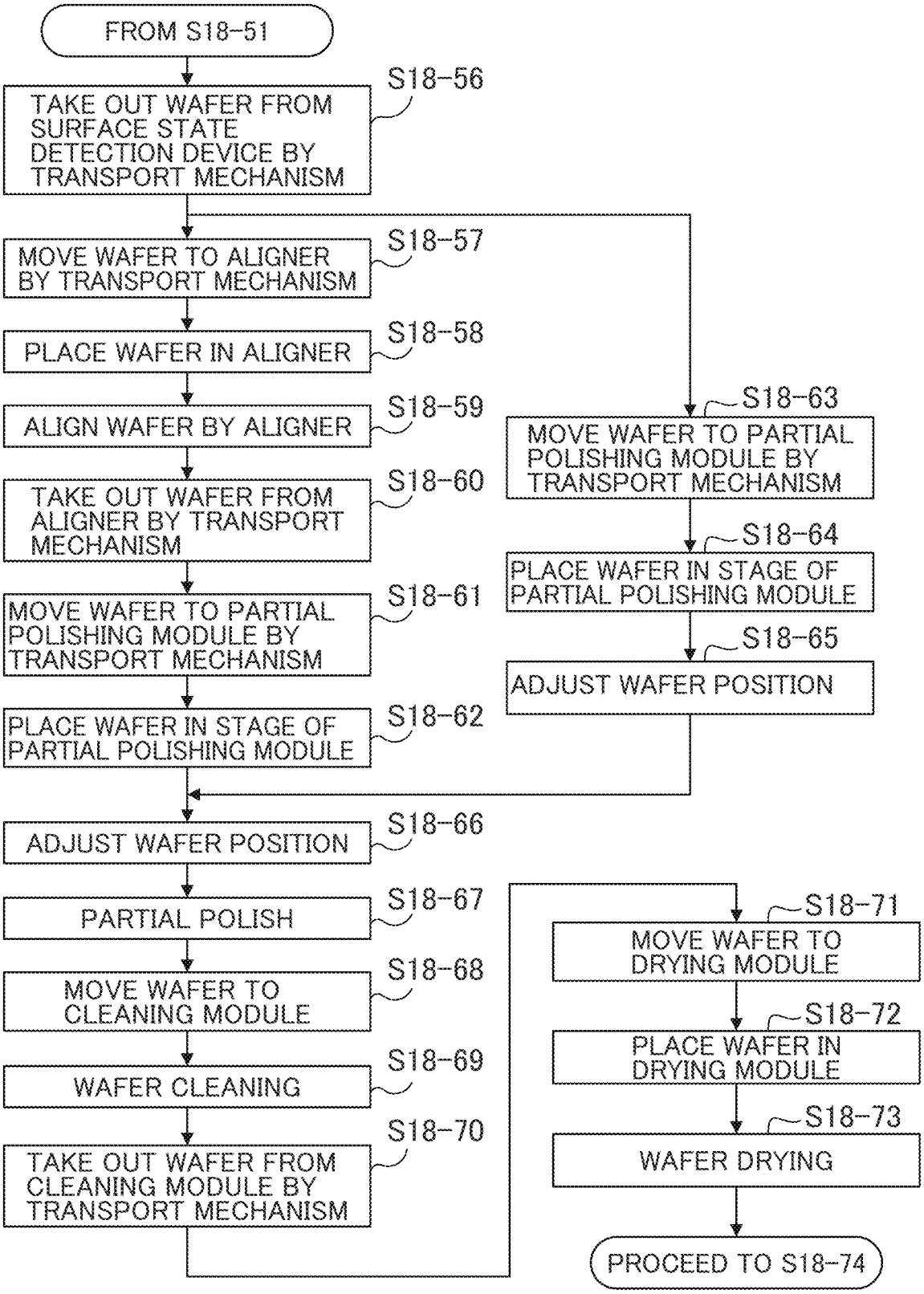
FIG. 33D is a flowchart showing the flow of polishing process according to the example 18, using the polishing machine according to one embodiment.
Figure 33E:
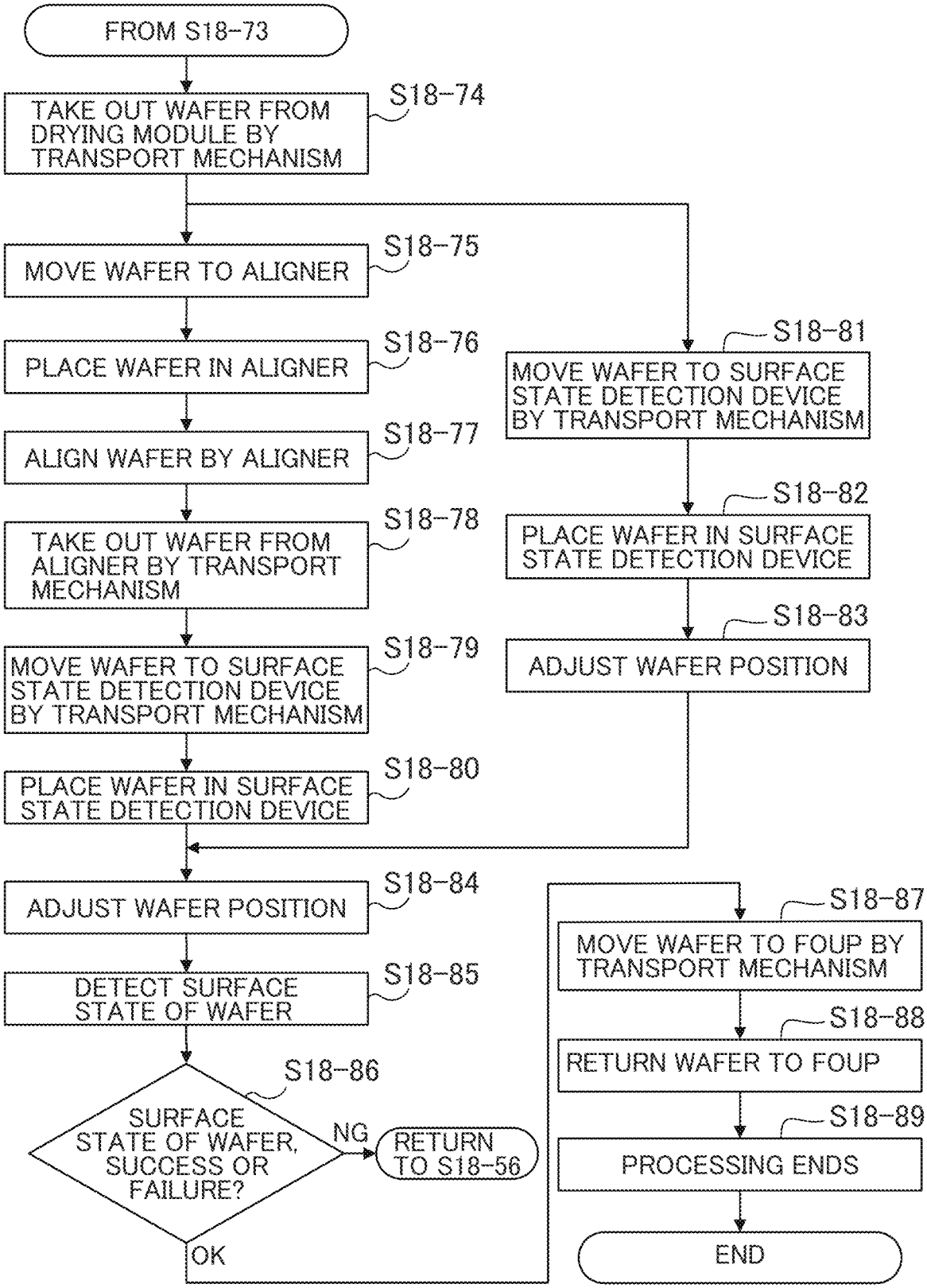
FIG. 33E is a flowchart showing the flow of polishing process according to the example 18, using the polishing machine according to one embodiment.
Figure 34A:
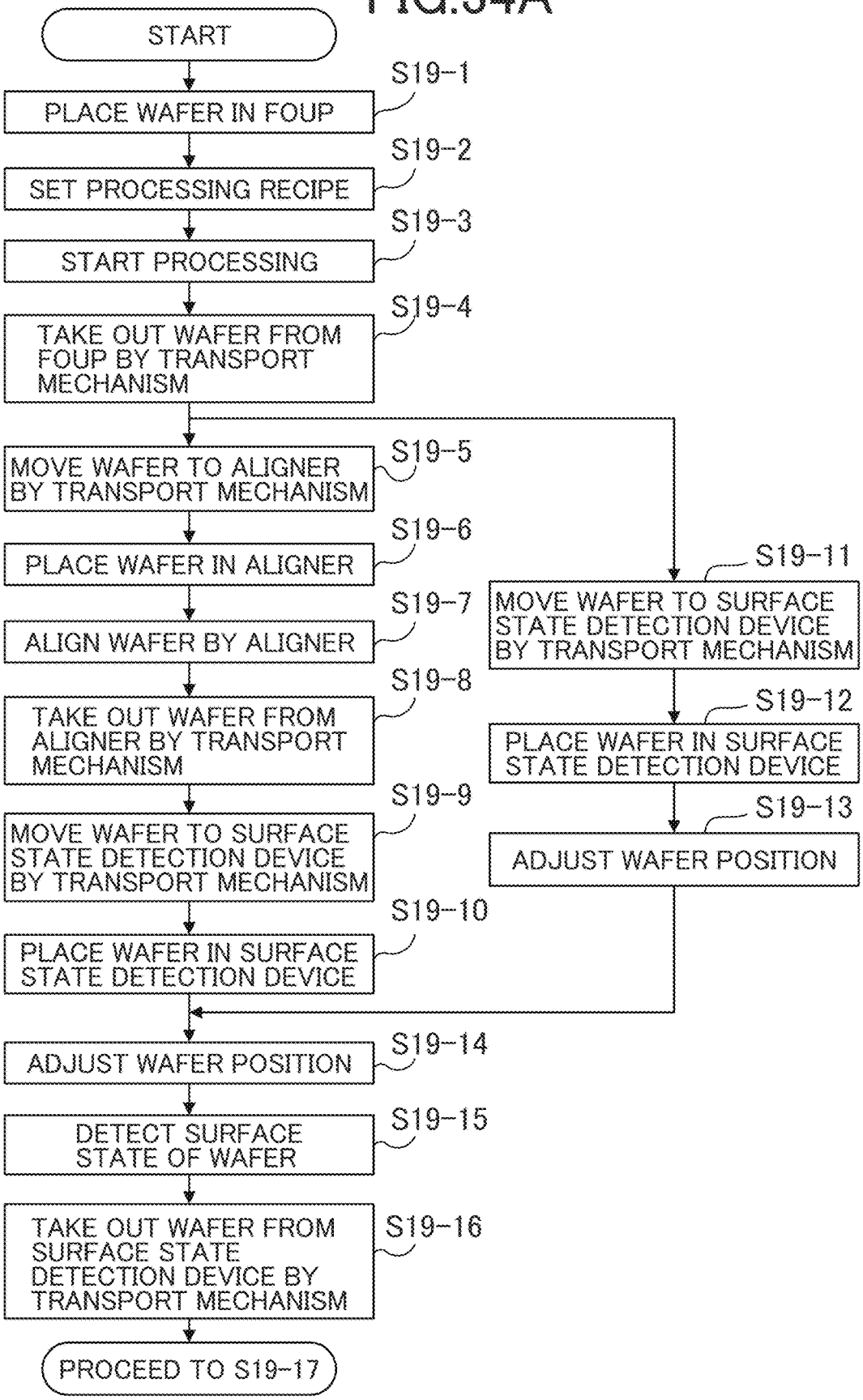
FIG. 34A is a flowchart showing a flow of polishing process according to an example 19, using a polishing machine according to one embodiment.
Figure 34B:
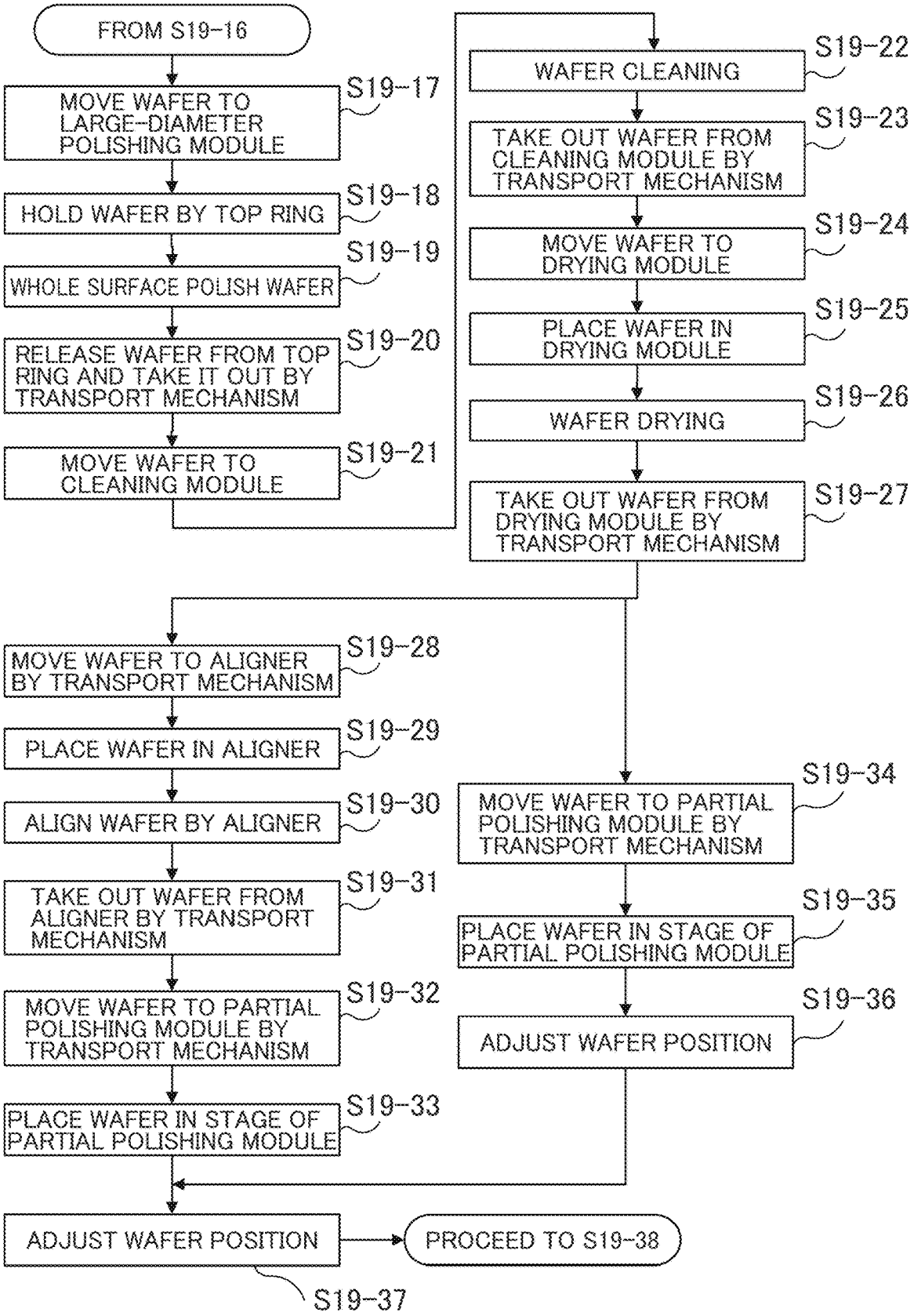
FIG. 34B is a flowchart showing the flow of polishing process according to the example 19, using the polishing machine according to one embodiment.
Figure 34C:
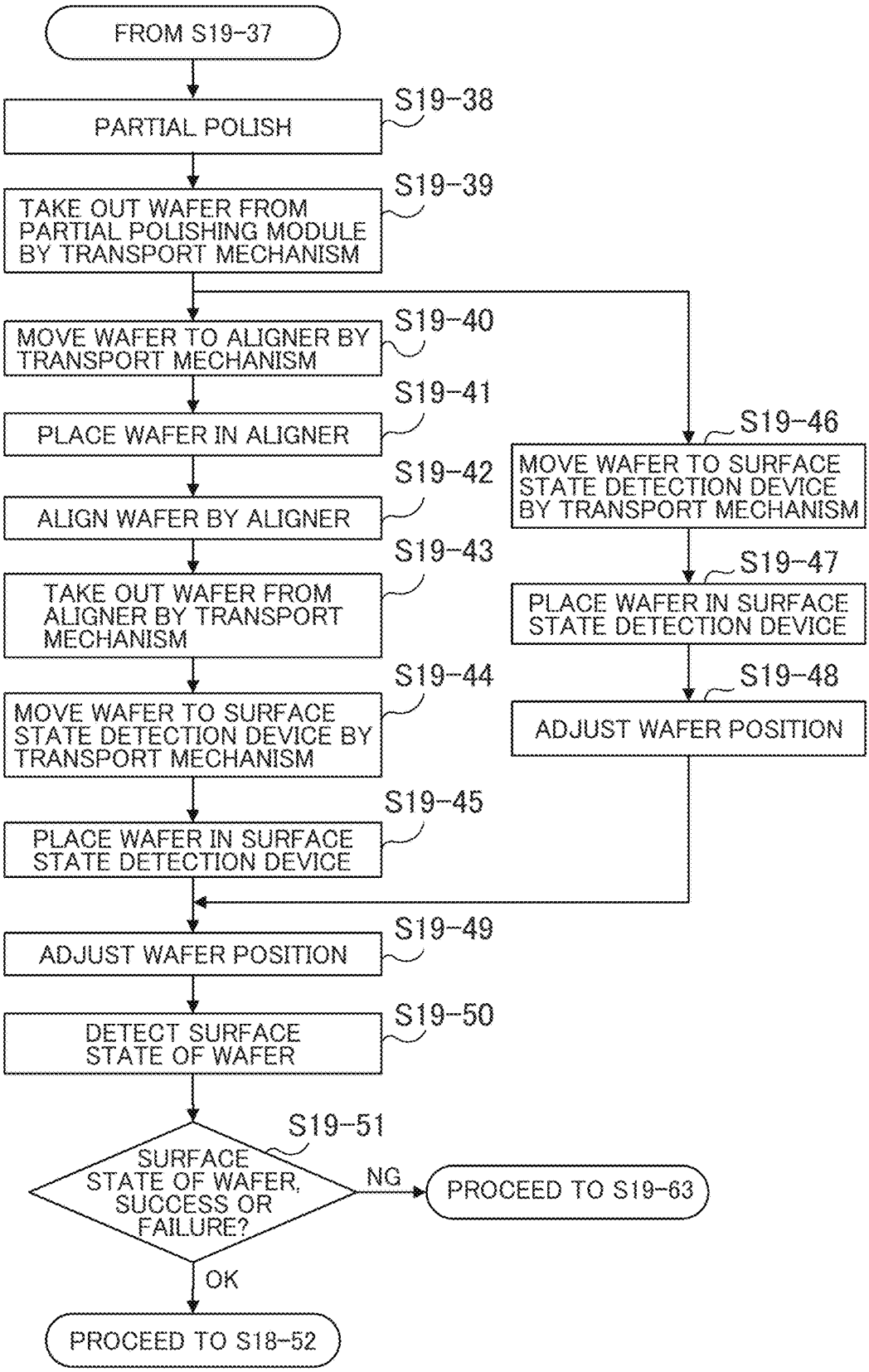
FIG. 34C is a flowchart showing the flow of polishing process according to the example 19, using the polishing machine according to one embodiment.
Figure 34D:
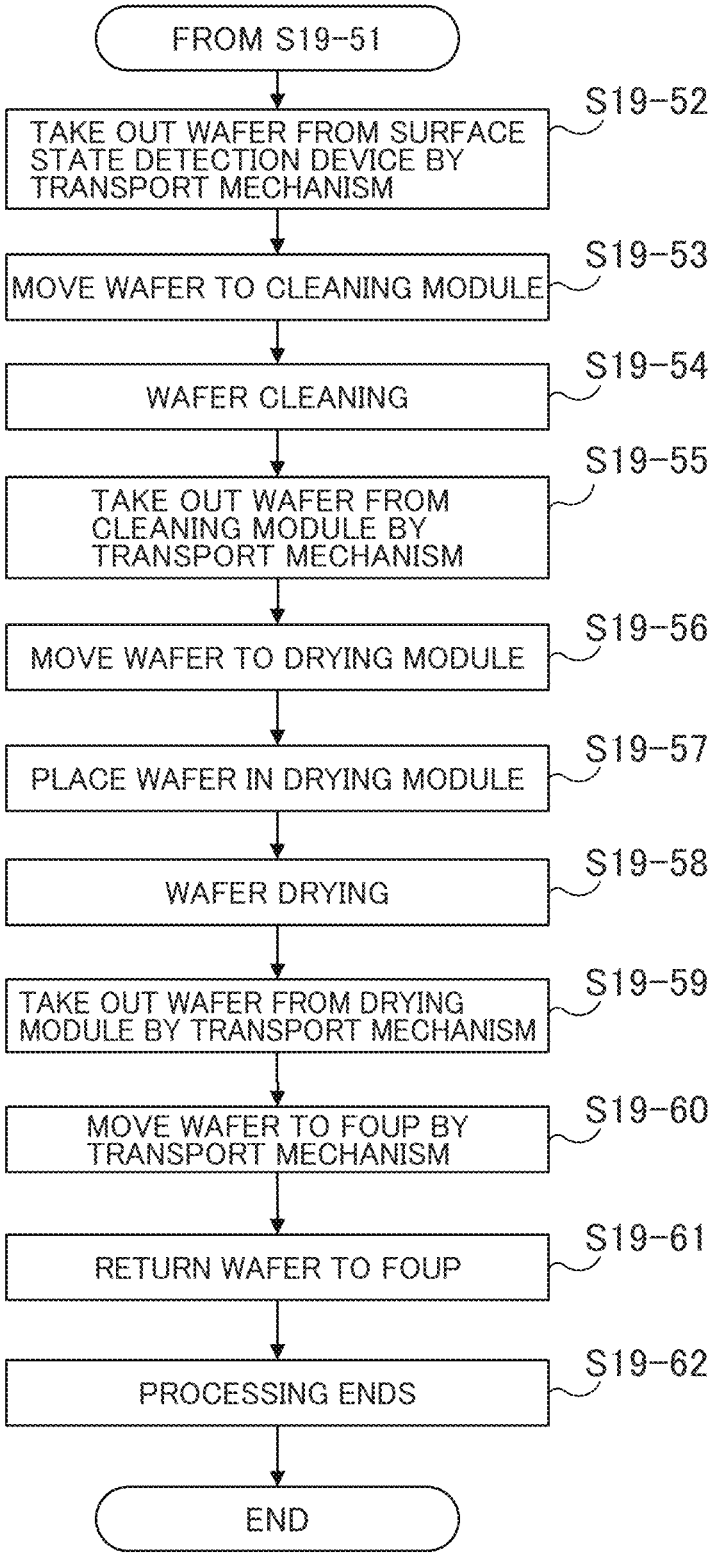
FIG. 34D is a flowchart showing the flow of polishing process according to the example 19, using the polishing machine according to one embodiment.
Figure 34E:
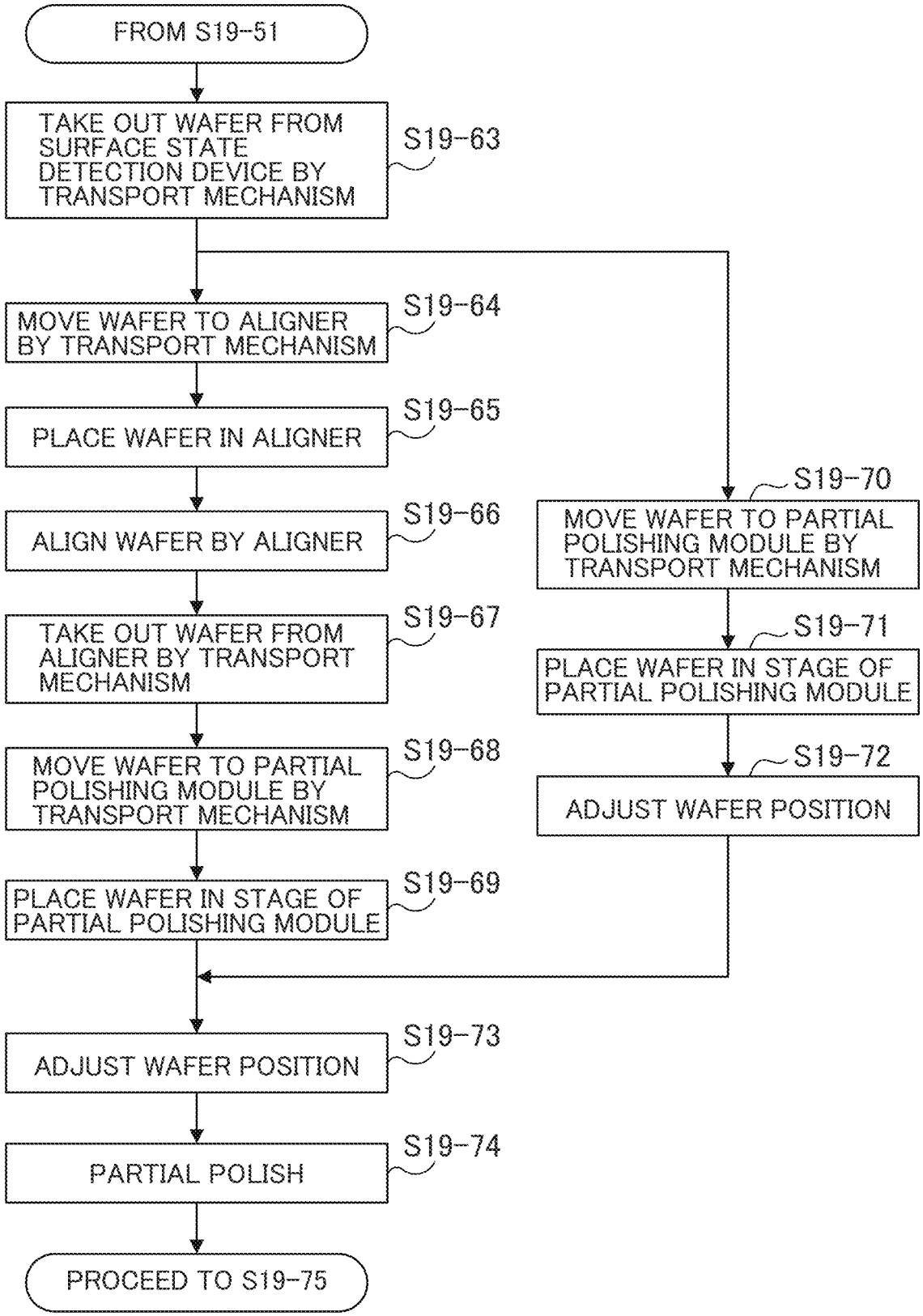
FIG. 34E is a flowchart showing the flow of polishing process according to the example 19, using the polishing machine according to one embodiment.
Figure 34F:
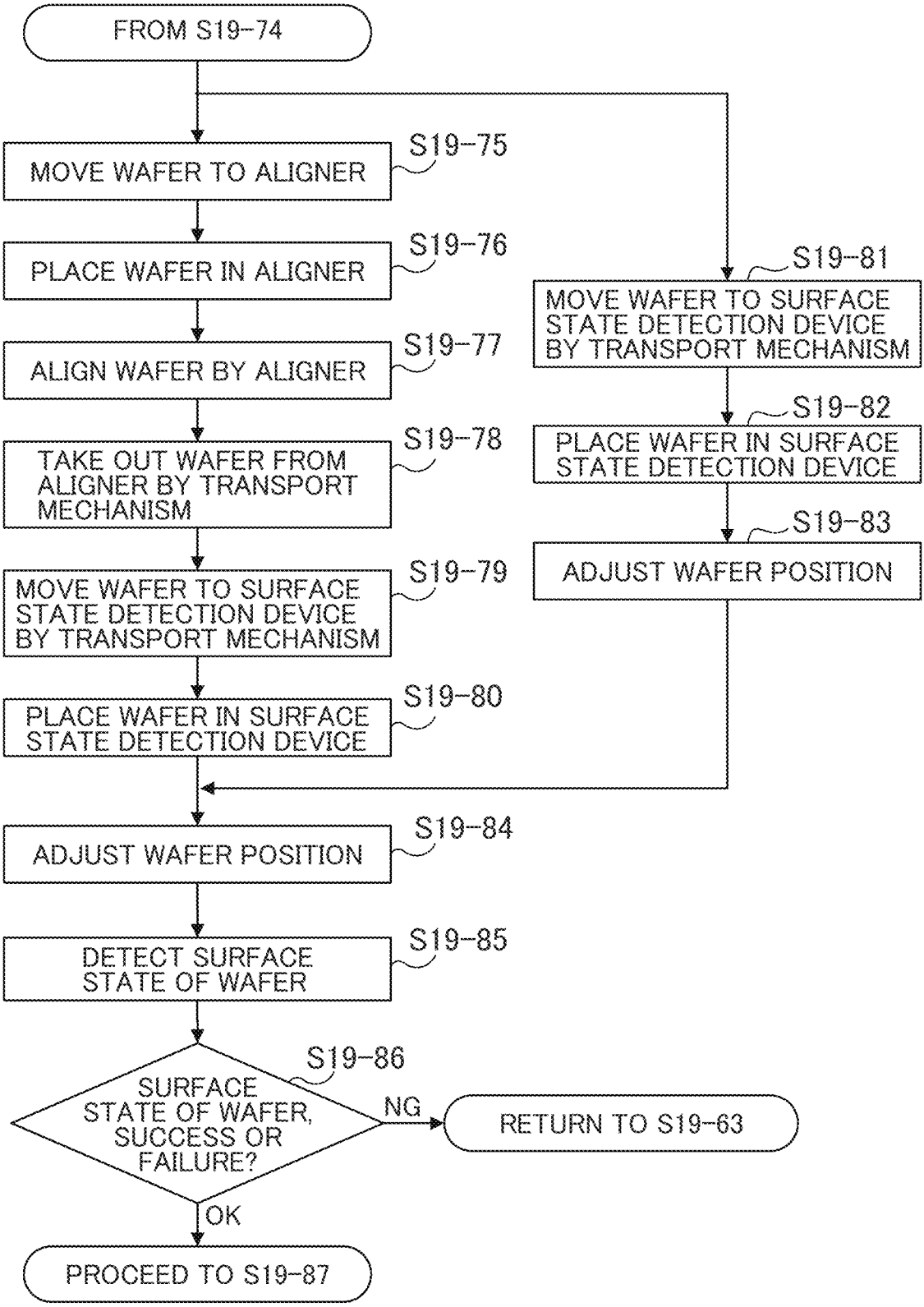
FIG. 34F is a flowchart showing the flow of polishing process according to the example 19, using the polishing machine according to one embodiment.
Figure 34G:
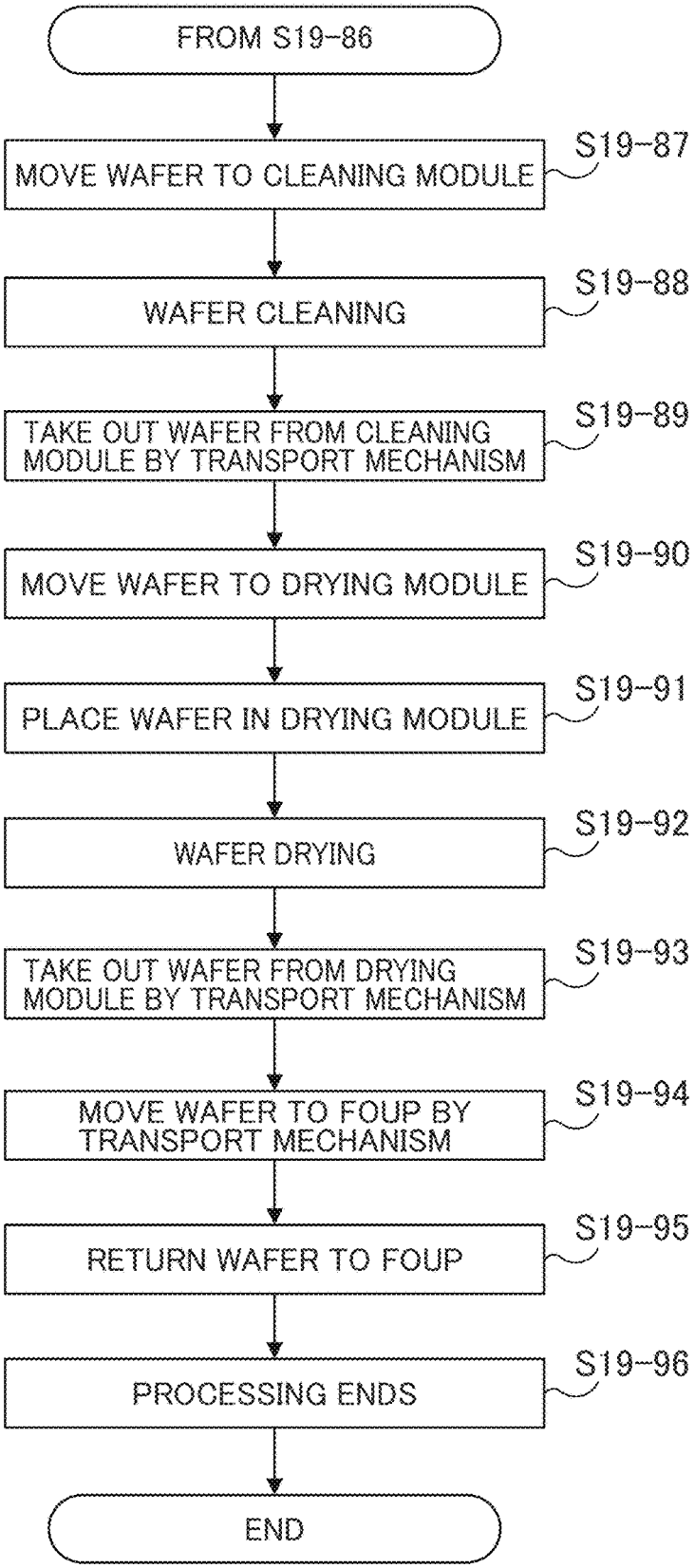
FIG. 34G is a flowchart showing the flow of polishing process according to the example 19, using the polishing machine according to one embodiment.
Figure 35A:
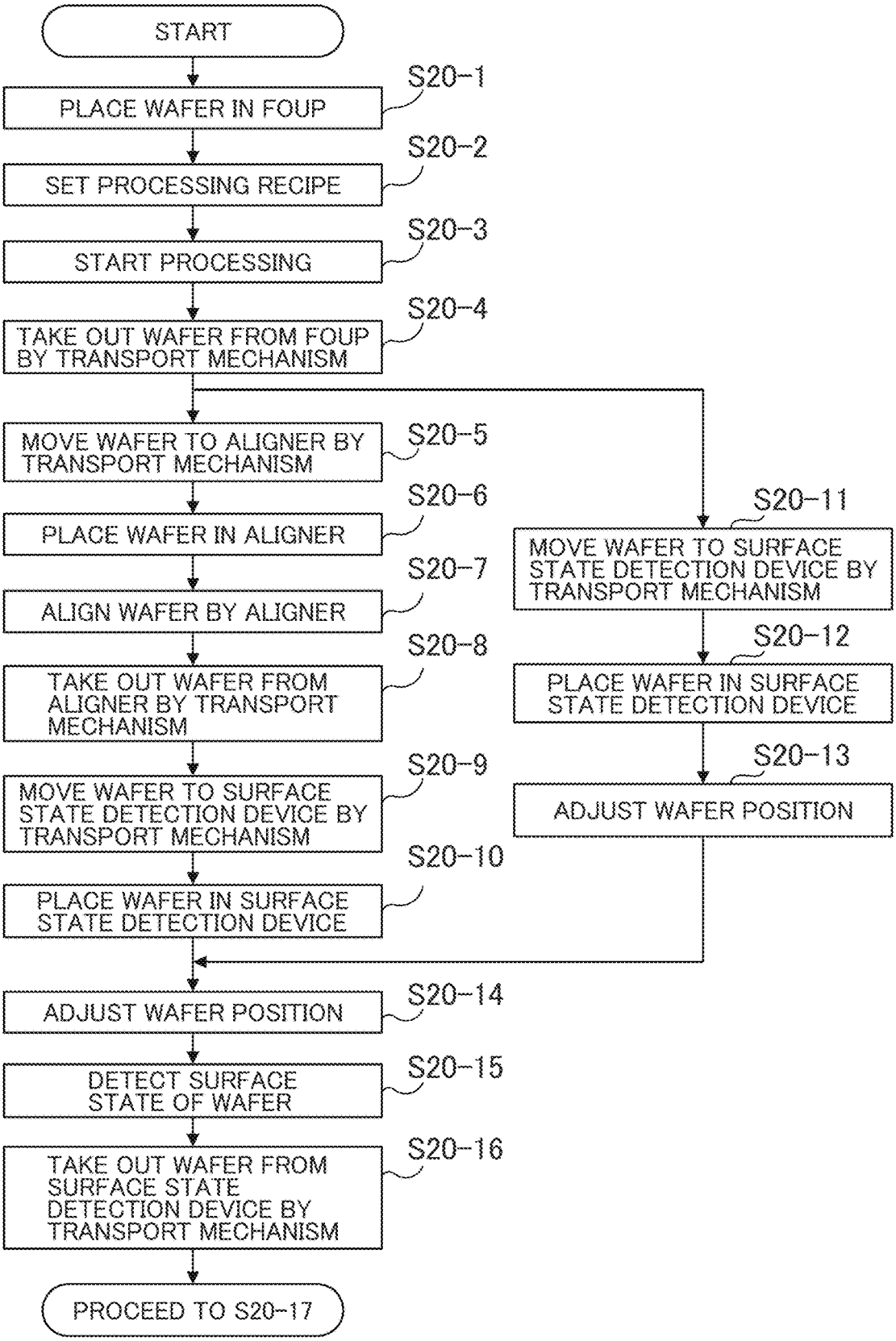
FIG. 35A is a flowchart showing a flow of polishing process according to an example 20, using a polishing machine according to one embodiment.
Figure 35B:
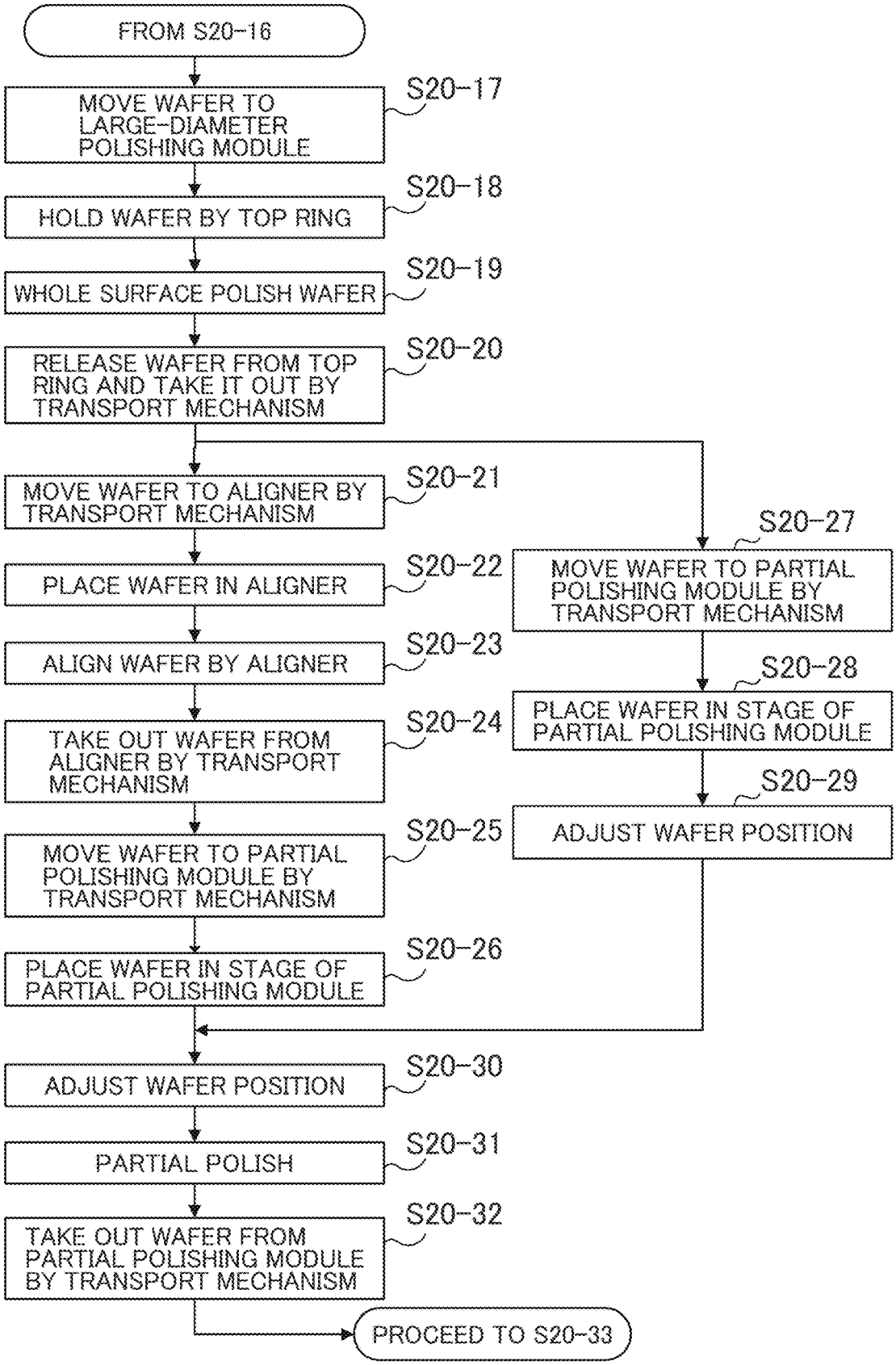
Figure 35C:
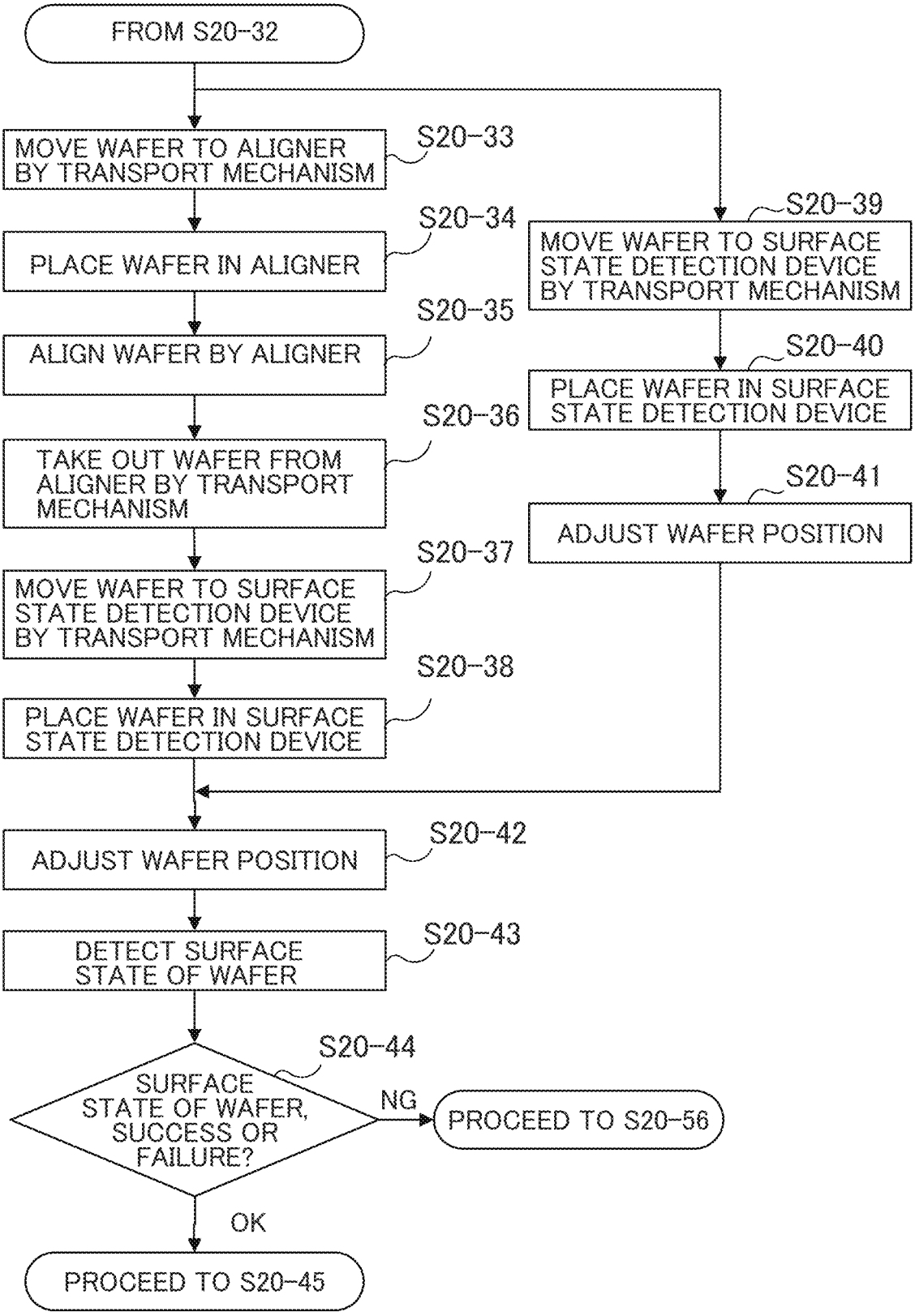
Figure 35D:
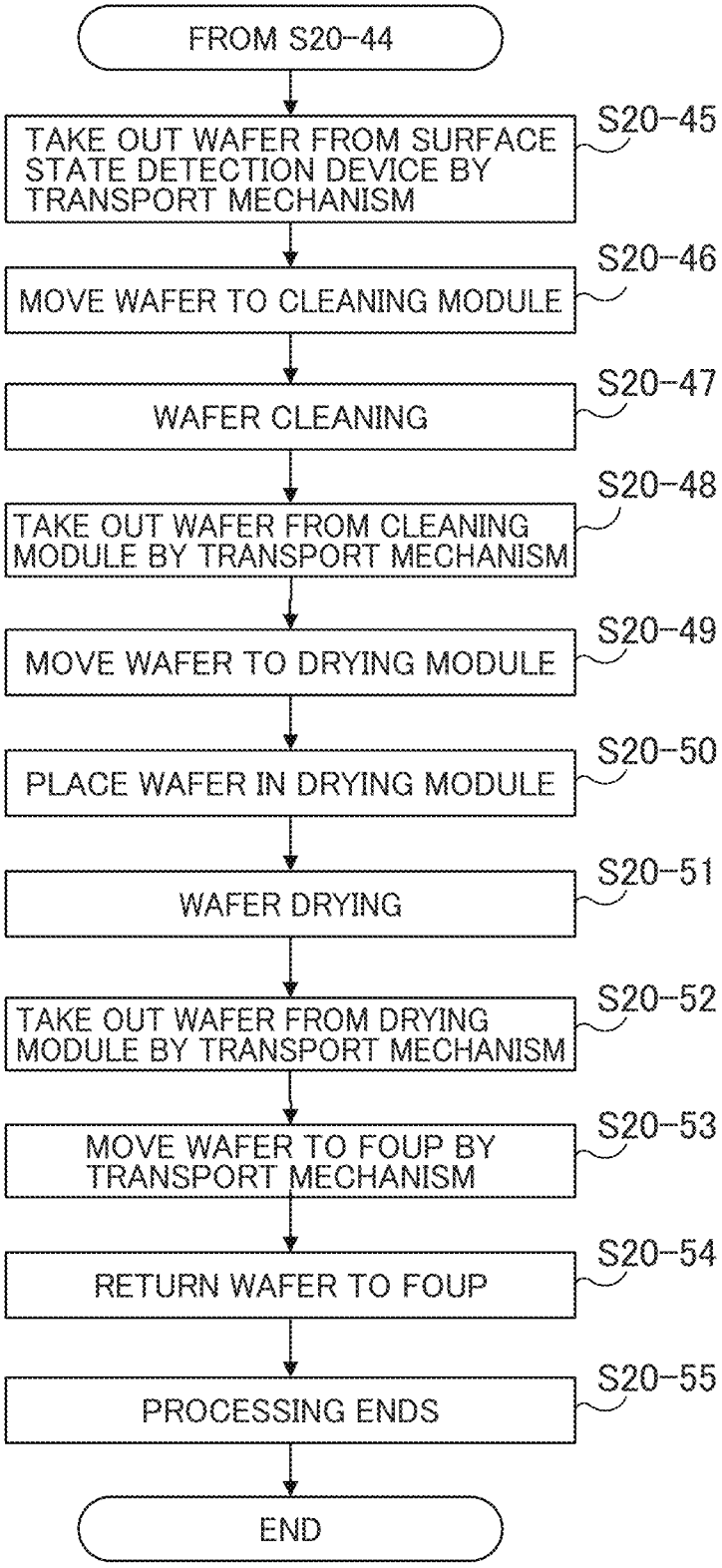
Figure 35E:
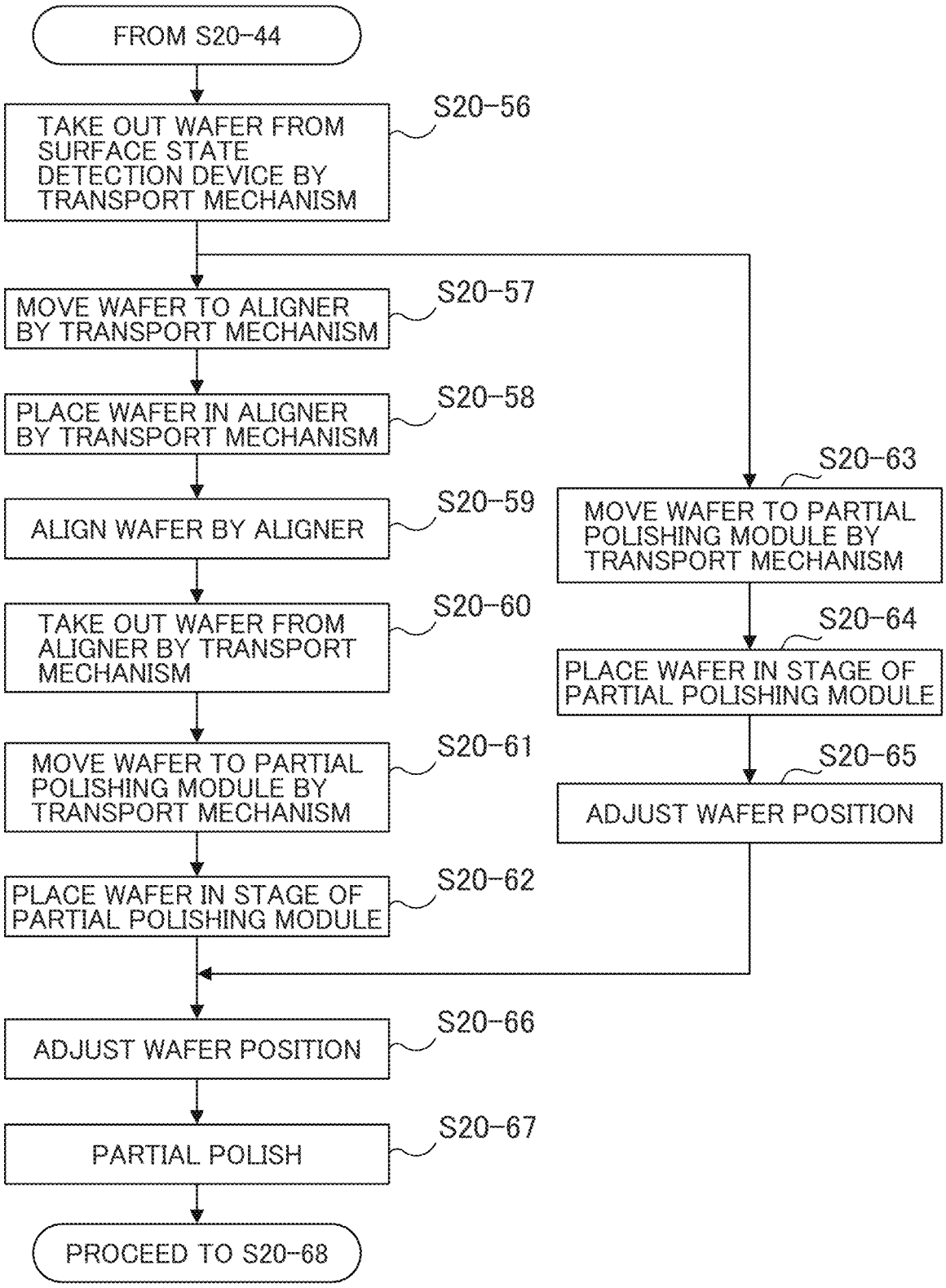
Figure 35F:
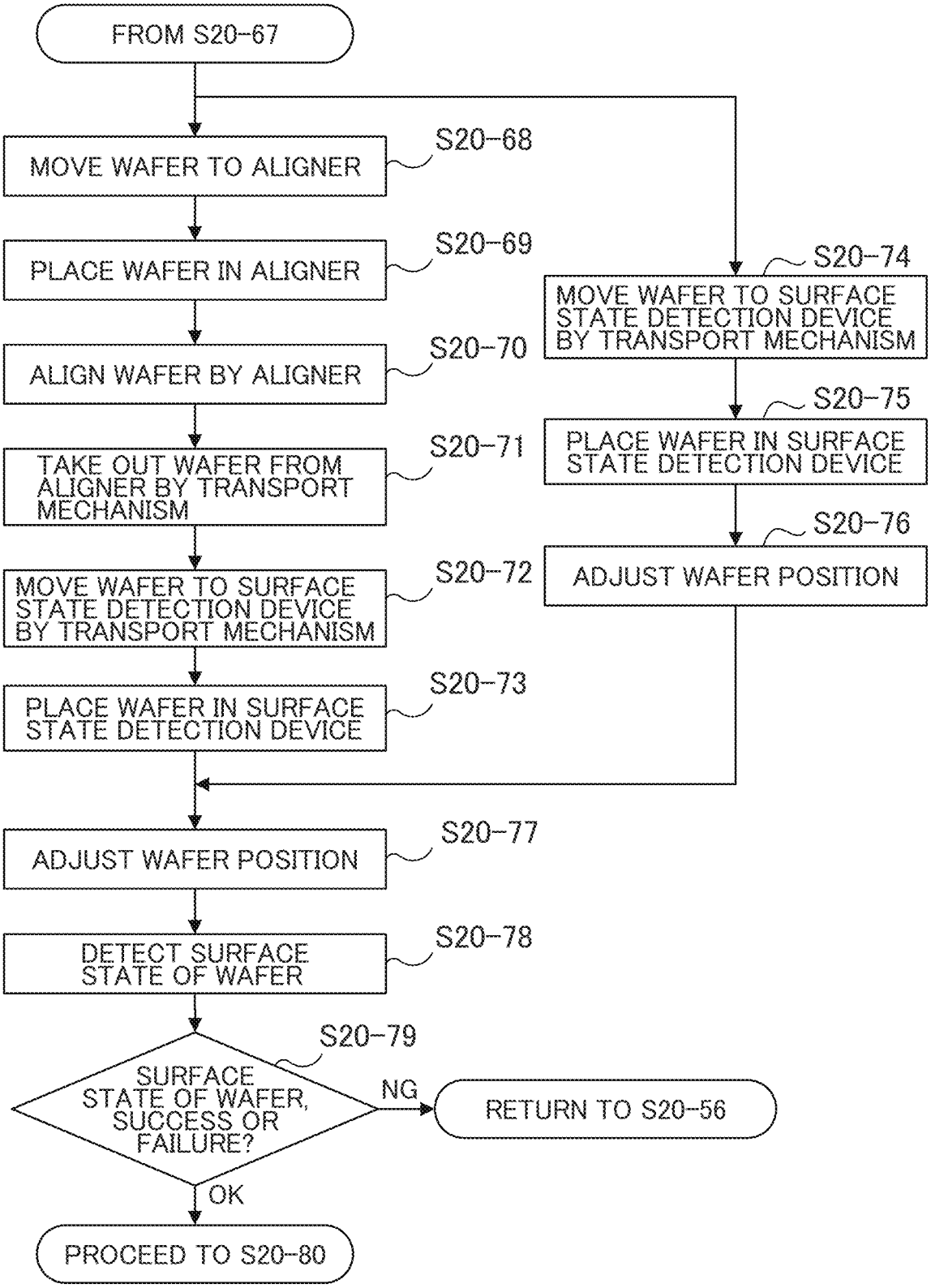
Figure 35G:
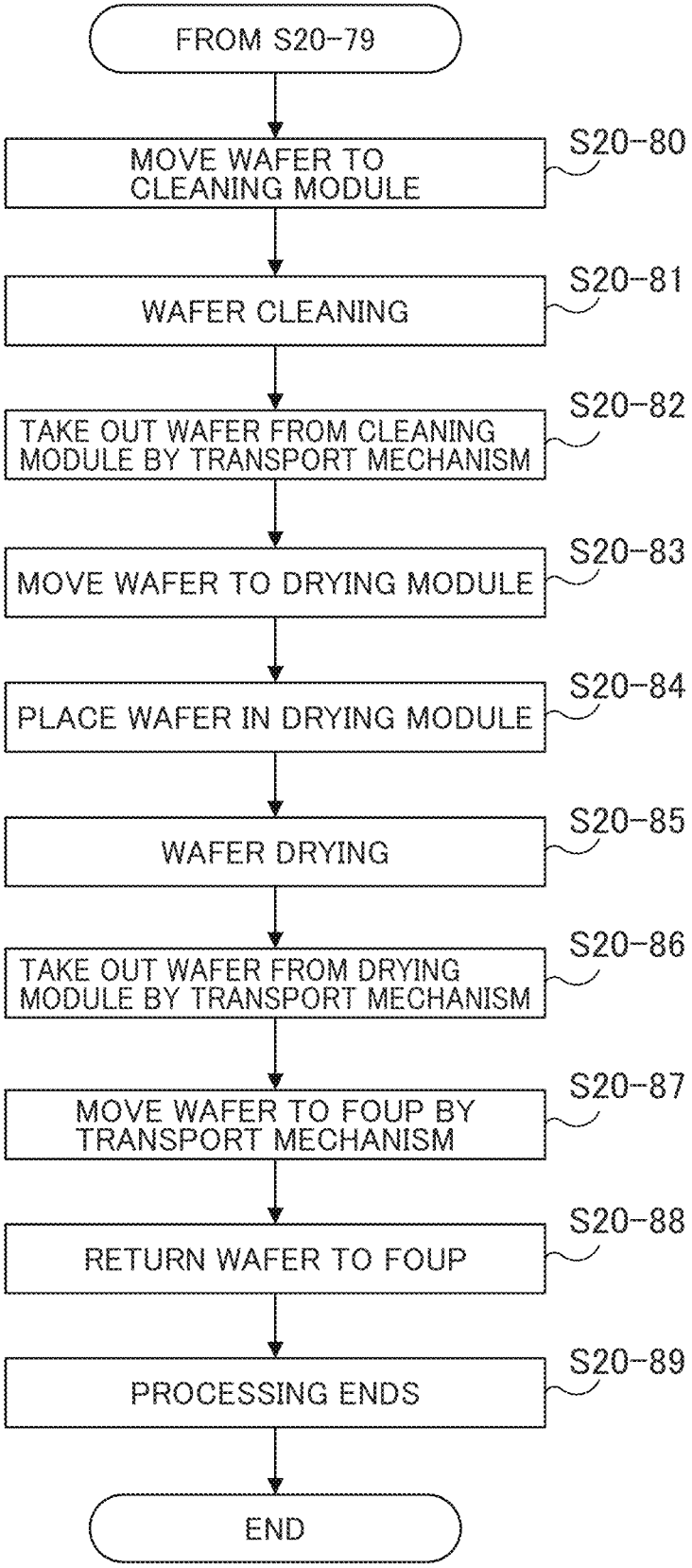
Figure 36A:
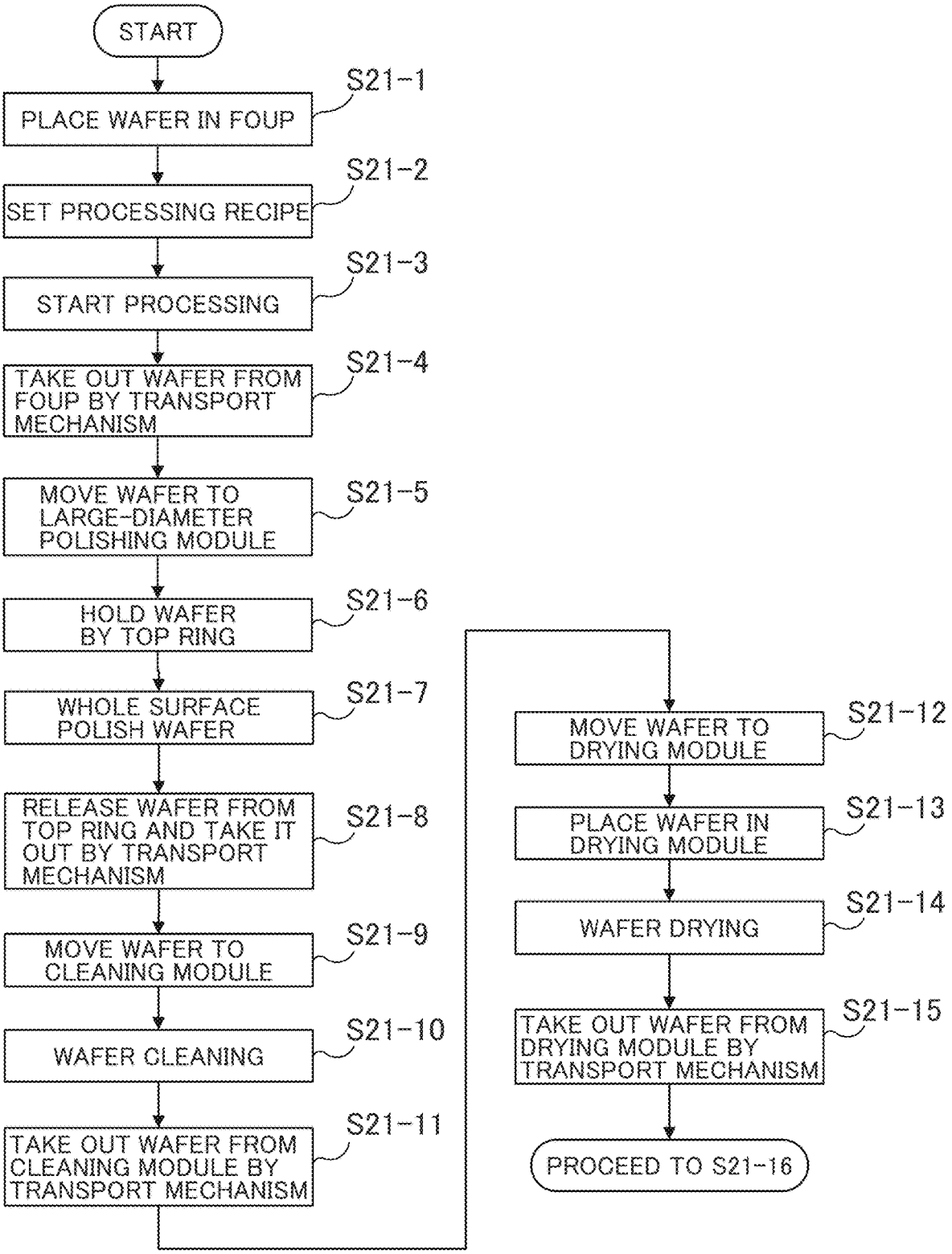
Figure 36B:
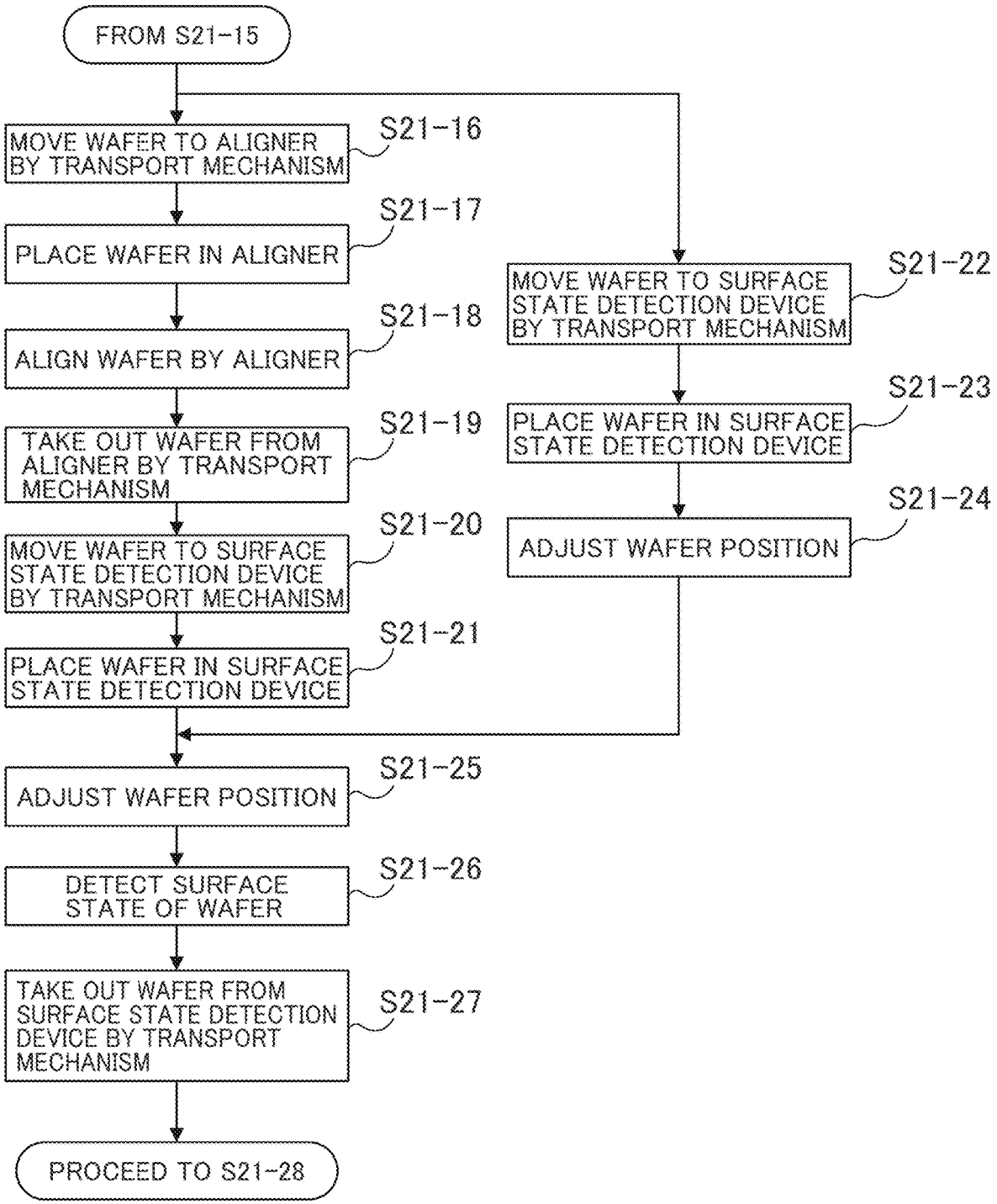
Figure 36C:
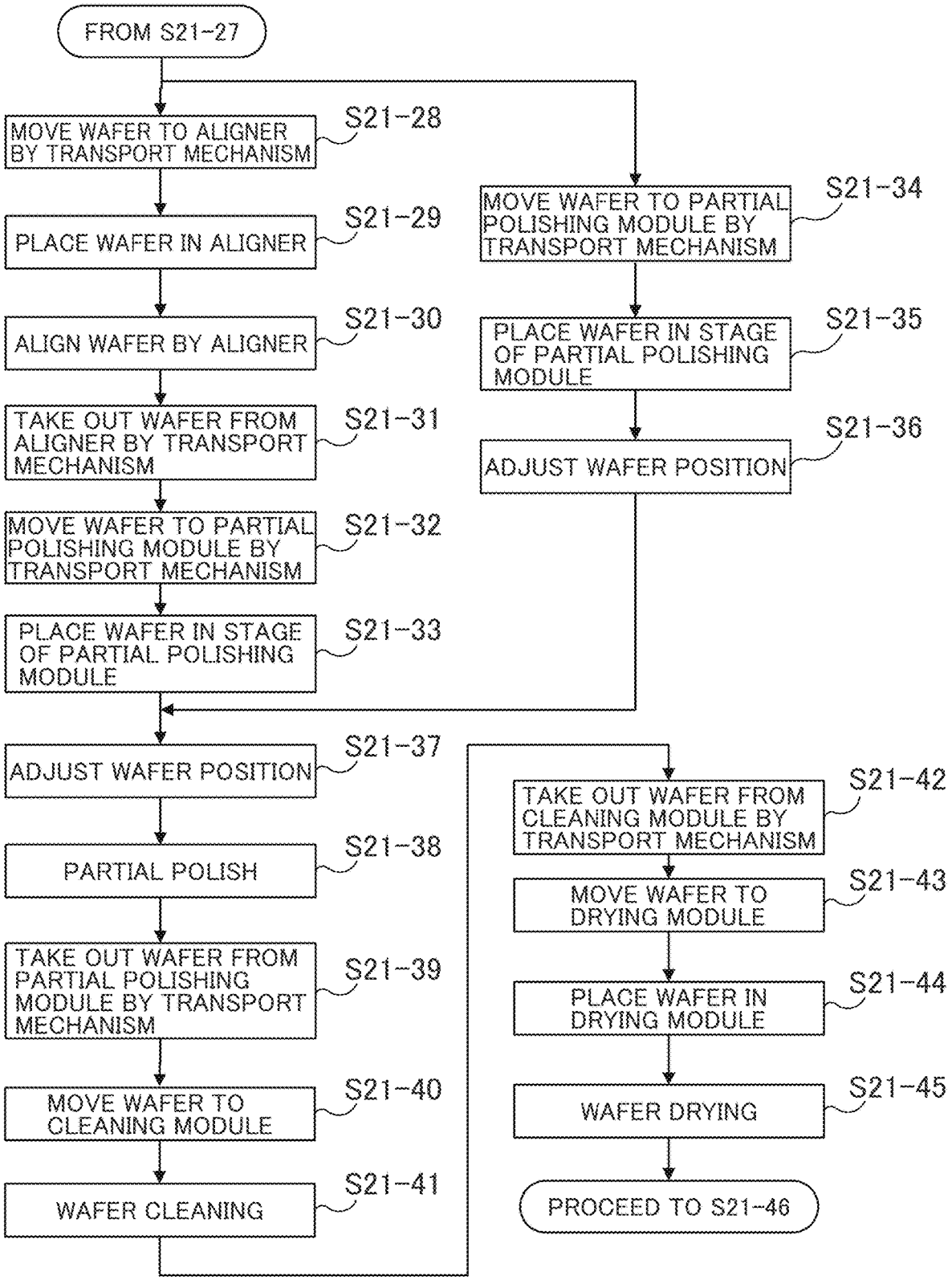
Figure 36D:
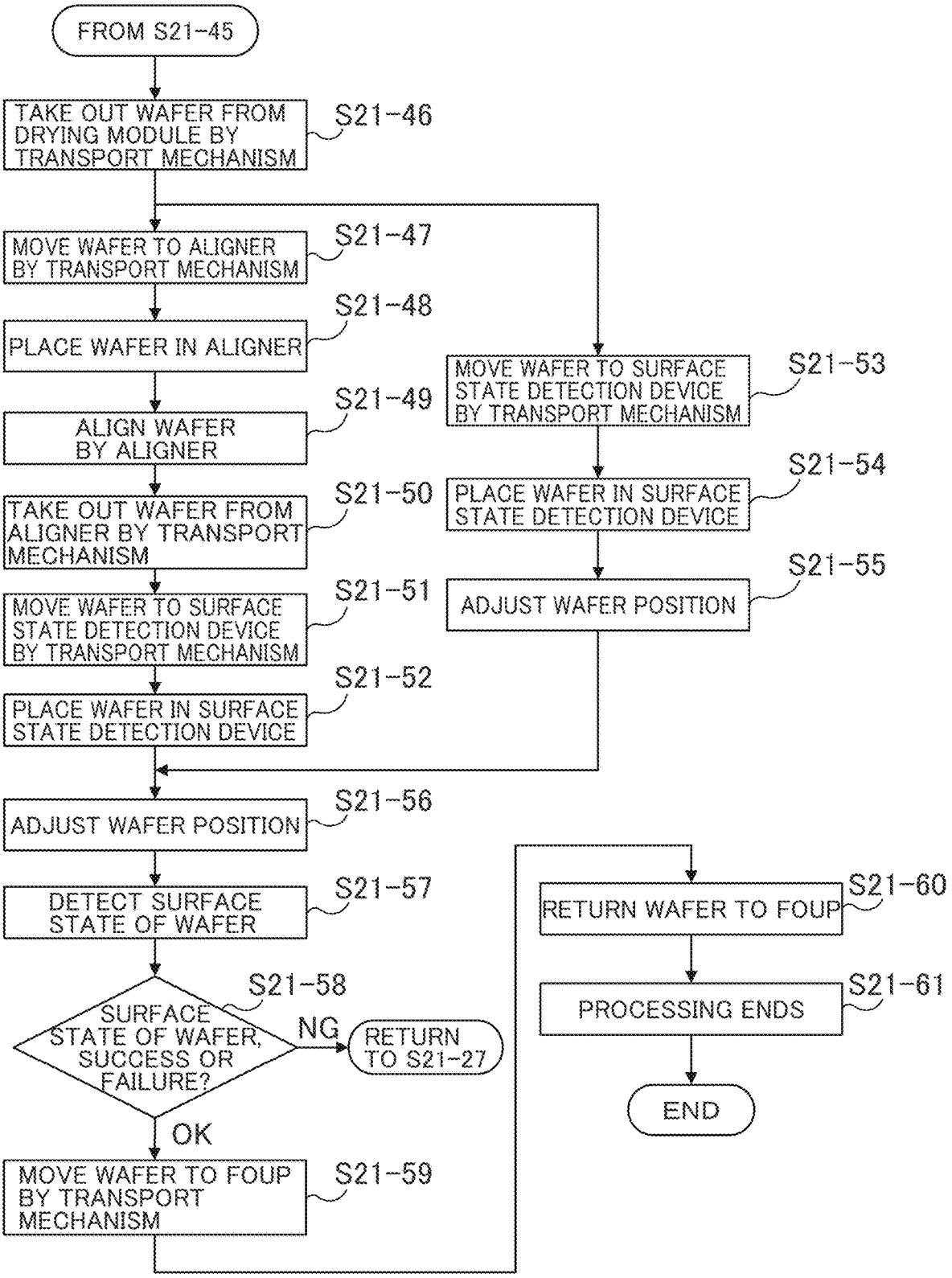

FIGS. 31A to 31C are a flowchart showing process of a polishing machine according to one example. A hardware configuration of the polishing machine of Example 16 is similar to that of the polishing machine of Example 4. A behavior of the polishing machine of this example will be described with reference to FIGS. 31A to 31C. Steps S16-1 to S16-27 are similar to steps S12-1 to S12-27 of Example 12. In Example 16, subsequently, whole surface polishing is performed (from S16-28 to S16-29). Subsequently, cleaning and drying are performed (from S16-30 to S16-36). Subsequently, the wafer Wf is moved to FOUP (S16-37, 38). Subsequently, the wafer Wf is stored in FOUP (S16-39). Subsequently, process in the polishing machine is terminated (S16-40).

Example 17

FIGS. 32A to 32F are a flowchart showing process of a polishing machine according to one example. A hardware configuration of the polishing machine of Example 17 is similar to that of the polishing machine of Example 4. A behavior of the polishing machine of this example will be described with reference to FIGS. 32A to 32F. In Example 17, differently from Examples 4 to 16, partial polishing is performed after whole surface polishing.

Similarly to other examples, after, first, a processing recipe is set, the surface state of the wafer Wf is detected (from S17-1 to S17-15). Subsequently, whole surface polishing is performed (from S17-16 to S17-19), and the wafer Wf is cleaned (from S17-20 to S17-22) and the wafer Wf is dried (from S17-23 to S17-26). Subsequently, the wafer Wf is partially polished (from S17-27 to S17-38). Subsequently, the wafer Wf is cleaned (from S17-39 to S17-41) and the wafer Wf is dried (from 17-42 to S17-45), and the surface state of the wafer Wf is detected (from S17-46 to S17-57). Subsequently, it is determined whether the surface state of the wafer Wf passes or fails (S17-58). Indications of a criterion for judging whether the surface state passes or fails include, for example, a residual film of the surface to be polished, a surface shape and a distribution of signals corresponding to those on the surface of a wafer Wf or a distribution of polishing amounts on the surface of a wafer Wf, and at least one of those is the judgment criterion. For example, by comparing at least one of the residual film state, the shape state and the polishing amount measured at step S17-57 with a corresponding one of a residual film state, a shape state and a polishing amount that are set as a target, it is determined whether the surface state of the wafer passes or fails. At step S17-58, if it is determined that the indication neither reaches a target value nor falls within a target range, proceed to step S17-63, and partial polishing performed again. At step S17-58, if it is determined that the indication reaches the target value or falls within the target range, the wafer Wf is returned to FOUP and process is terminated (from S17-59 to S17-62). A feedback control of partial polishing, cleaning, drying and detection after step S17-63 is similar to that in steps from S7-63 to S7-96 of Example 7, and description thereof will be omitted.

Example 18

FIGS. 33A to 33D are a flowchart showing process of a polishing machine according to one example. A hardware configuration of the polishing machine of Example 18 is similar to that of the polishing machine of Example 4. A behavior of the polishing machine of this example will be described with reference to FIGS. 33A to 33D. Steps S18-1 to S18-19 are similar to steps S17-1 to S17-19 of Example 17. Subsequently, in Example 18, the wafer Wf is partially polished (from S18-20 to S18-31), and the wafer Wf is cleaned (from S18-32 to S18-34) and dried (from S18-35 to S18-38). Subsequently, the surface state of the wafer Wf is detected (from S18-39 to S18-50). Subsequently, it is determined whether the surface state of the wafer Wf passes or fails (S18-51). Indications of a criterion for judging whether the surface state passes or fails include, for example, a residual film of the surface to be polished, a surface shape and a distribution of signals corresponding to those on the surface of a wafer Wf or a distribution of polishing amounts on the surface of a wafer Wf, and at least one of those is the judgment criterion. For example, by comparing at least one of the residual film state, the shape state and the polishing amount measured at step S18-50 with a corresponding one of a residual film state, a shape state and a polishing amount that are set as a target, it is determined whether the surface state of the wafer passes or fails. At step S18-51, if it is determined that the indication neither reaches a target value nor falls within a target range, proceed to step S18-56, and partial polishing is performed again. At step S18-51, if it is determined that the indication reaches the target value or falls within the target range, the wafer Wf is returned to FOUP and process is terminated (from S18-52 to S18-55). A feedback control of partial polishing, cleaning, drying and detection after step S18-56 is similar to that in steps from S13-56 to S13-89 of Example 13, and description thereof will be omitted.

Example 19

FIGS. 34A to 34G are a flowchart showing process of a polishing machine according to one example. A hardware configuration of the polishing machine of Example 19 is similar to that of the polishing machine of Example 4. A behavior of the polishing machine of this example will be described with reference to FIGS. 34A to 34G. Steps S19-1 to S19-38 are similar to steps S17-1 to S17-38 of Example 17. Subsequently, in Example 19, the surface state of the wafer Wf is detected (from S19-39 to S19-50). Subsequently, it is determined whether the surface state of the wafer Wf passes or fails (S19-51). Indications of a criterion for judging whether the surface state passes or fails include, for example, a residual film of the surface to be polished, a surface shape and a distribution of signals corresponding to those on the surface of a wafer Wf or a distribution of polishing amounts on the surface of a wafer Wf, and at least one of those is the judgment criterion. For example, by comparing at least one of the residual film state, the shape state, and the polishing amount measured at step S19-50 with a corresponding one of a residual film state, a shape state and a polishing amount that are set as a target, it is determined whether the surface state of the wafer passes or fails. At step S19-51, if it is determined that the indication neither reaches a target value nor falls within a target range, proceed to S19-63, and partial polishing is performed again. At step S19-51, if it is determined that the indication reaches the target value or falls within the target range, the wafer Wf is cleaned (from S19-52 to S19-54) and dried (from S19-55 to S19-58). Subsequently, the wafer Wf is returned to FOUP and process is terminated (from S19-59 to S19-62). A feedback control of partial polishing, cleaning, drying and detection after step S19-63 is similar to that in to from S8-63 to S8-96 of Example 8, and description thereof will be omitted.

Example 20

FIGS. 35A to 35G are a flowchart showing process of a polishing machine according to one example. A hardware configuration of the polishing machine of Example 20 is similar to that of the polishing machine of Example 4. A behavior of the polishing machine of this example will be described with reference to FIGS. 35A to 35G. Steps S20-1 to S20-32 are similar to steps S8-1 to S18-32 of Example 18. In Example 20, subsequently, the surface state of the wafer Wf is detected (from S20-33 to S20-43). Subsequently, it is determined whether the surface state of the wafer Wf passes or fails (S20-44). Indications of a criterion for judging whether the surface state passes or fails include, for example, a residual film of the surface to be polished, a surface shape and a distribution of signals corresponding to those on the surface of a wafer Wf or a distribution of polishing amounts on the surface of a wafer Wf, and at least one of those is the judgment criterion. For example, by comparing at least one of the residual film state, the shape state and the polishing amount measured at step S20-43 with a corresponding one of a residual film state, a shape state and a polishing amount that are set as a target, it is determined whether the surface state of the wafer passes or fails. At step S20-44, if it is determined that the indication neither reaches a target value nor falls within a target range proceed to step S20-56, and partial polishing is performed again. At step S20-44, if it is determined that the indication reaches the target value or falls within the target range, the wafer Wf is cleaned (from S20-45 to S20-47) and dried (from S20-48 to S20-51). Subsequently, the wafer Wf is returned to FOUP and process is terminated (from S20-52 to S20-55). A feedback control of partial polishing, detection, cleaning and drying after step S20-56 is similar to that in steps from S14-56 to S14-89 of Example 14, and description thereof will be omitted.

Example 21

FIGS. 36A to 36D are a flowchart showing process of a polishing machine according to one example. A hardware configuration of the polishing machine of Example 21 is similar to that of the polishing machine of Example 4. A behavior of the polishing machine of this example will be described with reference to FIGS. 36A to 36D. In Example 21, after, first, a processing recipe is set, whole surface polishing is performed (from S21-1 to S21-7). The whole surface polishing is performed according to the recipe set at step S21-2. Subsequently, the wafer Wf is cleaned (from S21-8 to S21-10) and dried (from S21-11 to S21-14). Subsequently, the surface state of the wafer Wf is detected (from S21-15 to S21-26), and depending on the result, the wafer Wf is partially polished (from S21-27 to S21-38). Subsequently, the wafer Wf is cleaned (from S21-39 to S21-41) and dried (from S21-42 to 321-45). Subsequently, the surface state of the wafer Wf is detected (from S21-46 to S21-57). Subsequently, it is determined whether the surface state of the wafer Wf passes or fails (S21-58). Indications of a criterion for judging whether the surface state passes or fails include, for example, a residual film of the surface to be polished, a surface shape and a distribution of signals corresponding to those on the surface of a wafer Wf or a distribution of polishing amounts on the surface of a wafer Wf, and at least one of those is the judgment criterion. For example, by comparing at least one of the residual film state, the shape state and the polishing amount measured at step S21-57 with a corresponding one of a residual film state, a shape state and a polishing amount that are set as a target, it is determined whether the surface state of the wafer passes or fails. At step S21-58, if it is determined that the indication neither reaches a target value nor falls within the target range, proceed to step S21-27, and partial polishing is performed again. At step S21-53, if it is determined that the indication reaches the target value or fails within the target range, the wafer Wf is returned to FOUP and process is terminated (from S21-59 to S21-61).

Example 22

FIGS. 37A to 37C are a flowchart showing process of a polishing machine according to one example. A hardware configuration of the polishing machine of Example 22 is similar to that of the polishing machine of Example 4. A behavior of the polishing machine of this example will be described with reference to FIGS. 37A to 37C. In Example 22, after, first, a processing recipe is set, whole surface polishing is performed (from S22-1 to S22-7). The whole surface polishing is performed according to the recipe set at step S22-2. Subsequently, the surface state of the wafer Wf is detected (from S22-8 to S22-19), and depending on the result, the wafer Wf is partially polished (from S22-20 to S22-31). Subsequently, the wafer Wf is cleaned (from S22-32 to S22-34) and dried (from S22-35 to S22-38). Subsequently, the surface state of the wafer Wf is detected (from S22-39 to S22-50). Subsequently, it is determined whether the surface state of the wafer Wf passes or fails (S22-51). Indications of a criterion for judging whether the surface state passes or fails include, for example, a residual film of the surface to be polished, a surface shape and a distribution of signals corresponding to those on the surface of a wafer Wf or a distribution of polishing amounts on the surface of a wafer Wf, and at least one of those is the judgment criterion. For example, by comparing at least one of the residual film state, the shape state and the polishing amount measured at step S22-50 with a corresponding one of a residual film state, a shape state and a polishing amount that are set as a target, it is determined whether the surface state of the wafer passes or fails. At step S22-51, if it is determined that the indication neither reaches a target value nor falls within a target range, return to step S22-20 and partial polishing is performed again. At step S22-51, if it is determined that the indication reaches the target value or falls within the target range, the wafer Wf is returned to FOUP and process is terminated (from S22-52 to S22-54).

Example 23

FIGS. 38A to 38D are a flowchart showing process of a polishing machine according to one example. A hardware configuration of the polishing machine of Example 23 is similar to that of the polishing machine of Example 4. A behaviour of the polishing machine of this example will be described with reference to FIGS. 38A to 38D. Steps S23-1 to S23-39 are similar to steps S21-1 to S21-39 of Example 21. Subsequently, in Example 23, the surface state of the wafer Wf is detected (from S23-40 to S23-50). Subsequently, it is determined whether the surface state of the wafer Wf passes or fails (S23-51). Indications of a criterion for judging whether the surface state passes or fails include, for example, a residual film of the surface to be polished, a surface shape and a distribution of signals corresponding to those on the surface of a wafer Wf or a distribution of polishing amounts on the surface of a wafer Wf, and at least one of those is the judgment criterion. For example, by comparing at least one of the residual film state, the shape state and the polishing amount measured at step S23-50 with a corresponding one of a residual film state, a shape state and a polishing amount that are set as a target, it is determined whether the surface state of the wafer passes or fails. At step S23-51, if it is determined that the indication neither reaches a target value nor falls within a target range, return to step S23-27, and partial polishing performed again. At step S23-51, if it is determined that the indication reaches the target value or fails within the target range, the wafer Wf is cleaned (from S23-52 to S23-53) and dried (from S23-54 to S23-57). Subsequently, the wafer Wf is returned to FOUP and process is terminated (from S23-58 to S23-61).

Example 24

FIGS. 39A to 39C are a flowchart showing process of a polishing machine according to one example. A hardware configuration of the polishing machine of Example 24 is similar to that of the polishing machine of Example 4. A behavior of the polishing machine of this example will be described with reference to FIGS. 39A to 39C. Steps S24-1 to S24-32 are similar to steps S22-1 to S22-32 of Example 22. Subsequently, in Example 24, the surface state of the wafer Wf is detected (from S24-33 to S24-43). Subsequently, it is determined whether the surface state of the wafer Wf passes or fails (S24-44). Indications of a criterion for judging whether the surface state passes or fails include, for example, a residual film of the surface to be polished, a surface shape and a distribution of signals corresponding to those on the surface of a wafer Wf or a distribution of polishing amounts on the surface of a wafer Wf, and at least one of those is the judgment criterion. For example, by comparing at least one of the residual film state, the shape state and the polishing amount measured at step S24-43 with a corresponding one of a residual film state, a shape state and a polishing amount that are set as a target, it is determined whether the surface state of the wafer passes or fails. At step S24-44, if it is determined that the indication neither reaches a target value nor falls within a target range, return to step S24-20, and partial polishing is performed again. At step S24-44, if it is determined that the indication reaches the target value or falls within the target range, the wafer Wf is cleaned (from S24-43 to S24-46) and dried (from S24-47 to S24-50). Subsequently, the wafer Wf is returned to FOUP and process is terminated (from S24-50 to S24-54).

Example 25

FIGS. 40A to 40C are a flowchart showing process of a polishing machine according to one example. A hardware configuration of the polishing machine of Example 25 is similar to that of the polishing machine of Example 4. A behavior of the polishing machine of this example will be described with reference to FIGS. 40A to 40C. Steps S25-1 to S25-39 are similar to steps S19-1 to S19-39 of Example 19. Subsequently, in Example 25, without the feedback control, the wafer Wf is cleaned (from S25-40 to S25-41) and dried (from S25-42 to S25-45). Subsequently, the wafer Wf is returned to FOUP and process is terminated (from S25-46 to S25-49).

Example 26

FIGS. 41A to 41C are a flowchart showing process of a polishing machine according to one example. A hardware configuration of the polishing machine of Example 26 is similar to that of the polishing machine of Example 4. A behavior of the polishing machine of this example will be described with reference to FIGS. 41A to 41C. Steps S26-1 to S26-32 are similar to steps S20-1 to S20-32 of Example 20. Subsequently, in Example 26, without the feedback control, the wafer Wf is cleaned (from S26-33 to S26-34) and dried (from S26-35 to S26-38). Subsequently, the wafer Wf is returned to FOUP and process is terminated (from S26-39 to S26-42).

Example 27

FIGS. 42A to 42C are a flowchart showing process of a polishing machine according to one example. A hardware configuration of the polishing machine of Example 27 is similar to that of the polishing machine of Example 4. A behavior of the polishing machine of this example will be described with reference to FIGS. 42A to 42C. Steps S27-1 to S27-46 are similar to steps S21-1 to S21-46 of Example 21. Subsequently, in Example 27, the wafer Wf is returned to FOUP and process is terminated (from S27-47 to S27-49).

REFERENCE SIGNS LIST

3 large-diameter polishing module
10 polishing pad
300 partial polishing module
500 head
502 polishing pad
510-2 detection part
900 control device
1000 polishing machine
Wf wafer

What is claimed is:

1. A polishing machine for polishing an object, the polishing machine comprising:

a detector for detecting the state of a surface of the object, a first polishing module for performing a first step of polishing by moving the object and a first polishing pad having a smaller dimension than that of the object relative to each other while the first polishing pad is made to contact the object, a second polishing module for performing a second step of polishing by moving the object and a second polishing pad having a larger dimension than that of the object relative to each other while the second polishing pad is made to contact the object, and a control device for controlling the first polishing module and the second polishing module, wherein the control device controls so that the second step of polishing is performed after the first step of polishing, and the detector detects the state of the surface of the object before the first step of polishing, the polishing machine further comprising a cleaning module for cleaning the object, wherein:

the first polishing module comprises a first polishing solution supply device for supplying a first polishing solution over the surface of the object; and the second polishing module comprises a second polishing solution supply device for supplying a second polishing solution over the surface of the object;

wherein after the first step of polishing and before the second step of polishing, the control device determines whether the object should be cleaned by comparing the first polishing solution and the second polishing solution; and the control device controls the polishing machine such that the cleaning module cleans the object before the second step of polishing if the control device determines the object should be cleaned.

2. The polishing machine according to claim 1, wherein the control device is configured to determine a polishing condition for the first step of polishing based on the state of the surface detected by the detector.

3. The polishing machine according to claim 1, comprising:

a storage device for storing data about the state of the surface that is a target to the object, wherein the control device is configured to determine a polishing condition for the first step of polishing and a polishing condition for the second step of polishing based on the data stored in the storage device and the state of the surface detected by the detector.

4. The polishing machine according to claim 3, wherein the control device is configured to determine a processing condition for the first polishing based on the data of removal rate against polish condition stored in a database.

5. The polishing machine according to claim 1, wherein the detector is configured to detect at least one distribution of a film thickness of the surface of the object, a signal corresponding to the film thickness and a signal corresponding to a surface shape.

6. The polishing machine according to claim 1, wherein the first polishing pad has a diameter not greater than 30 mm.

7. The polishing machine according to claim 1, wherein the first polishing pad is held by a polishing head via a cushion layer softer than a surface layer in contact with the object.

* * * * *